US007414508B2

(12) United States Patent
Okuzawa et al.

(10) Patent No.: US 7,414,508 B2
(45) Date of Patent: Aug. 19, 2008

(54) COMMON MODE CHOKE COIL AND METHOD OF MANUFACTURING THE SAME

(75) Inventors: Nobuyuki Okuzawa, Tokyo (JP); Makoto Yoshida, Tokyo (JP)

(73) Assignee: TDK Corporation, Tokyo (JP)

( * ) Notice: Subject to any disclaimer, the term of this patent is extended or adjusted under 35 U.S.C. 154(b) by 37 days.

(21) Appl. No.: 11/528,410

(22) Filed: Sep. 28, 2006

(65) Prior Publication Data

US 2007/0075819 A1 Apr. 5, 2007

(30) Foreign Application Priority Data

Oct. 5, 2005 (JP) ..... 2005-291881

(51) Int. Cl.
*H01F 5/00* (2006.01)
*H01F 7/06* (2006.01)

(52) U.S. Cl. ..... 336/200; 336/223; 336/232; 29/602.1

(58) Field of Classification Search ..... 336/200, 336/223, 232; 29/602.1, 605, 606
See application file for complete search history.

(56) References Cited

U.S. PATENT DOCUMENTS

| | | | | |
|---|---|---|---|---|
| 5,372,967 | A | 12/1994 | Sundaram et al. | |
| 6,008,102 | A | 12/1999 | Alford et al. | |
| 6,114,937 | A * | 9/2000 | Burghartz et al. | 336/200 |
| 6,696,912 | B2 * | 2/2004 | Ahn et al. | 336/200 |
| 6,876,285 | B2 | 4/2005 | Liang et al. | |
| 6,992,557 | B2 * | 1/2006 | Aoyagi | 336/200 |
| 7,088,215 | B1 * | 8/2006 | Winter et al. | 336/200 |

FOREIGN PATENT DOCUMENTS

JP B2 3601619 10/2004

* cited by examiner

*Primary Examiner*—Anh T Mai
(74) *Attorney, Agent, or Firm*—Oliff & Berridge, PLC

(57) ABSTRACT

The invention relates to a common mode choke coil and a method of manufacturing the same and provides a compact, low-profile, and low-cost common mode choke coil and a method of manufacturing the same. A common mode choke coil has a general outline in the form of a rectangular parallelepiped provided by forming an insulation layer, a first helical coil unit, a second helical coil unit, and a closed magnetic path on a silicon substrate made of a single-crystal using thin film forming techniques. The first and second helical coil units are formed such that their axes of spiral extend substantially parallel to a substrate surface of the silicon substrate.

16 Claims, 161 Drawing Sheets

1'
2
3
4
11
12
13
14
15
16
17
18
31
31a
32
32a
35
35a
36
36a
41
43a
43b
63
64
143
IP1
IP2
P
w
f 5
6
7
8
19
20
21
22
23
24
25
26
41
43a
45a
45b
47
48
63
64
65
66
143
145
147
163a
163b
164a
164b
165a
165b
166a
166b
IP1
IP2
P
w
f

FIG.137

| | FIRST EMBODIMENT | SECOND EMBODIMENT | THIRD EMBODIMENT | FOURTH EMBODIMENT | RELATED ART |
|---|---|---|---|---|---|
| Al FILM FORMATION | 4 | 3 | 5 | 4 | 0 |
| CONDUCTOR ELECTRODE FILM | 3 | 2 | 3 | 2 | 4 |
| CORE PART ELECTRODE FILM | 1 | 1 | 4 | 3 | 0 |
| ETCHING | 4 | 3 | 6 | 4 | 0 |
| CONDUCTOR PLATING | 4 | 3 | 4 | 3 | 4 |
| CORE PART PLATING | 1 | 1 | 3 | 3 | 0 |
| PHOTO-PROCESS | 5 | 6 | 8 | 7 | 10 |
| PLANARIZATION | 2 | 1 | 3 | 3 | 0 |
| OPENING ETICHING | 0 | 1 | 0 | 1 | 0 |
| CURING | 0 | 1 | 0 | 1 | 5 |
| TOTAL NUMBER OF STEPS | 24 | 22 | 36 | 31 | 23 |

COMMON MODE CHOKE COIL AND METHOD OF MANUFACTURING THE SAME

BACKGROUND OF THE INVENTION

1. Field of the Invention

The present invention relates to a common mode choke coil and a method of manufacturing the same.

2. Description of the Related Art

Known coil components mounted on internal circuits of electronic apparatus such as personal computers and portable telephones include wire-wound types provided by winding a copper wire around a ferrite core, multi-layer types provided by forming a coil conductor pattern on a magnetic sheet made of ferrite etc. and stacking such magnetic sheets one over another, and thin-film types provided by alternately forming insulation films and metal thin-film coil conductors using a thin film forming technique. Recently, there is a rapid trend toward electronic apparatus having smaller sizes and higher performance, which has resulted in strong demand for coil components having smaller sizes and higher performance. Referring to thin-film type coil components, coil components of a chip size of 1 mm or less are supplied to the market by providing coil conductors having smaller thickness.

Coil components include common mode choke coils for suppressing a common mode current which can cause electromagnetic interference in a balanced transmission system and inductors which are combined with a capacitor to provide a low-pass filter (LPF). Patent Document 1 discloses a thin-film type common mode choke coil having an insulation layer and a spiral coil conductor formed using a thin film forming technique between a pair of magnetic substrates disposed opposite to each other. Patent Documents 2 and 3 disclose thin-film type inductors and methods of manufacturing the same. Patent Document 4 discloses a thin-film type micro-coil having a core and a method of manufacturing the same.

Patent Document 1: Japanese Patent No. 3601619

Patent Document 2: U.S. Pat. No. 6,008,102

Patent Document 3: U.S. Pat. No. 5,372,967

Patent Document 4: U.S. Pat. No. 6,876,285

Further size reduction of common mode choke coils is still required. However, in the case of the common mode choke coil according to the related art disclosed in Patent Document 1, it is required to increase the number of turns of the coil conductor to improve electrical characteristics such as impedance characteristics, for example. As a result, the coil conductor must be formed in a larger area, and a problem arises in that it will be difficult to reduce the size of the common mode choke coil.

Further, since the common mode choke coil according to the related art has a pair of magnetic substrates disposed opposite to each other, there is a problem in that it is difficult to provide the choke coil with a low profile.

The common mode choke coil according to the related art is completed through a thin film forming step for forming an insulation layer and a coil conductor (coil layer) on a magnetic substrate in the form of a wafer using a thin film forming technique such as a photo-process, a substrate combining step for combining the substrate with another magnetic substrate by bonding them using a bonding layer formed on the insulation layer, a cutting step for cutting the wafer to divide it into chips, and an external electrode forming step for forming an external electrode. As thus described, the manufacture of a common mode choke coil involves a plurality of manufacturing steps and therefore requires a high manufacturing cost, which results in a problem in that the cost of the common mode choke coil is increased.

SUMMARY OF THE INVENTION

It is an object of the invention to provide a common mode choke coil having high electrical characteristics, a small size, and a low profile at a low cost and to provide a method of manufacturing the same.

The above-described object is achieved by a common mode choke coil comprising:

a first helical coil unit having a plurality of elongate first conductive layers arranged in parallel on a bottom insulation layer, second conductive layers formed on both ends of the first conductive layers, and a third conductive layer formed on the second conductive layers, which is electrically connected to the second conductive layer at one end thereof and which is electrically connected, at another end thereof, to the second conductive layer formed on the first conductive layer adjacent to the first conductive layer directly under the second conductive layer, one turn of the coil being formed by the first conductive layer, the second conductive layer, the third conductive layer and the another second conductive layer; and a second helical coil unit having a configuration similar to that of the first helical coil unit.

The common mode choke coil according to the invention is characterized in that it includes:

a core extending through the first and second helical coil units on the side of the inner circumferences thereof; and a magnetic member part connected to the core and cooperating with the core to form a closed magnetic path.

The common mode choke coil according to the invention is characterized in that the closed magnetic path is formed substantially parallel to the surface on which the first conductive layers are formed.

The common mode choke coil according to the invention is characterized in that the closed magnetic path is formed substantially orthogonal to the surface on which the first conductive layers are formed.

The common mode choke coil according to the invention is characterized in that the core is formed from a material having a high permeability.

The common mode choke coil according to the invention is characterized in that a first imaginary plane including three conductive layers among the first, second, third, and second conductive layers forming one turn of the coil of the first helical coil unit and a second imaginary plane including three conductive layers among the first, second, third, and second conductive layers forming one turn of the coil of the second helical coil unit are substantially orthogonal to axes of spiral of the first and second helical coil units.

The common mode choke coil according to the invention is characterized in that the first and second imaginary planes are substantially orthogonal to the extending direction of the core.

The common mode choke coil according to the invention is characterized in that the conductive layer which is not included in the first imaginary plane among the first, second, third and second conductive layers forming one turn of the coil of the first helical coil unit is formed so as not to extend across the second imaginary plane and in that the conductive layer which is not included in the second imaginary plane among the first, second, third and second conductive layers forming one turn of the coil of the second helical coil unit is formed so as not to extend across the first imaginary plane.

The above-described object is achieved by a method of manufacturing a common mode choke coil, comprising the steps of:

forming a first electrode film on a substrate;

forming a first resist layer on the first electrode film;

forming a plurality of elongate first openings in parallel in the first resist layer to expose the first electrode film;

forming each of first conductive layers electrically connected to the first electrode film through the first openings using a plating process;

forming a second resist layer on the entire surface after removing the first resist layer;

forming a plurality of second openings for exposing both ends of the first conductive layers in the second resist layer;

forming each of second conductive layers electrically connected to the first conductive layers through the second openings using a plating process;

removing the second resist layer and the first electrode film under the second resist layer;

forming a first insulation layer on which the tops of the second conductive layers are exposed;

forming a second electrode film electrically connected to the second conductive layers on the first insulation layer;

forming a third resist layer on the second electrode film;

forming the third resist layer with a plurality of elongate third openings arranged in parallel to expose the second electrode film in positions where the openings overlap the second conductive layers at one end thereof and overlap, at another end thereof, the second conductive layers formed on the first conductive layer adjacent to the first conductive layer directly under the second conductive layer when the substrate surface is viewed in the normal direction thereof;

forming each of third conductive layers electrically connected to the second electrode film through the third openings using a plating process;

removing the third resist layer and the second electrode film under the third resist layer;

forming a first helical coil unit one turn of which is formed by the first, second, third, and second conductive layers; and similarly forming a second helical coil unit simultaneously with the first helical coil unit.

The method of manufacturing a common mode choke coil according to the invention is characterized in that it includes the steps of:

forming a first intermediate electrode film between the second conductive layers and the second electrode film;

forming a first intermediate resist layer on the first intermediate electrode film;

forming the first intermediate resist layer with a first intermediate opening exposing the first intermediate electrode film and extending across the first conductive layers when the substrate surface is viewed in the normal direction thereof;

forming a first magnetic member layer on the first intermediate electrode film in the first intermediate opening using a plating process;

removing the first intermediate resist layer and the first intermediate electrode film under the first intermediate resist layer;

forming a core constituted by the first magnetic member layer and extending through the first and second helical coil units on the side of the inner circumference thereof;

forming a second intermediate electrode film electrically connected to the second conductive layers on the entire surface;

forming a second intermediate resist layer on the second intermediate electrode film;

forming a second intermediate opening in the second intermediate resist layer to expose the second intermediate electrode film on the second conductive layer;

forming a first intermediate conductive layer electrically connected to the second intermediate electrode film through the second intermediate opening using a plating process;

removing the second intermediate resist layer and the second intermediate electrode film under the second intermediate resist layer;

forming a second insulation layer on the first insulation layer with the first intermediate conductive layer exposed; and forming the first and second helical coil units with the second electrode film electrically connected to the second conductive layers through the second intermediate electrode film and the first intermediate conductive layer.

The method of manufacturing a common mode choke coil according to the invention is characterized in that it includes the steps of:

forming the first intermediate opening in an annular shape; and forming a magnetic member part forming a closed magnetic path in cooperation with the core in the first intermediate opening at the same time when the core is formed.

The method of manufacturing a common mode choke coil according to the invention is characterized in that it includes the steps of:

removing the first intermediate resist layer instead of the step of removing the first intermediate resist layer and the first intermediate electrode film under the first intermediate resist layer;

forming a third intermediate resist layer on the first intermediate electrode film and the first magnetic member layer;

forming the third intermediate resist layer with a third intermediate opening for exposing both ends of the first magnetic member layer;

forming a second magnetic member layer on the first magnetic member layer in the third intermediate opening using a plating process;

forming the core by removing the third intermediate resist layer and the first intermediate electrode film under the same;

forming a third electrode film on the second insulation layer and the second magnetic member layer after forming the first and second helical coil units;

forming a fourth resist layer on the third electrode film;

forming the fourth resist layer with a fourth opening for exposing the third electrode film on the second magnetic member layer;

forming a third magnetic member layer on the third electrode film in the fourth opening using a plating process;

removing the fourth resist layer and the third electrode film under the same;

forming a third insulation layer on which the third magnetic member layer is exposed;

forming a fourth electrode film on the third insulation layer;

forming a fifth resist layer on the fourth electrode film;

forming the fifth resist layer with a fifth opening for exposing the fourth electrode film on the third magnetic member layer on both ends thereof;

forming a fourth magnetic member layer on the fourth electrode film in the fifth opening using a plating process; and forming a closed magnetic path constituted by the core and the second, third, and fourth magnetic member layers by removing the fifth resist layer and the fourth conductive film under the fifth resist layer.

The method of manufacturing a common mode choke coil according to the invention is characterized in that it includes the steps of:

forming a first intervening resist layer between the second conductive layer and the second electrode film after forming the first insulation layer;

forming the first intervening resist layer with a first intervening opening exposing the first insulation layer and extending across the first conductive layer when the substrate surface is viewed in the normal direction thereof;

forming a groove on the first insulation layer under the first intervening opening;

removing the first intervening resist layer;

forming a first intervening electrode film in the groove and on the first insulation layer;

forming a first magnetic member layer on the first intervening electrode film in the groove using a plating process;

forming a core constituted by the first magnetic member layer and extending through the first and second helical coil units on the side of the inner circumferences thereof; and forming the second electrode film on the first insulation layer.

The method of manufacturing a common mode choke coil according to the invention is characterized in that it includes the steps of:

forming the first intervening opening in an annular shape; and forming a magnetic member part forming a closed magnetic path in cooperation with the core in the first intervening opening at the same time when the core is formed.

The method of manufacturing a common mode choke coil according to the invention is characterized in that it includes the steps of:

forming a second intervening resist electrode film on the first insulation layer after forming the first insulation layer;

forming a second intervening resist layer on the second intervening electrode film;

forming the second intervening resist layer with a second intervening opening for exposing the second intervening electrode film on both ends of the core;

forming a second magnetic member layer on the second intervening electrode film in the second intervening opening using a plating process;

removing the second intervening resist layer and the second intervening electrode film under the second intervening resist layer;

forming the second electrode film on the first insulation layer;

forming a second insulation layer for exposing the second magnetic member layer after forming the first and second helical coil units;

forming a third electrode film on the second insulation layer;

forming a fourth resist layer on the third electrode film;

forming the fourth resist layer with a fourth opening exposing the third electrode film on the second magnetic member layer at both ends thereof;

forming a third magnetic member layer on the third electrode film in the fourth opening using a plating process; and forming a closed magnetic path constituted by the core and the second and third magnetic member layers by removing the fourth resist layer and the third electrode film under the fourth resist layer.

The method of manufacturing a common mode choke coil according to the invention is characterized in that it includes the steps of:

forming an organic insulating material in a gap between the first and second helical coil units; and heating and curing the organic insulating material to insulate the first and second helical coil units from each other.

The invention makes it possible to manufacture a compact and low-profile common mode choke coil having high electrical characteristics at a low cost.

BRIEF DESCRIPTION OF THE DRAWINGS

FIGS. 120A and 120B show the method of manufacturing the common mode choke coil 601 according to the fourth embodiment of the invention;

FIGS. 121A and 121B show the method of manufacturing the common mode choke coil 601 according to the fourth embodiment of the invention;

FIGS. 122A and 122B show the method of manufacturing the common mode choke coil 601 according to the fourth embodiment of the invention;

FIGS. 123A and 123B show the method of manufacturing the common mode choke coil 601 according to the fourth embodiment of the invention;

FIGS. 124A and 124B show the method of manufacturing the common mode choke coil 601 according to the fourth embodiment of the invention;

FIGS. 125A and 125B show the method of manufacturing the common mode choke coil 601 according to the fourth embodiment of the invention;

FIGS. 126A and 126B show the method of manufacturing the common mode choke coil 601 according to the fourth embodiment of the invention;

FIGS. 127A and 127B show the method of manufacturing the common mode choke coil 601 according to the fourth embodiment of the invention;

FIGS. 128A and 128B show the method of manufacturing the common mode choke coil 601 according to the fourth embodiment of the invention;

FIGS. 129A and 129B show the method of manufacturing the common mode choke coil 601 according to the fourth embodiment of the invention;

FIGS. 130A and 130B show the method of manufacturing the common mode choke coil 601 according to the fourth embodiment of the invention;

FIGS. 131A and 131B show the method of manufacturing the common mode choke coil 601 according to the fourth embodiment of the invention;

Figure 132A:
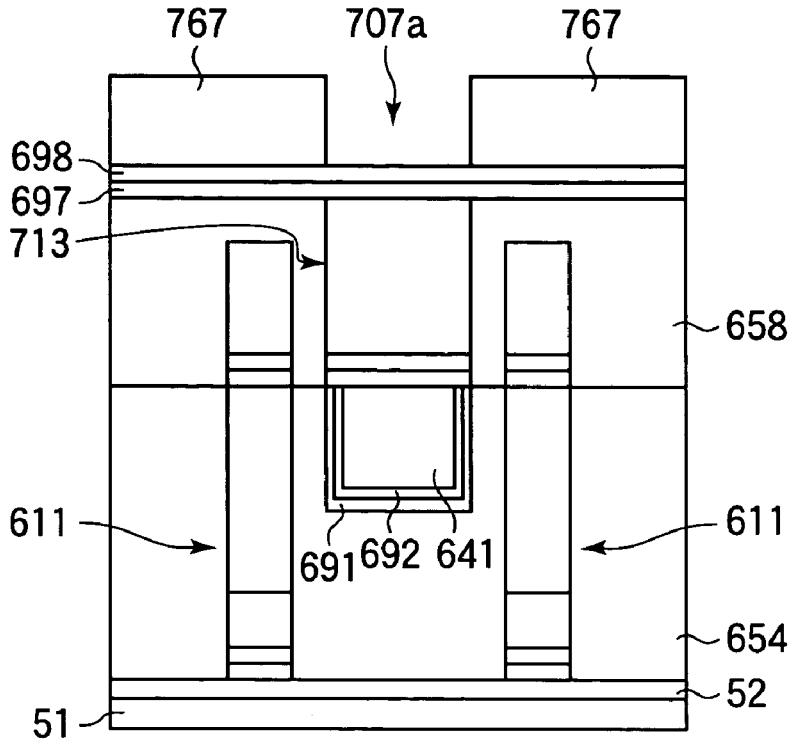
Figure 132B:
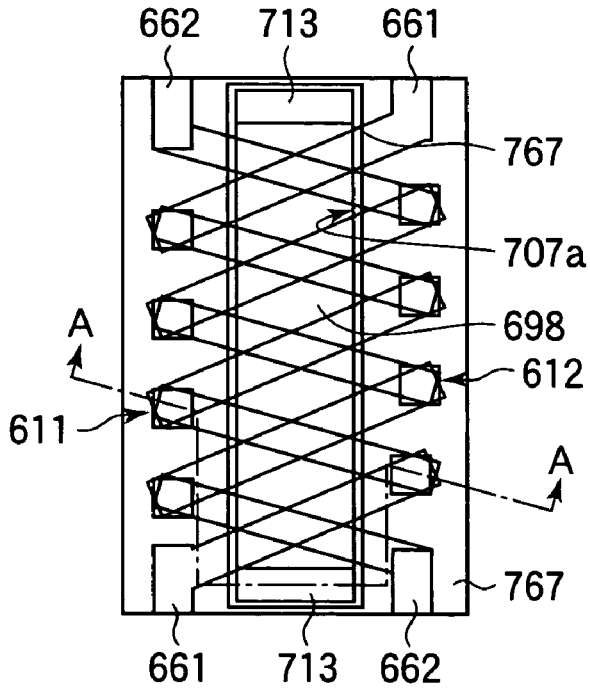
Figure 133A:
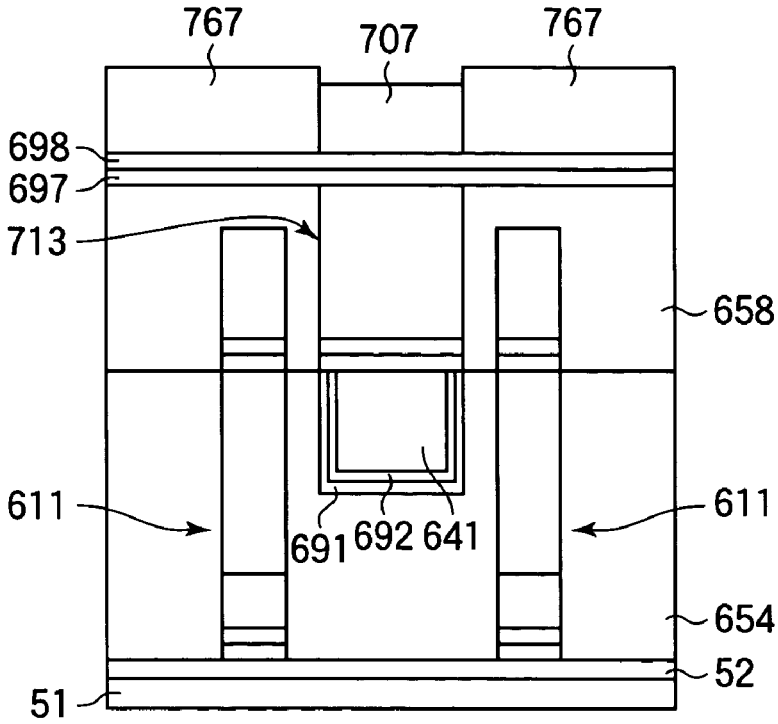
Figure 133B:
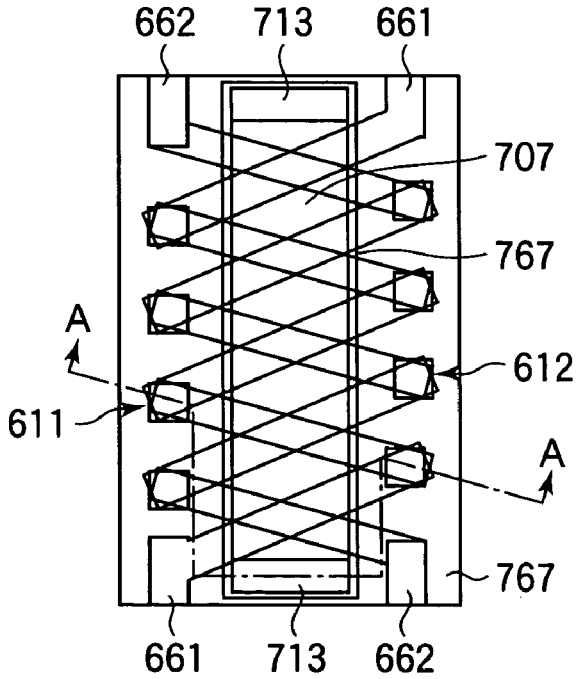
Figure 134A:
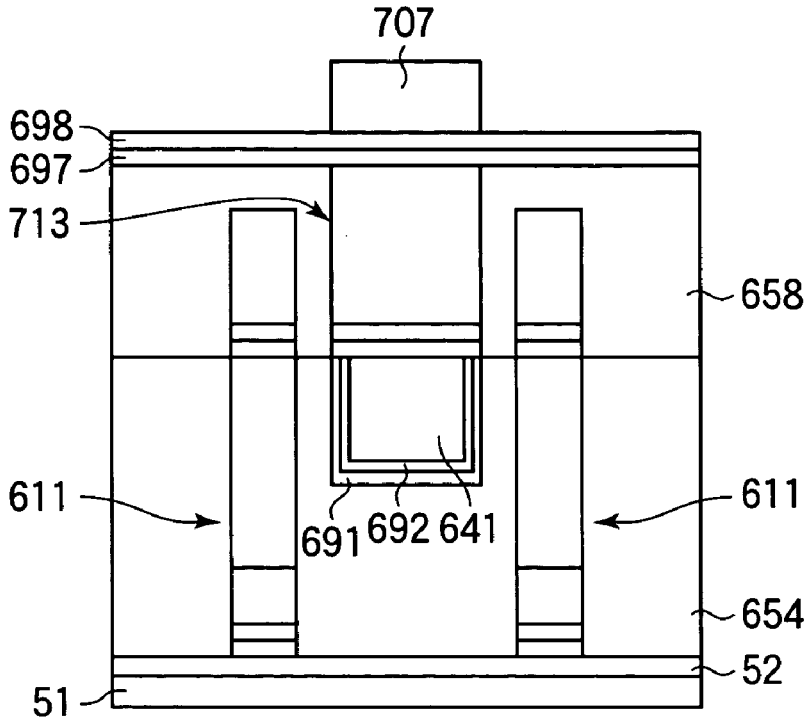
Figure 134B:
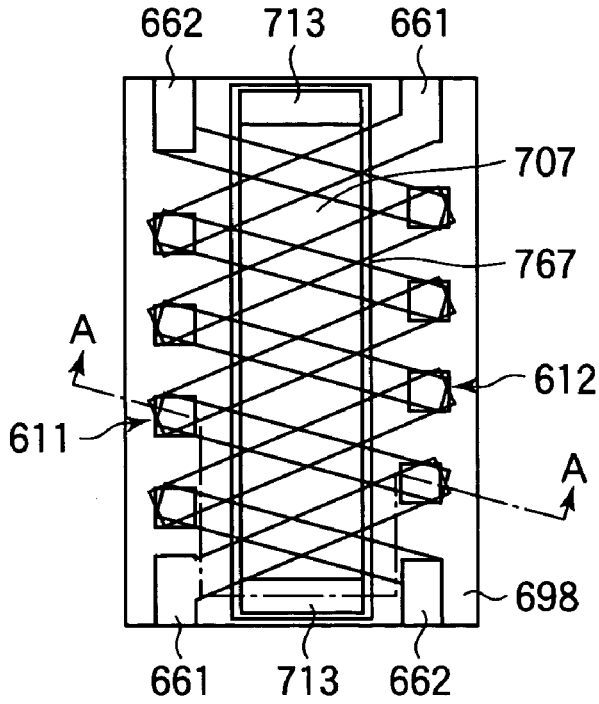
Figure 135A:
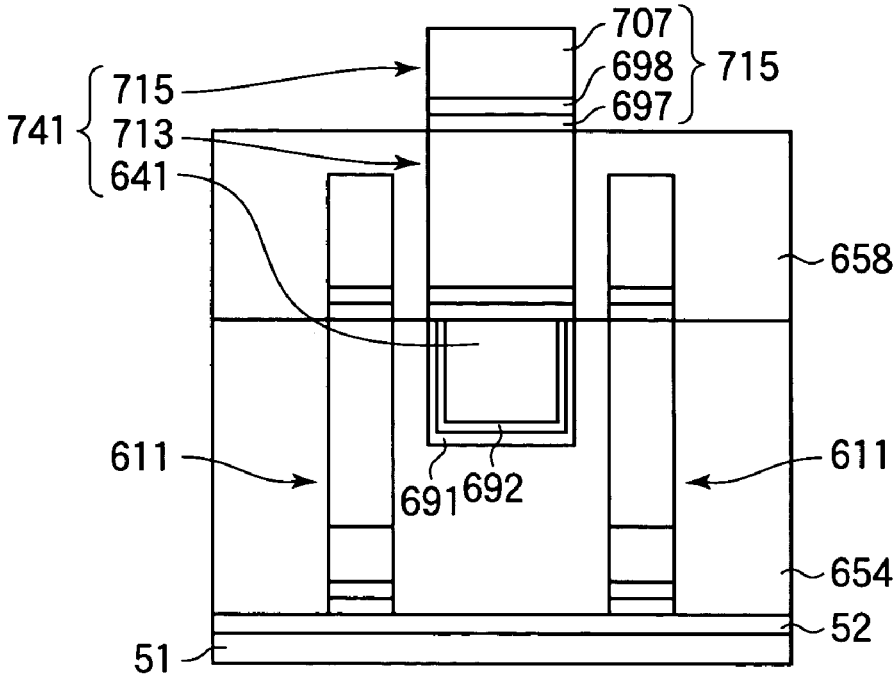
Figure 135B:
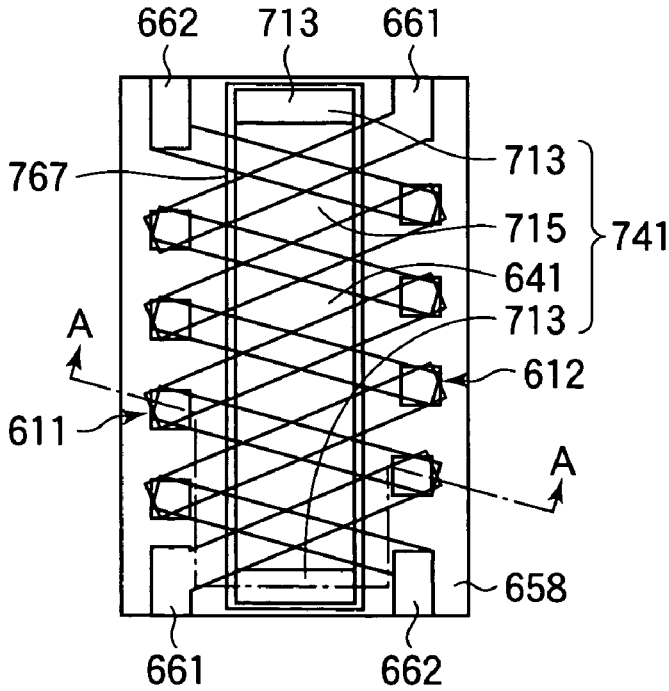
Figure 136A:
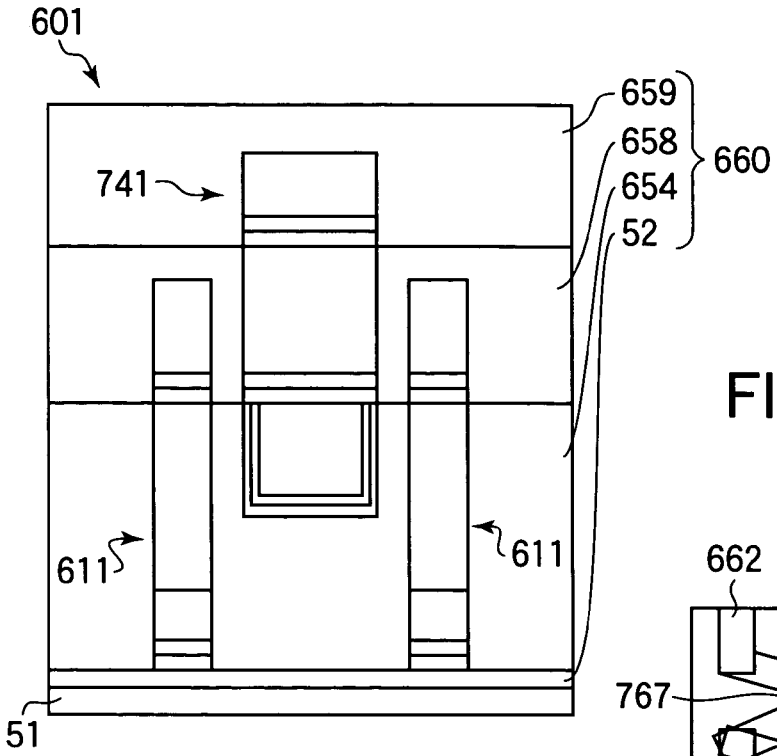
Figure 136B:
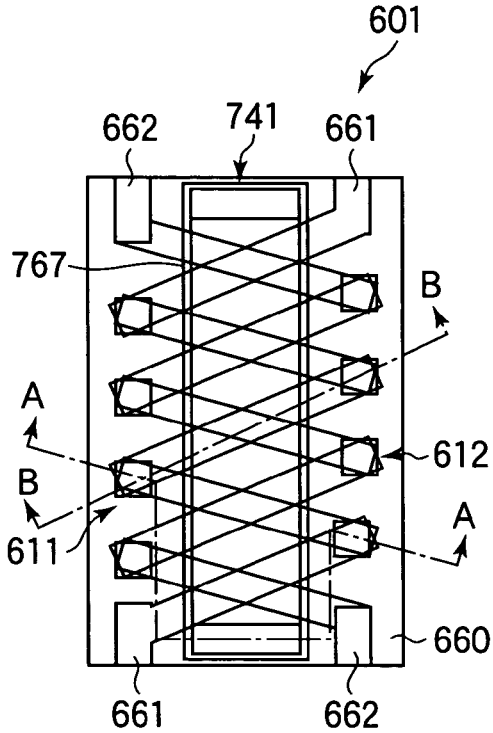
Figure 136C:
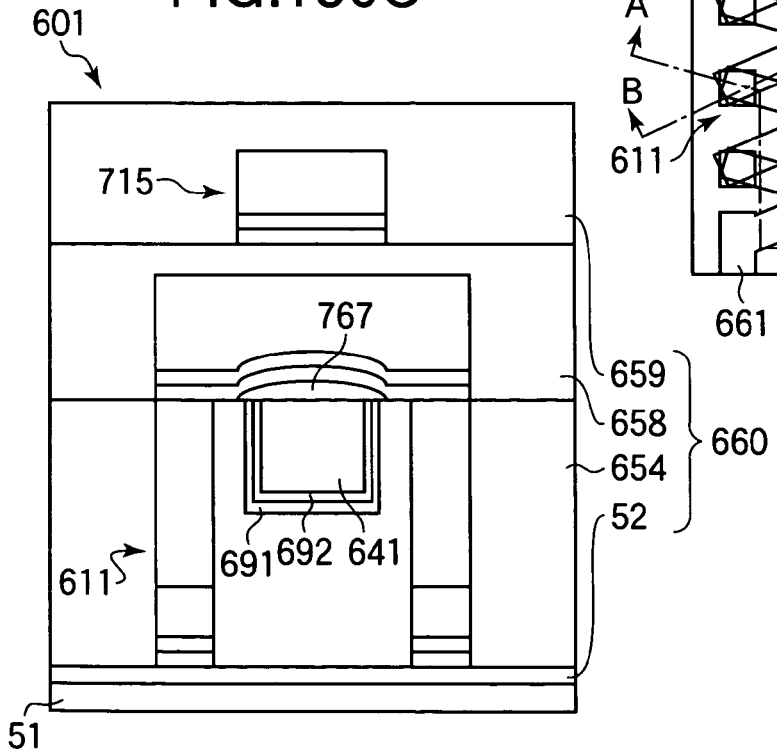
Figure 138A:
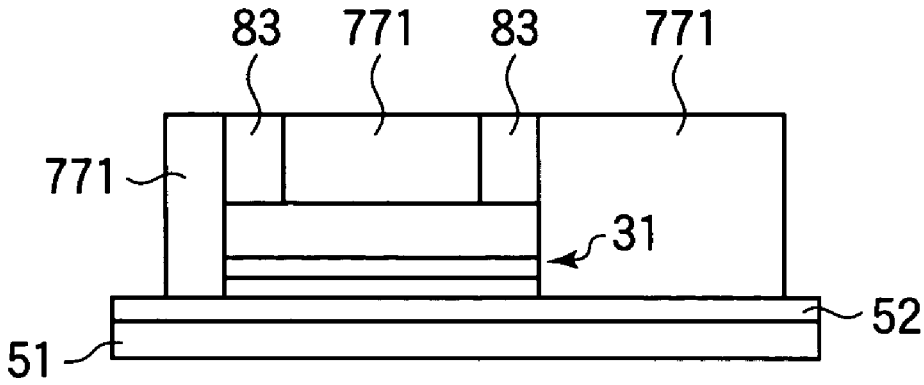
Figure 138B:
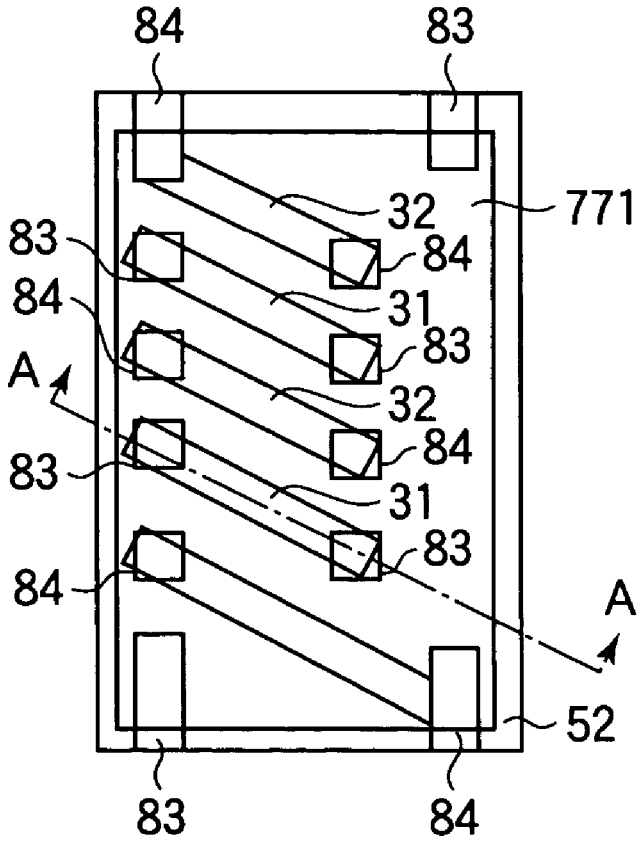
Figure 139A:
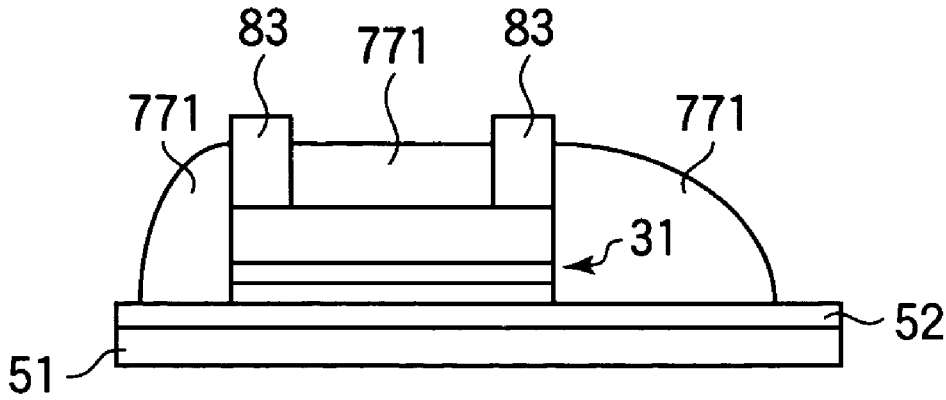
Figure 139B:
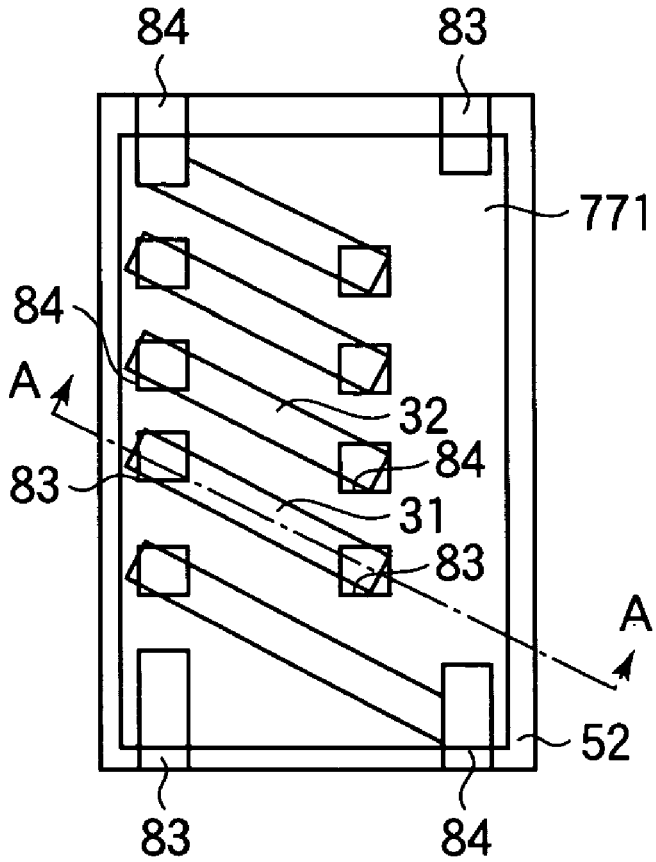
Figure 140A:
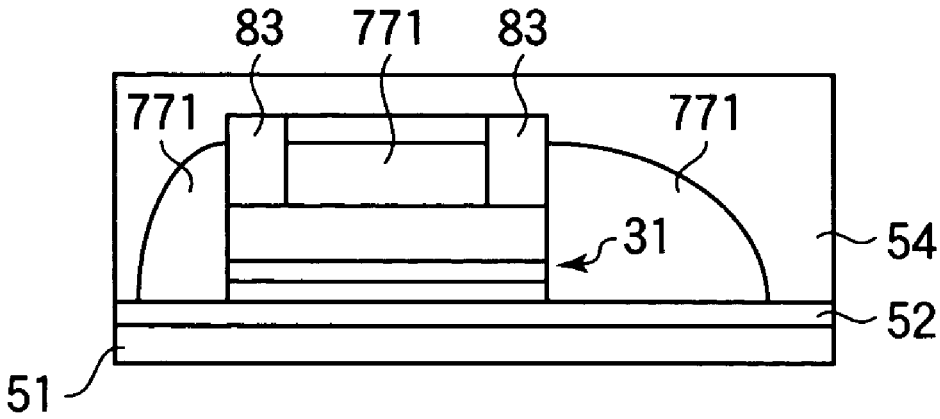
Figure 140B:
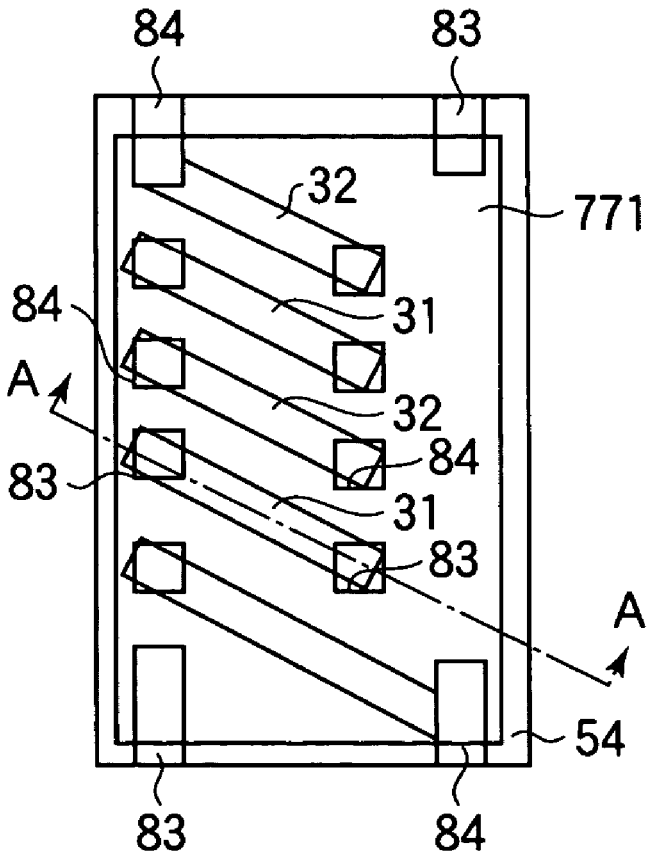
Figure 141A:
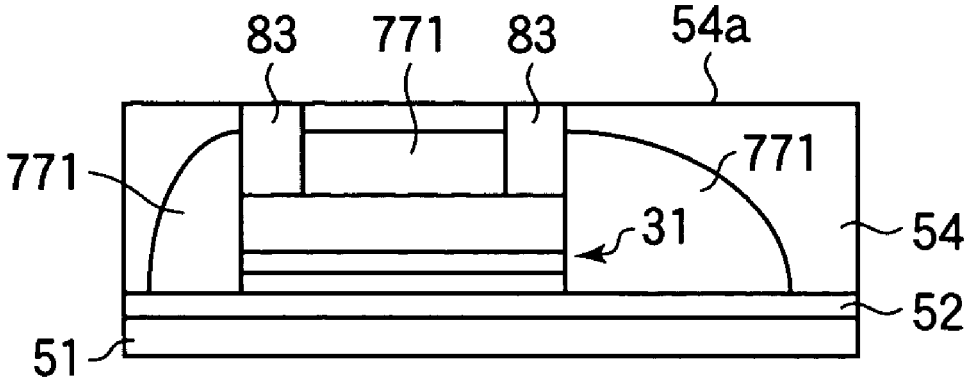
Figure 141B:
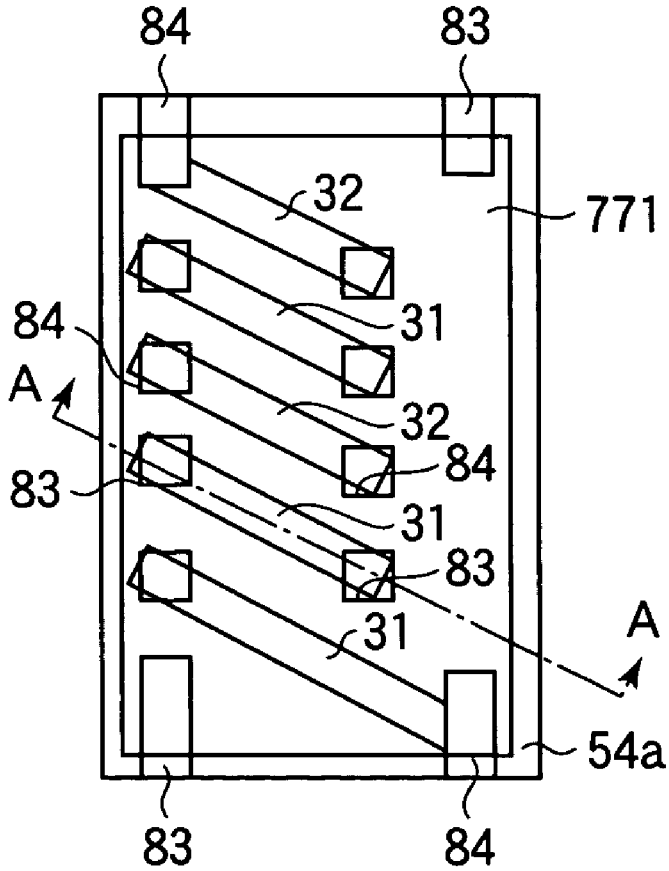
Figure 142A:
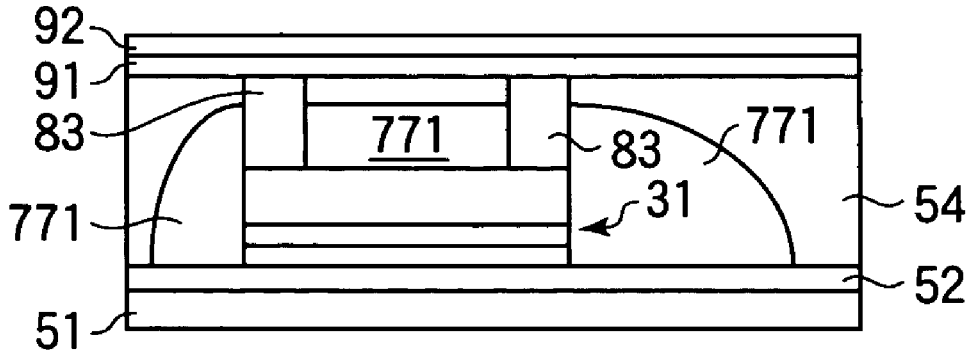
Figure 142B:
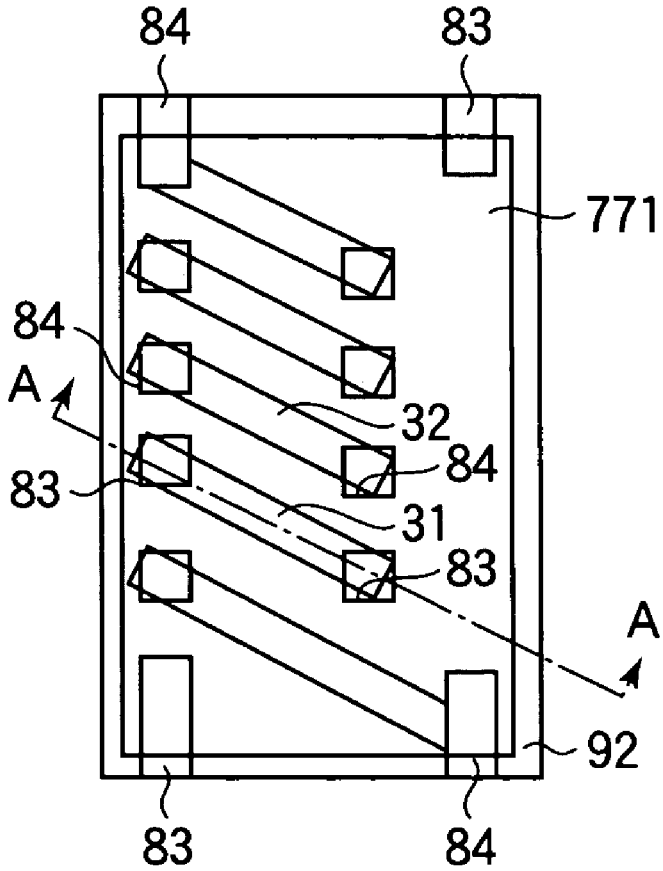
Figure 143A:
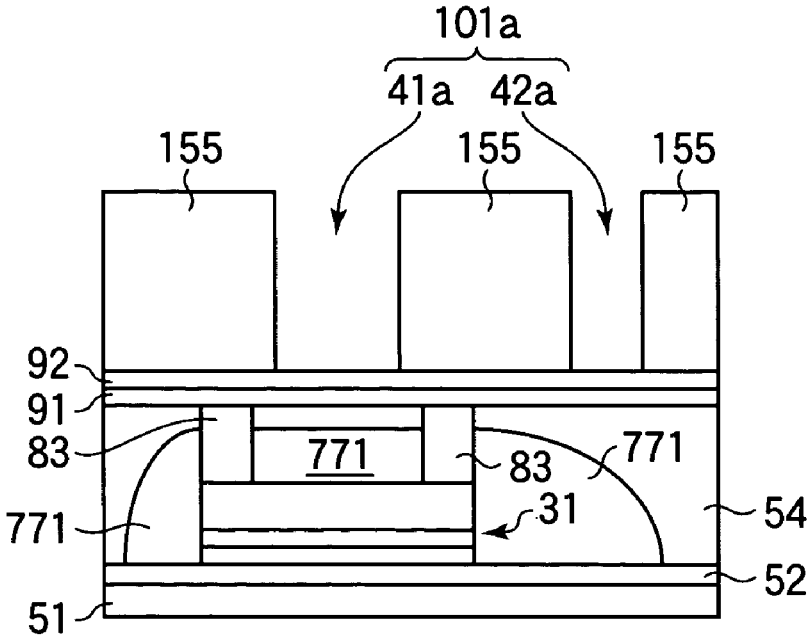
Figure 143B:
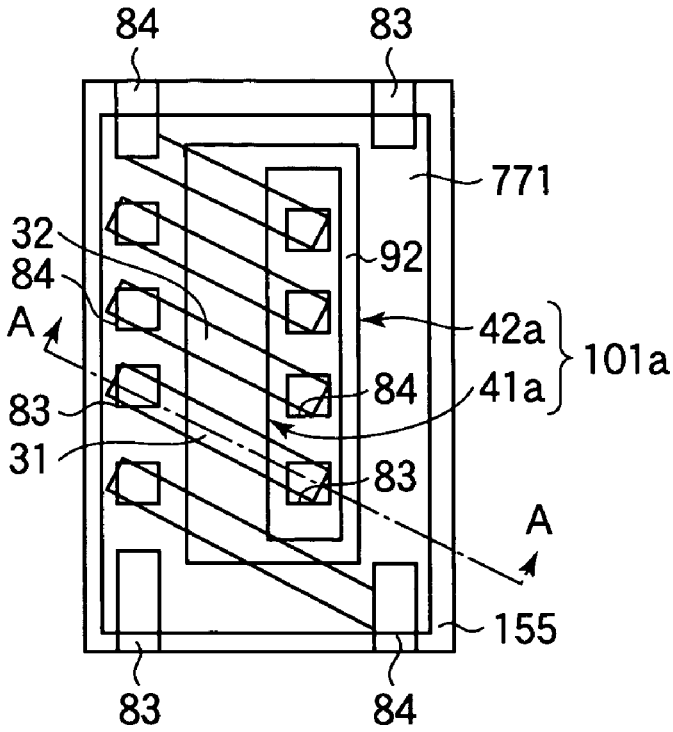
Figure 144A:
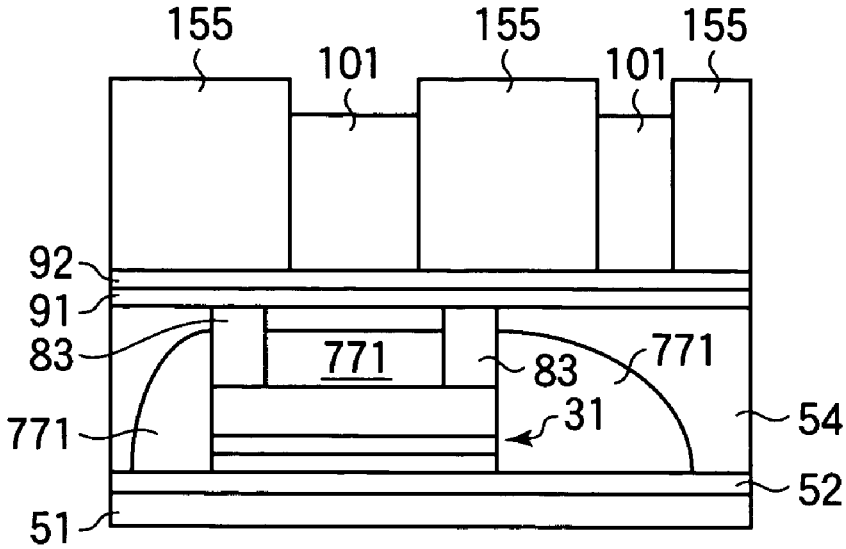
Figure 144B:
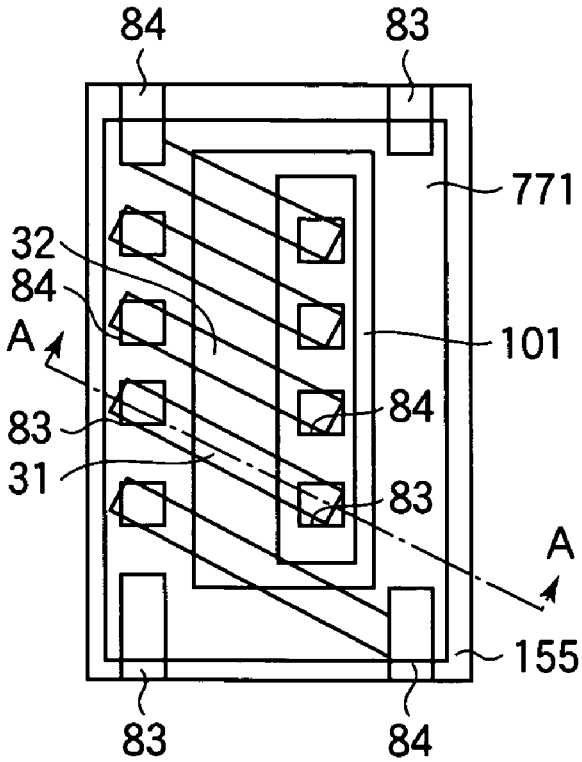
Figure 145A:
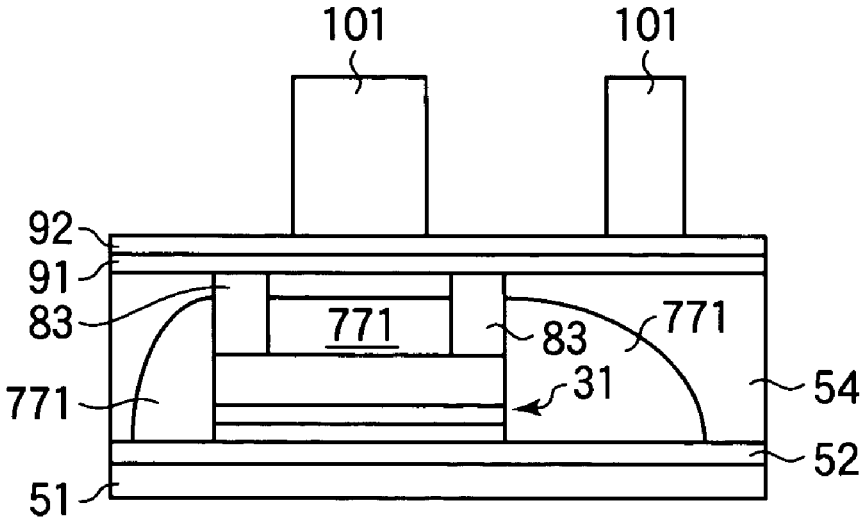
Figure 145B:
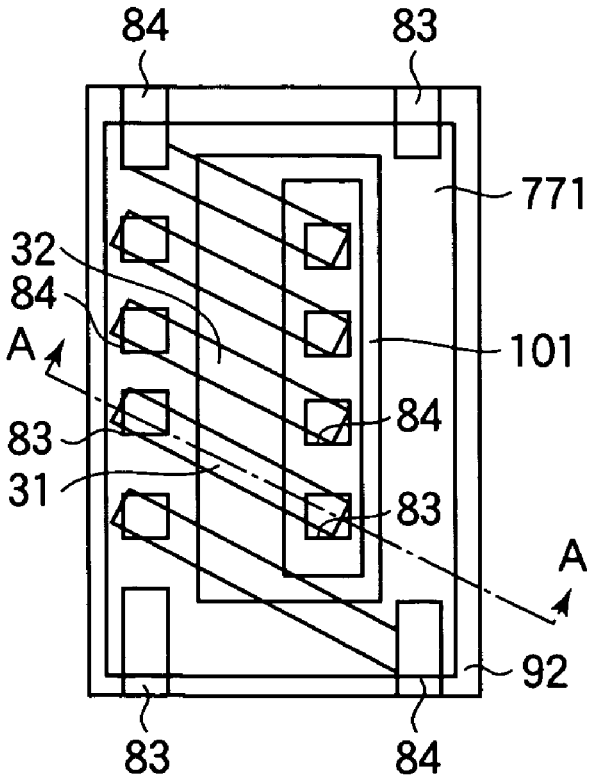
Figure 146A:
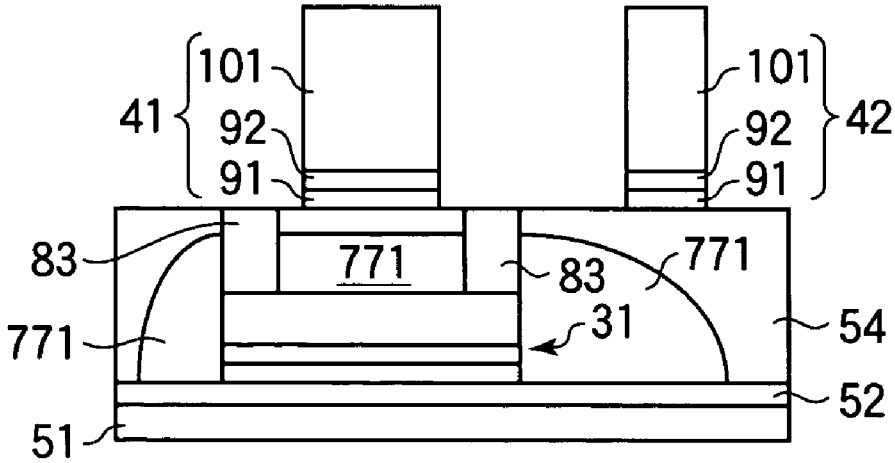
Figure 146B:
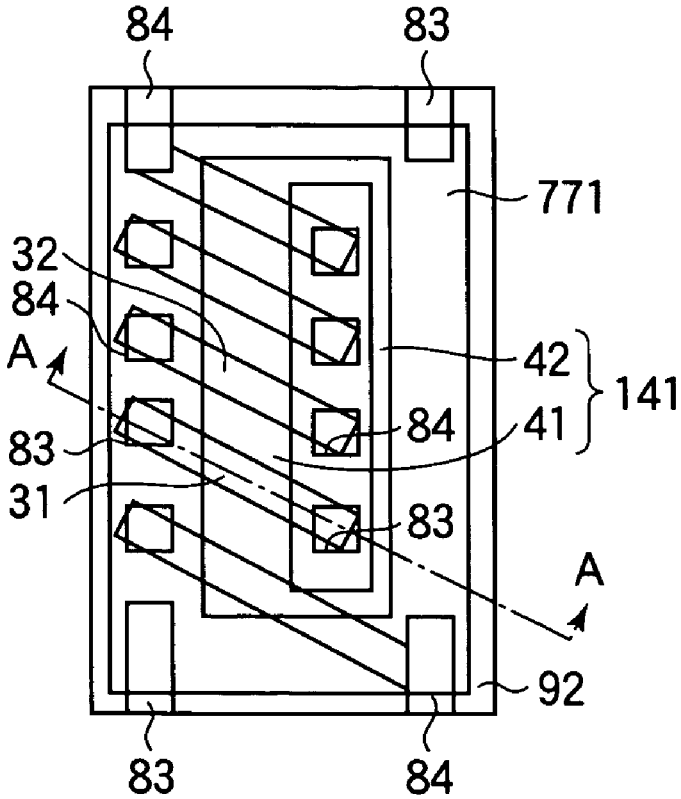
Figure 147A:
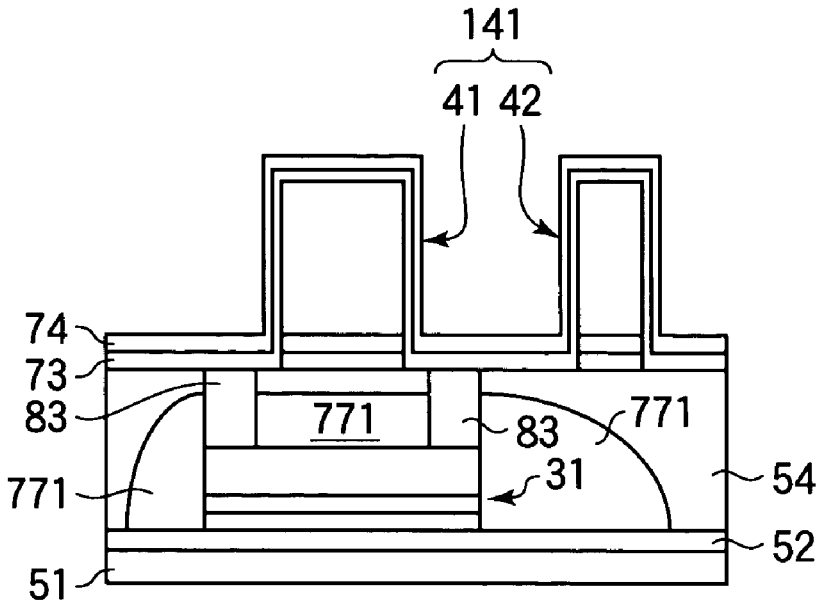
Figure 147B:
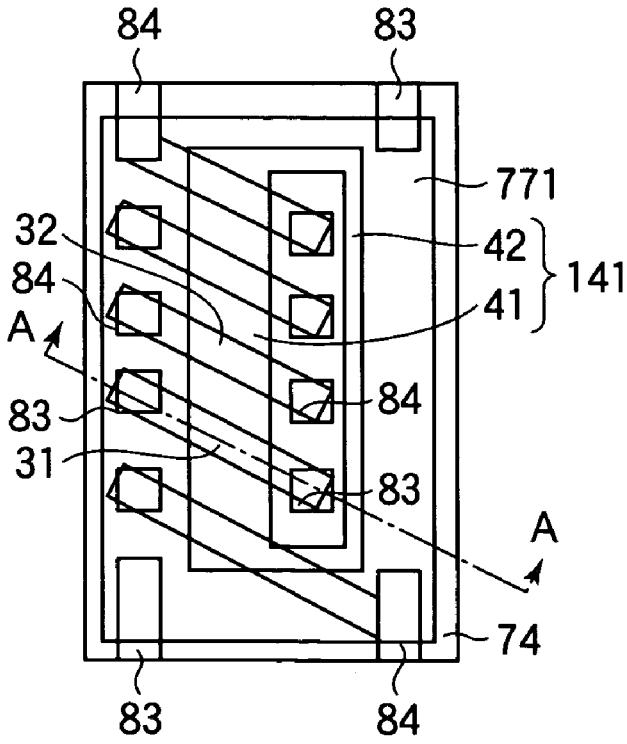
Figure 148A:
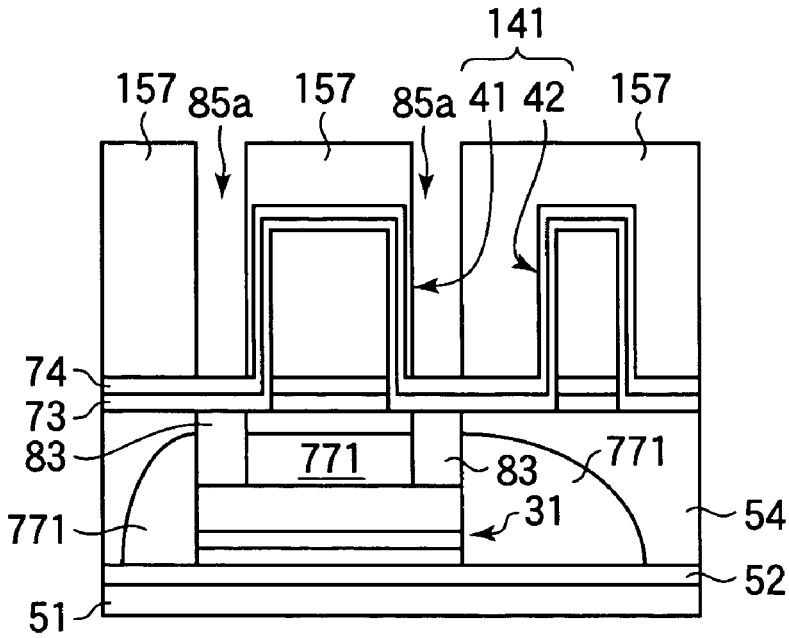
Figure 148B:
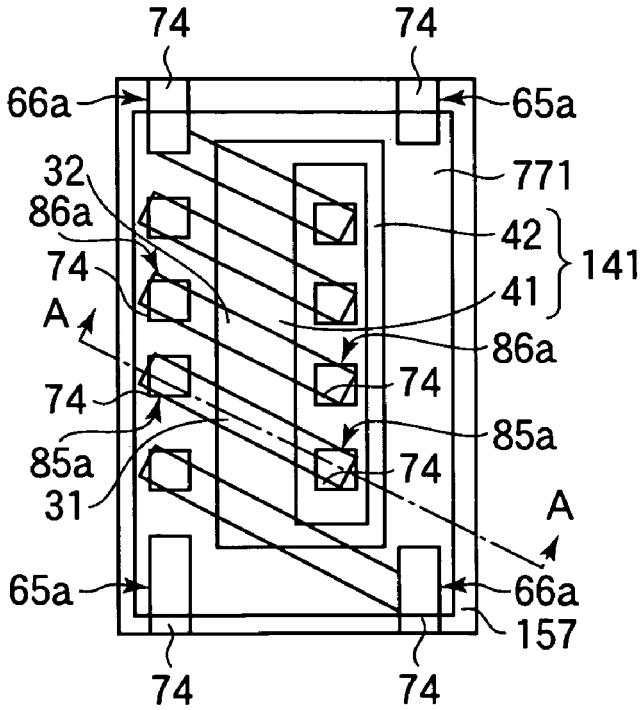
Figure 149A:
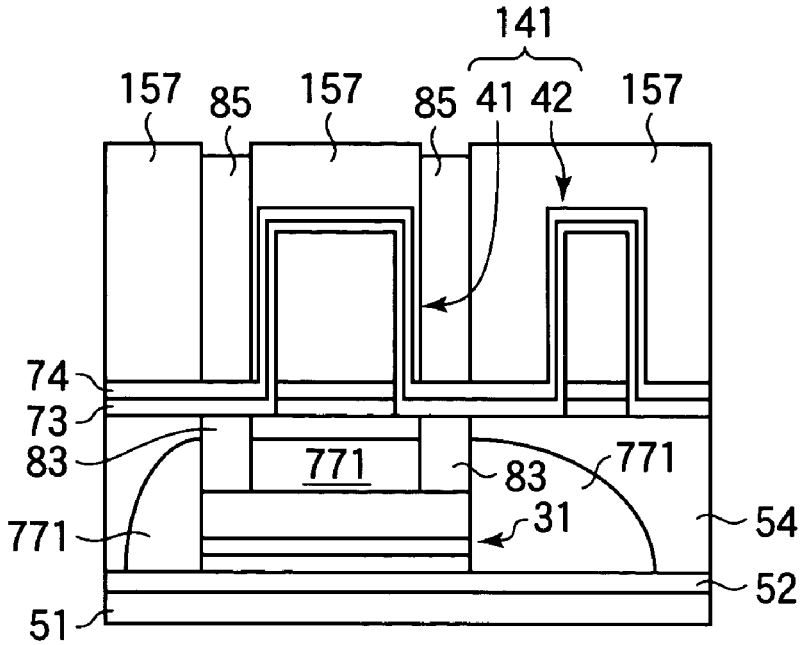
Figure 149B:
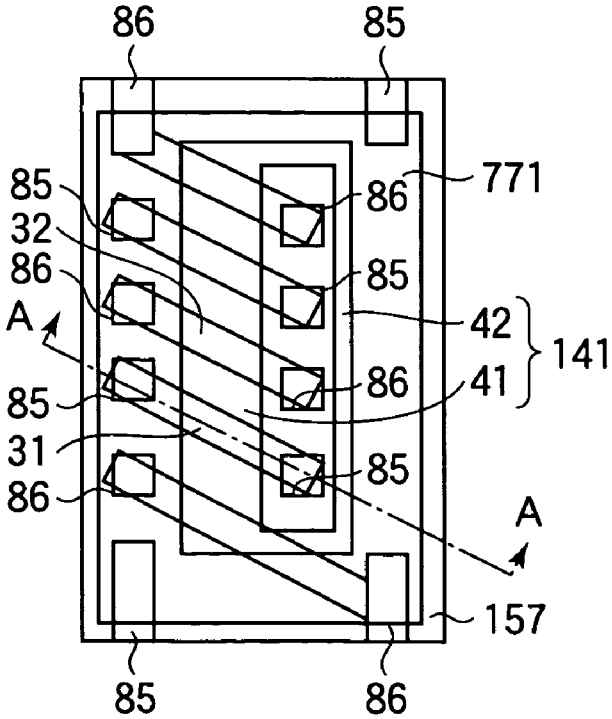
Figure 150A:
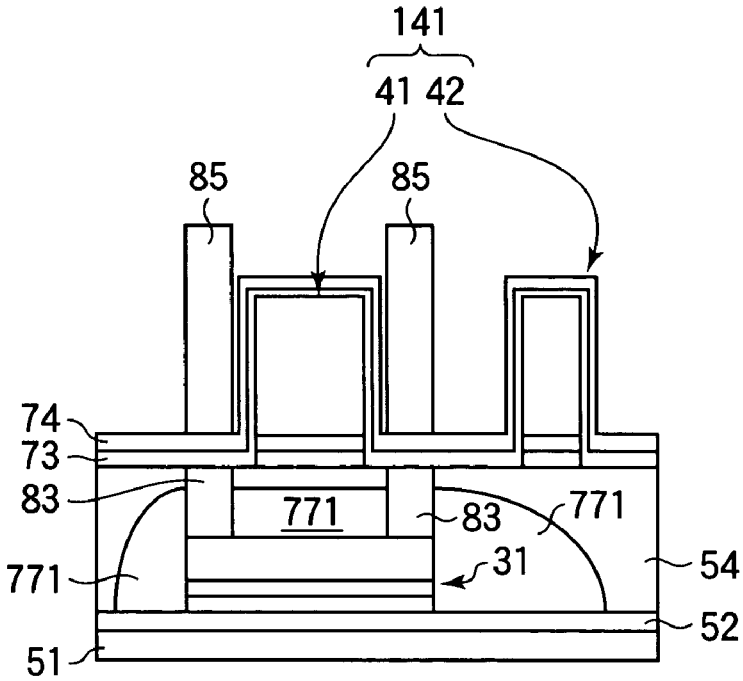
Figure 150B:
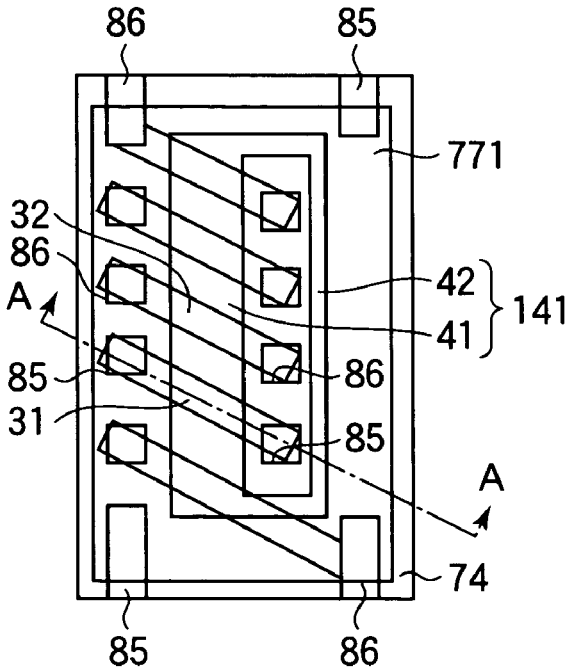
Figure 151A:
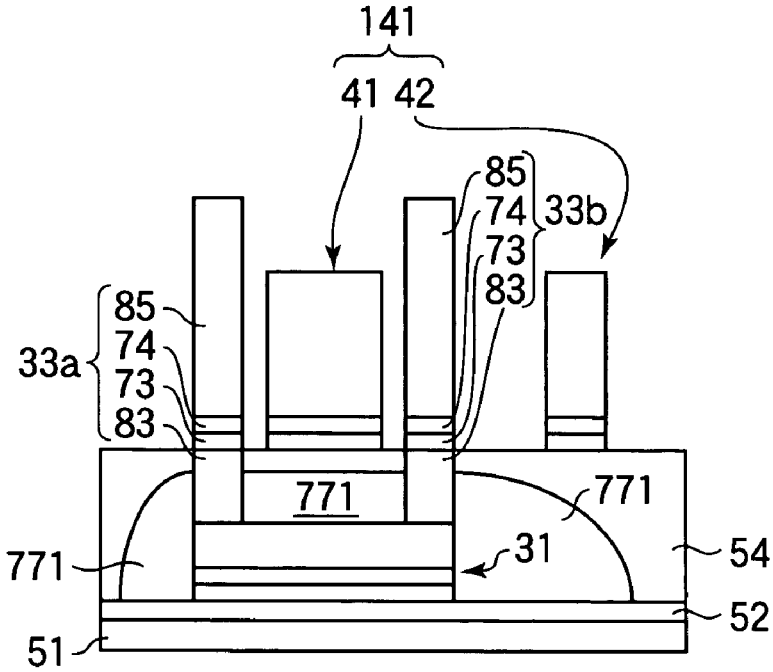
Figure 151B:
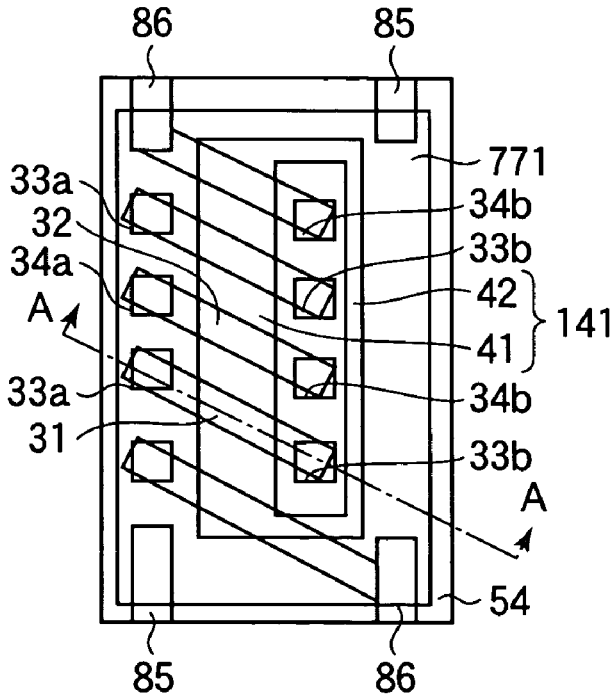
Figure 152A:
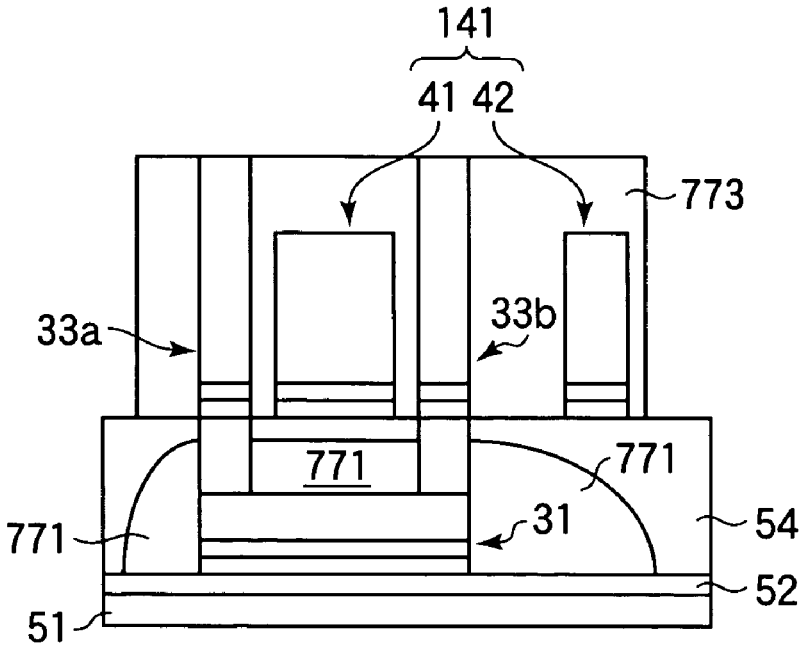
Figure 152B:
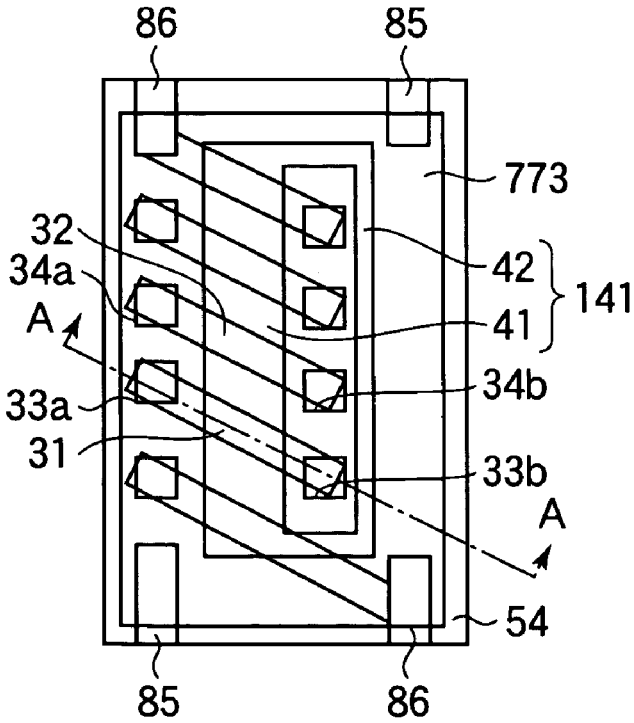
Figure 153A:
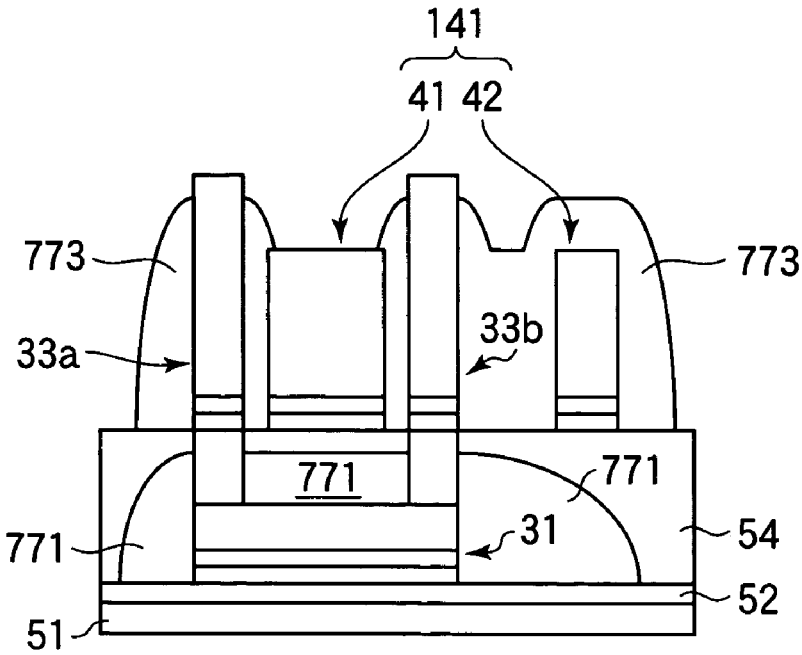
Figure 153B:
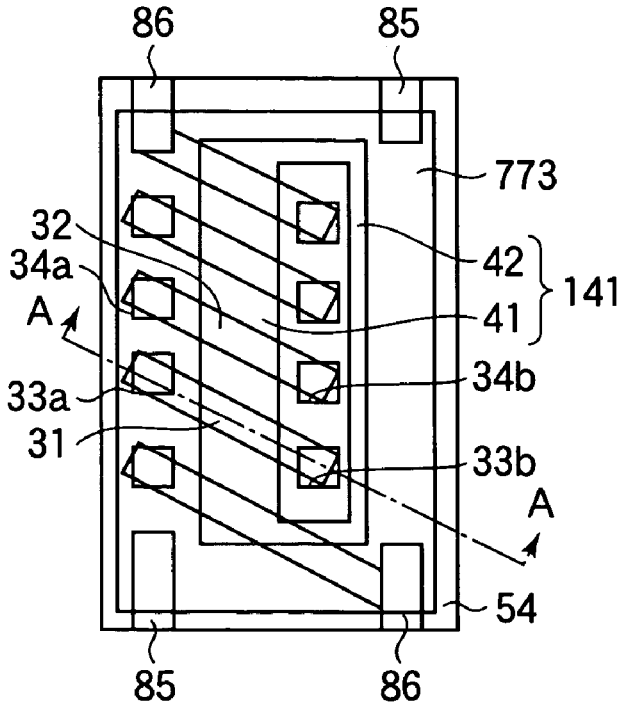
Figure 154A:
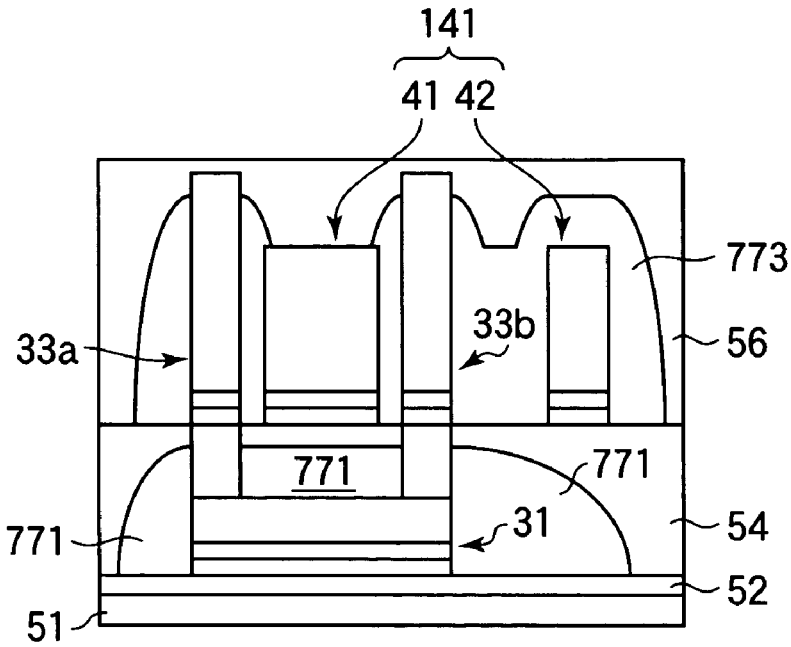
Figure 154B:
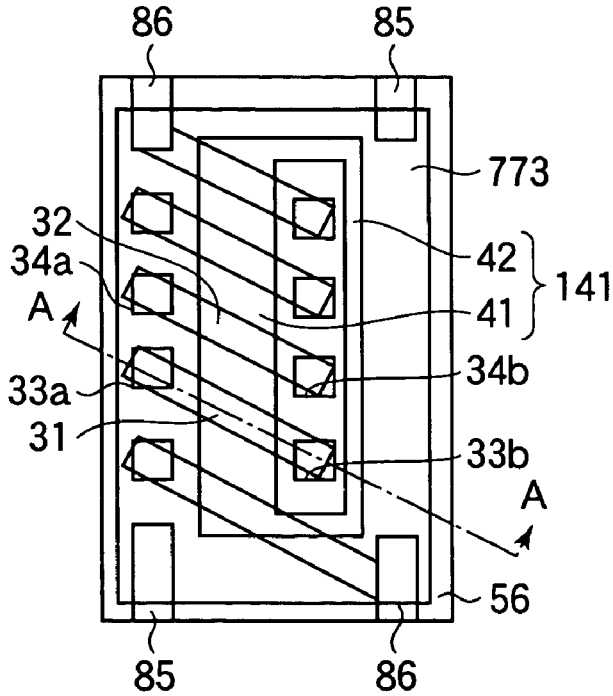
Figure 155A:
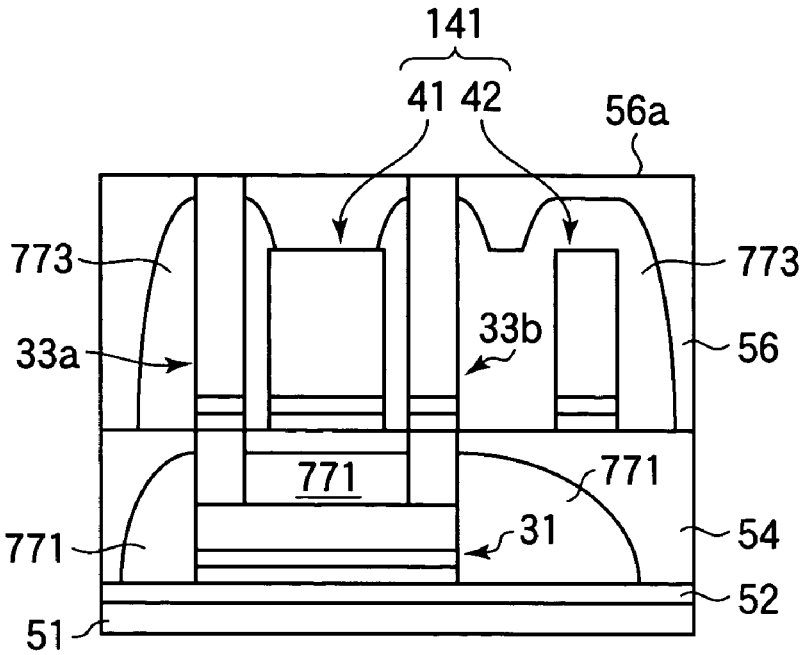
Figure 155B:
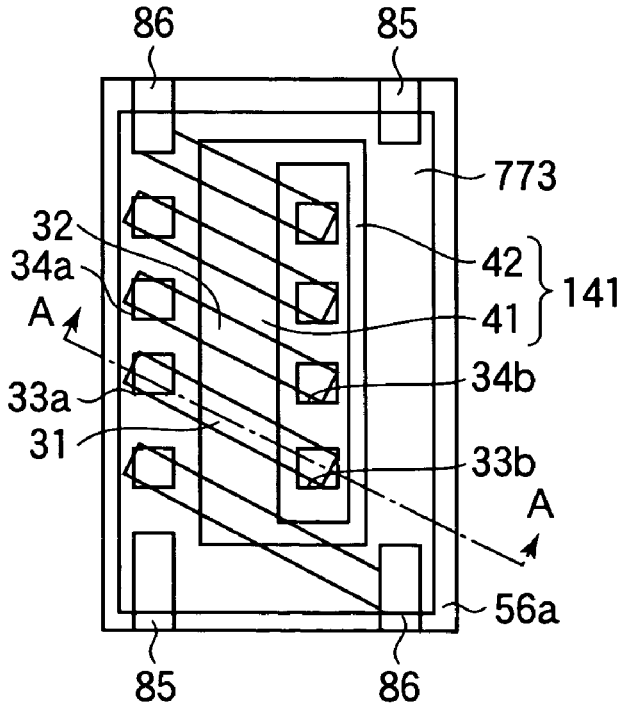
Figure 156A:
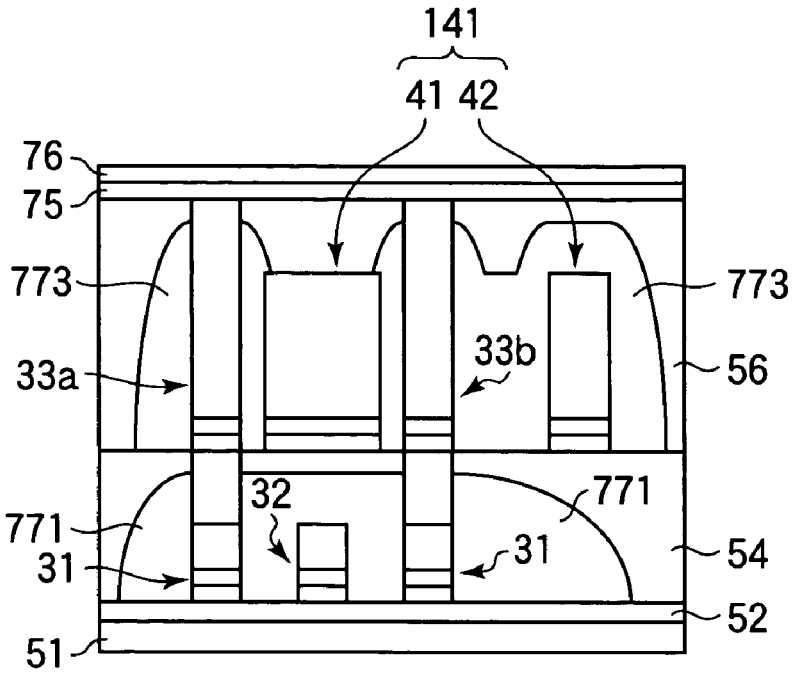
Figure 156B:
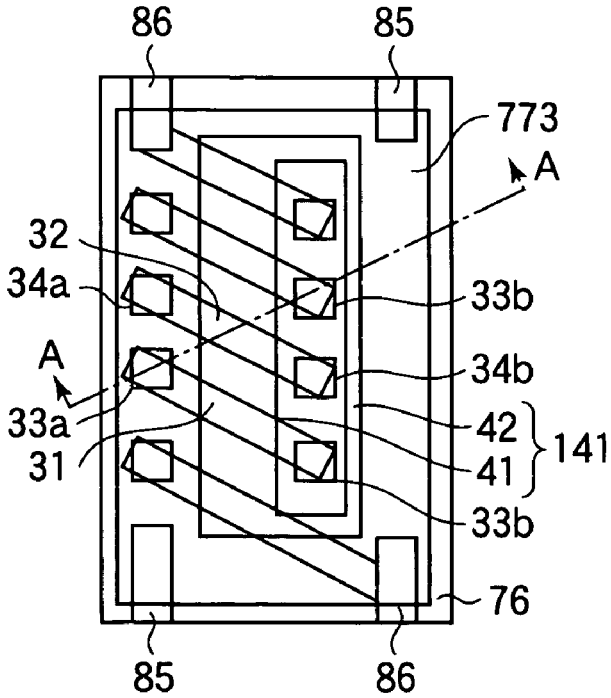
Figure 157A:
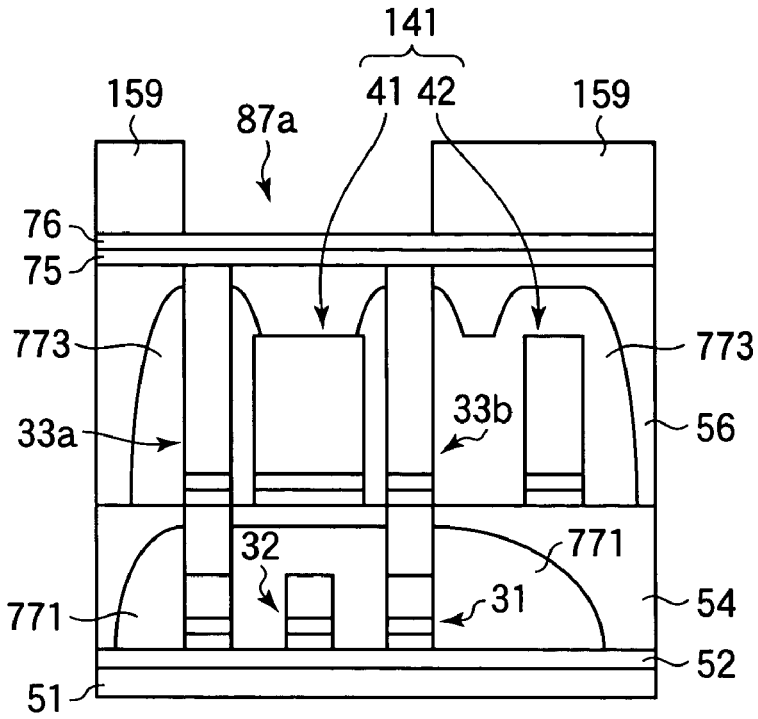
Figure 157B:
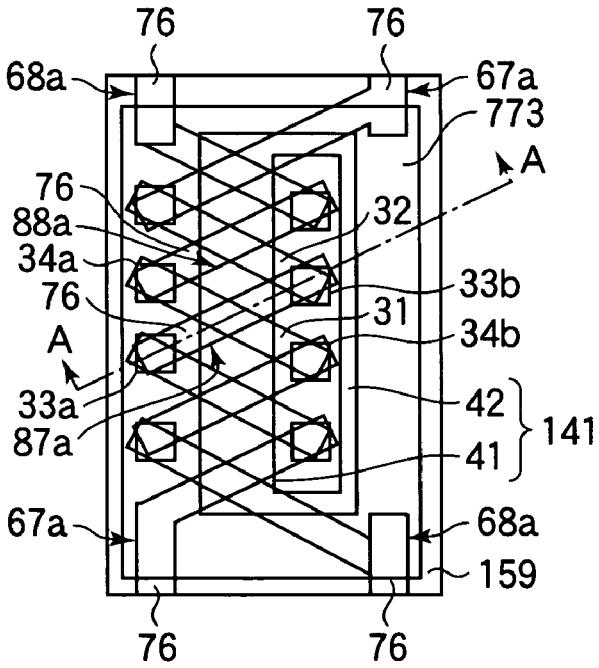
Figure 158A:
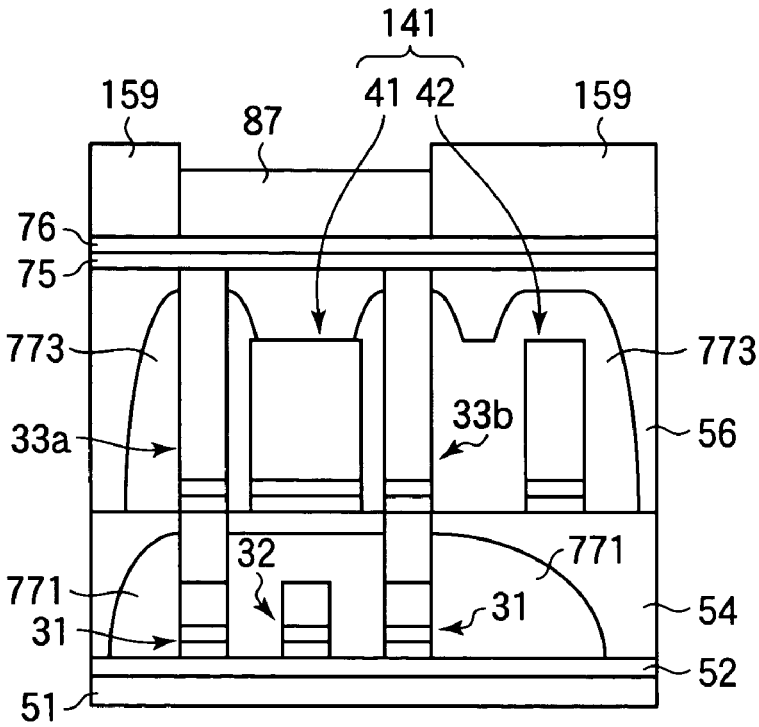
Figure 158B:
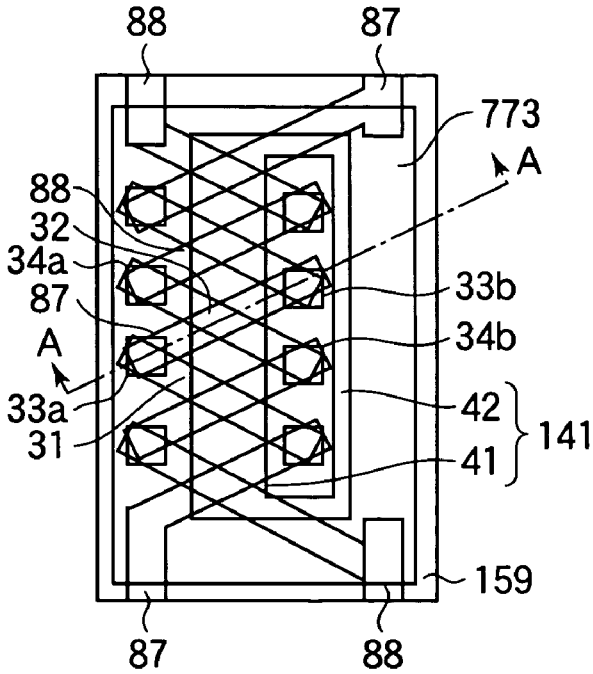
Figure 159A:
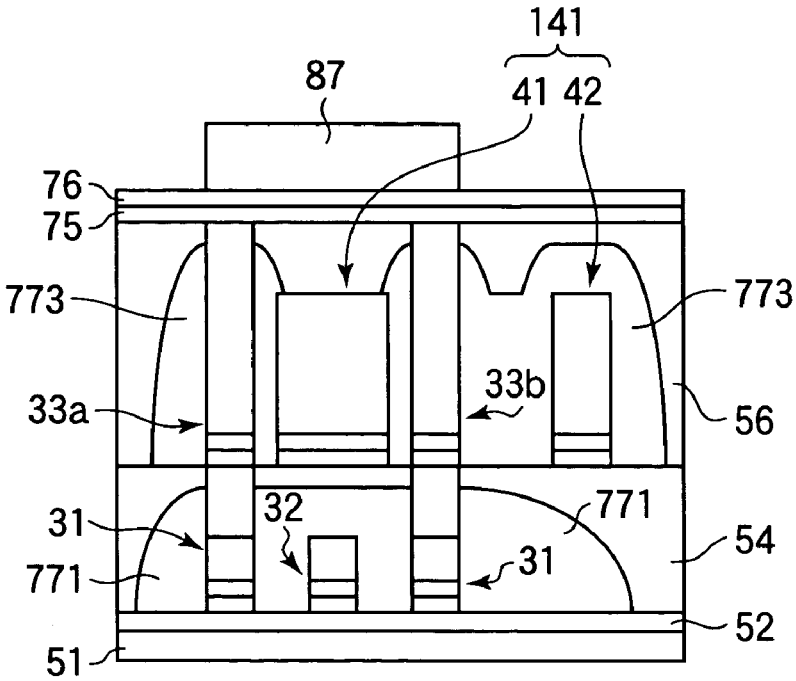
Figure 159B:
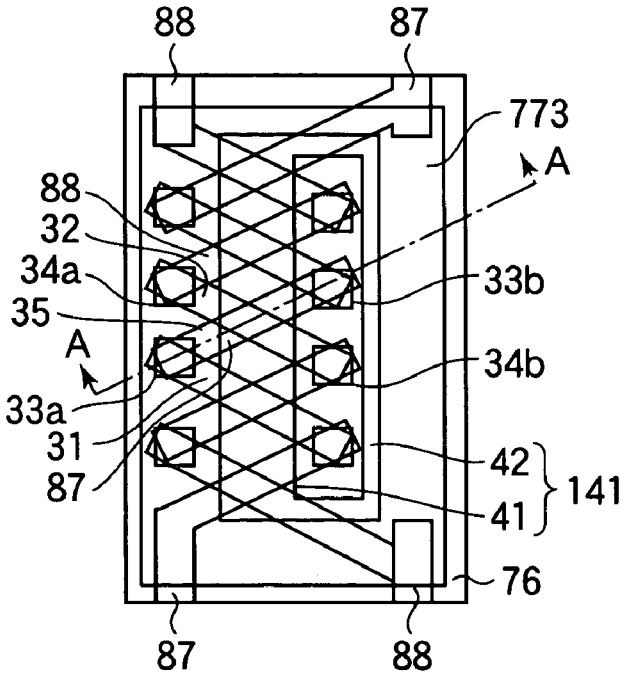
Figure 160A:
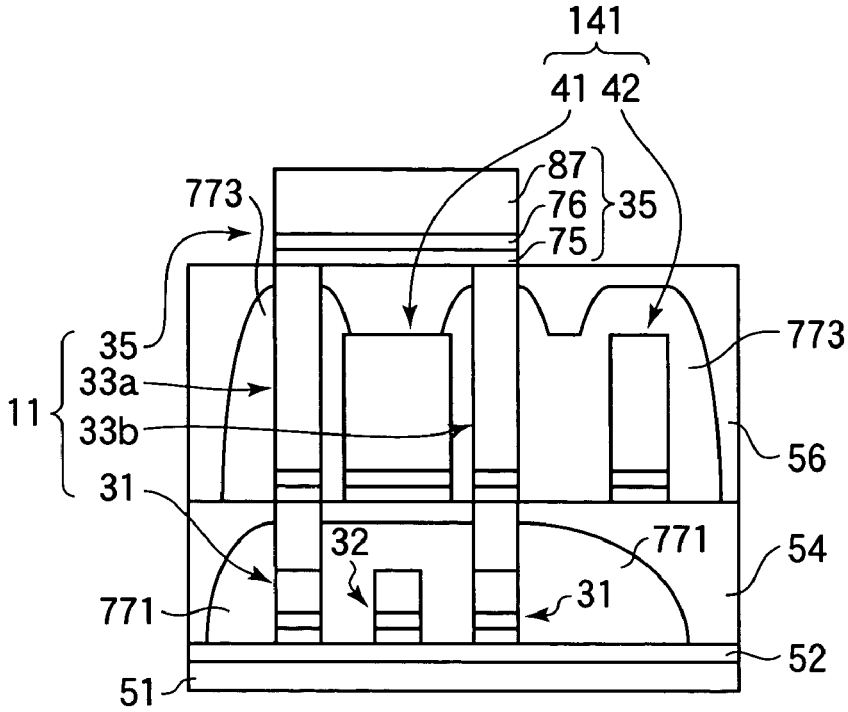
Figure 160B:
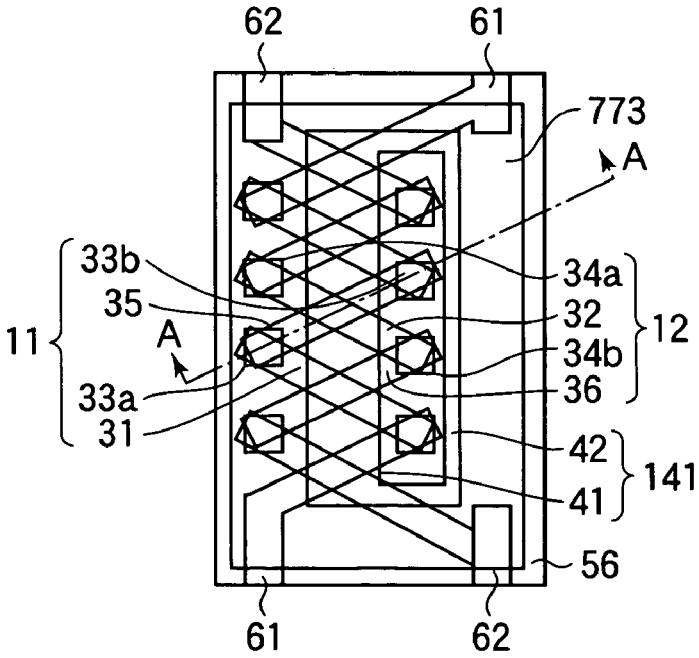
Figure 161A:
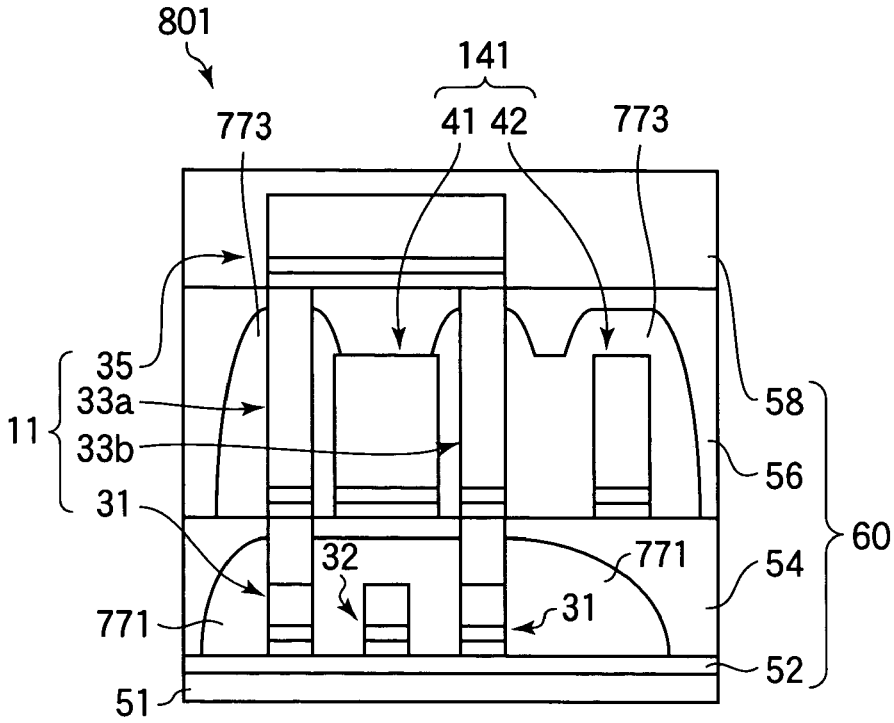
Figure 161B:
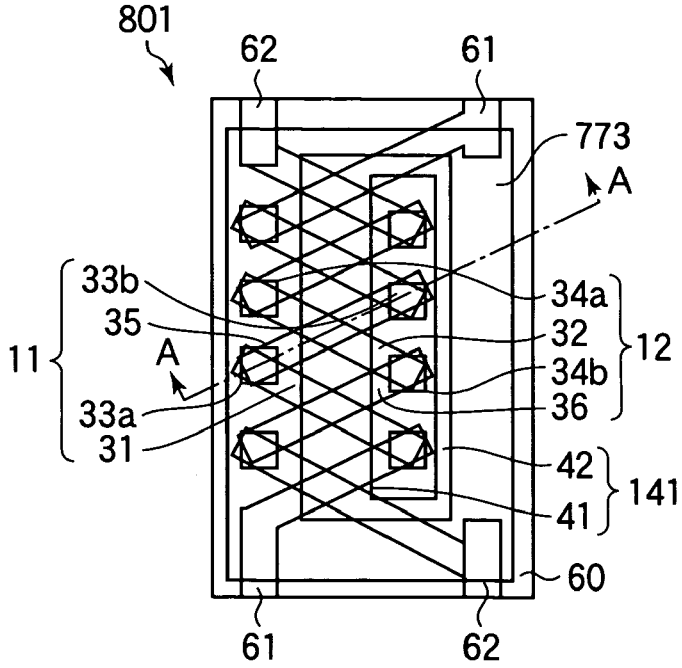

FIGS. 132A and 132B show the method of manufacturing the common mode choke coil 601 according to the fourth embodiment of the invention;

FIGS. 133A and 133B show the method of manufacturing the common mode choke coil 601 according to the fourth embodiment of the invention;

FIGS. 134A and 134B show the method of manufacturing the common mode choke coil 601 according to the fourth embodiment of the invention;

FIGS. 135A and 135B show the method of manufacturing the common mode choke coil 601 according to the fourth embodiment of the invention;

FIGS. 136A, 136B, and 136C show the method of manufacturing the common mode choke coil 601 according to the fourth embodiment of the invention;

FIG. 137 is a table showing the numbers of thin film manufacturing steps required for common mode choke coils according to the first to fourth embodiments of the invention and the related art;

FIGS. 138A and 138B show a method of manufacturing a common mode choke coil 801 according to a fifth embodiment of the invention;

FIGS. 139A and 139B show the method of manufacturing the common mode choke coil 801 according to the fifth embodiment of the invention;

FIGS. 140A and 140B show the method of manufacturing the common mode choke coil 801 according to the fifth embodiment of the invention;

FIGS. 141A and 141B show the method of manufacturing the common mode choke coil 801 according to the fifth embodiment of the invention;

FIGS. 142A and 142B show the method of manufacturing the common mode choke coil 801 according to the fifth embodiment of the invention;

FIGS. 143A and 143B show the method of manufacturing the common mode choke coil 801 according to the fifth embodiment of the invention;

FIGS. 144A and 144B show the method of manufacturing the common mode choke coil 801 according to the fifth embodiment of the invention;

FIGS. 145A and 145B show the method of manufacturing the common mode choke coil 801 according to the fifth embodiment of the invention;

FIGS. 146A and 146B show the method of manufacturing the common mode choke coil 801 according to the fifth embodiment of the invention;

FIGS. 147A and 147B show the method of manufacturing the common mode choke coil 801 according to the fifth embodiment of the invention;

FIGS. 148A and 148B show the method of manufacturing the common mode choke coil 801 according to the fifth embodiment of the invention;

FIGS. 149A and 149B show the method of manufacturing the common mode choke coil 801 according to the fifth embodiment of the invention;

FIGS. 150A and 150B show the method of manufacturing the common mode choke coil 801 according to the fifth embodiment of the invention;

FIGS. 151A and 151B show the method of manufacturing the common mode choke coil 801 according to the fifth embodiment of the invention;

FIGS. 152A and 152B show the method of manufacturing the common mode choke coil 801 according to the fifth embodiment of the invention;

FIGS. 153A and 153B show the method of manufacturing the common mode choke coil 801 according to the fifth embodiment of the invention;

FIGS. 154A and 154B show the method of manufacturing the common mode choke coil 801 according to the fifth embodiment of the invention;

FIGS. 155A and 155B show the method of manufacturing the common mode choke coil 801 according to the fifth embodiment of the invention;

FIGS. 156A and 156B show the method of manufacturing the common mode choke coil 801 according to the fifth embodiment of the invention;

FIGS. 157A and 157B show the method of manufacturing the common mode choke coil 801 according to the fifth embodiment of the invention;

FIGS. 158A and 158B show the method of manufacturing the common mode choke coil 801 according to the fifth embodiment of the invention;

FIGS. 159A and 159B show the method of manufacturing the common mode choke coil 801 according to the fifth embodiment of the invention;

FIGS. 160A and 160B show the method of manufacturing the common mode choke coil 801 according to the fifth embodiment of the invention; and FIGS. 161A and 161B show the method of manufacturing the common mode choke coil 801 according to the fifth embodiment of the invention.

DESCRIPTION OF THE PREFERRED EMBODIMENTS

First Embodiment

Figure 1:
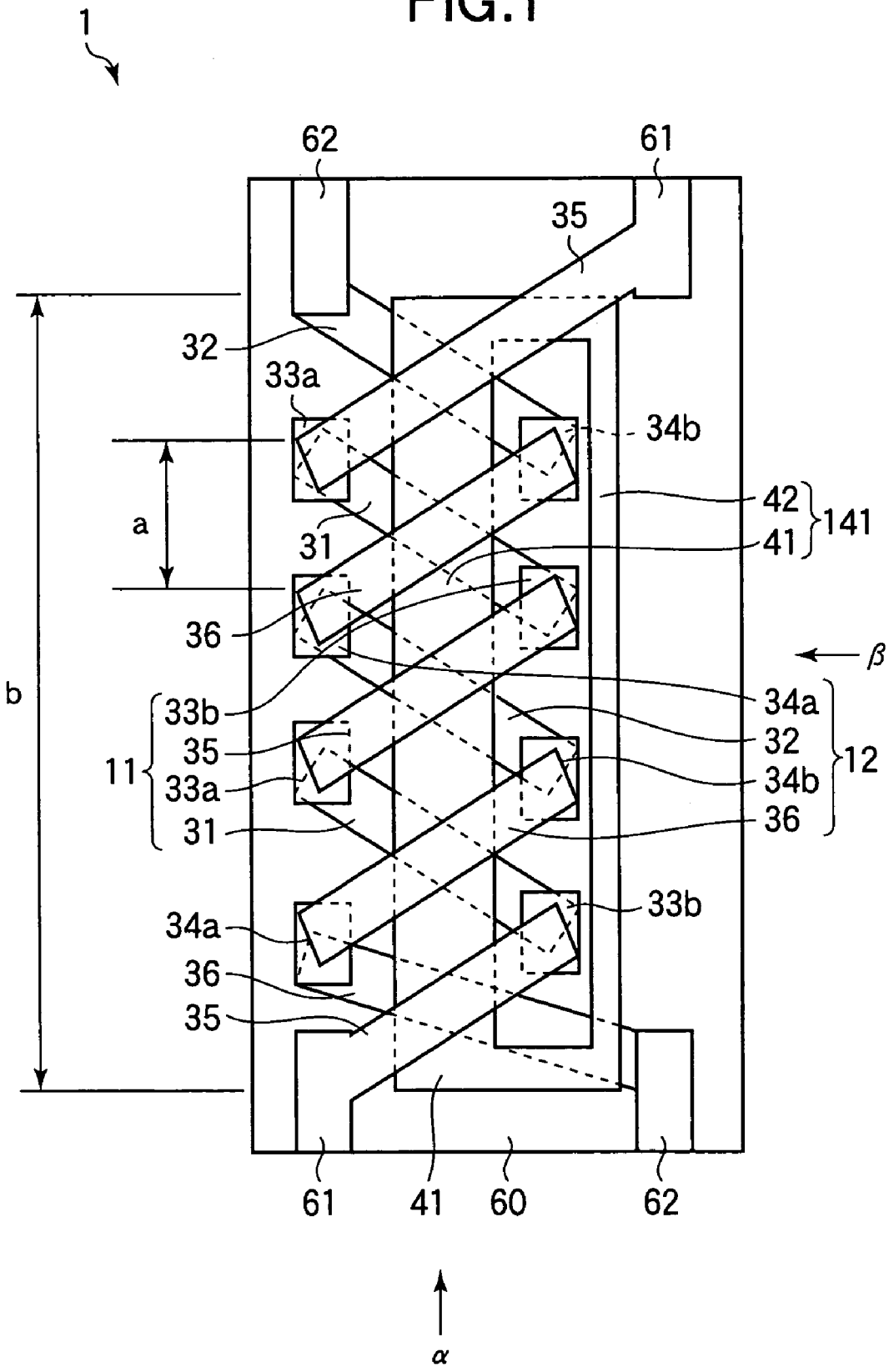
FIG. 1 is a plan view of a common mode choke coil 1 according to a first embodiment of the invention.
Figure 2:
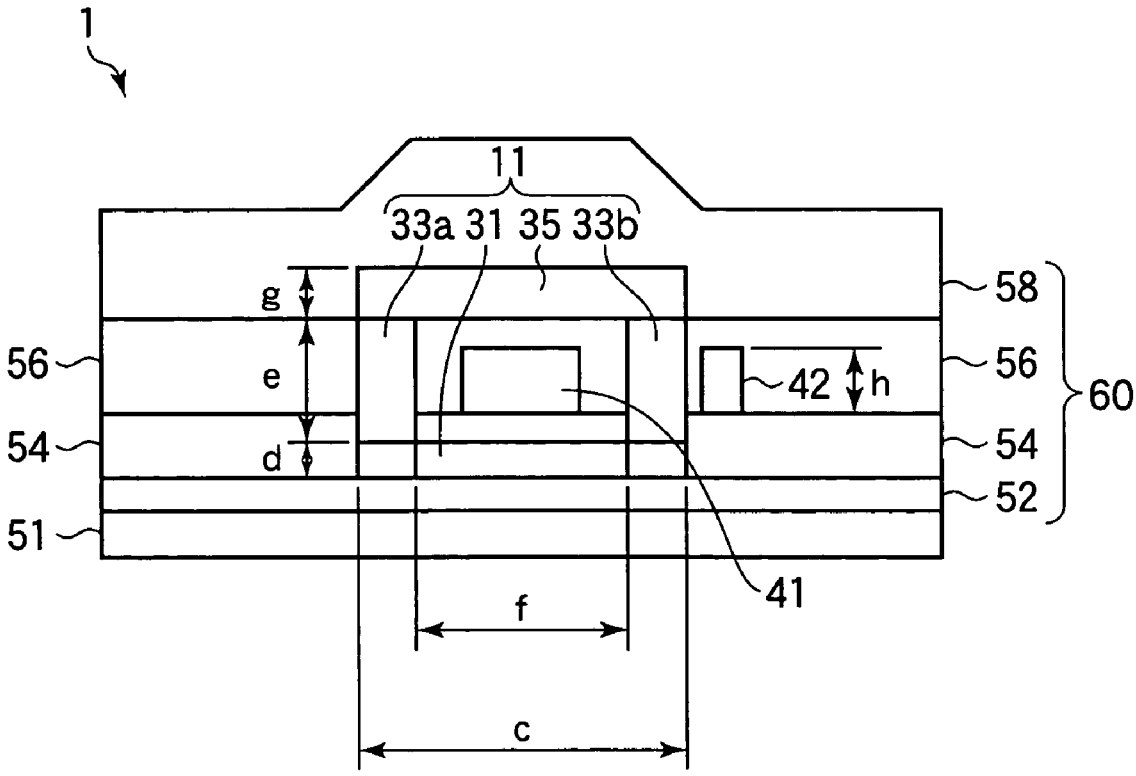
FIG. 2 is a front view of the common mode choke coil 1 according to the first embodiment of the invention.
Figure 3:
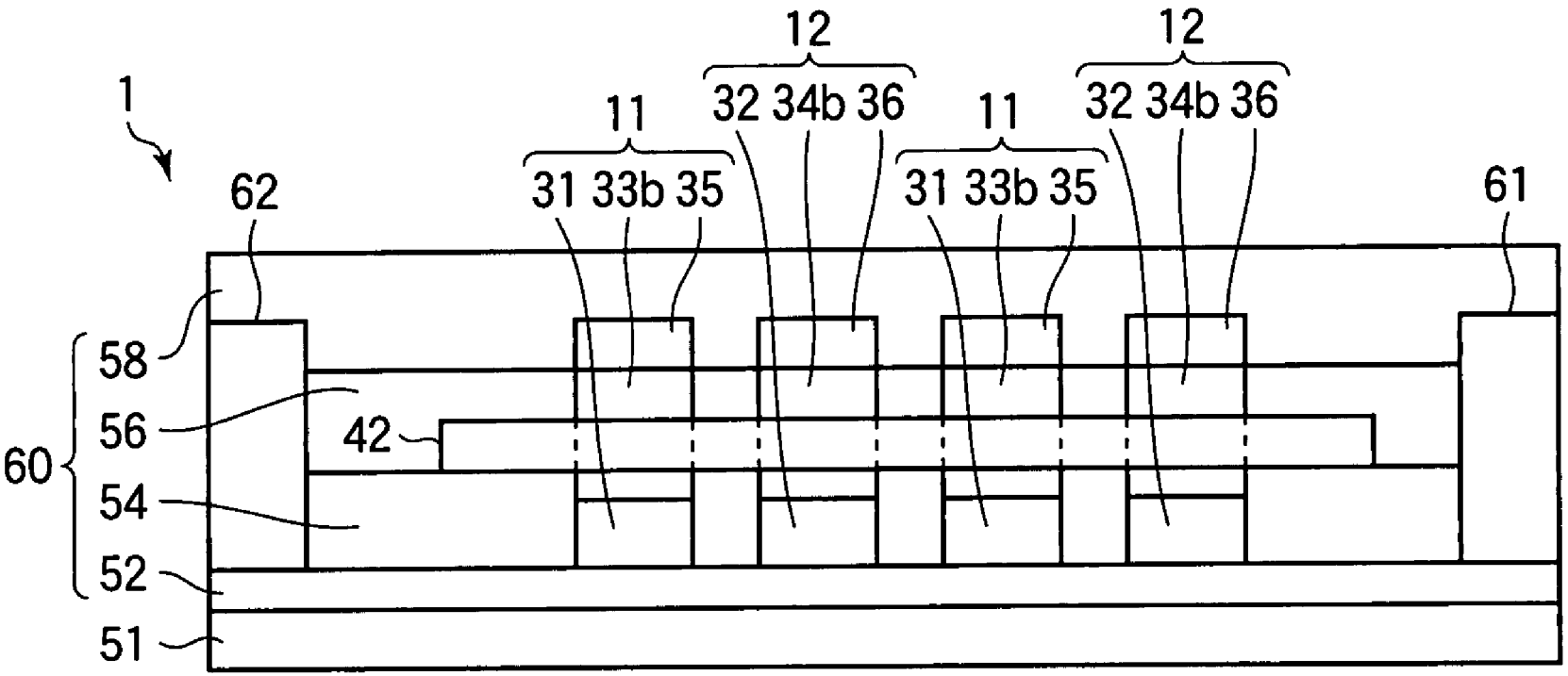
FIG. 3 is a side view of the common mode choke coil 1 according to the first embodiment of the invention.

A common mode choke coil and a method of manufacturing the same according to a first embodiment of the invention will now be described with reference to FIGS. 1 to 35. First, a common mode choke coil 1 according to the present embodiment will be described with reference to FIGS. 1 to 3. FIG. 1 is a plan view of the common mode choke coil 1 of the present embodiment showing an internal structure of the same. FIG. 2 is a front view of the common mode choke coil 1 taken in the direction indicated by α in FIG. 1 to show the internal structure. For easier understanding, FIG. 2 shows a coil bottom part 31 and a coil top part 35 in one and the same plane, although they are not formed in one and the same plane in practice. FIG. 3 is a side view of the common mode choke coil 1 taken in the direction indicated by β in FIG. 1 to show the internal structure. In FIGS. 1 and 3, hidden outlines are represented by broken lines.

As shown in FIGS. 1 and 3, the common mode choke coil 1 has a general outline in the form of a rectangular parallelepiped provided by forming an insulation layer 60, a first helical coil unit 11, a second helical coil unit 12, and a closed magnetic path 141 on a silicon path 51 made of a single-crystal silicon using a thin-film forming technique.

As shown in FIG. 1, the closed magnetic path 141 has an elongate frame-like shape when viewed in the normal direction of a substrate surface of the silicon path 51, and it is formed in the insulation layer 60. The closed magnetic path 141 has a core 41 in the form of a rectangular parallelepiped and a magnetic member part 42 which is in the form of an inverted "C" when viewed in the normal direction of the substrate surface of the silicon substrate 51.

Each of the first and second helical coil units 11 and 12 is helically (spirally) wound around the core 41 and formed in the insulation layer 60. The first and second helical coil units 11 and 12 are formed such that their axes of spiral are substantially parallel to the substrate surface of the silicon substrate 51. The axes of spiral of the first and second helical coil units 11 and 12 substantially coincide with each other.

The first helical coil unit 11 includes one coil having n turns (two turns in FIG. 1), each turn being constituted by a coil bottom part 31, a coil side part 33*a*, a coil top part 35, and a coil side part 33*b* which are each formed, for example, like a rectangular parallelepiped. Similarly, the second helical coil unit 12 includes one coil having n turns, each turn being constituted by a coil bottom part 32, a coil side part 34*a*, a coil top part 36, and a coil side part 34*b* which are each formed, for example, like a rectangular parallelepiped. The coil bottom parts 31 and the coil bottom parts 32 are alternately disposed at equal intervals under the core 41 (on the side of the silicon substrate 51), and the coil top parts 35 and the coil top parts 36 are alternately disposed at equal intervals above the core 41.

In the present application, a term "double spiral structure" is used to refer to a structure in which the coil top parts and the coil bottom parts of the two helical coil units are disposed such that the respective parts alternate with each other and in which the axes of spiral of the helical coil units substantially coincide with each other.

For example, an interval a between one turn of the first helical coil unit 11 and one turn of the second helical coil unit 12 adjacent to the one turn of the coil is in the range from 10 to 50 μm. The first and second helical coil units 11 and 12 are formed from, for example, copper (Cu) to provide the coils with a low resistance. As shown in FIG. 2, one turn of the coil of the first helical coil unit 11 is formed in a rectangular shape when viewed in the direction of the axis of spiral. An internal diameter f of the first helical coil unit 11 in a direction parallel to the substrate surface of the silicon path 51 is, for example, in the range from 5 to 60 μm, and an inner diameter e of the same in a direction perpendicular to the substrate surface is, for example, in the range from 5 to 30 μm. Similarly, one turn of the coil of the second helical coil unit 12 is formed in a rectangular shape. An internal diameter f of the second helical coil unit 12 in the direction parallel to the substrate surface of the silicon path 51 is, for example, in the range from 5 to 60 μm, and an inner diameter e of the same in the direction perpendicular to the substrate surface is, for example, in the range from 5 to 30 μm. The first and second helical coils 11 and 12 are formed to have a section of a constant size in a direction orthogonal to the direction of a current flowing through them.

As shown in FIGS. 1 and 2, the coil bottom parts 31 are formed as a plurality of elongate features whose longer sides have a length c, for example, in the range from 20 to 300 μm and which have a thickness d, for example, in the range from 2 to 10 μm. The coil bottom parts 31 are disposed in parallel on a bottom insulation layer 52 at equal intervals. The coil bottom parts 31 are disposed in parallel at a predetermined angle to the shorter sides of the silicon substrate 51.

A coil side part 33*a* having a height equal to the inner diameter e of the first helical coil unit 11 is formed on one end of a coil bottom part 31 (the left end in FIGS. 1 and 2) in the direction of the longer sides of the same, and a coil side part 33*b* having a height substantially equal to that of the coil side part 33*a* is formed on another end of the same (the right end in FIGS. 1 and 2).

A plurality of elongate coil top parts 35 having, for example, substantially the same shape as the coil bottom parts 31 (having a length c in the range from 20 to 300 μm along the longer sides thereof and a thickness g in the range from 2 to 10 μm) are disposed in parallel at equal intervals on the coil side parts 33*a* and 33*b*. As shown in FIG. 1, one end of a coil top part 35 is electrically connected to a coil side part 33*a*, and another end of the top coil part 35 is electrically connected to a coil side part 33*b* formed on one end of a coil bottom part 31 which extends adjacent to the coil bottom part 31 directly under the above-mentioned coil side part 33*a* so as to sandwich a coil bottom part 32 between them.

The coil bottom parts 32 are disposed between the coil bottom parts 31 substantially in parallel with the coil bottom parts 31. The coil bottom parts 32 are formed from the same material and in the same shape as the coil bottom parts 31 at the same time using the same method of formation. A coil side part 34*a* is formed on one end of a coil bottom part 32 (the left end in FIGS. 1 and 2) in the direction of the longer sides of the same, and a coil side part 34*b* is formed on another end of the same (the right end in FIGS. 1 and 2). The coil side parts 34*a* and 34*b* are formed from the same material and in the same shape as the coil side parts 33*a* and 33*b* at the same time using the same method of formation. The coil side parts 34*a* are disposed at equal intervals on a straight line so as to alternate with the coil side parts 33*a*, and the coil side parts 34*b* are disposed at equal intervals on a straight line so as to alternate with the coil side parts 33*b*.

A plurality of elongate coil top parts 36 is disposed in parallel at equal intervals on the coil side parts 34*a* and 34*b*. The coil top parts 36 are disposed between the coil top parts 35 substantially in parallel with the coil top parts 35. The coil top parts 36 are formed from the same material and in the same shape as the coil top parts 35 at the same time using the same method of formation. As shown in FIG. 1, one end of a coil top part 36 is electrically connected to a coil side part 34*a*, and another end of the top coil part 36 is electrically connected to a coil side part 34*b* formed on one end of a coil bottom part 32 which extends adjacent to the coil bottom part 32 directly under the above-mentioned coil side part 34*a* so as to sandwich a coil bottom part 31 between them. As shown in FIG. 1, when the substrate surface of the silicon path 51 is viewed in the normal direction thereof, the coil top parts 35 extend across the coil bottom parts 32 at a predetermined angle to them, and the coil top parts 36 extend across the coil bottom parts 31 at a predetermined angle to them.

As shown in FIGS. 1 to 3, the core 41 is disposed to extend through the first and second helical coil units 11 and 12 on the side of the inner circumferences of the coils, the core 41 being in the form of a rectangular parallelepiped having, for example, an overall length b in the range from 100 to 300 μm and a thickness h in the range from 5 to 10 μm. The core 41 is formed to extend substantially coaxially with the axes of spiral of the first and second helical coil units 11 and 12. The core 41 extends across the coil bottom parts 31 and 32 and the coil top parts 35 and 36 at a predetermined angle to them when the substrate surface of the silicon substrate 51 is viewed in the normal direction thereof. The core 41 is formed from a material having high permeability such as NiFe (permalloy). Since the core 41 is formed from a material having high permeability, the common mode choke coil 1 has a high inductance value, and it can therefore be provided with improved electrical characteristics such as impedance characteristics.

As shown in FIGS. 1 and 2, the magnetic member part 42, which is formed from the same material as the core 41 to the same thickness h, is connected to both ends of the core 41. The magnetic member part 42 cooperates with the core 41 to form an annular closed magnetic path 141. The closed magnetic path 141 is formed substantially in parallel with the surface on which the coil bottom parts 31 are formed. The coil side parts 33*a* and 34*a* are disposed on the side of the outer circumference of the magnetic path 141, and the coil side parts 33*b* and 34*b* are disposed on the side of the inner circumference of the same. Since the closed magnetic path 141 is formed in an annular shape from a material having high permeability, the leakage of magnetic flux can be prevented.

As shown in FIG. 2, the insulation layer 60 is provided by forming the insulation layer (bottom insulation layer) 52, an insulation layer 54, an insulation layer 56, and an insulation layer 58 one over another in the order listed on the silicon substrate 51. For example, each of the insulation layers 52, 54, 56, and 58 is formed from alumina ($Al_2O_3$). The coil bottom parts 31 and 32 are formed on the insulation layer 52. The core 41 and the magnetic member part 42 are formed on the insulation layer 54. The coil top parts 35 and 36 are formed on the insulation layer 56. As thus described, the common mode choke coil 1 has a multi-layer structure in which the features such as the core 41 and coil bottom parts 31 and insulation layers 52 to 58 are formed one over another.

As shown in FIG. 1, each of two ends of the first helical coil unit 11 is electrically connected to an external electrode connecting part 61 in the form of a rectangular parallelepiped. Similarly, each of two ends of the second helical coil unit 12 is electrically connected to an external electrode connecting part 62. The external electrode connecting parts 61 and 62 are formed such that they are partially exposed on each of a pair of outer surfaces of the insulation layer 60 opposite to each other. Although not shown, external electrodes are formed on the sides of the common mode choke coil 1 so as to cover the exposed parts of the external electrode connecting parts 61 and 62. The common mode choke coil 1 is solder-mounted to a printed circuit board (PCB) using the external electrodes.

As described above, in the common mode choke coil 1 of the present embodiment, the first and second helical coil units 11 and 12 are formed such that their axes of spiral are substantially in parallel with the substrate surface of the silicon substrate 51. Therefore, an increase in the number of turns of the coil results in substantially no change in the thickness of the coil. Further, the closed magnetic path 141 is formed in a plane which is substantially in parallel with the substrate surface of the silicon substrate 51. Therefore, even if the common mode choke coil 1 has a great number of turns, it can be provided with a profile lower than that of a common mode choke coil whose axis of spiral is oriented perpendicularly to a substrate surface of a silicon path 51 thereof. Since the common mode choke coil 1 has helical coils, the coil 1 can be made smaller than a common mode choke coil having spiral coil extending in one plane even if it has a great number of turns.

The common mode choke coil 1 can be provided with a small profile because it does not have two magnetic substrates disposed opposite to each other unlike common mode choke coils according to the related art.

A method of manufacturing a common mode choke coil 1 according to the present embodiment will now be described with reference to FIGS. 4A to 32B. While a multiplicity of common mode choke coils 1 are simultaneously formed on a wafer, FIGS. 4A to 32B show an element forming region of one common mode choke coil 1. FIGS. 4 to 32 having a suffix A are sectional views taken along lines A-A in FIGS. 4 to 32 having a suffix B. FIGS. 4 to 32 having a suffix B are plan views showing the method of manufacturing a common mode choke coil 1.

Figure 4A:
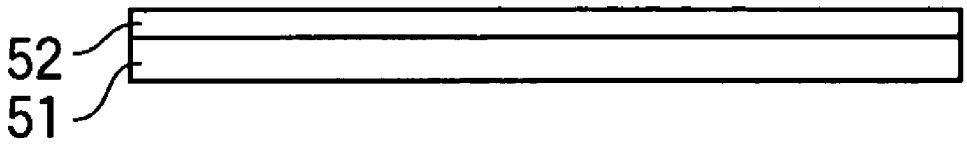
FIGS. 4A and 4B show a method of manufacturing the common mode choke coil 1 according to the first embodiment of the invention.
Figure 4B:
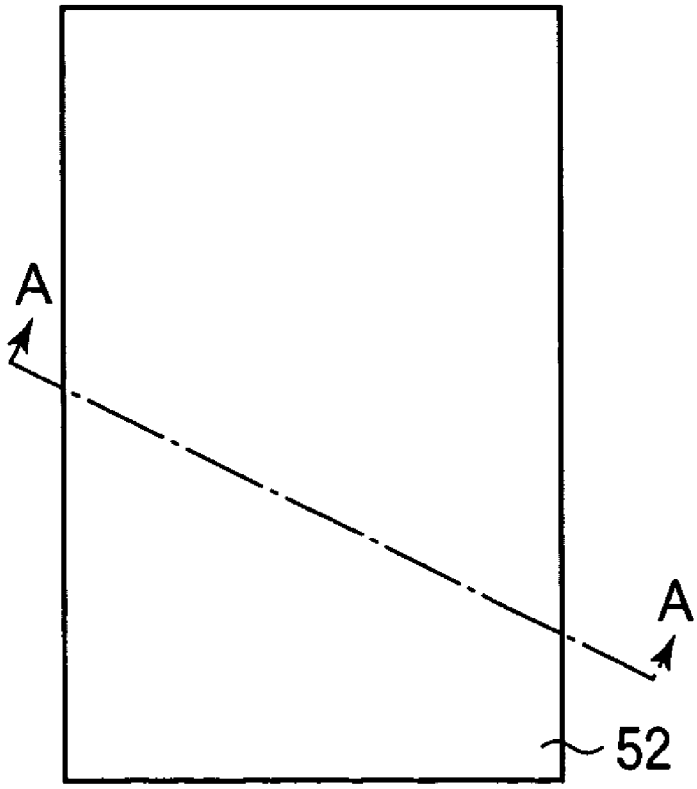

First, as shown in FIGS. 4A and 4B, a film of alumina ($Al_2O_3$) is formed on a silicon path 51 having a thickness of about 0.8 mm formed from a single-crystal silicon using, for example, a sputtering process to provide an insulation layer (bottom insulation layer) 52 having a thickness of about 3 μm. It is not required to form the insulation layer 52 when an insulated substrate having a sufficiently smooth surface is used. Although an organic insulating material may be used to form the insulation layer 52, alumina is preferred because it can easily form a planar surface compared to an organic insulating material. Each of insulation layers to be described later is formed using the same method as for the insulation layer 52.

Figure 5A:
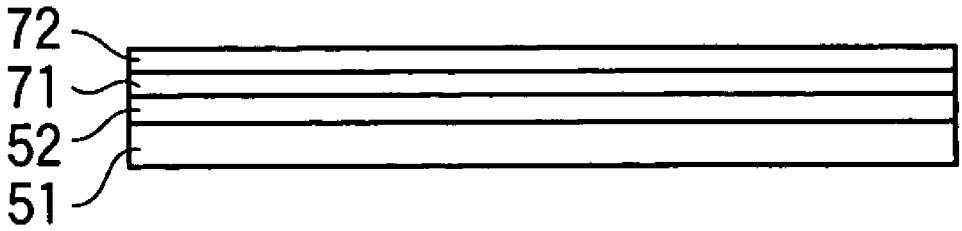
FIGS. 5A and 5B show the method of manufacturing the common mode choke coil 1 according to the first embodiment of the invention.
Figure 5B:
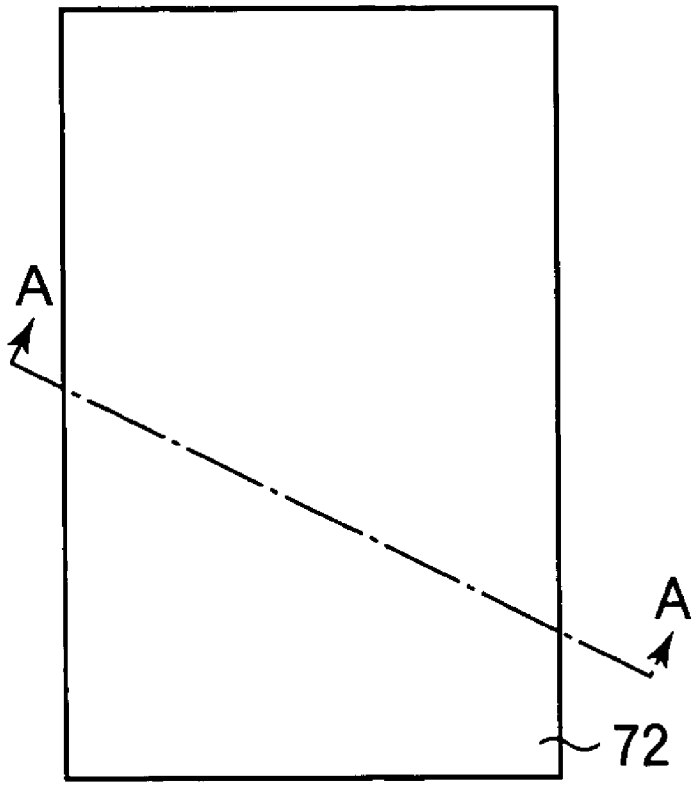

Next, as shown in FIG. 5A, a titanium (Ti) electrode film 71 having a thickness of about 10 nm is formed on the insulation layer 52 using, for example, a sputtering process. The electrode film 71 is used as a buffer film for improving adhesion of a Cu electrode film 72 which will be described later. The buffer film may be formed from other metal materials such as chromium (Cr). Next, as shown in FIGS. 5A and 5B, a Cu electrode film (first electrode film) 72 having a thickness of about 100 nm is formed on the electrode film 71 using, for example, a sputtering process. The electrode film 72 is used as an electrode film for plating the patterns of conductive layers 81 and 82 which will be described later. Each of electrode films to be described later is formed using the same method as for the electrode films 71 and 72.

Figure 6A:
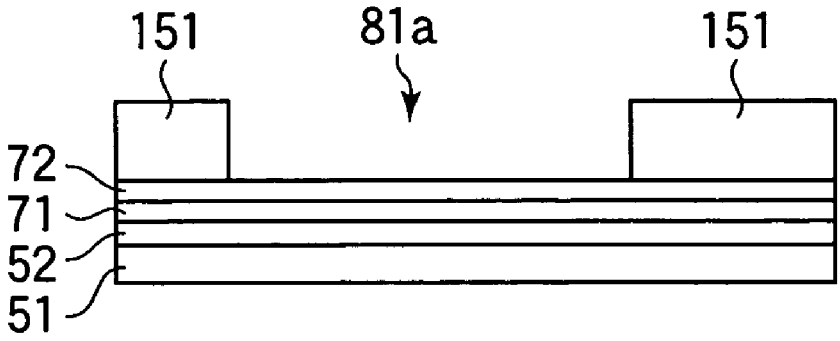
FIGS. 6A and 6B show the method of manufacturing the common mode choke coil 1 according to the first embodiment of the invention.
Figure 6B:
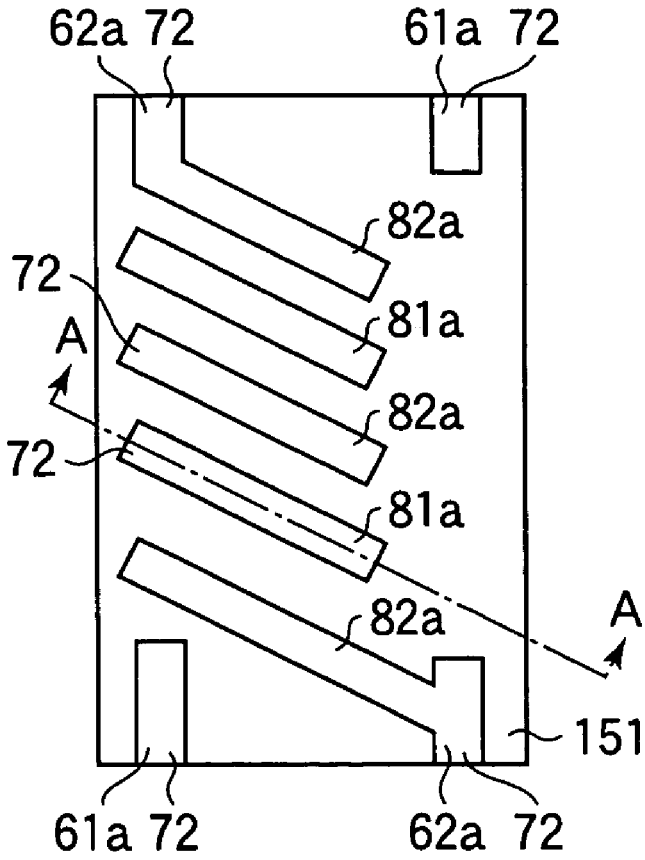

Next, a resist is applied to the electrode film 72 using, for example, a spin coat process to form a resist layer (first resist layer) 151 having a thickness in the range from 10 to 15 μm. Each of resist layers to be described later is formed using the same method as for the resist layer 151. Next, as shown in FIGS. 6A and 6B, the resist layer 151 is patterned to form openings 61*a* and 62*a* and openings (first openings) 81*a* and 82*a* for exposing the electrode film 72 in the resist layer 151. The openings 61*a* and 62*a* are formed in parallel on each of shorter sides of the element forming region in positions inside and near longer sides of the outer circumference of the region. A plurality of elongate openings 81*a* and 82*a* are alternately formed in parallel at substantially equal intervals. The openings 81*a* and 82*a* are formed at a predetermined angle to the shorter sides of the element forming region. The two openings 82*a* disposed near the shorter sides are formed such that they are connected to the openings 62*a* at one end thereof.

Figure 7A:
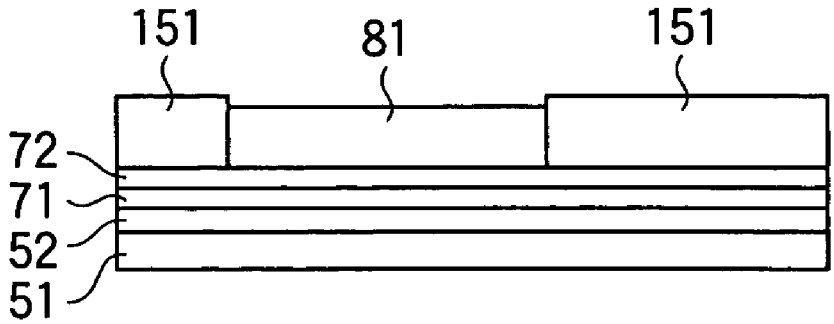
FIGS. 7A and 7B show the method of manufacturing the common mode choke coil 1 according to the first embodiment of the invention.
Figure 7B:
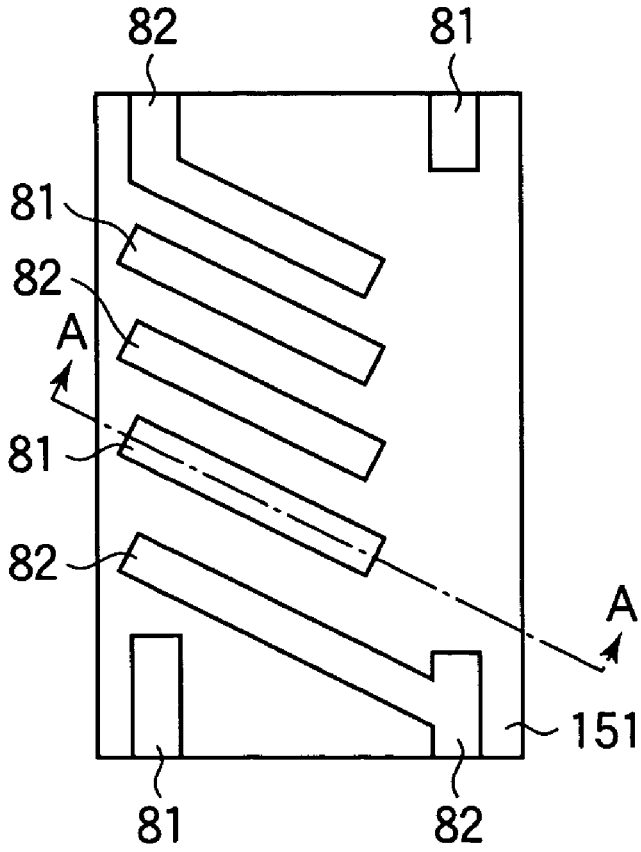
Figure 8A:
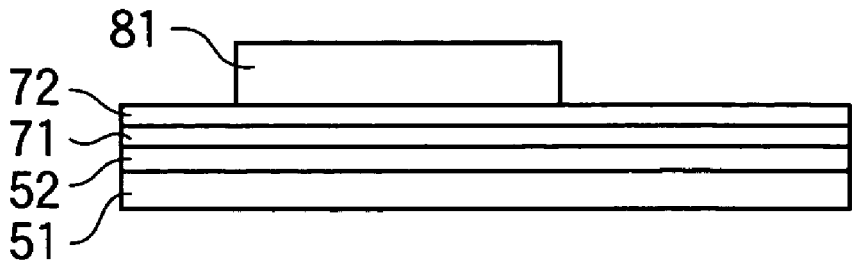
FIGS. 8A and 8B show the method of manufacturing the common mode choke coil 1 according to the first embodiment of the invention.
Figure 8B:
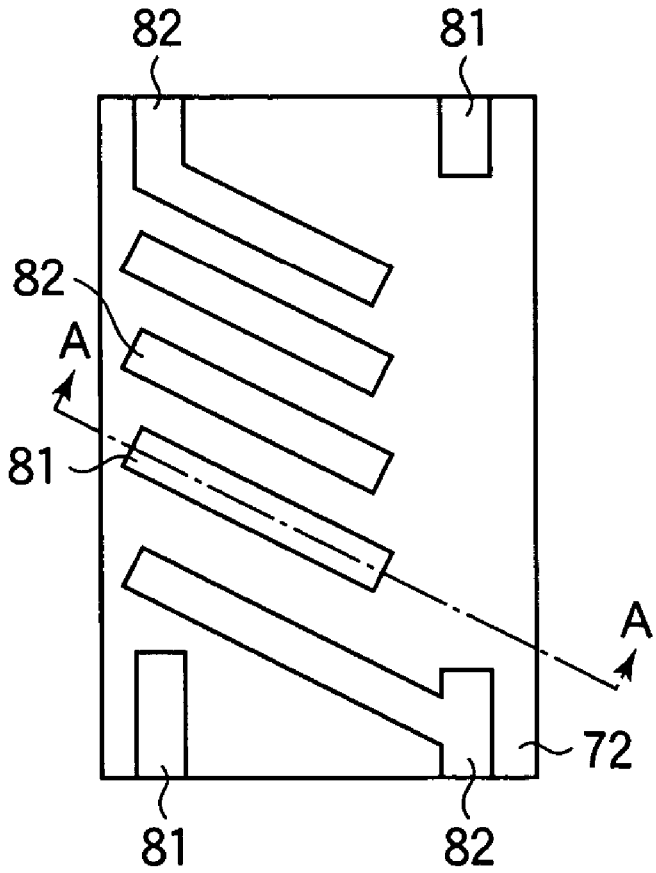

Next, as shown in FIGS. 7A and 7B, Cu electrode layers (first conductive layers) 81 having a thickness in the range from 7 to 10 μm are formed on the electrode film 72 in the openings 61*a* and 81*a*, and conductive layers (first conductive layers) 82 having the same thickness are formed from the same material on the electrode film 72 in the openings 62*a* and 82*a*. For example, the conductive layers 81 and 82 are simultaneously formed using a pattern plating process and are each electrically connected to the electrode film 72 under the same. Cu is used to form the conductive layers 81 and 82 in order that first and second helical coil units 11 and 12 to be finally formed will have a low resistance. Each of Cu electrodes to be described later is formed and patterned using the same method as for the conductive layers 81 and 82. As shown in FIGS. 8A and 8B, the resist layer 151 is then etched away.

Figure 9A:
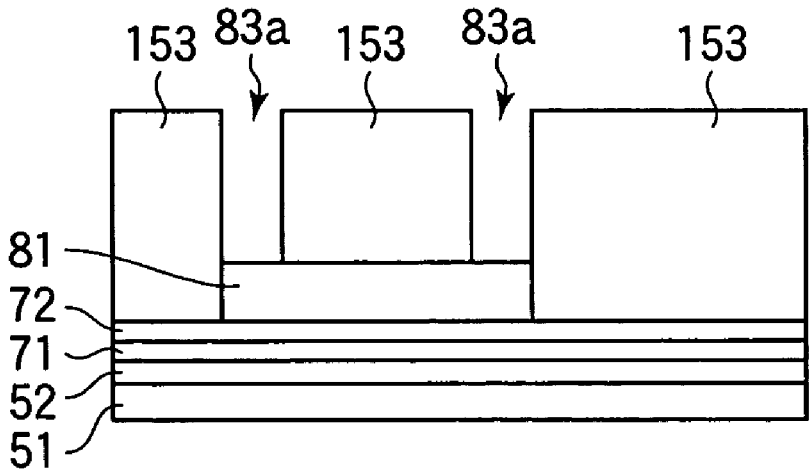
FIGS. 9A and 9B show the method of manufacturing the common mode choke coil 1 according to the first embodiment of the invention.
Figure 9B:
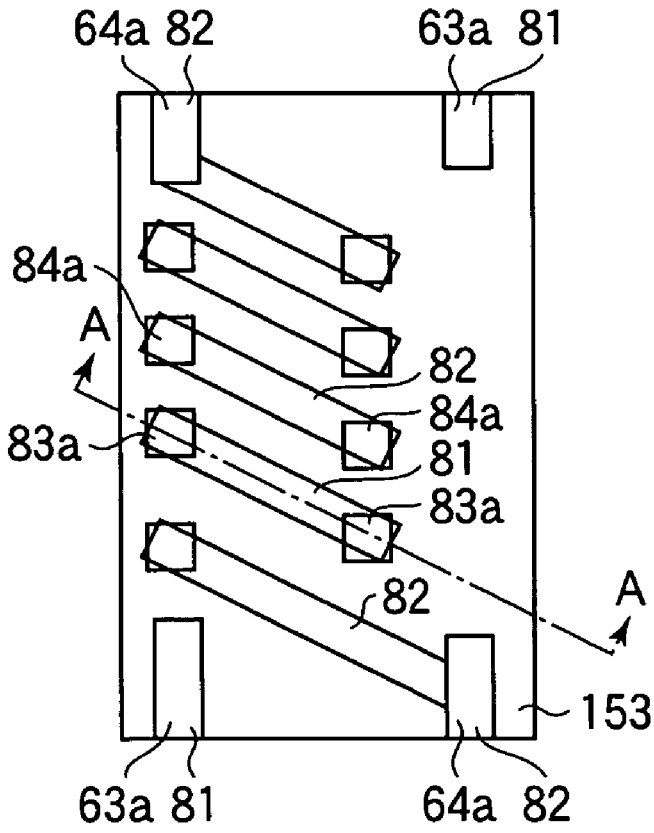
Figure 10A:
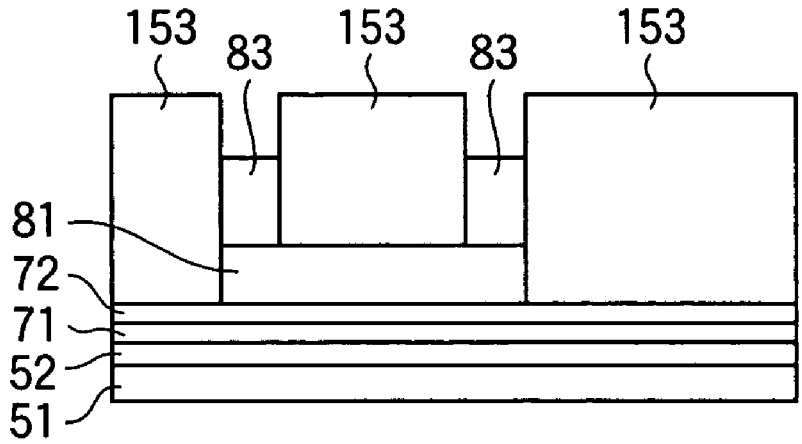
FIGS. 10A and 10B show the method of manufacturing the common mode choke coil 1 according to the first embodiment of the invention.
Figure 10B:
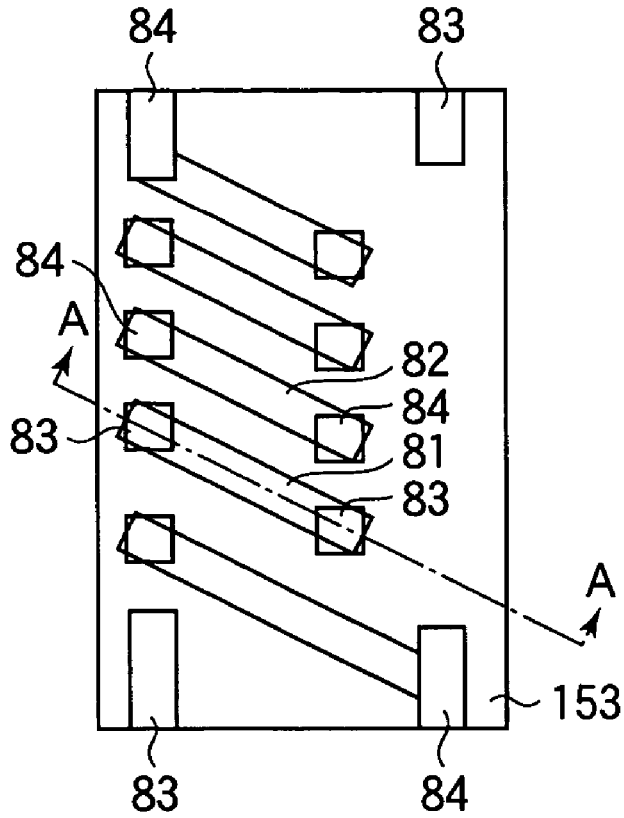

Next, a resist is applied throughout the resultant surface to form a resist layer (second resist layer) 153 having a thickness in the range from 15 to 20 μm. Next, as shown in FIGS. 9A and 9B, the resist layer 153 is patterned to form the resist layer 153 with a plurality of openings (second openings) 83*a* and 84*a* for exposing both ends of the conductive layers 81 and 82 formed in the openings 81*a* and 82*a* and openings 63*a* and 64*a* for exposing the conductive layers 81 and 82 formed in the openings 61*a* and 62*a*. As shown in FIG. 9B, the plurality of openings 83*a* and 84*a* formed above one end of the plurality of respective conductive layers 81 and 82 are alternately disposed on a straight line at equal intervals, and the plurality of openings 83*a* and 84*a* formed above another end of the respective layers are alternately disposed on a straight line at equal intervals. Next, as shown in FIGS. 10A and 10B, Cu conductive layers (second conductive layers) 83 having a thickness of about 3 μm are formed on the conductive layers 81 in the openings 63*a* and 83*a*, and conductive layers (second conductive layers) 84 are formed from the same material with the same thickness on the conductive layers 82 in the openings 64*a* and 84*a*. The conductive layers 83 and 84 are simultaneously formed using a pattern plating process. Thus, the conductive layers 83 are electrically connected to the conductive layers 81 located under the same, and the conductive layers 84 are electrically connected to the conductive layers 82 located under the same.

Figure 11A:
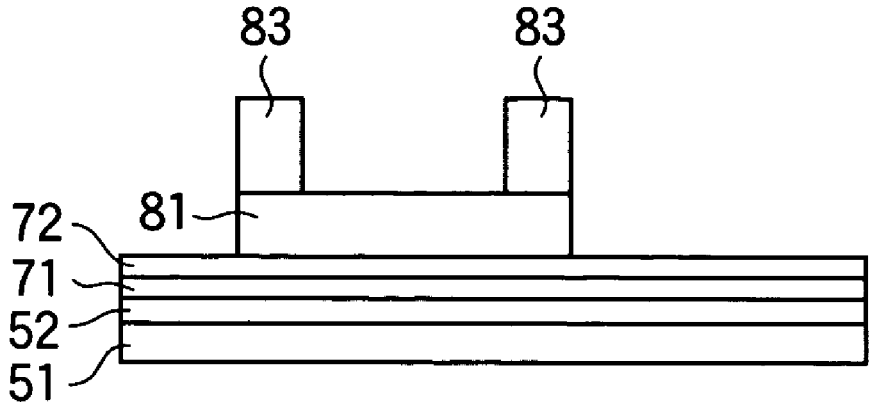
FIGS. 11A and 11B show the method of manufacturing the common mode choke coil 1 according to the first embodiment of the invention.
Figure 11B:
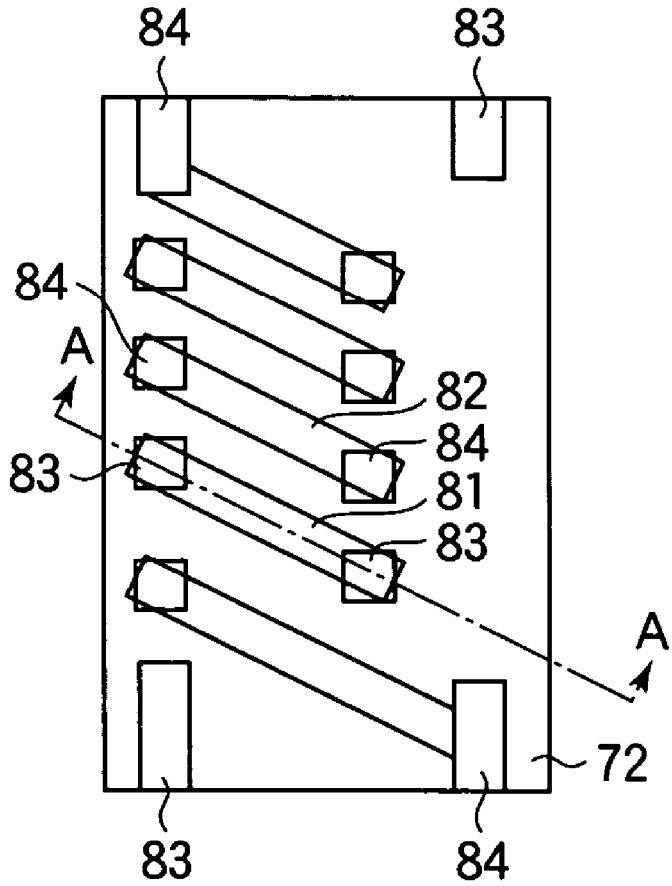
Figure 12A:
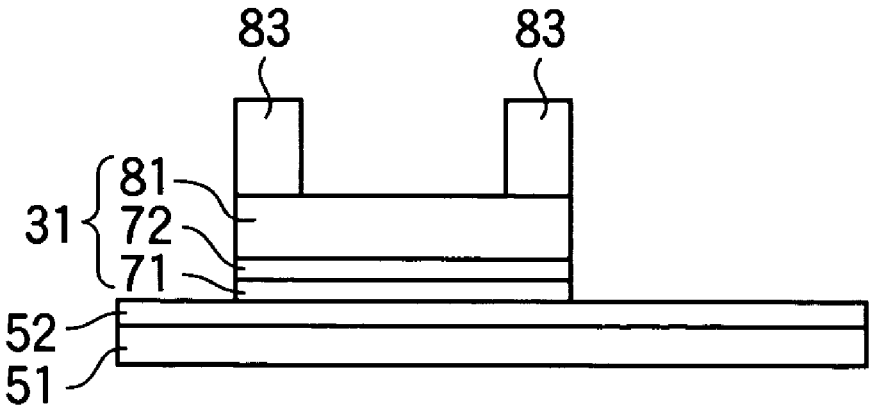
FIGS. 12A and 12B show the method of manufacturing the common mode choke coil 1 according to the first embodiment of the invention.
Figure 12B:
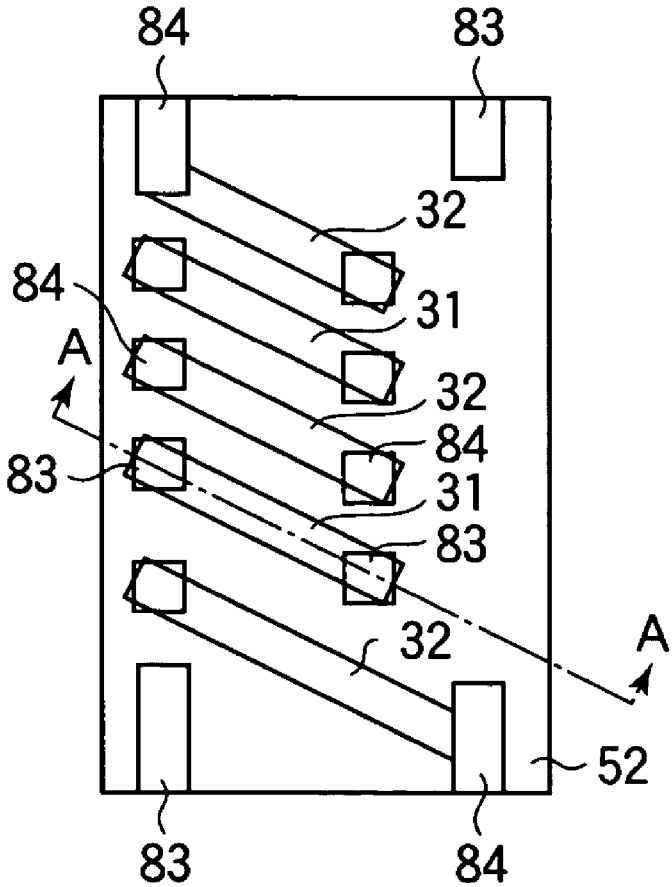

Next, as shown in FIGS. 11A and 11B, the resist layer 153 is etched away. As shown in FIGS. 12A and 12B, dry etching (milling) is then performed to remove the electrode film 72 which has been exposed as a result of the removal of the resist layer 153 and to remove the electrode film 71 located under the electrode film 72. When the electrode films 71 and 72 are removed, the surfaces of the conductive layers 81 to 84 are also etched in an amount substantially equivalent to the thickness of the electrode films 71 and 72. However, since the conductive layers 81 to 84 are formed sufficiently thick compared to the electrode films 71 and 72, the layers are not completely removed as a result of the dry etching. Each of electrode films to be described later is removed using the same method as for the electrode films 71 and 72. Through the above-described steps, coil bottom parts 31 having a multi-layer structure are provided by forming the electrode films 71 and 72 and the conductive layers 81 one over another, and coil bottom parts 32 having a multi-layer structure are provided by forming the electrode films 71 and 72 and the conductive layers 82 one over another. The coil bottom parts 31 and 32 are alternately formed in parallel on the silicon substrate 51.

Figure 13A:
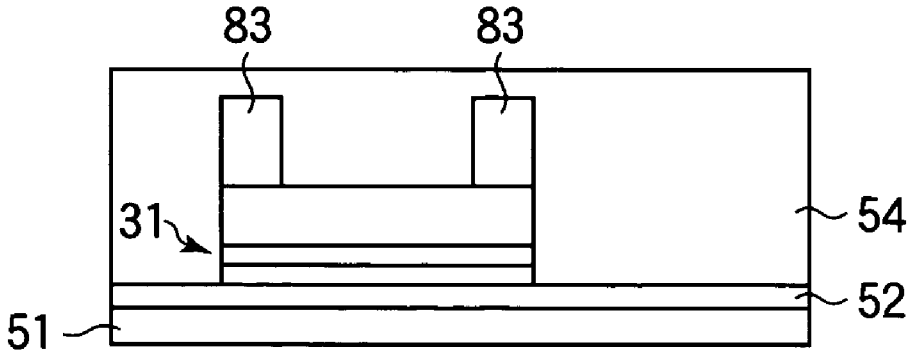
FIGS. 13A and 13B show the method of manufacturing the common mode choke coil 1 according to the first embodiment of the invention.
Figure 13B:
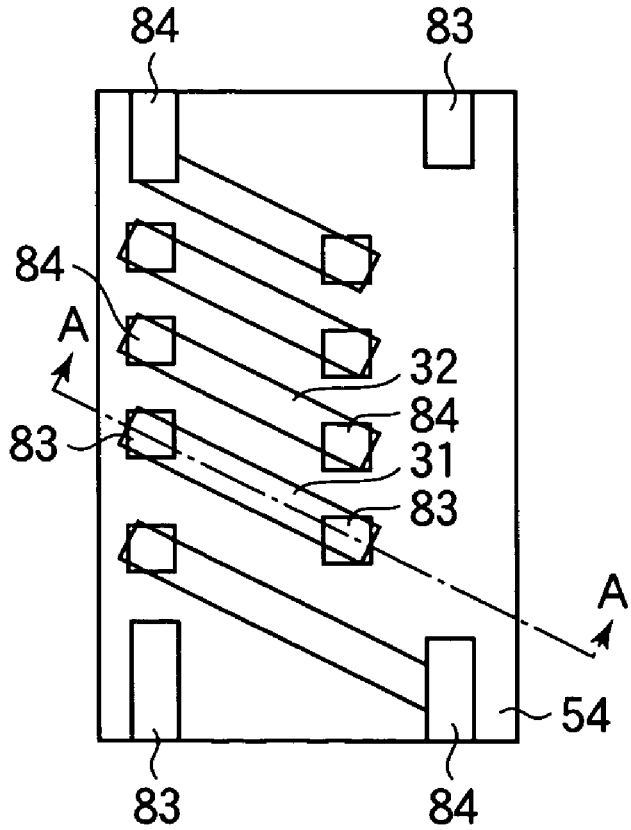
Figure 14A:
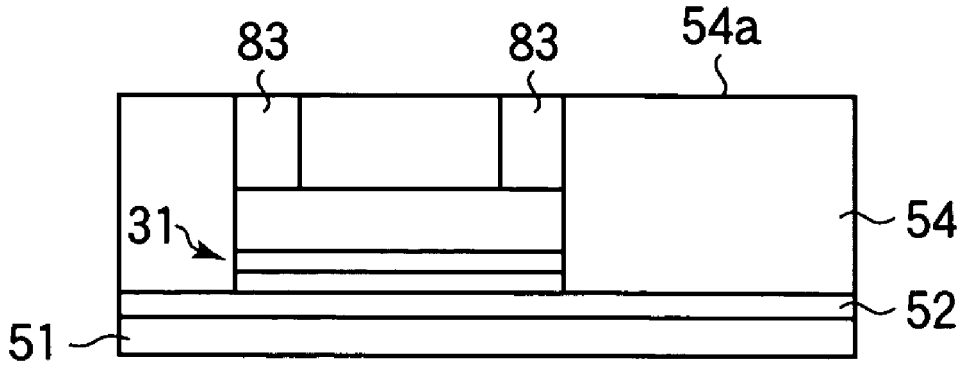
FIGS. 14A and 14B show the method of manufacturing the common mode choke coil 1 according to the first embodiment of the invention.
Figure 14B:
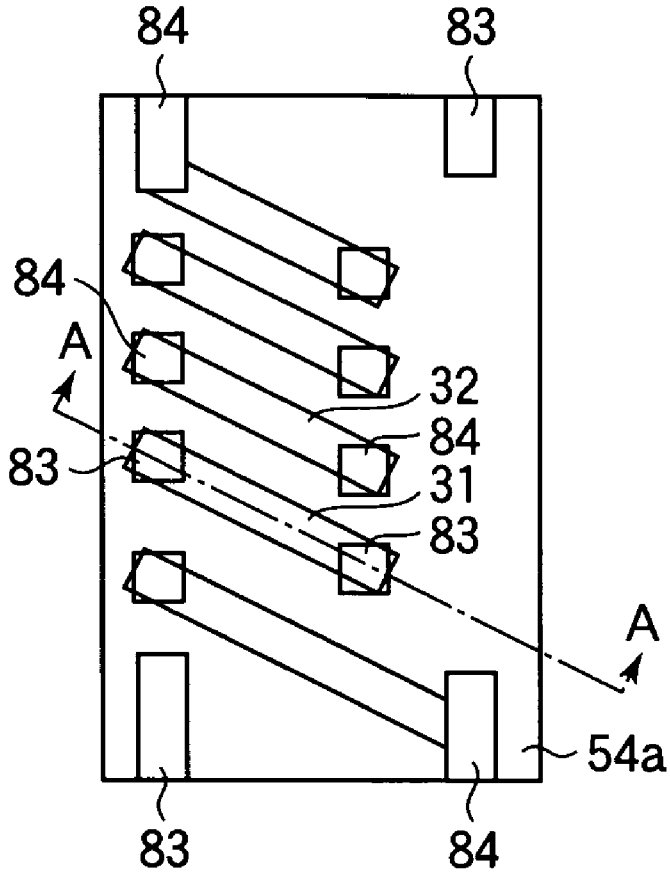

Next, as shown in FIGS. 13A and 13B, a film of alumina is formed throughout the resultant surface using a sputtering process to provide an insulation layer (first insulation layer) 54 having a thickness in the range from 10 to 13 μm. As shown in FIGS. 14A and 14B, a CMP (chemical mechanical polishing) process is then performed to polish the surface of the insulation layer 54 until the tops of the conductive layers 83 and 84 are exposed, and a planar surface (CMP surface) 54*a* is thereby formed. Visual observation is conducted to check whether the conductive layers 83 and 84 have been exposed or not.

Figure 15A:
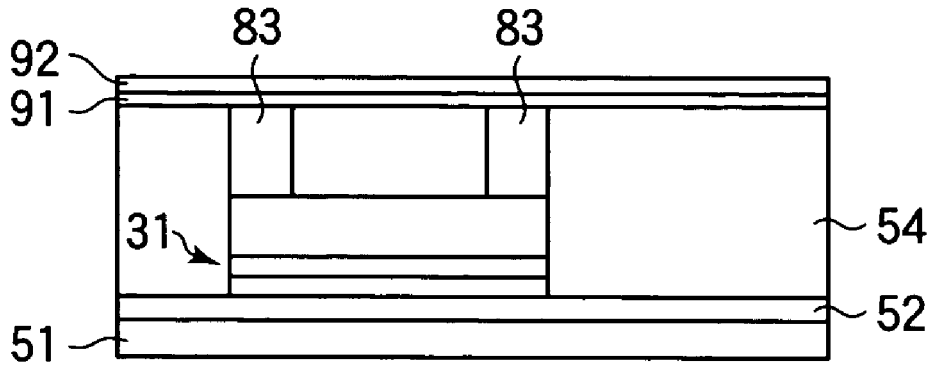
FIGS. 15A and 15B show the method of manufacturing the common mode choke coil 1 according to the first embodiment of the invention.
Figure 15B:
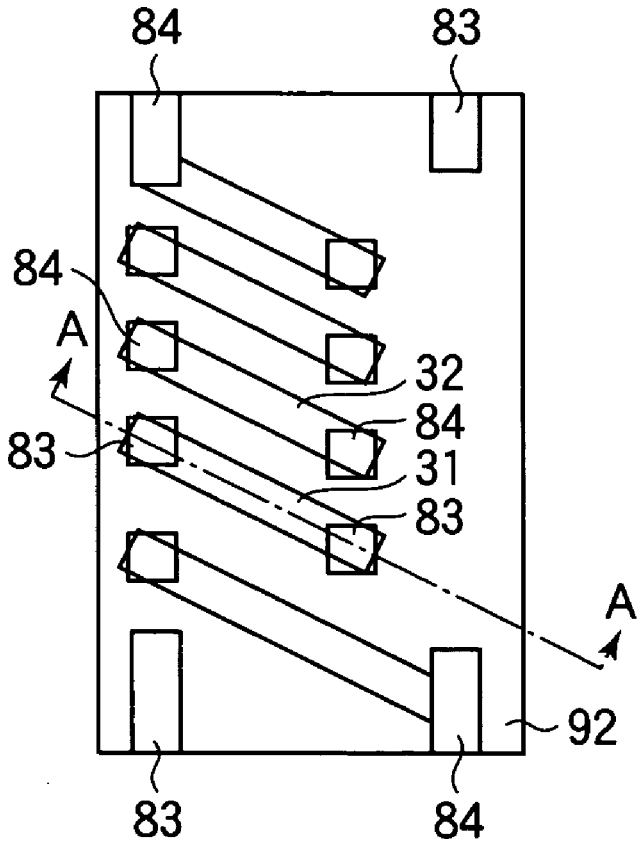

Next, as shown in FIGS. 15A and 15B, a Ti electrode film 91 having a thickness of about 10 nm is formed on the planar surface 54*a* of the insulation layer 54 using a sputtering process, and a NiFe (permalloy) electrode film (first intermediate electrode film) 92 having a thickness of about 100 nm is formed on the electrode film 91 using a sputtering process. Like the electrode film 71, the electrode film 91 is formed as a buffer film for improving the adhesion of the electrode film 92. The electrode film 92 is used as an electrode film for plating the pattern of a magnetic member layer 101 which will be described later.

Figure 16A:
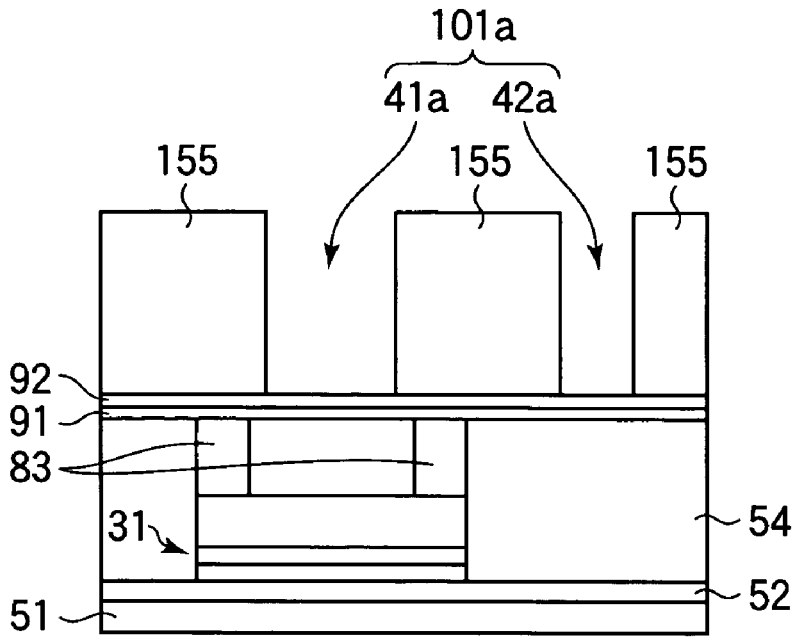
FIGS. 16A and 16B show the method of manufacturing the common mode choke coil 1 according to the first embodiment of the invention.
Figure 16B:
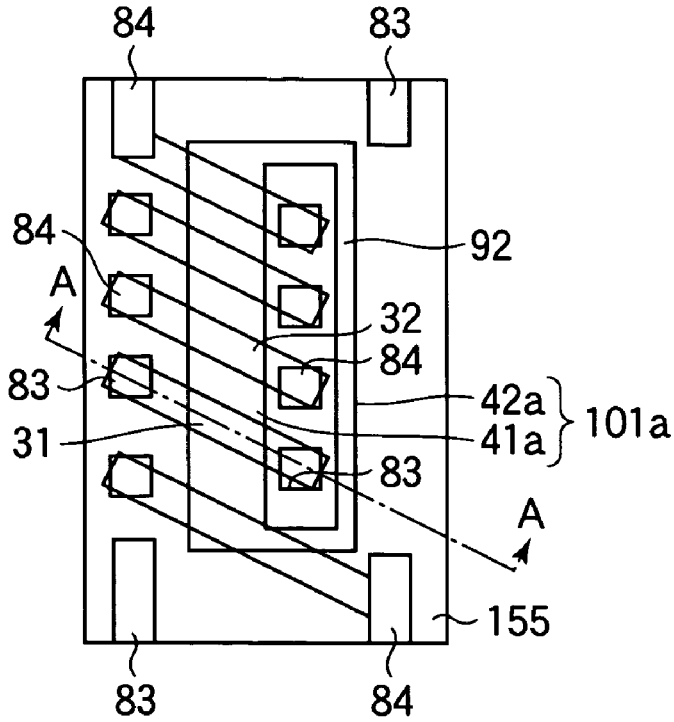

A resist is then applied to the electrode film 92 to form a resist layer (first intermediate resist layer) 155 having a thickness in the range from 8 to 13 μm. Next, as shown in FIGS. 16A and 16B, the resist layer 155 is patterned to form an opening (first intermediate opening) 101*a* for exposing the electrode film 92 in the resist layer 155. The opening 101*a* is formed like a rectangular window when the element forming region is viewed in the normal direction thereof (the normal direction of the substrate surface of the silicon substrate 51), and the opening includes a rectangular opening 41*a* and an opening 42*a* which is in the form of an inverted "C". Referring to FIG. 16B, the opening 101*a* is formed such that the conductive layers 83 and 84 on the left are disposed on the side of the outer circumference of the opening and such that the conductive layers 83 and 84 on the right are disposed on the side of the inner circumference of the opening. The opening 41*a* is disposed between the conductive layers 83 and 84 on both ends of the coil bottom parts 31 and 32 so as to extend across the coil bottom parts 31 and 32 at a predetermined angle to them when the element forming region is viewed in the normal direction thereof.

Figure 17A:
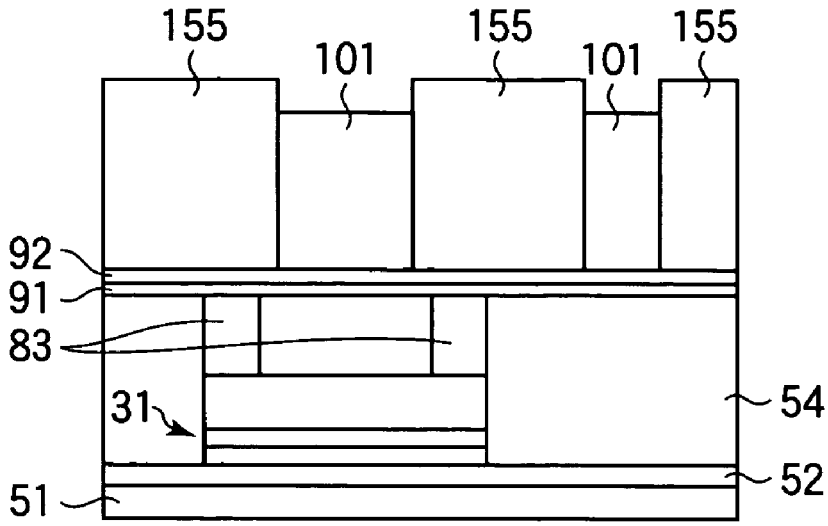
FIGS. 17A and 17B show the method of manufacturing the common mode choke coil 1 according to the first embodiment of the invention.
Figure 17B:
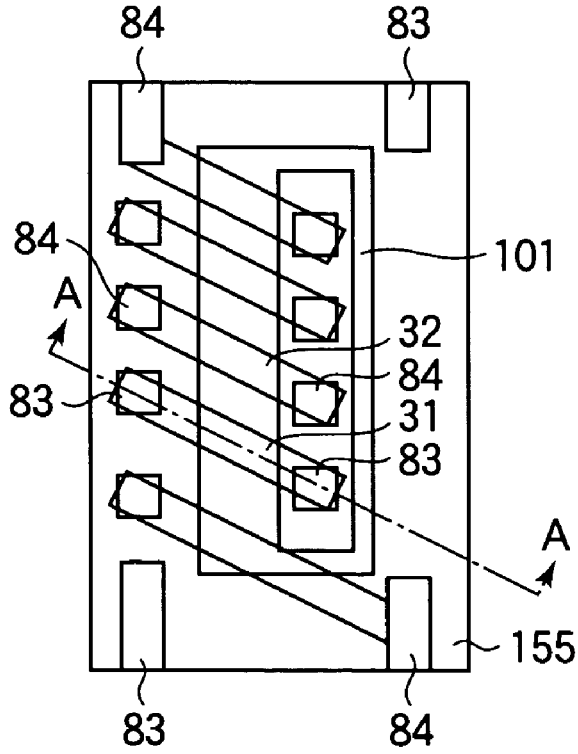
Figure 18A:
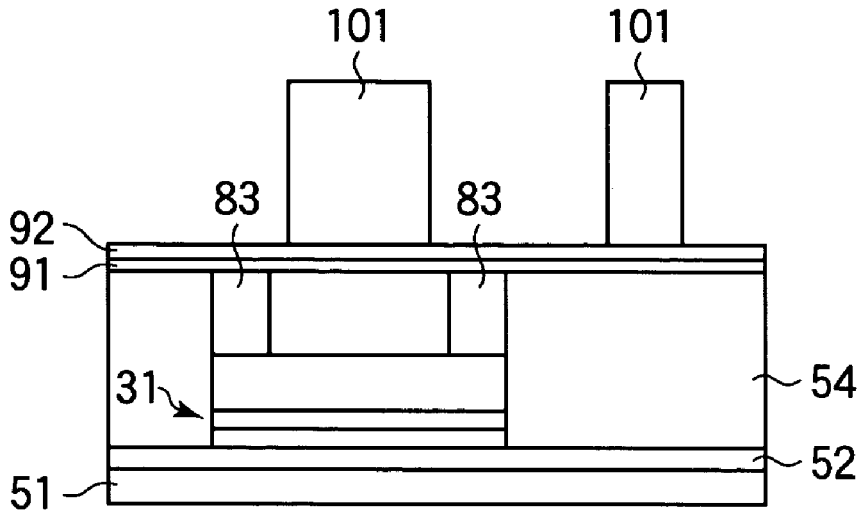
FIGS. 18A and 18B show the method of manufacturing the common mode choke coil 1 according to the first embodiment of the invention.
Figure 18B:
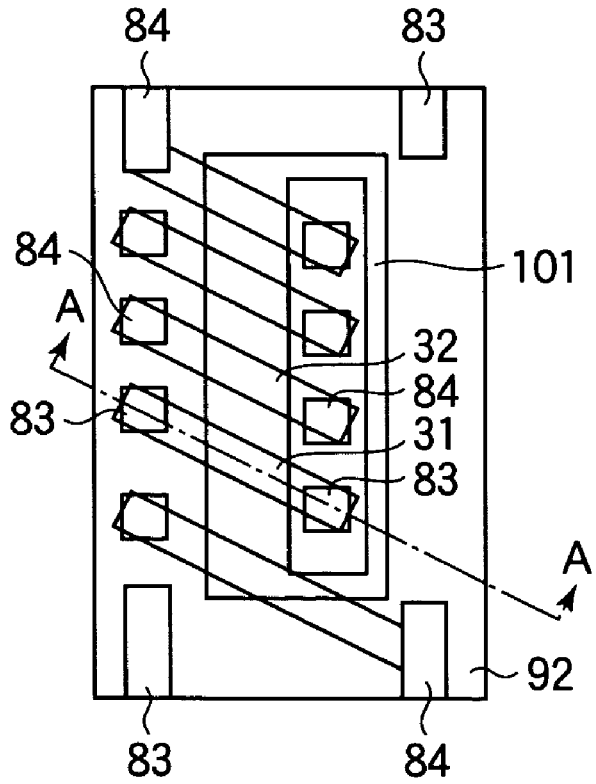
Figure 19A:
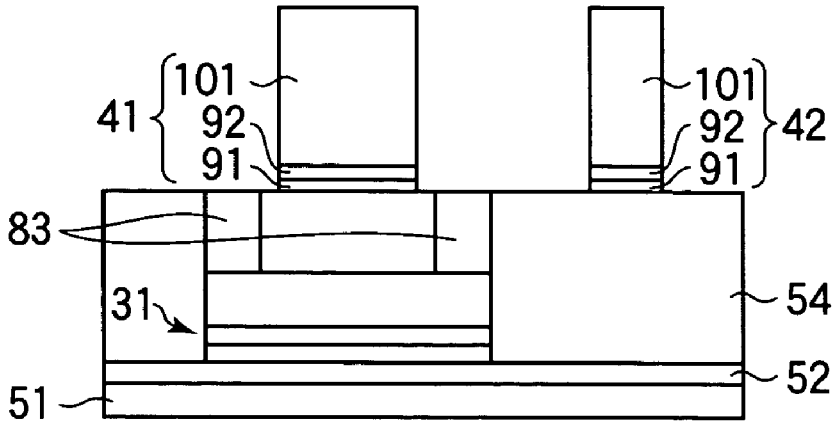
FIGS. 19A and 19B show the method of manufacturing the common mode choke coil 1 according to the first embodiment of the invention.
Figure 19B:
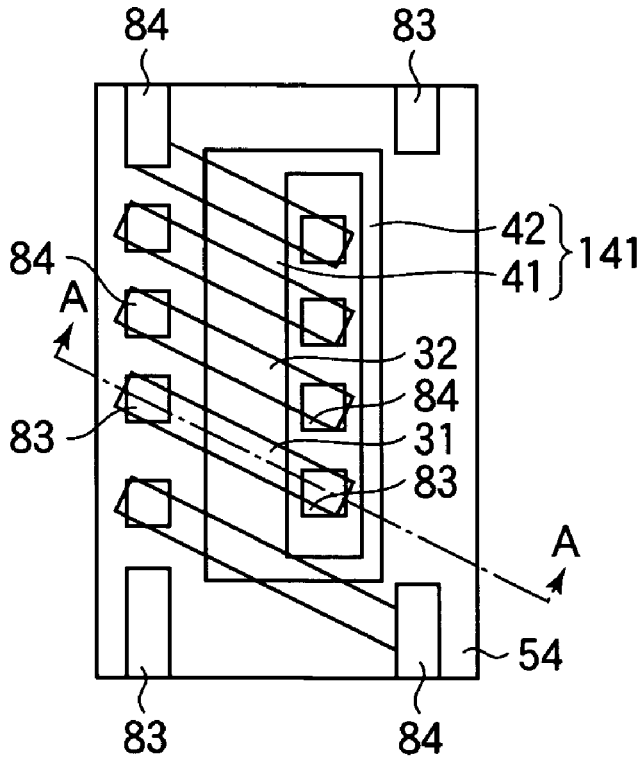

Next, as shown in FIGS. 17A and 17B, a NiFe magnetic member layer (first magnetic member layer) 101 having a thickness in the range from 5 to 10 μm is formed on the electrode film 92 in the opening 101*a* using, for example, a pattern plating process. The magnetic member layer 101 may be formed from a material having high permeability other than NiFe. Next, as shown in FIGS. 18A and 18B, the resist layer 155 is etched away. As shown in FIGS. 19A and 19B, dry etching is then performed to remove the electrode film 92 which has been exposed as a result of the removal of the resist layer 155 and to remove the electrode film 91 located under the electrode film 92. When the electrode films 91 and 92 are removed, the surface of the magnetic member layer 101 is also etched in an amount substantially equivalent to the thickness of the electrode films 91 and 92. However, since the magnetic member layer 101 is formed sufficiently thick compared to the electrode films 91 and 92, the layer is not completely removed as a result of the dry etching. Through the above-described steps, a core 41 having a multi-layer structure is provided in the opening 41*a* by forming the electrode films 91 and 92 and the conductive magnetic member layer 101 one over another. A magnetic member part 42 having a multi-layer structure identical to that of the core 41 and forming a closed magnetic path 141 in cooperation with the core 41 is also formed in the opening 42*a*.

Figure 20A:
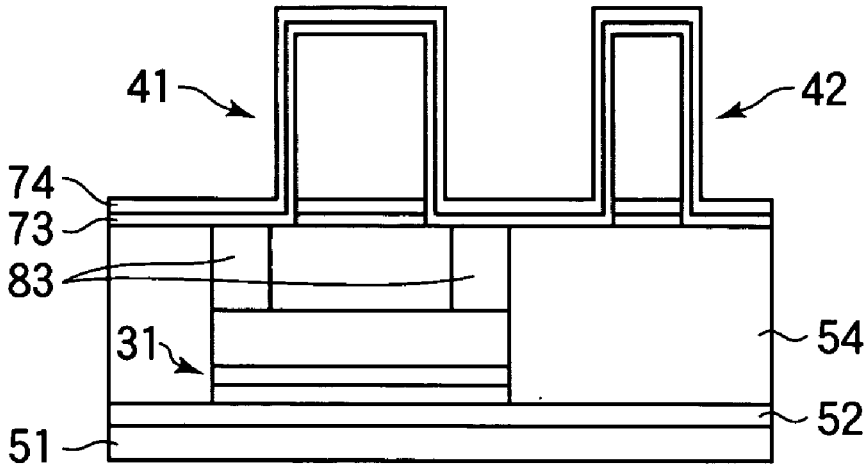
FIGS. 20A and 20B show the method of manufacturing the common mode choke coil 1 according to the first embodiment of the invention.
Figure 20B:
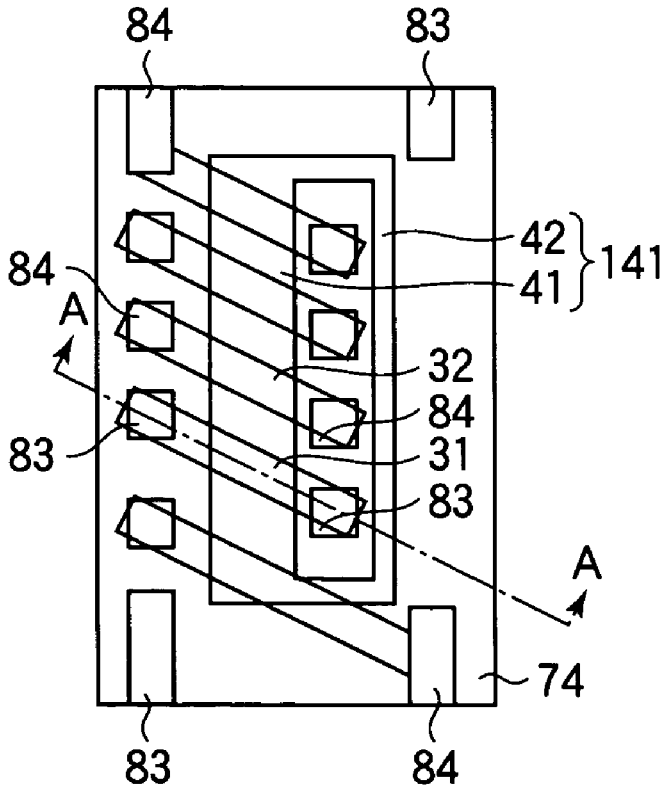

Next, as shown in FIGS. 20A and 20B, a Ti electrode film 73 having a thickness of about 10 nm is formed throughout the surface using a sputtering process, and a Cu electrode film (second intermediate electrode film) 74 having a thickness of about 100 nm is then formed on the electrode film 73 using a sputtering process. The electrode films 73 and 74 are electrically connected to the conductive layers 83 and 84 located under the same.

Figure 21A:
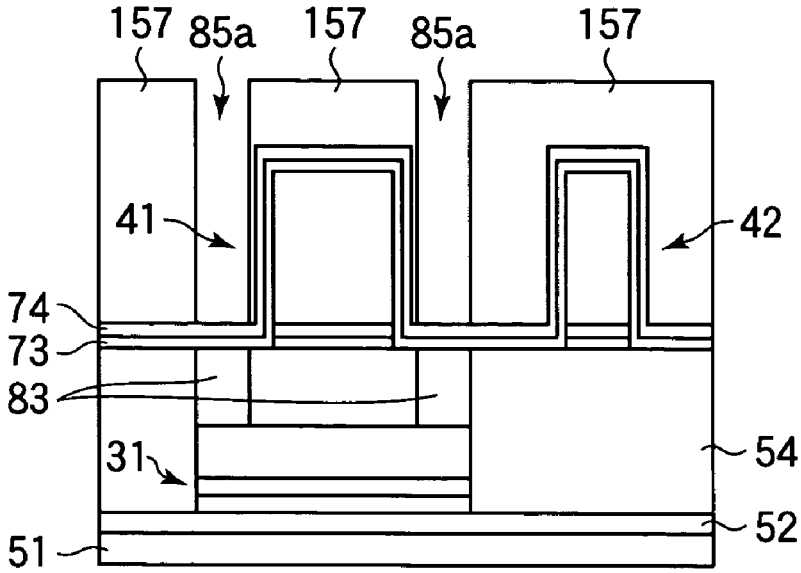
FIGS. 21A and 21B show the method of manufacturing the common mode choke coil 1 according to the first embodiment of the invention.
Figure 21B:
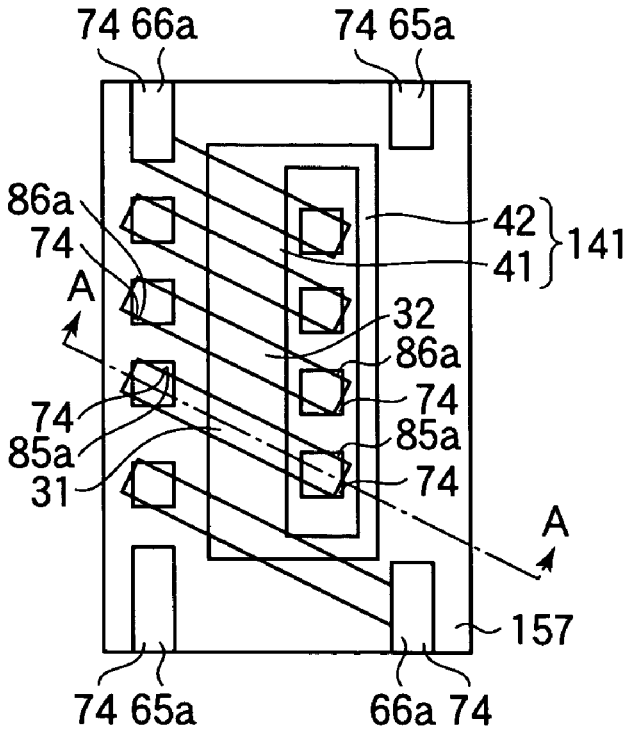

Next, a resist is applied to the electrode film 74 to form a resist layer (second intermediate resist layer) 157 having a thickness in the range from 15 to 20 μm. Next, as shown in FIGS. 21A and 21B, the resist layer 157 is patterned to form the resist layer 157 with openings (second intermediate openings) 85*a* and 86*a* for exposing the electrode film 74 on the conductive layers 83 and 84 formed in the openings 83*a* and 84*a*and openings 65*a* and 66*a* for exposing the electrode film 74 on the conductive layers 83 and 84 formed in the openings 63*a* and 64*a*.

Figure 22A:
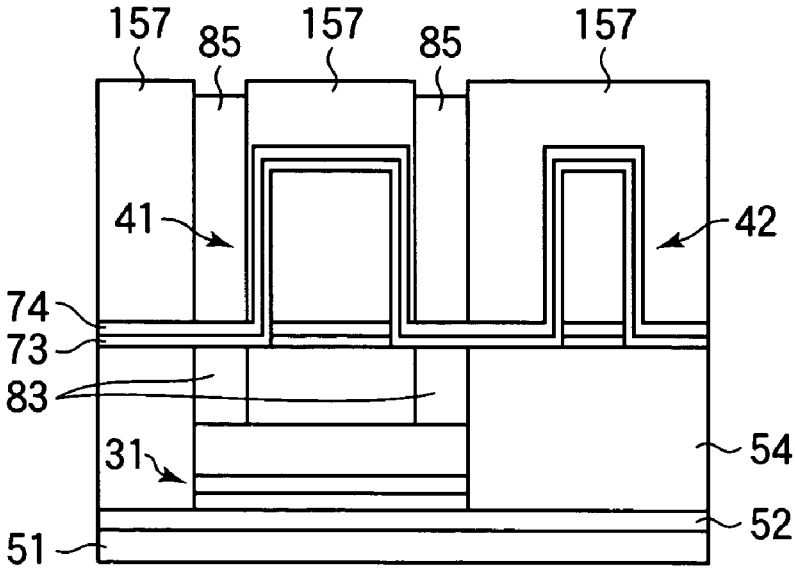
FIGS. 22A and 22B show the method of manufacturing the common mode choke coil 1 according to the first embodiment of the invention.
Figure 22B:
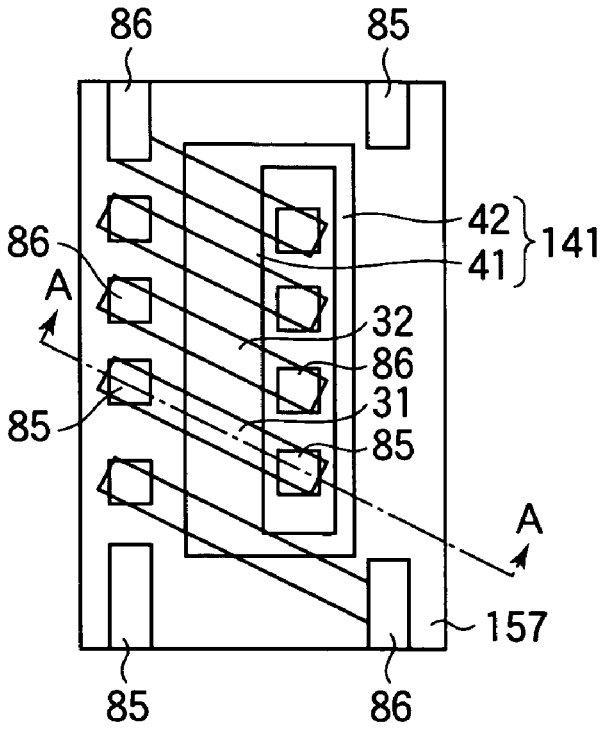
Figure 23A:
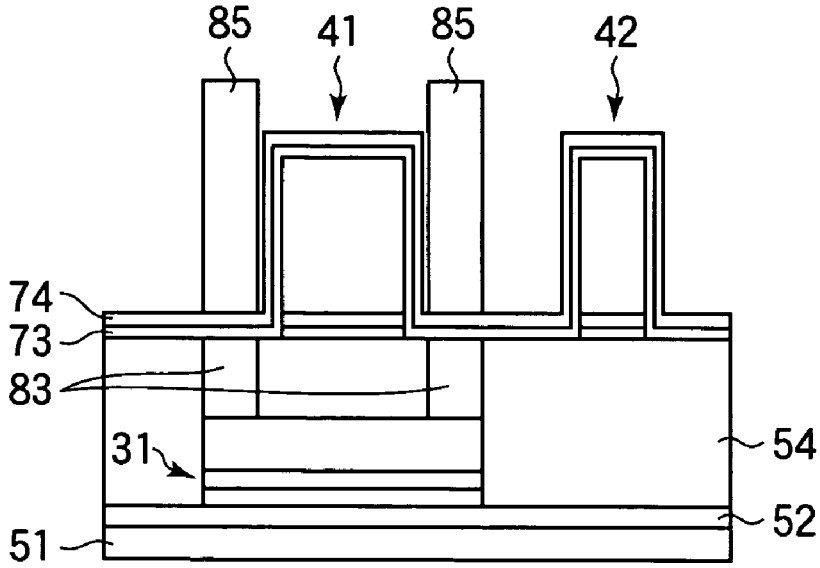
FIGS. 23A and 23B show the method of manufacturing the common mode choke coil 1 according to the first embodiment of the invention.
Figure 23B:
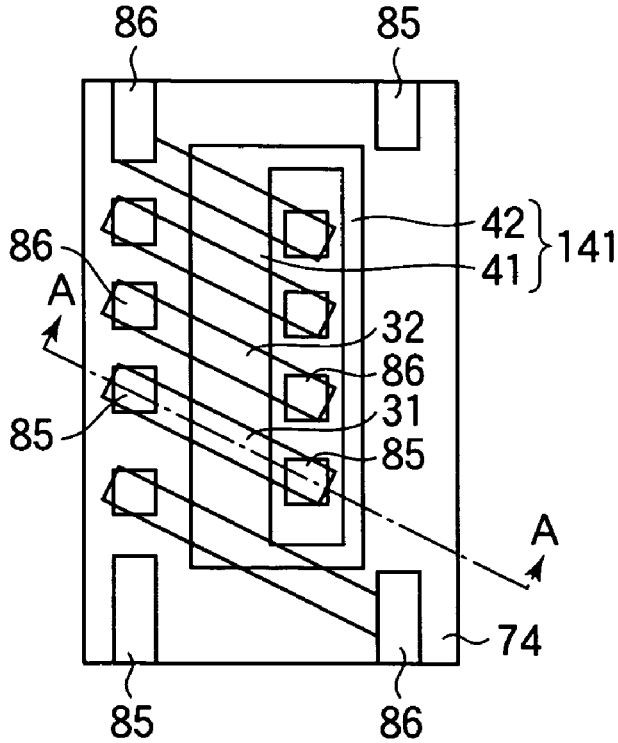
Figure 24A:
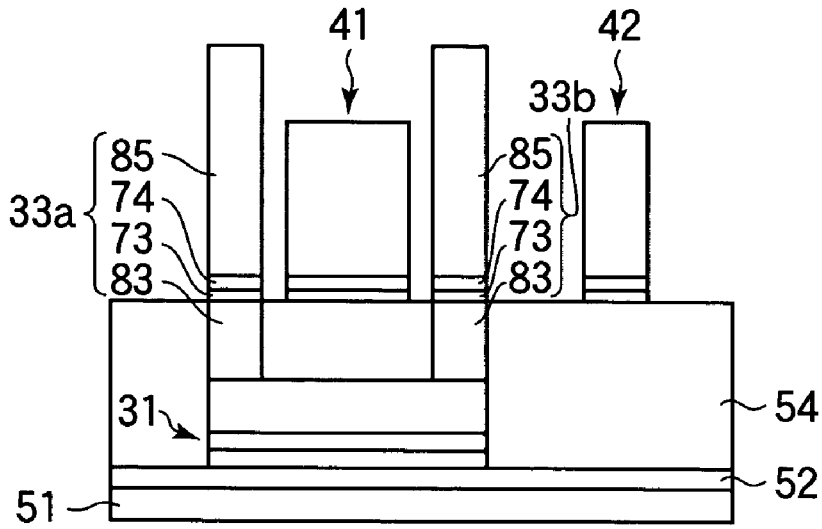
FIGS. 24A and 24B show the method of manufacturing the common mode choke coil 1 according to the first embodiment of the invention.
Figure 24B:
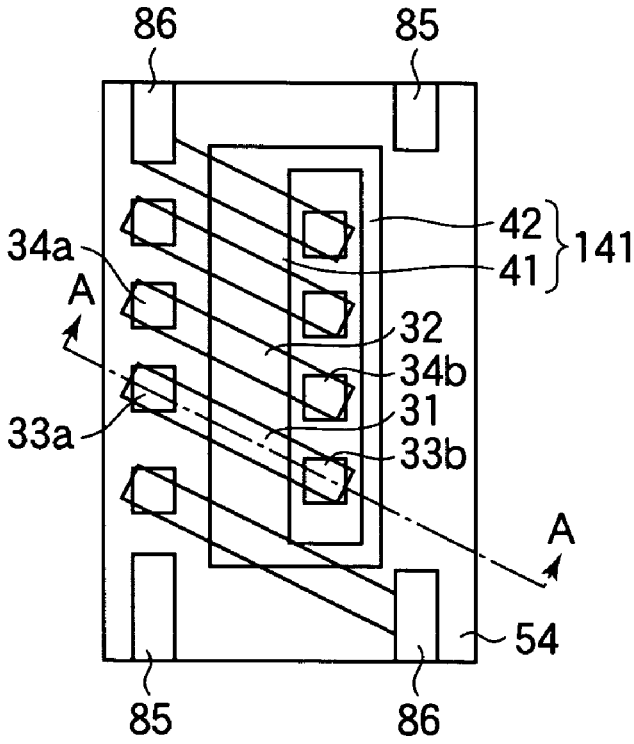

Next, as shown in FIGS. 22A and 22B, Cu conductive layers (first intermediate conductive layers) 85 having a thickness in the range from 7 to 15 μm are formed on the electrode film 74 in the openings 65*a* and 85*a*, and conductive layers (first intermediate conductive layers) 86 are formed from the same material with the same thickness on the electrode film 74 in the openings 66*a* and 86*a*. The conductive layers 85 and 86 are formed using a pattern plating process and are each electrically connected to the electrode film 74 located under the same. Next, as shown in FIGS. 23A and 23B, the resist layer 157 is etched away. As shown in FIGS. 24A and 24B, dry etching is then performed to remove the electrode film 74 exposed as a result of the removal of the resist layer 157 and to remove the electrode film 73 under the electrode film 74. Through the above-described steps, coil side parts 33*a* and 33*b* having a multi-layer structure are provided by forming the conductive layers 83, the electrode films 73 and 74, and the conductive layers 85 one over another, and coil side parts 34*a* and 34*b* having a multi-layer structure are provided by forming the conductive layers 84, the electrode films 73 and 74, and the conductive layers 86 one over another. Referring to FIG. 24B, the coil side parts 33*a* and 34*a* are alternately disposed on the left side to align on a straight line at equal intervals, and the coil side parts 33*b* and 34*b* are alternately disposed on the right side to align on a straight line at equal intervals.

Figure 25A:
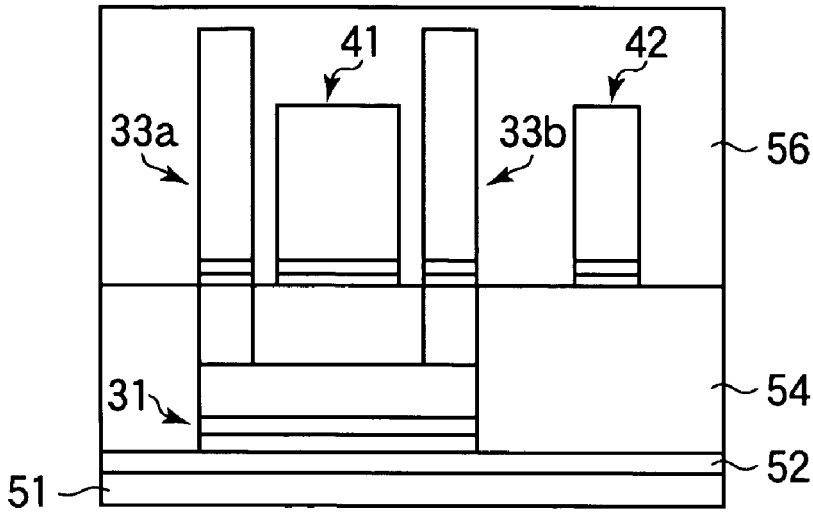
FIGS. 25A and 25B show the method of manufacturing the common mode choke coil 1 according to the first embodiment of the invention.
Figure 25B:
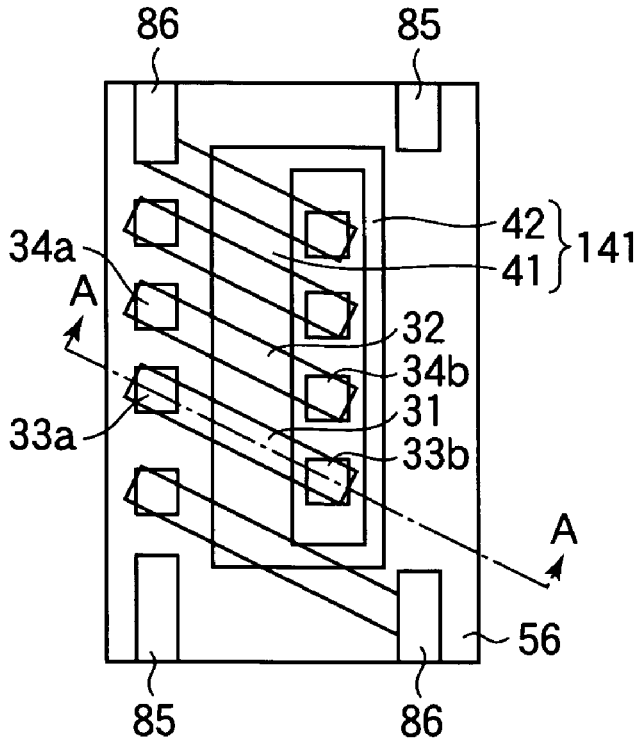
Figure 26A:
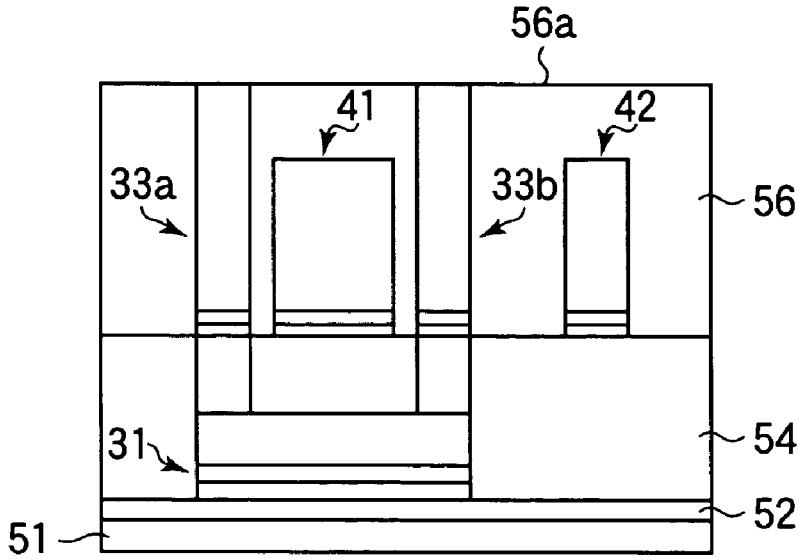
FIGS. 26A and 26B show the method of manufacturing the common mode choke coil 1 according to the first embodiment of the invention.
Figure 26B:
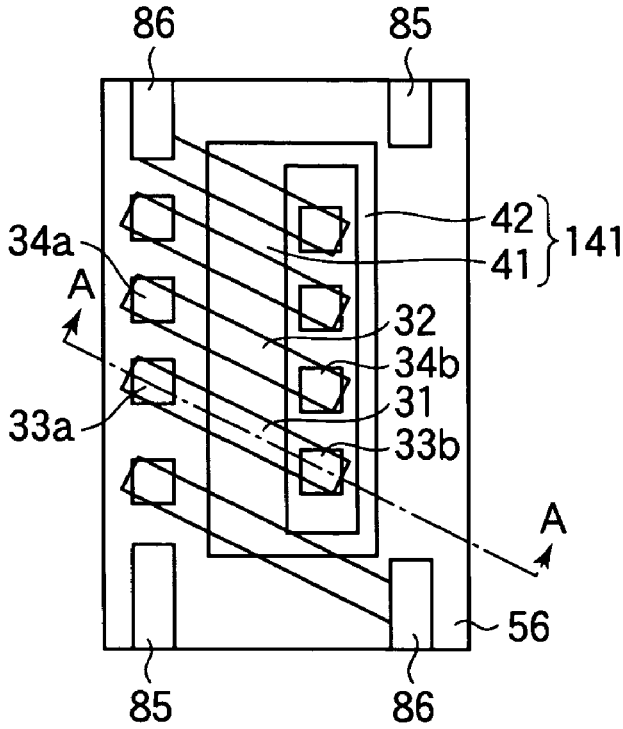

Next, as shown in FIGS. 25A and 25B, a film of alumina is formed throughout the resultant surface using a sputtering process to provide an insulation layer (second insulation layer) 56 having a thickness in the range from 7 to 15 μm. As shown in FIGS. 26A and 26B, a CMP process is then performed to polish the surface of the insulation layer 56 until the tops of the conductive layers 85 and 86 is exposed, and a planar surface 56*a* is thereby formed. In doing so, the insulation layer 56 is not polished until the core 41 and the magnetic member part 42 are exposed.

Figure 27A:
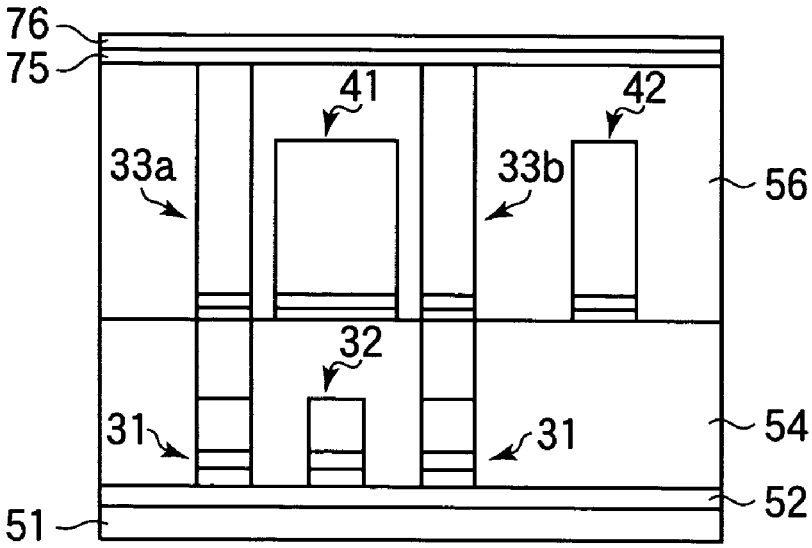
FIGS. 27A and 27B show the method of manufacturing the common mode choke coil 1 according to the first embodiment of the invention.
Figure 27B:
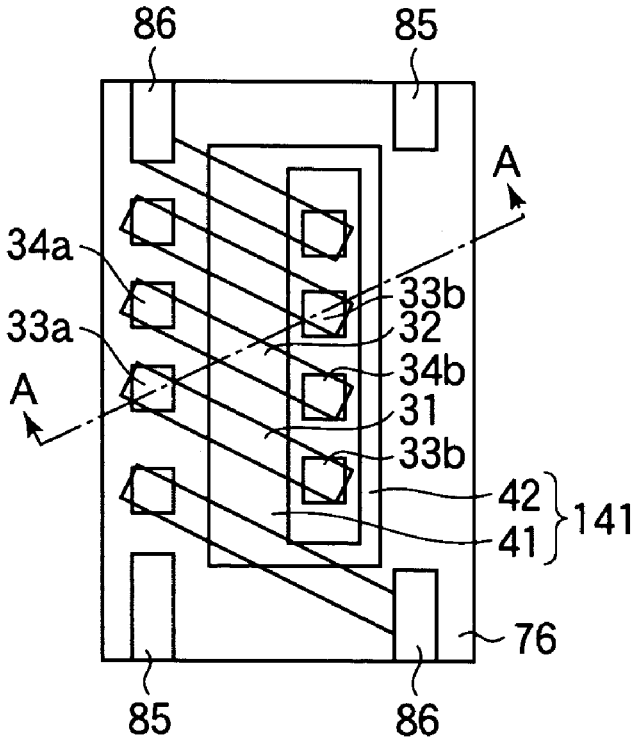

Next, as shown in FIGS. 27A and 27B, a Ti electrode film 75 having a thickness of about 10 nm is formed on the planar surface 56*a* of the insulation layer 56 using a sputtering process, and a Cu electrode film (second electrode film) 76 having a thickness of about 100 nm is formed on the electrode film 75 using a sputtering process. The electrode films 75 and 76 are electrically connected to the conductive layers 83 through the electrode films 73 and 74 and the conductive layers 85 and are electrically connected to the conductive layers 84 through the electrode films 73 and 74 and the conductive layers 86.

Figure 28A:
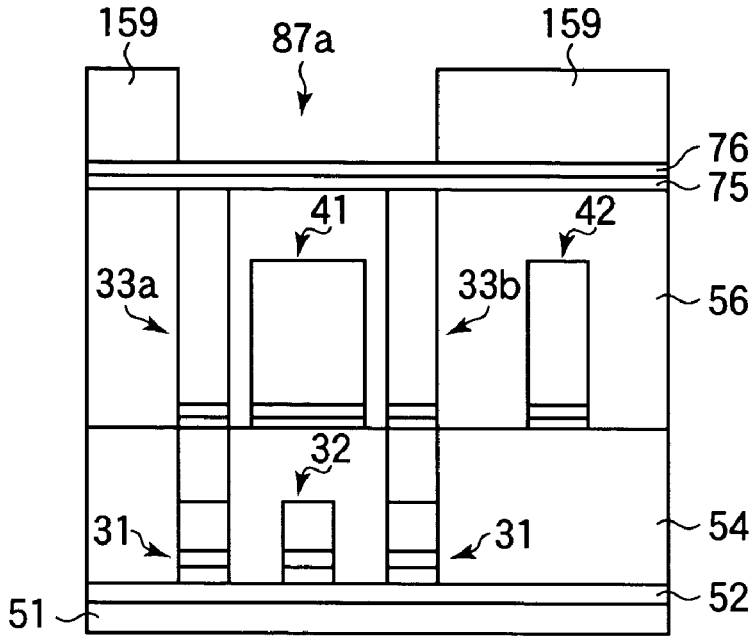
FIGS. 28A and 28B show the method of manufacturing the common mode choke coil 1 according to the first embodiment of the invention.
Figure 28B:
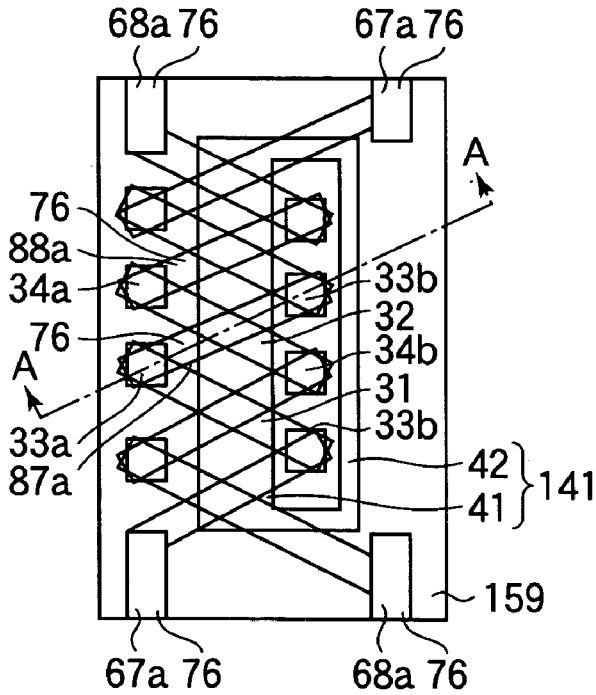

A resist is then applied to the electrode film 76 to form a resist layer (third resist layer) 159 having a thickness in the range from 10 to 15 μm. Next, as shown in FIGS. 28A and 28B, the resist layer 159 is patterned to form a plurality of openings (third openings) 87*a* and 88*a* for exposing the electrode film 76 in the form of elongate strips and to form openings 67*a* and 68*a* for exposing the electrode film 76 on the conductive layers 85 and 86 formed in the openings 65*a* and 66*a*. As a result, when the element forming region is viewed in the normal direction thereof, the openings 87*a* and the openings 88*a* are alternately formed in parallel at substantially equal intervals, each opening 87*a* exposing the electrode film 76 on a coil side part 33*a* at one end thereof and exposing, at another end thereof, the electrode film 76 on the coil side part 33*b* on a coil bottom part 31 extending adjacent to the coil bottom part 31 directly under the above-mentioned coil side 33*a* so as to sandwich a coil bottom part 32 between them, each opening 88*a* exposing the electrode film 76 on a coil side part 34*a* at one end thereof and exposing, at another end thereof, the electrode film 76 on the coil side part 34*b* on a coil bottom part 32 extending adjacent to the coil bottom part 32 directly under the above-mentioned coil side part 34*a* so as to sandwich a coil bottom part 31 between them. The openings 87*a* are formed to extend across the coil bottom parts 32 and to face the bottom parts with the core 41 sandwiched between them when the element forming region is viewed in the normal direction thereof. The openings 88*a* are formed to extend across the coil bottom parts 31 and to face the bottom parts 31 with the core 41 sandwiched between them, when viewed in the same direction. The openings 87*a* disposed near the shorter sides of the element forming region are formed in connection with the respective openings 67*a* at one end thereof.

Figure 29A:
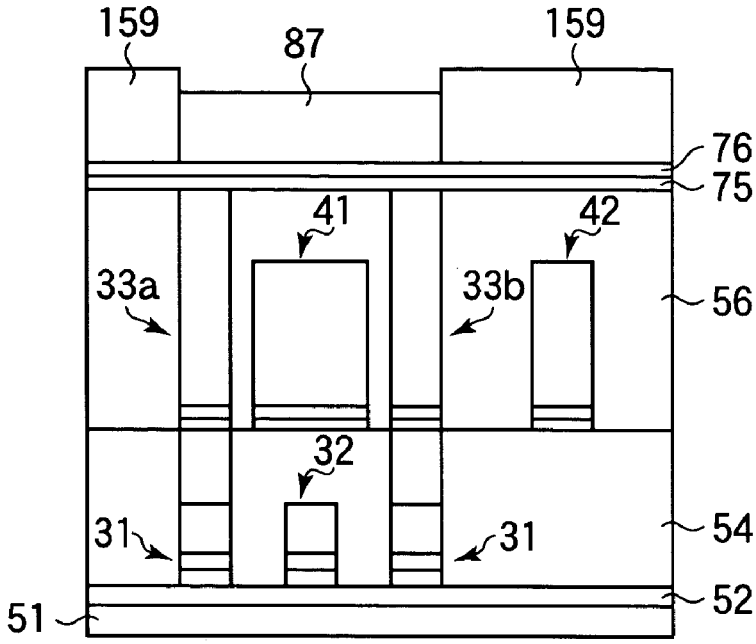
FIGS. 29A and 29B show the method of manufacturing the common mode choke coil 1 according to the first embodiment of the invention.
Figure 29B:
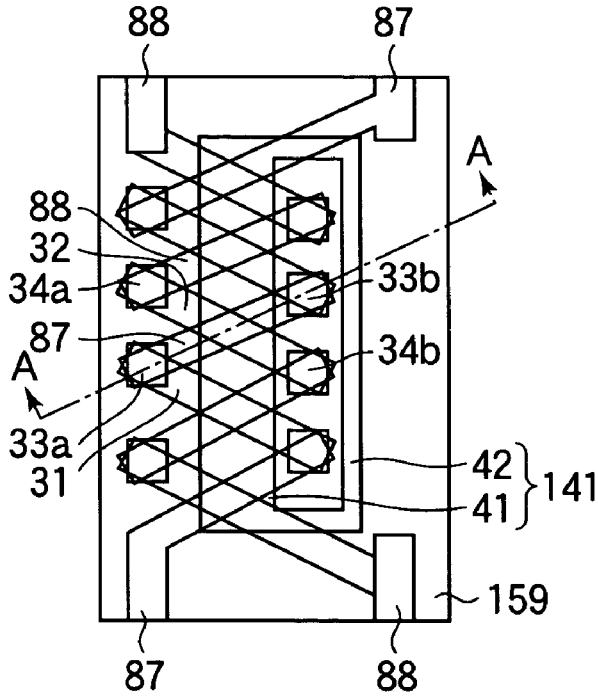
Figure 30A:
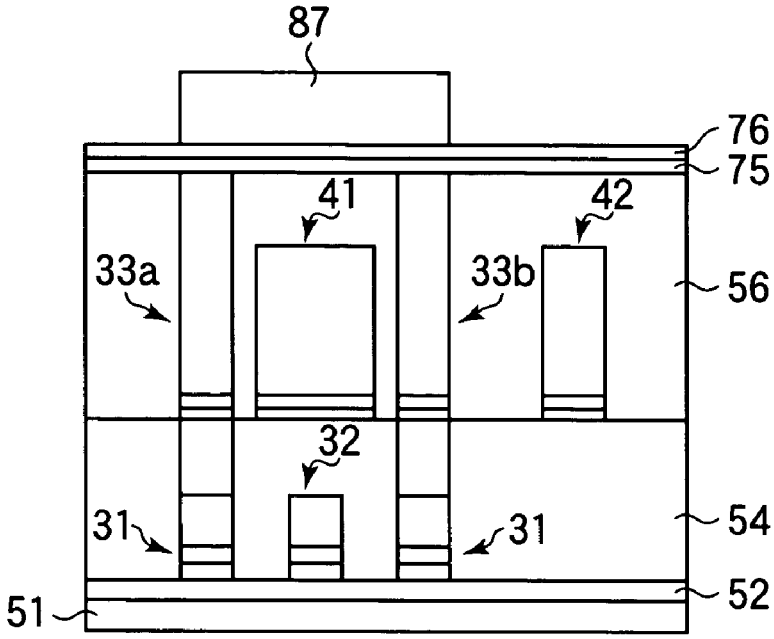
FIGS. 30A and 30B show the method of manufacturing the common mode choke coil 1 according to the first embodiment of the invention.
Figure 30B:
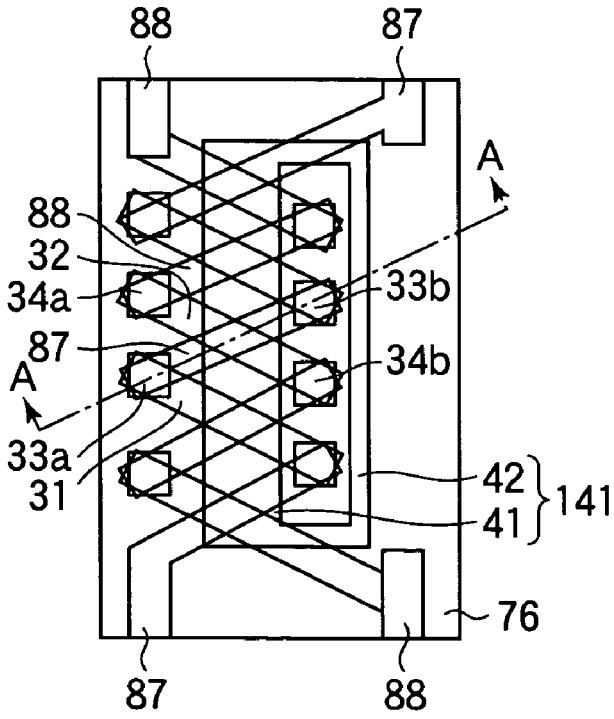
Figure 31A:
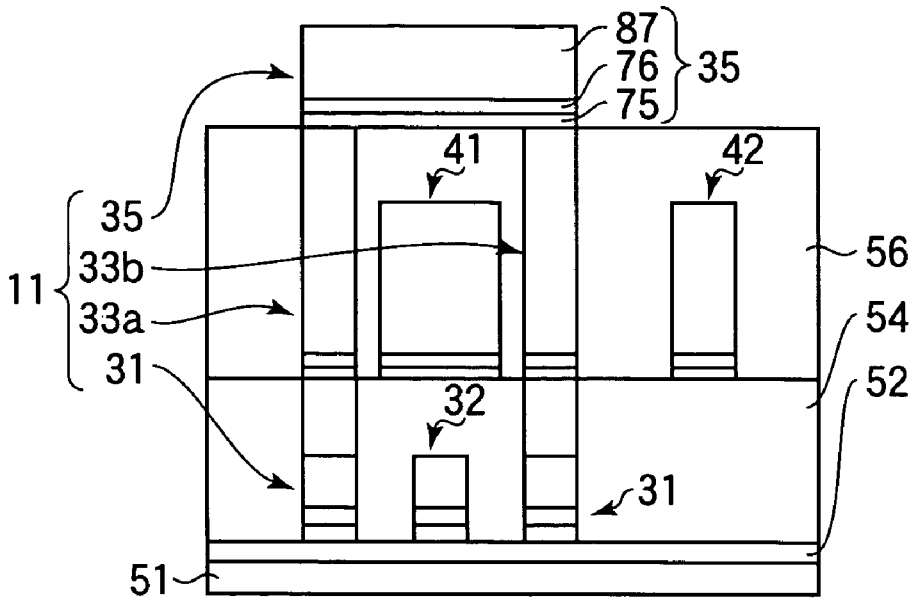
FIGS. 31A and 31B show the method of manufacturing the common mode choke coil 1 according to the first embodiment of the invention.
Figure 31B:
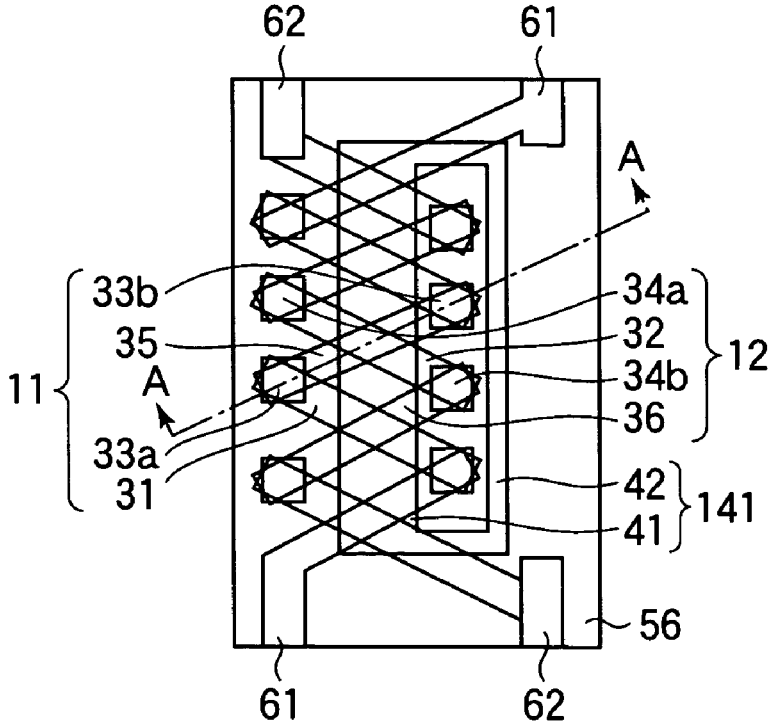

Next, as shown in FIGS. 29A and 29B, Cu conductive layers (third conductive layers) 87 having a thickness in the range from 7 to 10 μm are formed on the electrode film 76 in the openings 67*a* and 87*a*, and conductive layers (third conductive layers) 88 are formed from the same material to the same thickness on the electrode film 76 in the openings 68*a* and 88*a*. The conductive layers 87 and 88 are simultaneously formed using a pattern plating process and are each electrically connected to the electrode film 76 under the same. Next, as shown in FIGS. 30A and 30B, the resist layer 159 is etched away. Next, as shown in FIGS. 31A and 31B, the electrode film 76 which has been exposed as a result of the removal of the resist layer 159 and the electrode film 75 under the electrode film 76 are removed. Thus, coil top parts 35 having a multi-layer structure are provided by forming the electrode films 75 and 76 and the conductive layers 87 one over another, and coil top parts 36 having a multi-layer structure are provided by forming the electrode films 75 and 76 and the conductive layers 88 one over another.

Through the above-described steps, a first helical coil unit 11 is formed, which includes one coil having n turns each constituted by a coil bottom part 31, a coil side part 33*a*, a coil top part 35, and a coil side part 33*b*. At the same time, a second helical coil unit 12 is formed, which includes one coil having n turns each constituted by a coil bottom part 32, a coil side part 34*a*, a coil top part 36, and a coil side part 34*b*. The first and second helical coil units 11 and 12 are formed in a double spiral structure. External electrode connecting parts 61 having a multi-layer structure constituted by the conductive layers 81, 83, 85, and 87 are simultaneously formed in the openings 61*a*, 63*a*, 65*a*, and 67*a*, and external electrode connecting parts 62 having a multi-layer structure constituted by the conductive layers 82, 84, 86, and 88 are simultaneously formed in the openings 62*a*, 64*a*, 66*a*, and 68*a*.

The coil top parts 35 and 36 are alternately disposed in parallel. When the element forming region is viewed in the normal direction thereof, the coil top parts 35 are disposed to extend across the coil bottom parts 32 with the core 41 sandwiched between them, and the coil top parts 36 are disposed to extend across the coil bottom parts 31 with the core 41 sandwiched between them.

Figure 32A:
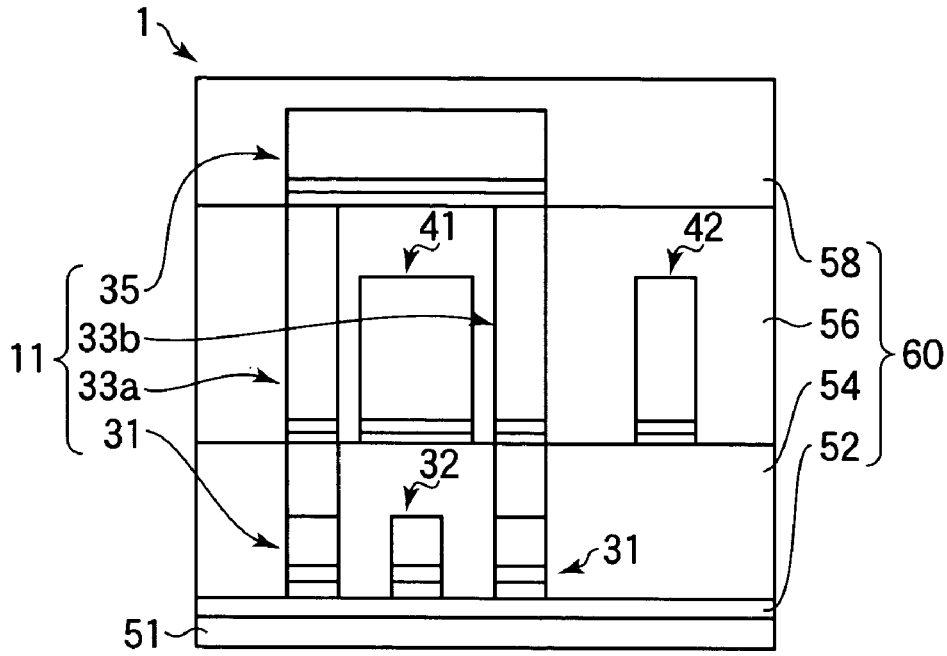
FIGS. 32A and 32B show the method of manufacturing the common mode choke coil 1 according to the first embodiment of the invention.
Figure 32B:
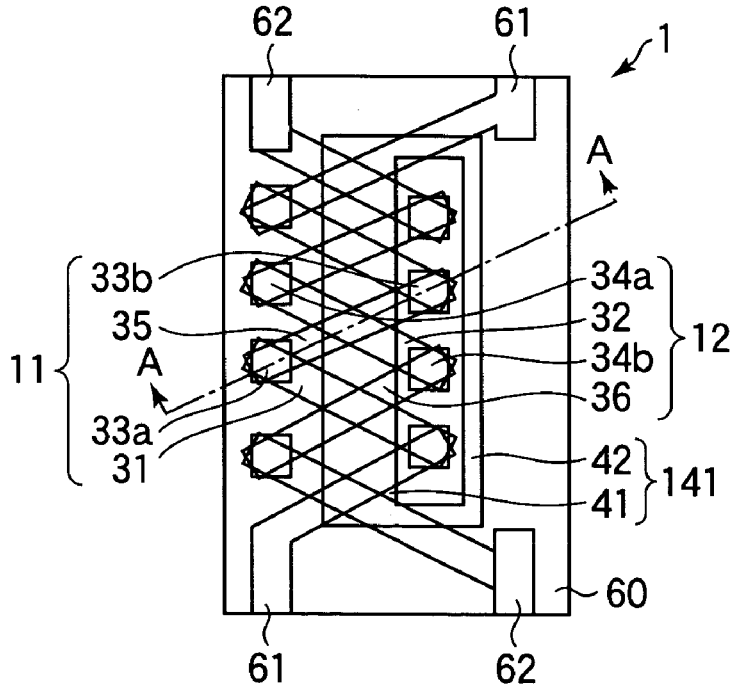

Next, as shown in FIGS. 32A and 32B, a film of alumina is formed throughout the surface using a sputtering process to provide an insulation layer 58 having a thickness of about 10 μm which is to serve as a protective film for the coil top parts 35 and 36. Referring to the material to form the insulation layer 58, an insulating material other than alumina may be used. Through the above-described steps, an insulation layer 60 having a multi-layer structure is provided by forming the insulation layers 52, 54, 56, and 58 one over another. The first and second helical coil units 11 and 12 and the closed magnetic path 141 are enclosed in the insulation layer 60.

Next, the silicon path 51 is ground from the bottom thereof to achieve a desired thickness or to remove the substrate completely. The wafer is then cut along predetermined cutting lines to divide a plurality of the common mode choke coils 1 formed on the wafer into each element forming region in the form of a chip. The external electrode connecting parts 61 and 62 are partially exposed on an outer surface of the insulation layer 60. Although not shown, external electrodes are then formed in electrical connection with the external electrode connecting parts 61 and 62. Next, chamfering is performed on corners of the chip to complete a common mode choke coil 1.

As described above, according to the method of manufacturing the common mode choke coil 1 of the present embodiment, the first and second helical coil units 11 and 12 having axes of spiral substantially in parallel with the substrate surface and the core 41 and the magnetic member part 42 forming the closed magnetic path 141 can be formed at a series of manufacturing steps using thin film formation techniques. Therefore, the common mode choke coil 1 can be provided at a low cost through a reduction in the number of manufacturing steps.

In the present embodiment, the closed magnetic path 141 can be formed at the same time when a thin film forming step is performed to form the first and second helical coil units 11 and 12, the external electrode connecting parts 61 and 62, and the insulation layer 60. Therefore, there is no need for a substrate combining step for combining a magnetic substrate with the coil by bonding it using a bonding layer formed on the insulation layer. Manufacturing steps for the common mode choke coil 1 can therefore be simpler than those for common mode choke coils according to the related art. Since the manufacturing cost can be thus reduced, the common mode choke coil 1 can be provided at a low cost.

A common mode choke coil according to a modification of the present embodiment will now be described with reference to FIGS. 33A to 35. Common mode choke coils 1' to 8 according to Modifications 1 to 8 are formed using the same manufacturing method as for the common mode choke coil 1 according to the present embodiment, and they have a general outline in the form of a rectangular parallelepiped. The common mode choke coils 1' to 8 include first and second helical coil units having axes of spiral substantially in parallel with a substrate surface (element forming surface) of a silicon substrate 51. Further, a core forming a part of a closed magnetic path is disposed on the side of the inner circumferences of the first and second coil units so as to extend through the coils. The closed magnetic path is formed in a plane in parallel with the element forming surface. In the following description, elements having functions and effects like those of elements in the first embodiment are indicated by like reference numerals and will not be described in detail.

Figures 33A, 33B, 33C, 33D:
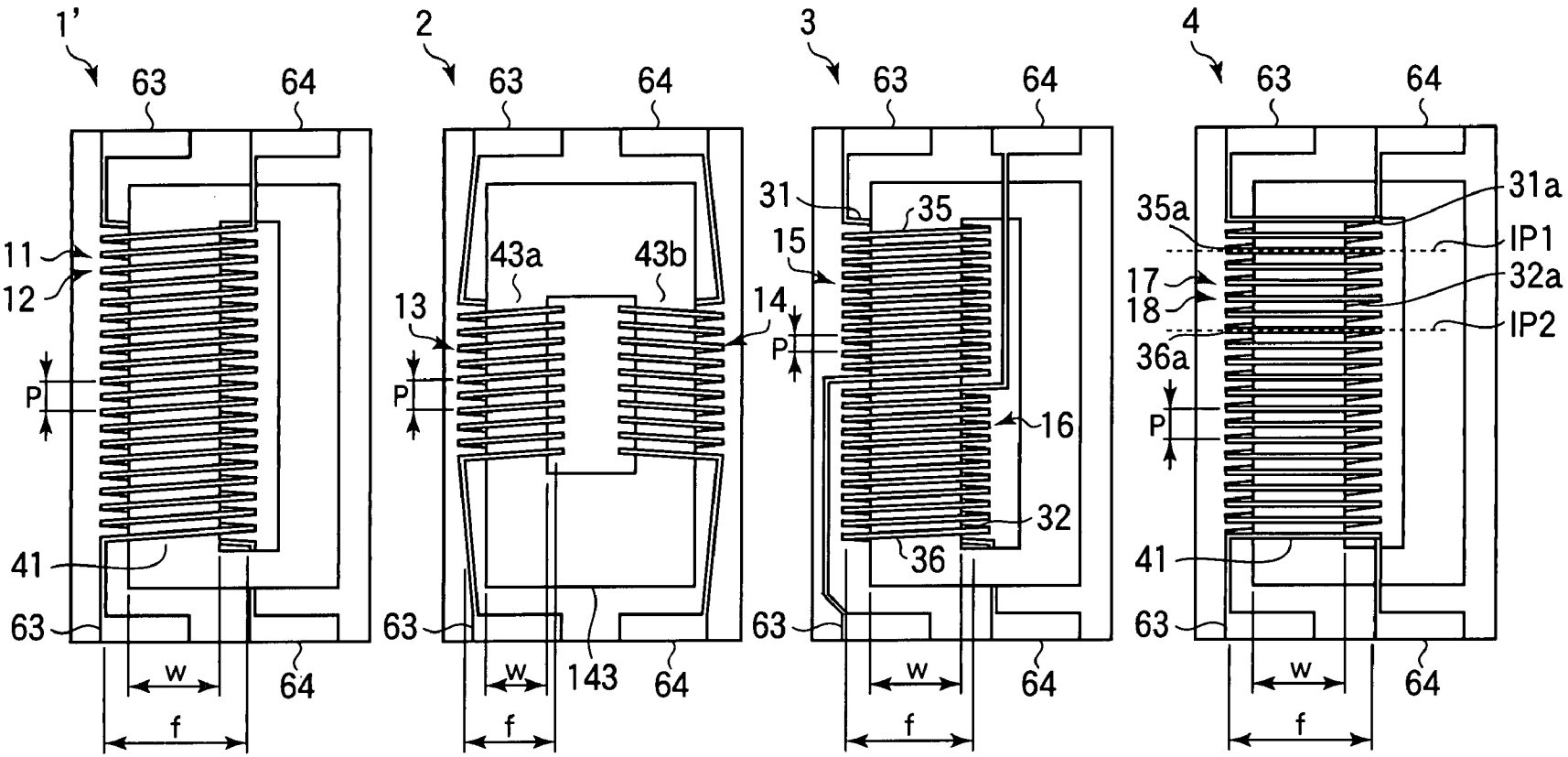
FIGS. 33A, 33B, 33C, and 33D are plan views of modifications of the common mode choke coil 1 according to the first embodiment of the invention.

First, a common mode choke coil 1' according to Modification 1 of the present embodiment will be described with reference to FIG. 33A. FIG. 33A is a plan view of the common mode choke coil 1' of the present modification showing an internal structure of the same. The common mode choke coil 1' of the present modification is identical in configuration to the common mode choke coil 1 of the first embodiment except for the number of turns of the coils and the shape of external electrode connecting parts 63 and 64.

A pair of external electrode connecting parts 63 and 64 is formed in parallel on each of short sides of the outer circumference of the common mode choke coil 1'. The external electrode connecting parts 61 and 62 of the common mode choke coil 1 shown in FIG. 1 are formed in a rectangular shape whose longitudinal direction extends along the longer sides of the coil 1 constituting the outer circumstance thereof. On the contrary, the external electrode connecting parts 63 and 64 of the common mode choke coil 1' of the present modification are formed in a rectangular shape whose longitudinal direction extends along the shorter sides of the outer circumference of the coil 1'. Both ends of the first helical coil unit 11 are electrically connected to the pair of external electrode connecting parts 63 respectively, and both ends of the second helical coil unit 12 are electrically connected to the pair of external electrode connecting parts 64 respectively. In common mode choke coils 2 to 5 to be described later, external electrode connecting parts 63 are similarly electrically connected to both ends of a first helical coil unit respectively, and external electrode connecting parts 64 are similarly electrically connected to both ends of a second helical coil unit respectively.

Table 1 shows four examples of configuration patterns of the common mode choke coil 1 which are different from each other in any of the coil pitch (represented by p) of the first and second helical coil units 11 and 12, the coil width on a section orthogonal to the direction in which a current flows through the coil, the number n of turns of the coil, the coil inner diameter (represented by f), and the width of the core 41 (represented by w). In Table 1, "14×2" means that each of the first and second helical coil units 11 and 12 has 14 turns.

TABLE 1

| | Pattern 1 | Pattern 2 | Pattern 3 | Pattern 4 |
|---|---|---|---|---|
| Coil Pitch p (μm) | 20 | 25 | 20 | 25 |
| Coil Width (μm) | 10 | 10 | 10 | 10 |
| Number of Turns n | 14 × 2 | 12 × 2 | 14 × 2 | 12 × 2 |
| Coil Inner Diameter f (μm) | 240 | 240 | 240 | 240 |
| Core Width w (μm) | 150 | 150 | 200 | 200 |

A common mode choke coil 2 according to Modification 2 of the present embodiment will now be described with reference to FIG. 33B. FIG. 33B is a plan view of the common mode choke coil 2 of the present modification showing an internal structure of the same. As shown in FIG. 33B, the common mode choke coil 2 of the present modification is characterized in that it includes two cores 43*a* and 43*b* which constitute an element of a closed magnetic path 143 by extending longitudinally of the closed magnetic path 143 that is in the form of a ring having a rectangular circumference so as to sandwich the hollow of the ring and first and second helical coil units 13 and 14 which are wound around the cores 43*a* and 43*b*, respectively. The closed magnetic path 143 is symmetric about an imaginary straight line passing through the center of the hollow and extending in parallel with the longitudinal direction of an element forming region. The first helical coil unit 13 is wound around the core 43*a*, and the second helical coil unit 14 is wound around the core 43*b*. The first and second helical coil units 13 and 14 have a spiral structure similar to that of the first helical coil unit 11. Table 2 shows two examples of configuration patterns of the common mode choke coil 2.

TABLE 2

| | Pattern 5 | Pattern 6 |
|---|---|---|
| Coil Pitch p (μm) | 20 | 25 |
| Coil Width (μm) | 10 | 10 |
| Number of Turns n | 14 × 2 | 12 × 2 |
| Coil Inner Diameter f (μm) | 190 | 190 |
| Core Width w (μm) | 100 | 100 |

A common mode choke coil 3 according to Modification 3 of the present embodiment will now be described with reference to FIG. 33C. FIG. 33C is a plan view of the common mode choke coil 3 of the present modification showing an internal structure of the same. As shown in FIG. 33C, the common mode choke coil 3 of the present modification is characterized in that first and second helical coil units 15 and 16 are wound around a core 41 separately from each other. Referring to FIG. 33C, the first helical coil unit 15 is disposed on the upper side of the core, and the second helical coil unit 16 is disposed on the lower side.

The angle at which coil top parts 35 and 36 and coil bottom parts 31 and 32 of the common mode choke coil 3 extend across the extending direction of the core 41 can be made closer to 90 deg when compared to such angles in the common mode choke coils 1, 1', and 2. Since the core 41 is therefore more efficiently magnetized by magnetic fields generated by the first and second helical coil units 15 and 16, the common mode choke coil 3 can be provided with higher electrical characteristics. Table 3 shows two examples of configuration patterns of the common mode choke coil 3.

TABLE 3

| | Pattern 7 | Pattern 8 |
|---|---|---|
| Coil Pitch p (μm) | 20 | 25 |
| Coil Width (μm) | 10 | 10 |
| Number of Turns n | 14 × 2 | 12 × 2 |
| Coil Inner Diameter f (μm) | 240 | 240 |
| Core Width w (μm) | 150 | 150 |

A common mode choke coil 4 according to Modification 4 of the present embodiment will now be described with reference to FIG. 33D. FIG. 33D is a plan view of the common mode choke coil 4 of the present modification showing an internal structure of the same. As shown in FIG. 33D, the common mode choke coil 4 of the present modification is characterized as follows. The coil includes first and second helical coil units 17 and 18 having a double spiral structure. One turn of the coil of the first helical coil unit 17 is constituted by a coil bottom part 31*a*, a coil side part (not shown), a coil top part 35*a*, and another coil side part (not shown), and a first imaginary plane IP1 including the coil top part 35*a* and the two coil side parts among those elements is orthogonal to the core 41. One turn of the coil of the second helical coil unit 18 is constituted by a coil bottom part 32*a*, a coil side part (not shown), a coil top part 36*a*, and another coil side part (not shown), and a second imaginary plane IP2 including the coil top part 36*a* and the two coil side parts among those elements is orthogonal to the core 41. The first imaginary plane IP1 and the second imaginary plane IP2 do not cross each other.

The axes of spiral of the first and second helical coil units 17 and 18 substantially coincide with the extending direction of the core 41. While the coil top parts 35*a* are orthogonal to the core 41, the coil bottom parts 31*a* extend across the core 41 at a predetermined angle to the same. Adjoining coil top parts 35*a* are electrically connected to each other by the coil bottom parts 31*a* through a coil side part. Similarly, the coil bottom parts 32*a* extend across the core 41 at a predetermined angle to the same, and adjoining coil top parts 36*a* are electrically connected to each other by the coil bottom parts 32*a* through a coil side part. In the first and second helical coil units 17 and 18 of the present modification, two coil side parts and a coil top part are included in an imaginary plane orthogonal to the core. Alternatively, those units may be formed such that two coil side parts and a coil bottom part are included in such an imaginary plane.

In the common mode choke coil 4, since each of the first and second imaginary planes IP1 and IP2 is orthogonal to the core 41, the core 41 can be more efficiently magnetized than in the common mode choke coil 3 of Modification 3, and further improvement of electrical characteristics can be achieved. Since the first and second helical coil units 17 and 18 form a double spiral structure without being separated from each other, the common mode choke coil 4 can sufficiently eliminate common mode noise signals. Table 4 shows two examples of configuration patterns of the common mode choke coil 4.

TABLE 4

| | Pattern 9 | Pattern 10 |
|---|---|---|
| Coil Pitch p (μm) | 20 | 25 |
| Coil Width (μm) | 10 | 10 |
| Number of Turns n | 14 × 2 | 12 × 2 |
| Coil Inner Diameter f (μm) | 240 | 240 |
| Core Width w (μm) | 150 | 150 |

Figures 34A, 34B, 34C, 34D:
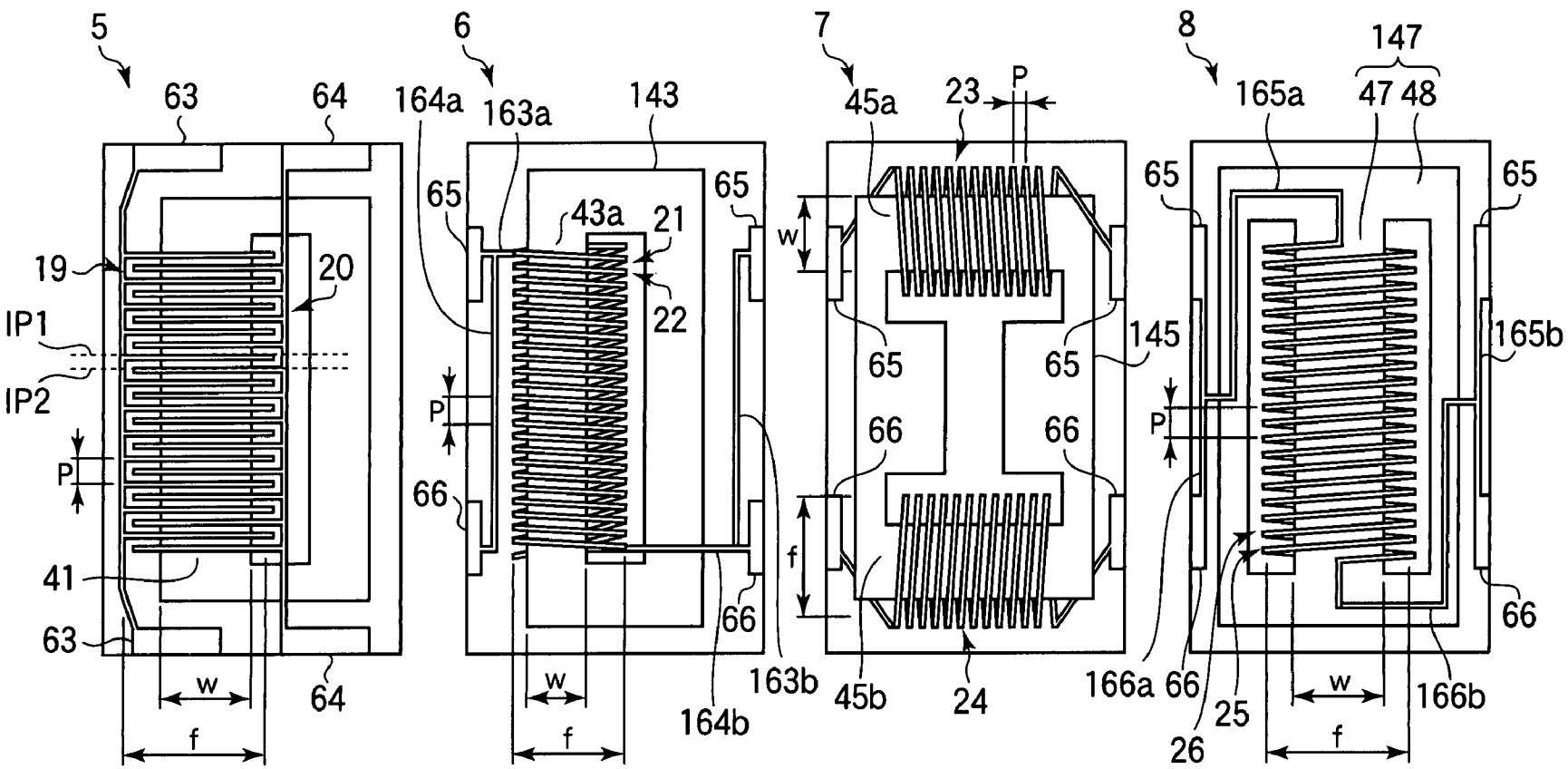
FIGS. 34A, 34B, 34C, and 34D are plan views of modifications of the common mode choke coil 1 according to the first embodiment of the invention.
Figure 35:
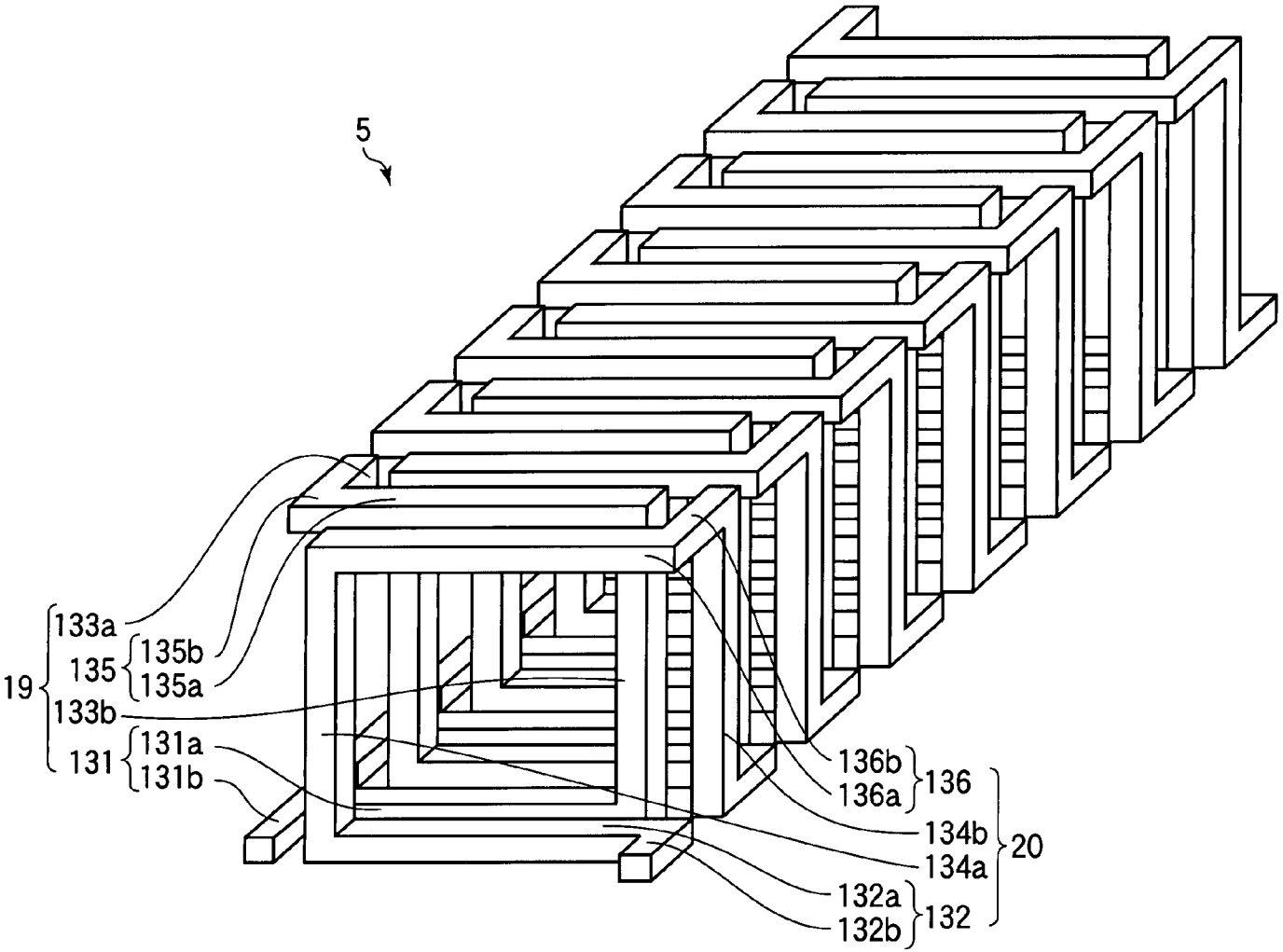
FIG. 35 is a perspective view of a modification of the common mode choke coil 1 according to the first embodiment of the invention.

A common mode choke coil according to Modification 5 of the present embodiment will now be described with reference to FIGS. 34A and 35. FIG. 34A is a plan view of a common mode choke coil 5 of the present modification showing an internal structure of the same. FIG. 35 is a perspective view of the common mode choke coil 5 taken with part of first and second helical coil units 19 and 20 removed. As shown in FIGS. 34A and 35, the common mode choke coil 5 of the present modification is characterized as follows. One turn of the coil of the first helical coil unit 19 is constituted by a coil bottom part 131, a coil side part 133*a*, a coil top part 135, and another coil side part 133*b*, and a first imaginary plane IP1 including the coil bottom part 131, the coil side part 133*b*, and the coil top part 135 among those elements is orthogonal to a core 41. One turn of the coil of the second helical coil unit 20 is constituted by a coil bottom part 132, a coil side part 134*a*, a coil top part 136, and another coil side part 134*b*, and a second imaginary plane IP2 including the coil bottom part 132, the coil side part 134*a*, and the coil top part 136 among those elements is orthogonal to the core 41. The first imaginary plane IP1 and the second imaginary plane IP2 do not cross each other.

As shown in FIG. 34A, when the element forming surface is viewed in the normal direction thereof, the first and second helical coil units 19 and 20 are formed like comb teeth and are interdigitated with each other. The first helical coil unit 19 is disposed on the left side in FIG. 34A, and the second helical coil unit 20 is disposed on the right side in the figure.

As shown in FIG. 35, the first helical coil unit 19 has a coil having n turns each constituted by a coil bottom part 131, a coil side part 133*a*, a coil top part 135, and a coil side part 133*b* which are in the form of a rectangular parallelepiped. The coil bottom part 131 has a shape in the form of "L" when viewed in the extending direction of the coil side parts 133*a* and 133*b*, and the part 131 includes a longer portion 131*a* orthogonal to the axis of spiral of the first helical coil unit 19 and a shorter portion 131*b* extending along the axis of spiral. Similarly, the coil top part 135 has a shape in the form of "L" when viewed in the extending direction of the coil side parts 133*a* and 133*b*, and the part 135 includes a longer portion 135*a* orthogonal to the axis of spiral of the first helical coil unit 19 and a shorter portion 135*b* extending along the axis of spiral.

The longer portion 131*a* of the coil bottom part 131 and the longer portion 135*a* of the coil top part 135 are disposed in an overlapping relationship when viewed in the extending direction of the coil side parts 133*a* and 133*b*. The coil bottom part 131 and the coil top part 135 are mirror-symmetric about the overlapping portion. The coil side part 133*b* is formed substantially orthogonally to the two longer portions 131*a* and 135*a* between the end of the longer portion 131*a* of the coil bottom part 131 which is not connected to the shorter portion 131*b* and the end of the longer portion 135*a* of the coil top part 135 which is not connected to the shorter portion 135*b*. The coil bottom part 131 and the coil top part 135 which are formed in the same first imaginary plane IP1 are electrically connected to each other by the coil side part 133*b*. The coil side part 133*a* is formed substantially orthogonally to the two shorter portions 131*b* and 135*b* between the end of the shorter portion 131*b* of the coil bottom part 131 which is not connected to the longer portion 131*a* and the end of the shorter portion 135*b* of the coil top part 135 which is not connected to the longer portion 135*a*. The coil bottom part 131 which is formed on one of adjoining first imaginary planes IP1 and the coil top part 135 which is formed on the other first imaginary plane IP1 are electrically connected to each other by the coil side part 133*a*.

Like the first helical coil unit 19, the second helical coil unit 20 has a coil having n turns each constituted by a coil bottom part 132, a coil side part 134*a*, a coil top part 136, and a coil side part 134*b* which are in the form of a rectangular parallelepiped. The coil bottom part 132 has a shape in the form of "L" when viewed in the extending direction of the coil side parts 134*a* and 134*b*, and the part 132 includes a longer portion 132*a* orthogonal to the axis of spiral of the second helical coil unit 20 and a shorter portion 132*b* extending along the axis of spiral. Similarly, the coil top part 136 has a shape in the form of "L" when viewed in the extending direction of the coil side parts 134*a* and 134*b*, and the part 136 includes a longer portion 136*a* orthogonal to the axis of spiral of the second helical coil unit 20 and a shorter portion 136*b* extending along the axis of spiral.

The longer portion 132*a* of the coil bottom part 132 and the longer portion 136*a* of the coil top part 136 are disposed in an overlapping relationship when viewed in the extending direction of the coil side parts 134*a* and 134*b*. The coil bottom part 132 and the coil top part 136 are mirror-symmetric about the overlapping portion. The coil side part 134*a* is formed substantially orthogonally to the two longer portions 132*a* and 136*a* between the end of the longer portion 132*a* of the coil bottom part 132 which is not connected to the shorter portion 132*b* and the end of the longer portion 136*a* of the coil top part 136 which is not connected to the shorter portion 136*b*. The coil bottom part 132 and the coil top part 136 which are formed in the same second imaginary plane IP2 are electrically connected to each other by the coil side part 134*a*. The coil side part 134*b* is formed substantially orthogonally to the two shorter portions 132*b* and 136*b* between the end of the shorter portion 132*b* of the coil bottom part 132 which is not connected to the longer portion 132*a* and the end of the shorter portion 136*b* of the coil top part 136 which is not connected to the longer portion 136*a*. The coil bottom part 132 which is formed on one of adjoining second imaginary planes IP2 and the coil top part 136 which is formed on the other second imaginary plane IP2 are electrically connected to each other by the coil side part 134*a*.

In the common mode choke coil 4 of Modification 4, the coil top parts 35*a* and 36*a* are orthogonal to the core 41, and the coil bottom parts 31*a* and 32*a* extend across the core 41 obliquely to the same. In the case of the common mode choke coil 5 of the present modification, among the coil bottom part 131 (longer portion 131*a*), the coil side part 133*b*, the coil top part 135 (loner portion 135*a*), and the coil side part 133*a* constituting one turn of the coil of the first helical coil unit 19, the coil side part 133*a* which is not included in the first imaginary plane IP1 is formed so as not to cross the first imaginary plane IP1. Among the coil bottom part 132 (longer portion 132*a*), the coil side part 134*a*, the coil top part 136 (loner portion 136*a*), and the coil side part 134*b* constituting one turn of the coil of the second helical coil unit 20, the coil side part 134*b* which is not included in the second imaginary plane IP2 is formed so as not to cross the first imaginary plane IP1. Thus, the coil parts 131 to 135 and 132 to 136 constituting the first and second helical coil units 19 and 20 are disposed substantially orthogonally to the extending direction of the core 41 except the shorter portions 131*b* and 132*b*. Since the core 41 of the common mode choke coil 5 is therefore more efficiently magnetized than that of the common mode choke coil 4 of Modification 4, further improvement of electrical characteristics can be achieved. Since the first and second helical coil units 19 and 20 form a double spiral structure instead of being separated from each other, the common mode choke coil 5 can sufficiently eliminate common mode noise signals.

A coil unit of a wire-wound type common mode choke coil according to the related art cannot be formed to have the structure employed for the first and second helical coil units 19 and 20 of the present modification. The structure of the first and second helical coil units 19 and 20 can be provided only by using methods of manufacturing a common mode choke coil according to the present embodiment and second to fifth embodiments to be described later. Table 5 shows two examples of configuration patterns of the common mode choke coil 5.

TABLE 5

| | Pattern 11 | Pattern 12 |
|---|---|---|
| Coil Pitch p (μm) | 20 | 25 |
| Coil Width (μm) | 10 | 10 |
| Number of Turns n | 14 × 2 | 12 × 2 |
| Coil Inner Diameter f (μm) | 240 | 240 |
| Core Width w (μm) | 150 | 150 |

A common mode choke coil 6 according to Modification 6 of the present embodiment will now be described with reference to FIG. 34B. FIG. 34B is a plan view of the common mode choke coil 6 of the present modification showing an internal structure of the same. While the common mode choke coil 1' of Modification 1 includes the external electrode connecting parts 63 and 64 formed on both shorter sides of the outer circumference of the coil, the common mode choke coil 6 of the present modification is characterized in that it includes a pair of external electrode connecting parts 65 and 66 formed on both longer sides of the outer circumference thereof, as shown in FIG. 34B. Both ends of the first helical coil unit 21 are electrically connected to the respective external electrode connecting parts 65 through lead wires 163*a* and 163*b*. Similarly, both ends of the second helical coil unit 22 are electrically connected to the respective external electrode connecting parts 66 through lead wires 164*a* and 164*b*. The lead wires 163*a* and 164*b* are formed above a closed magnetic path 143, and the lead wires 163*b* and 164*a* are formed under the closed magnetic path 143. Both ends of first helical coil units of common mode choke coils 7 and 8 to be described later are electrically connected to external electrode connecting parts 65, and both ends of second helical coil units of the same are electrically connected to external electrode connecting parts 66.

The first and second helical coil units 21 and 22 have a double spiral structure similar to that of the first and second helical coil units 11 and 12. A core 43*a* in the form of a rectangular parallelepiped is disposed on the side of the inner circumference of the first and second helical coil units 21 and 22 so as to extend through the units, the core constituting an element of the closed magnetic path in the form of a rectangular ring.

In the common mode choke coil 6 of the present modification, since the external electrode connecting parts 65 and 66 are formed to be exposed on the longer sides of the outer circumference of the coil 6, external electrodes may have a great electrode width. As a result, the common mode coke coil 6 can be mounted on a PCB with improved strength. Table 6 shows two examples of configuration patterns of the common mode choke coil 6.

TABLE 6

| | Pattern 13 | Pattern 14 |
|---|---|---|
| Coil Pitch p (μm) | 20 | 25 |
| Coil Width (μm) | 10 | 10 |
| Number of Turns n | 14 × 2 | 12 × 2 |
| Coil Inner Diameter f (μm) | 190 | 190 |
| Core Width w (μm) | 100 | 100 |

A common mode choke coil 7 according to Modification 7 of the present embodiment will now be described with reference to FIG. 34C. FIG. 34C is a plan view of the common mode choke coil 7 of the present modification showing an internal structure of the same. The common mode choke coil 2 of Modification 2 includes the external electrode connecting parts 63 and 64 formed on both shorter sides of the outer circumference of the coil. The common mode choke coil 7 of the present modification is characterized in that it includes external electrode connecting parts 65 and 66 which are formed on both longer sides of the outer circumference of the coil 7 and first and second helical coil units 23 and 24 which are wound around cores 45*a* and 45*b*, respectively, extending along shorter sides of the outer circumference to constitute an element of a closed magnetic path 145 as shown in FIG. 34C. The closed magnetic path 145 is in the form of a thin rectangular parallelepiped having an H-shaped hollow. The closed magnetic path 145 is symmetric about an imaginary straight line passing through the center of the hollow and extending substantially in parallel with shorter sides of an element forming region. The first helical coil unit 23 is wound around the core 45*a*, and the second helical coil unit 24 is wound around the core 45*b*. Although the hollow of the closed magnetic path 145 is H-shaped, it may alternatively be formed in a rectangular shape. The common mode choke coil 7 of the present modification can provide the same advantage as that of the common mode choke coil 6 of Modification 6. Table 7 shows two examples of configuration patterns of the common mode choke coil 7.

TABLE 7

| | Pattern 15 | Pattern 16 |
|---|---|---|
| Coil Pitch p (μm) | 20 | 25 |
| Coil Width (μm) | 10 | 10 |
| Number of Turns n | 14 × 2 | 12 × 2 |
| Coil Inner Diameter f (μm) | 240 | 240 |
| Core Width w (μm) | 150 | 150 |

A common mode choke coil 8 according to Modification 8 of the present embodiment will now be described with reference to FIG. 34D. FIG. 34D is a plan view of the common mode choke coil 8 of the present modification showing an internal structure of the same. As shown in FIG. 34D, the common mode choke coil 8 of the present modification is characterized in that it includes a closed magnetic path 147 having a magnetic member part 48 in the form of a frame and a core 47 stretched to extend longitudinally of the magnetic member part 48 substantially in the middle of a region on the side of the inner circumference of the magnetic member part 48, and first and second helical coil units 25 and 26 having a double spiral structure wound around the core 47. Both ends of the first helical coil unit 25 are electrically connected to respective external electrode connecting parts 65 through lead wires 165*a* and 165*b*. Similarly, both ends of the second helical coil unit 26 are electrically connected to respective external electrode connecting parts 66 through lead wires 166*a* and 166*b*. The lead wires 165*a* and 166*b* are formed above the closed magnetic path 147, and the lead wires 165*b* and 166*a* are formed under the closed magnetic path 147. The common mode choke coil 8 of the present modification can provide the same advantage as that of the common mode choke coils 6 and 7 of Modifications 6 and 7. Table. 8 shows two examples of configuration patterns of the common mode choke coil 8.

TABLE 8

| | Pattern 17 | Pattern 18 |
|---|---|---|
| Coil Pitch p (μm) | 20 | 25 |
| Coil Width (μm) | 10 | 10 |
| Number of Turns n | 14 × 2 | 12 × 2 |
| Coil Inner Diameter f (μm) | 240 | 240 |
| Core Width w (μm) | 150 | 150 |

Second Embodiment

A common mode choke coil and a method of manufacturing the same according to a second embodiment of the invention will now be described with reference to FIGS. 36A to 57B. A common mode choke coil 201 of the present embodiment is characterized by the method of manufacturing the same. The configuration of a common mode choke coil 201 completed by the method of manufacturing will not be described because it is similar to that of the common mode choke coil 1 of the first embodiment. Elements having functions and effects like those of the elements in the first embodiment are indicated by like reference numerals and will not be described in detail.

A method of manufacturing a common mode choke coil 201 according to the present embodiment will now be described with reference to FIGS. 36A to 57B. FIGS. 36A to 57B show an element forming region of one common mode choke coil 201. FIGS. 36 to 57 having a suffix A are sectional views taken along lines A—A in FIGS. 36 to 57 having a suffix B. FIGS. 36 to 57 having a suffix B are plan views showing the method of manufacturing a common mode choke coil 201.

First, an insulation layer (bottom insulation layer) 52 and Cu conductive layers 81 and 82 are formed on a silicon path 51 using the same manufacturing method as for the common mode choke coil 1 of the first embodiment (see FIGS. 4A to 8B).

Figure 36A:
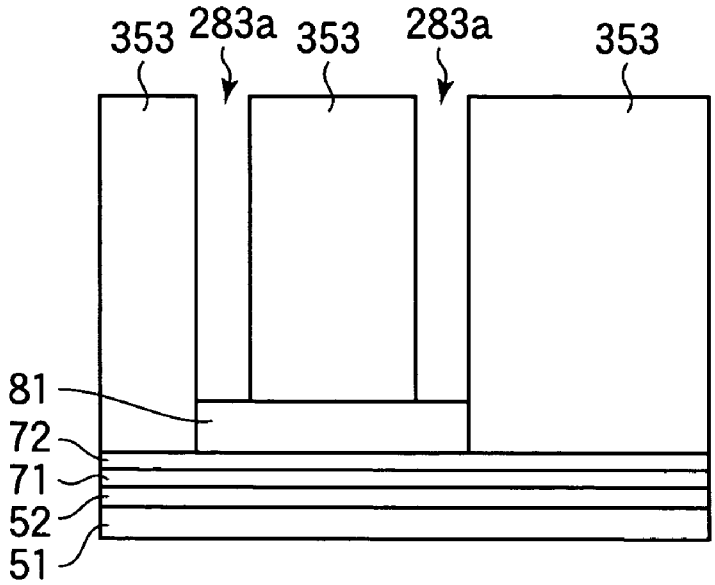
FIGS. 36A and 36B show a method of manufacturing a common mode choke coil 201 according to a second embodiment of the invention.
Figure 36B:
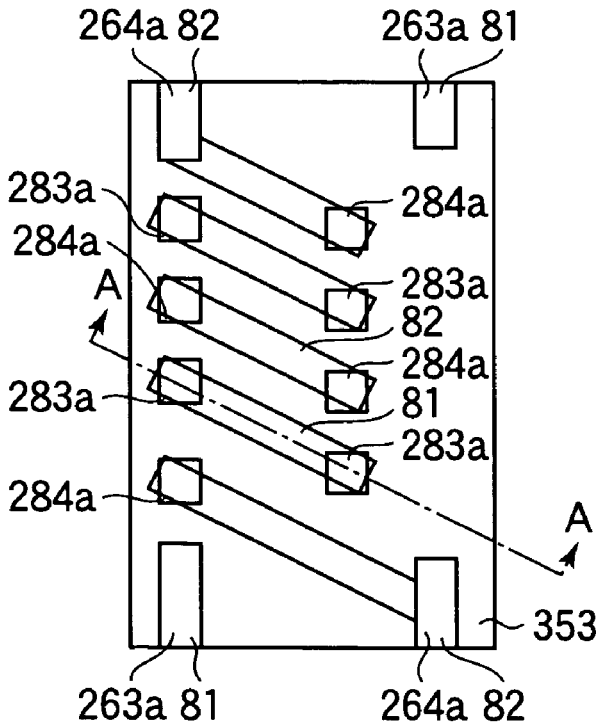
Figure 37A:
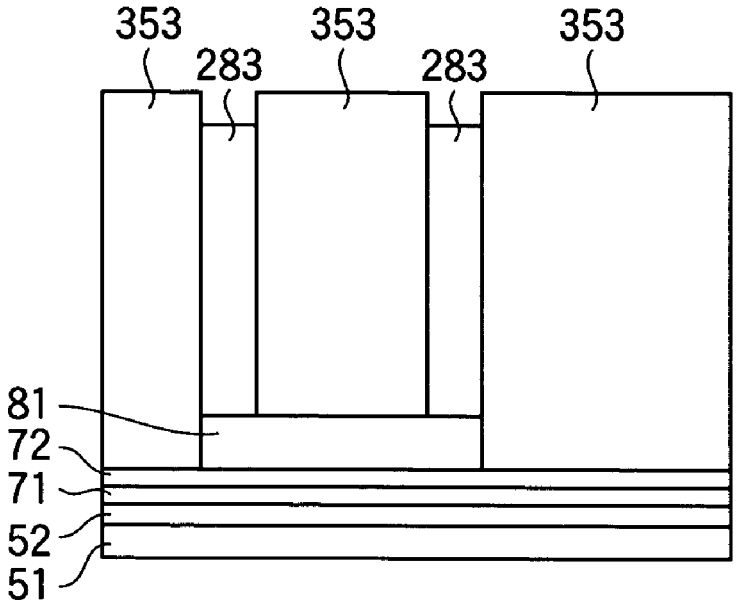
FIGS. 37A and 37B show the method of manufacturing the common mode choke coil 201 according to the second embodiment of the invention.
Figure 37B:
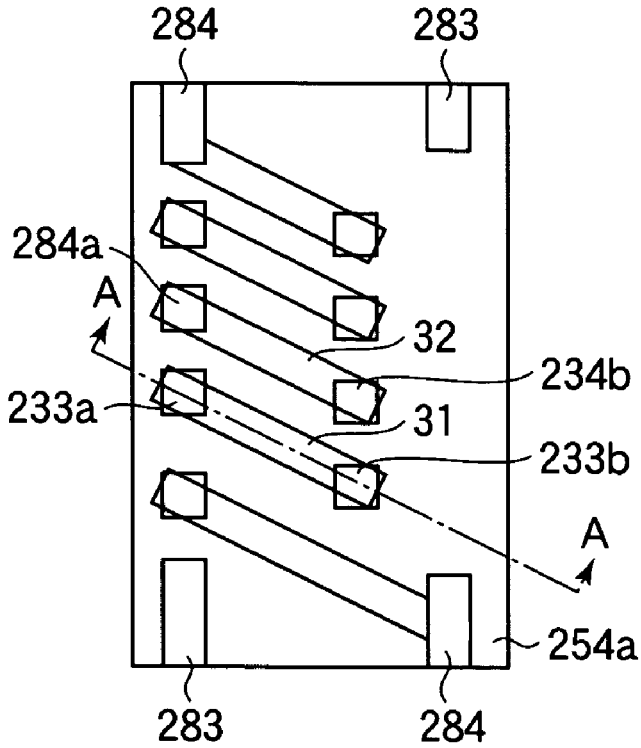

Next, a resist is applied throughout the resultant surface to form a resist layer (second resist layer) 353 having a thickness in the range from 20 to 30 μm. Next, as shown in FIGS. 36A and 36B, the resist layer 353 is patterned to form the resist layer 353 with openings (second openings) 283*a* and 284*a* for exposing both ends of a plurality of conductive layers 81 and 82 formed in an elongate shape, respectively, and openings 263*a* and 264*a* for exposing the conductive layers 81 and 82 formed in parallel on each of shorter sides of the outer circumference of the element forming region in positions near the longer sides of the region. As shown in FIG. 36B, the plurality of openings 283*a* and 284*a* formed above one end of the plurality of respective conductive layers 81 and 82 are alternately disposed on a straight line at equal intervals, and the plurality of openings 283*a* and 284*a* formed above another end of the respective layers are alternately disposed on a straight line at equal intervals. Next, as shown in FIGS. 37A and 37B, Cu conductive layers (second conductive layers) 283 having a thickness in the range from about 10 μm to about 18 μm are formed on the conductive layers 81 in the openings 263*a* and 283*a*, and conductive layers (second conductive layers) 284 are formed from the same material with the same thickness on the conductive layers 82 in the openings 264*a* and 284*a*. The conductive layers 283 and 284 are simultaneously formed using, for example, a pattern plating process. Thus, the conductive layers 283 are electrically connected to the conductive layers 81 located under the same, and the conductive layers 284 are electrically connected to the conductive layers 82 located under the same.

Figure 38A:
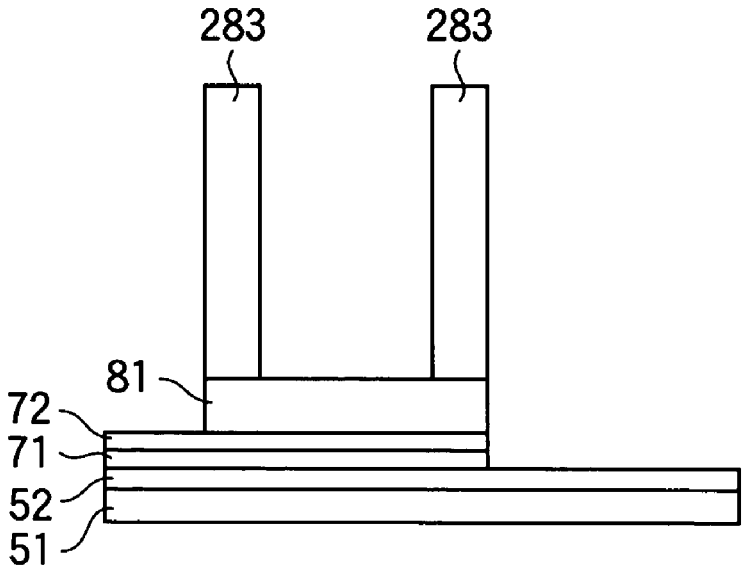
FIGS. 38A and 38B show the method of manufacturing the common mode choke coil 201 according to the second embodiment of the invention.
Figure 38B:
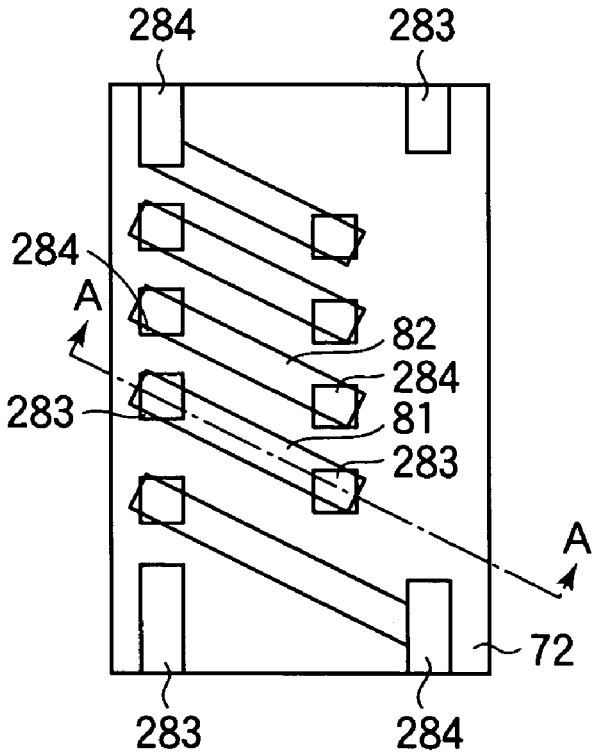
Figure 39A:
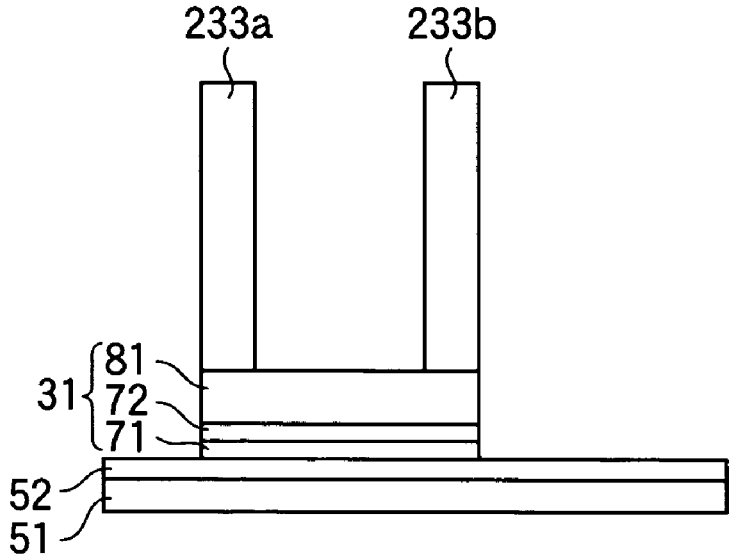
FIGS. 39A and 39B show the method of manufacturing the common mode choke coil 201 according to the second embodiment of the invention.
Figure 39B:
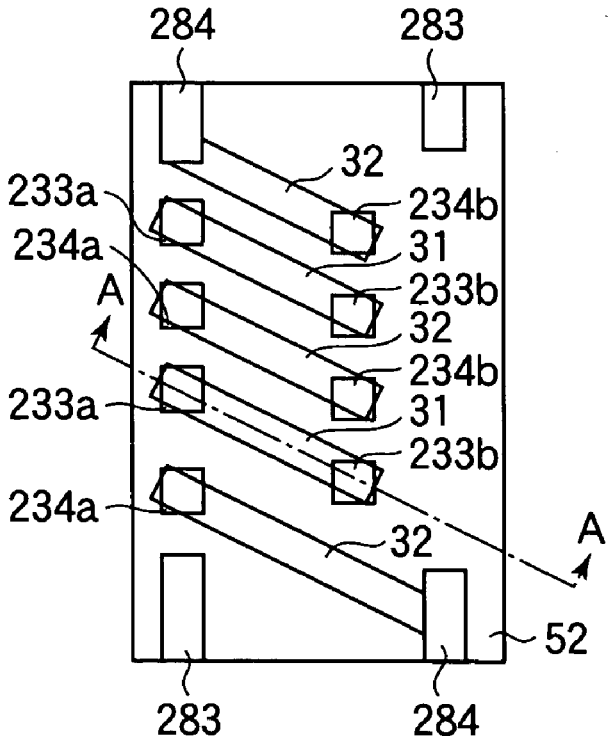

Next, as shown in FIGS. 38A and 38B, the resist layer 353 is etched away. As shown in FIGS. 39A and 39B, dry etching (milling) is then performed to remove an electrode film 72 which has been exposed as a result of the removal of the resist layer 353 and to remove an electrode film 71 located under the electrode film 72. When the electrode films 71 and 72 are removed, the surfaces of the conductive layers 81, 82, 283, and 284 are also etched in an amount substantially equivalent to the thickness of the electrode films 71 and 72. However, since the conductive layers 81, 82, 283, and 284 are formed sufficiently thick compared to the electrode films 71 and 72, the layers are not completely removed as a result of the dry etching. Each of electrode films to be described later is removed using the same method as for the electrode films 71 and 72. Through the above-described steps, coil bottom parts 31 having a multi-layer structure are provided by forming the electrode films 71 and 72 and the conductive layers 81 one over another, and coil bottom parts 32 having a multi-layer structure are provided by forming the electrode films 71 and 72 and the conductive layers 82 one over another. The coil bottom parts 31 and 32 are alternately formed in parallel on the silicon substrate 51. At the same time, coil side parts 233*a* and 233*b* constituted by the conductive layers 283 are provided on both ends of the coil bottom parts 31 respectively, and coil side parts 234*a* and 234*b* constituted by the conductive layers 284 are provided on both ends of the coil bottom parts 32 respectively. Referring to FIG. 39B, the coil side parts 233*a* and 234*a* are alternately disposed on the left side to align on a straight line at equal intervals, and the coil side parts 233*b* and 234*b* are alternately disposed on the right side to align on a straight line at equal intervals.

Figure 40A:
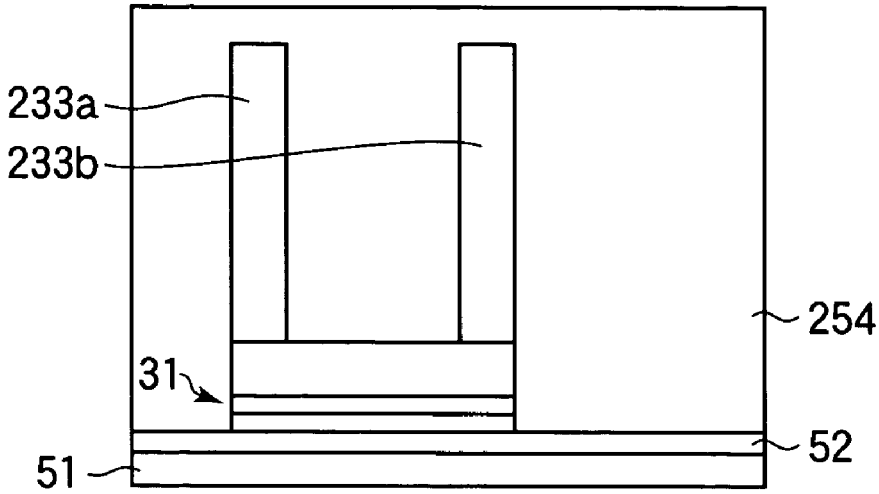
FIGS. 40A and 40B show the method of manufacturing the common mode choke coil 201 according to the second embodiment of the invention.
Figure 40B:
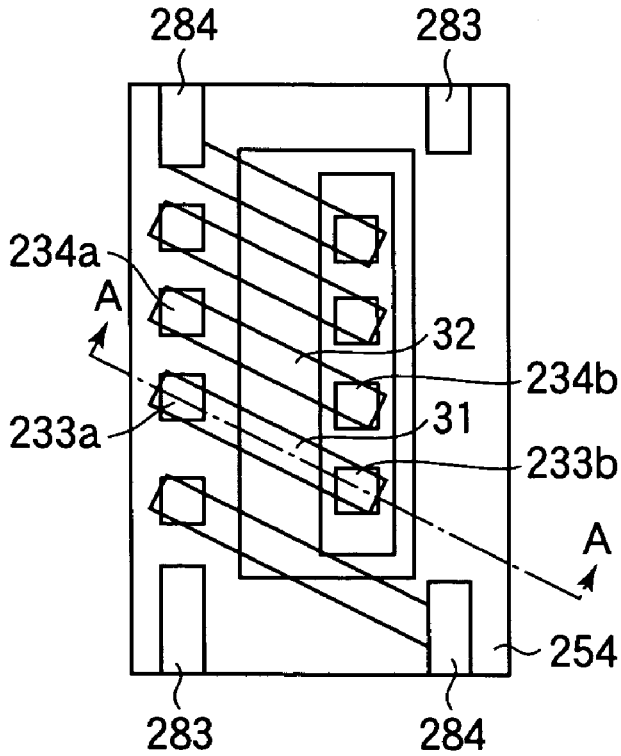
Figure 41A:
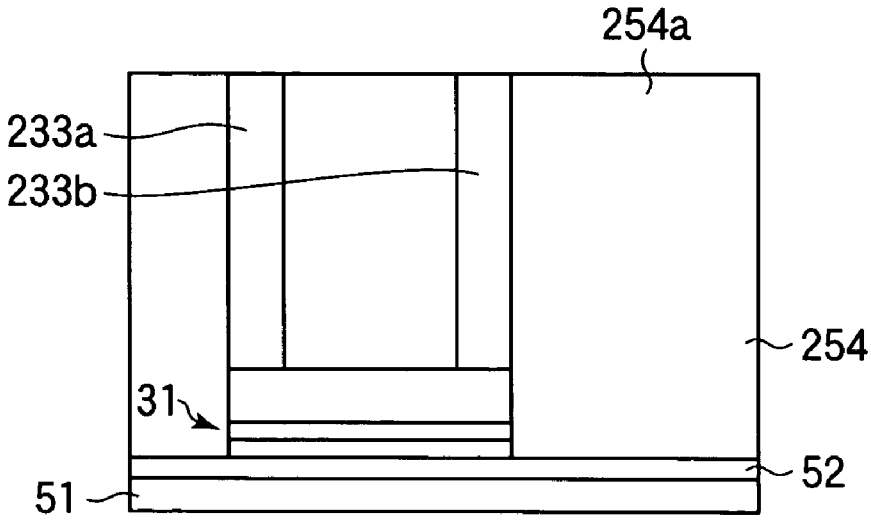
FIGS. 41A and 41B show the method of manufacturing the common mode choke coil 201 according to the second embodiment of the invention.
Figure 41B:
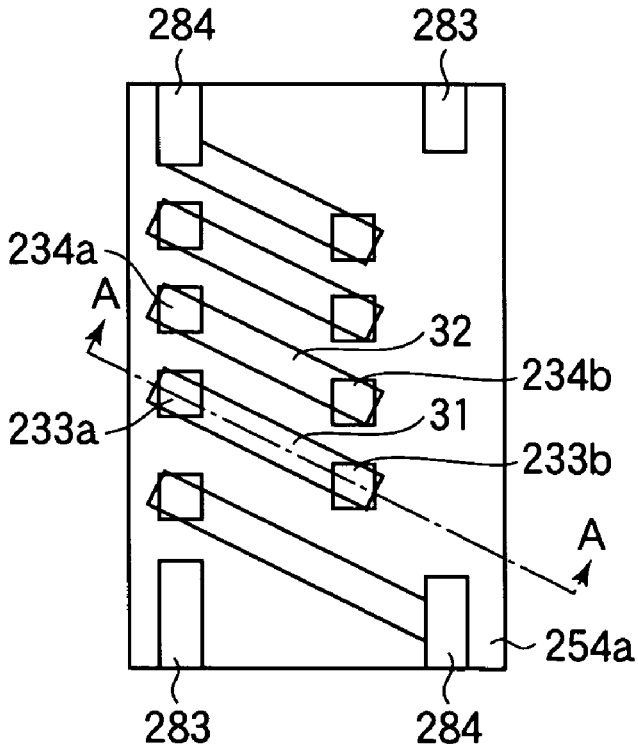

Next, as shown in FIGS. 40A and 40B, a film of alumina is formed throughout the resultant surface using a sputtering process to provide an insulation layer (first insulation layer) 254 having a thickness in the range from 17 to 28 μm. As shown in FIGS. 41A and 41B, a CMP (chemical mechanical polishing) process is then performed to polish the surface of the insulation layer 254 until the tops of the coil side parts 233*a*, 233*b*, 234*a*, and 234*b* are exposed, whereby a planar surface (CMP surface) 254*a* is formed. Visual observation is conducted to check whether the coil side parts 233*a*, 233*b*, 234*a*, and 234*b* have been exposed or not.

Figure 42A:
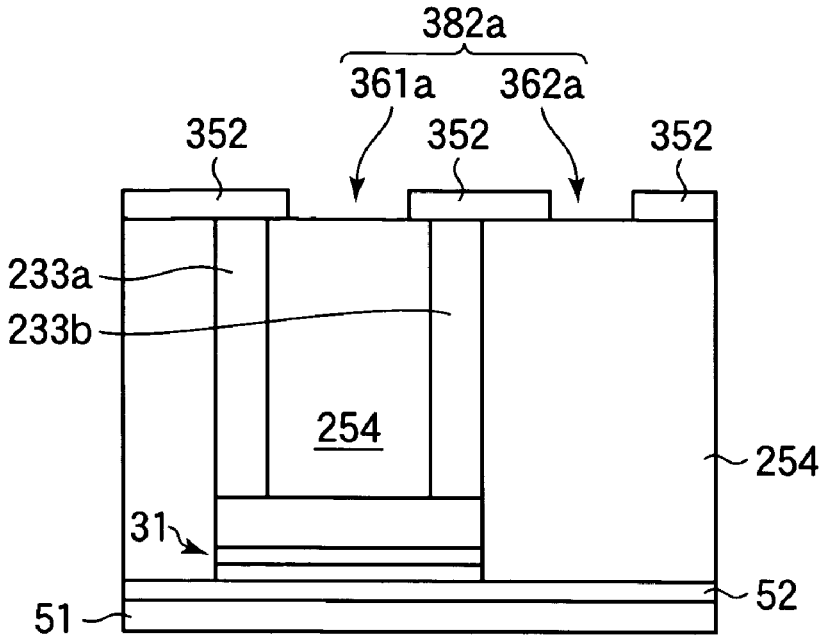
FIGS. 42A and 42B show the method of manufacturing the common mode choke coil 201 according to the second embodiment of the invention.
Figure 42B:
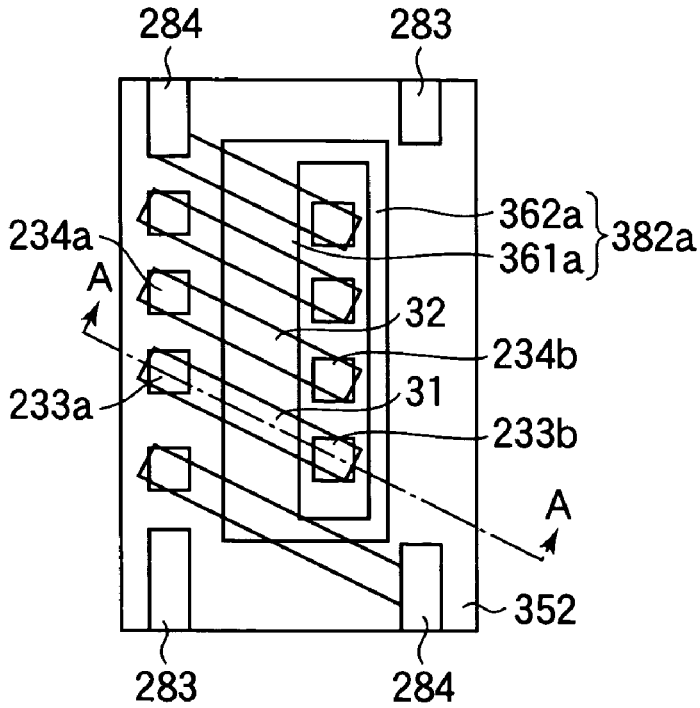

A resist is then applied throughout the resultant surface to form a resist layer (first intervening resist layer) 352 having a thickness of about 3 μm. Next, as shown in FIGS. 42A and 42B, the resist layer 352 is patterned to form an opening (first intervening opening) 382*a* for exposing the insulation layer 254 in the resist layer 352. When the element forming region is viewed in the normal direction thereof, the opening 382*a* is formed like a rectangular window constituted by a rectangular opening 361*a* and an opening 362*a* which is in the form of an inverted "C". The opening 382*a* is formed such that the coil side parts 233*a* and 234*a* are disposed on the side of the outer circumference of the opening and such that the coil side parts 233*b* and 234*b* are disposed on the side of the inner circumference of the opening. The opening 361*a* is disposed between the coil side parts 233*a*, 234*a* and the coil side parts 233*b*, 234*b* so as to extend across the coil bottom parts 31 and 32 at a predetermined angle to them when the element forming region is viewed in the normal direction thereof.

Figure 43A:
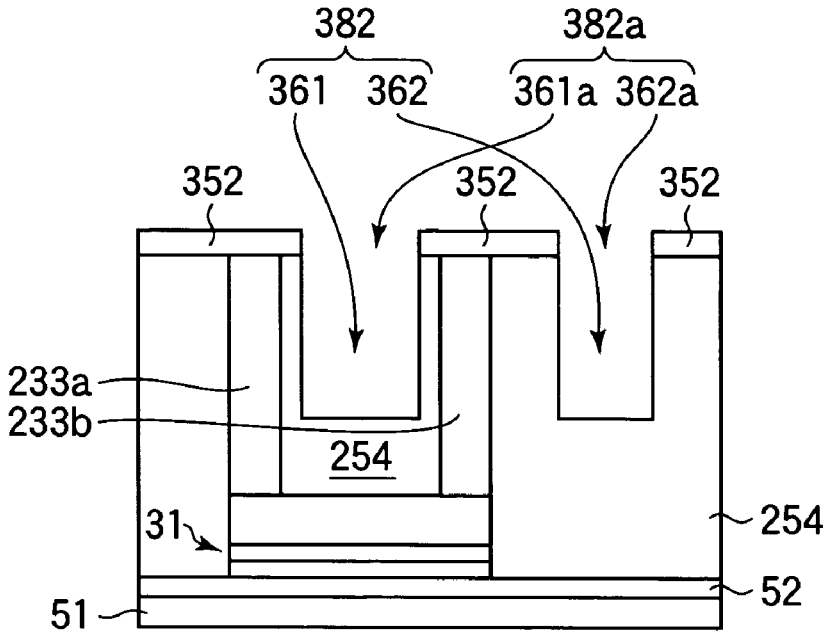
FIGS. 43A and 43B show the method of manufacturing the common mode choke coil 201 according to the second embodiment of the invention.
Figure 43B:
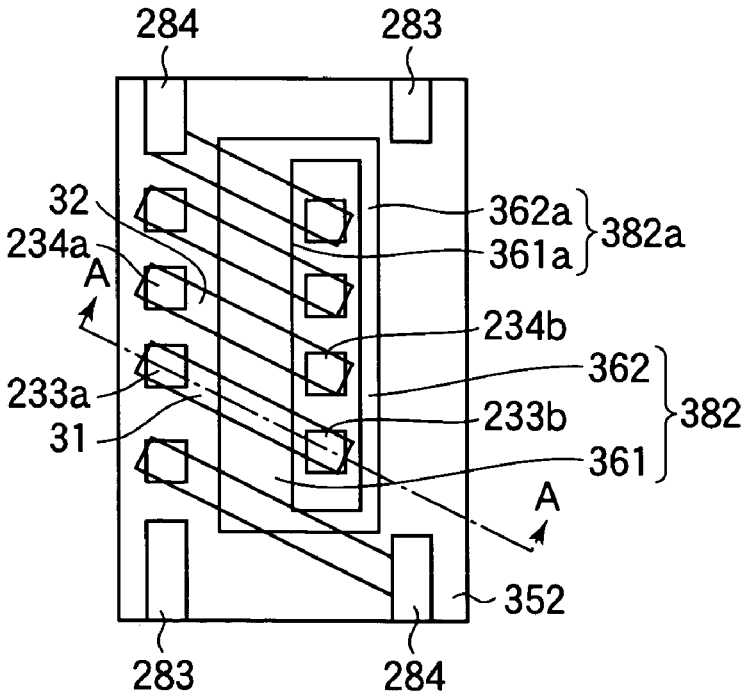
Figure 44A:
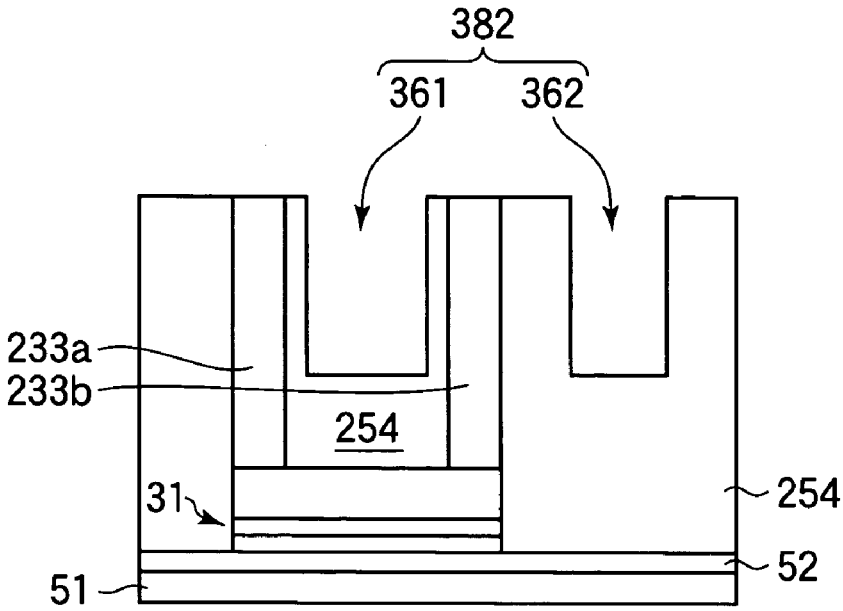
FIGS. 44A and 44B show the method of manufacturing the common mode choke coil 201 according to the second embodiment of the invention.
Figure 44B:
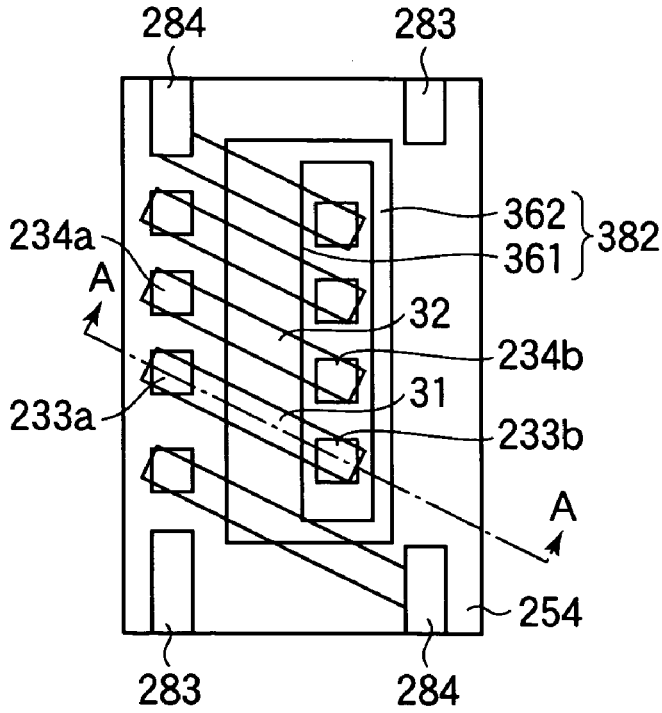

Next, as shown in FIGS. 43A and 43B, the insulation layer 254 exposed in the opening 382*a* is etched by performing reactive ion etching (RIE) to form a groove 382 having substantially the same shape as the opening 382*a* and a depth in the range from 8 to 13 μm on the insulation layer 254. The process is carried out such that the coil bottom parts 31 and 32 are not exposed on the bottom of the groove 382 and such that the coil side parts 233*a*, 233*b*, 234*a*, and 234*b* are not exposed on sides of the groove 382. Next, as shown in FIGS. 44A and 44B, the resist layer 352 is etched away.

Figure 45A:
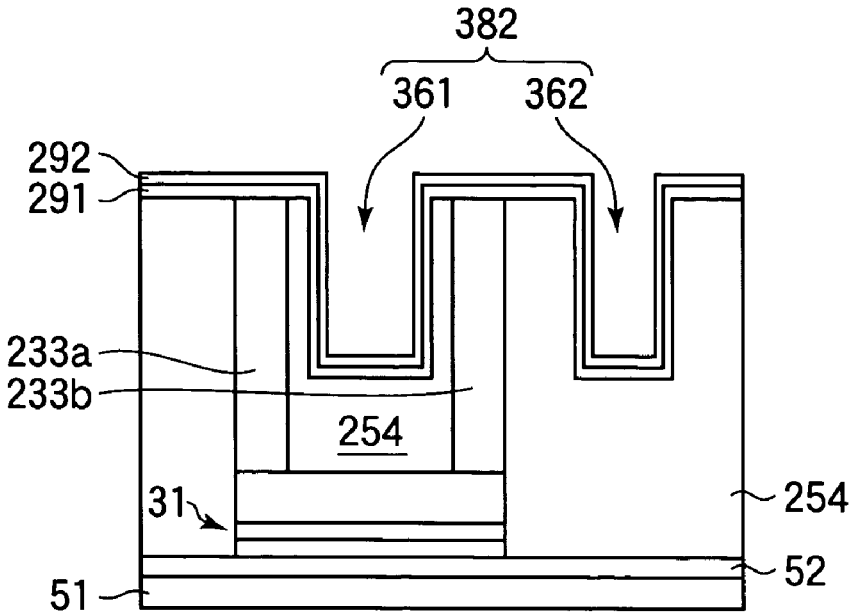
FIGS. 45A and 45B show the method of manufacturing the common mode choke coil 201 according to the second embodiment of the invention.
Figure 45B:
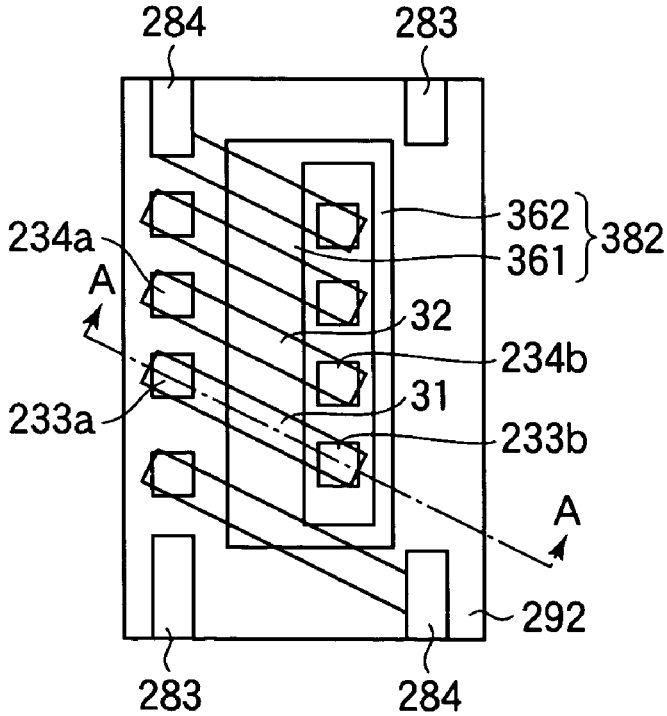

Next, as shown in FIGS. 45A and 45B, a Ti electrode film 291 having a thickness of about 10 nm is formed throughout the resultant surface using a sputtering process, and a NiFe electrode film (first intervening electrode film) 292 having a thickness of about 100 nm is then formed on the electrode film 291 using a sputtering process. The electrode films 291 and 292 are also formed on the sides of the groove 382 to a thickness smaller than that of the electrode films 291 and 292 formed on the bottom of the groove 382. The electrode film 291 is formed as a buffer film for improving the adhesion between the electrode film 292 and the insulation layer 254. The electrode film 292 is also used as an electrode film for plating the pattern of a magnetic member layer 301 which will be described later.

Figure 46A:
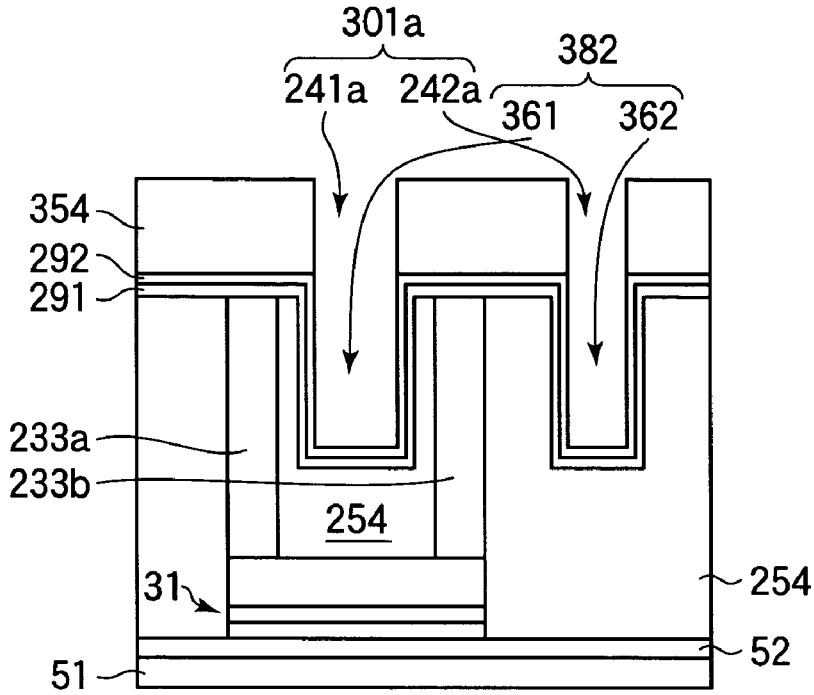
FIGS. 46A and 46B show the method of manufacturing the common mode choke coil 201 according to the second embodiment of the invention.
Figure 46B:
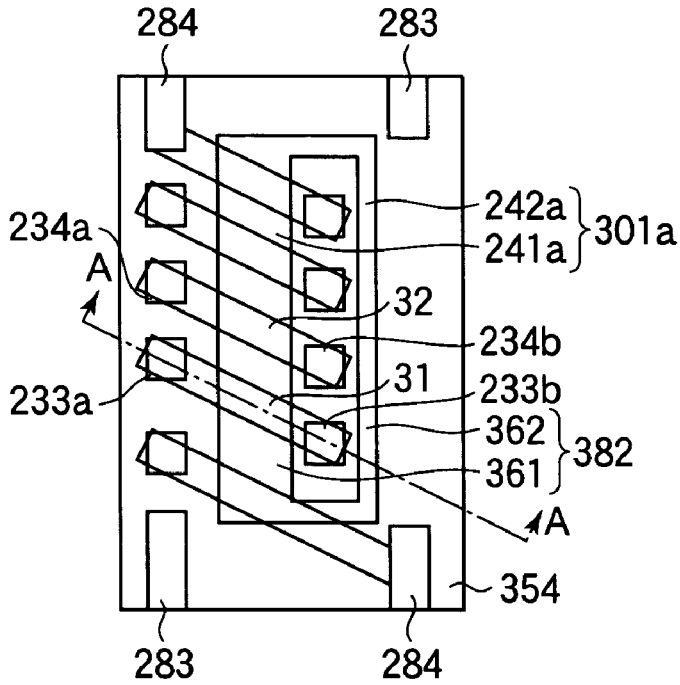

Next, a resist is applied to the electrode film 292 to form a resist layer 354 having a thickness of about 3 μm. Next, as shown in FIGS. 46A and 46B, the resist layer 354 is patterned to form the resist layer 354 with an opening 301*a* having substantially the same shape as the groove 382 and exposing the electrode film 292 in the groove 382. The opening 301*a* is provided in the form of a rectangular window constituted by an opening 241*a* exposing a groove portion 361 and an opening 242*a* exposing a groove portion 362.

Figure 47A:
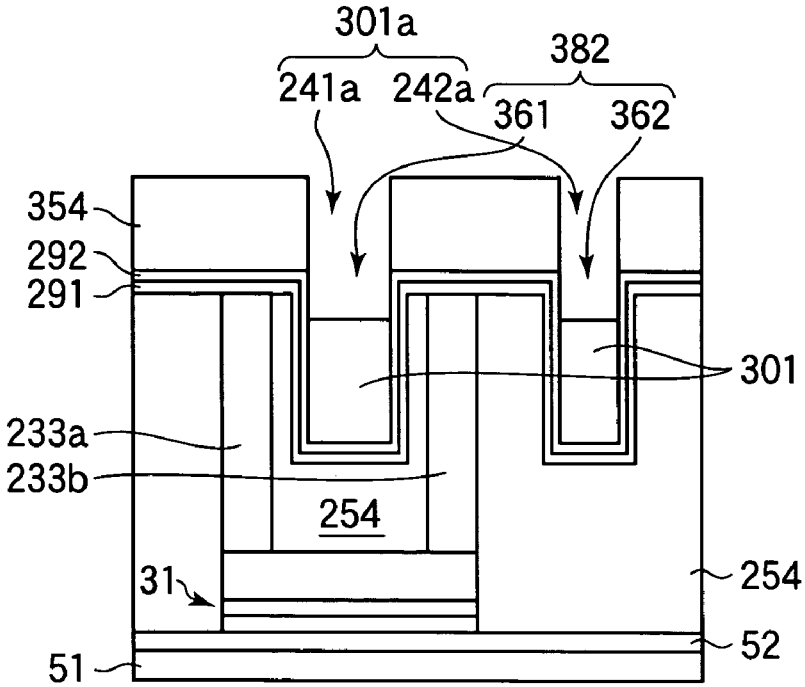
FIGS. 47A and 47B show the method of manufacturing the common mode choke coil 201 according to the second embodiment of the invention.
Figure 47B:
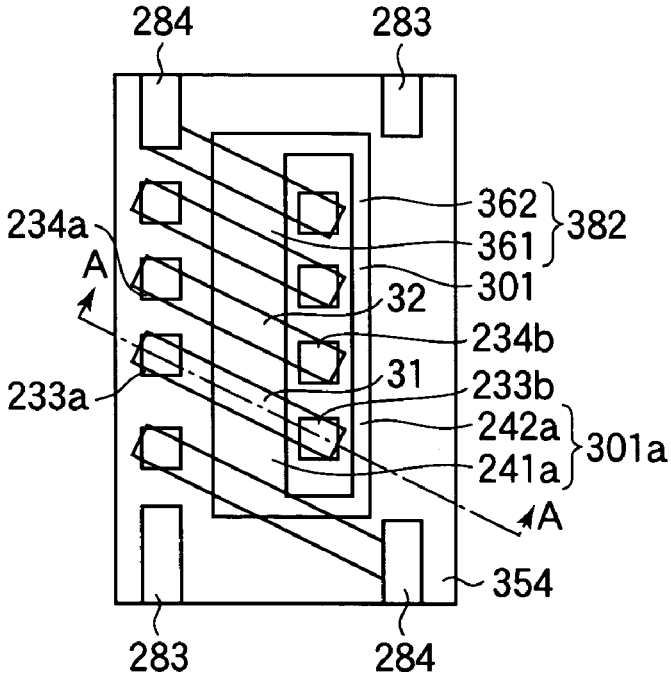
Figure 48A:
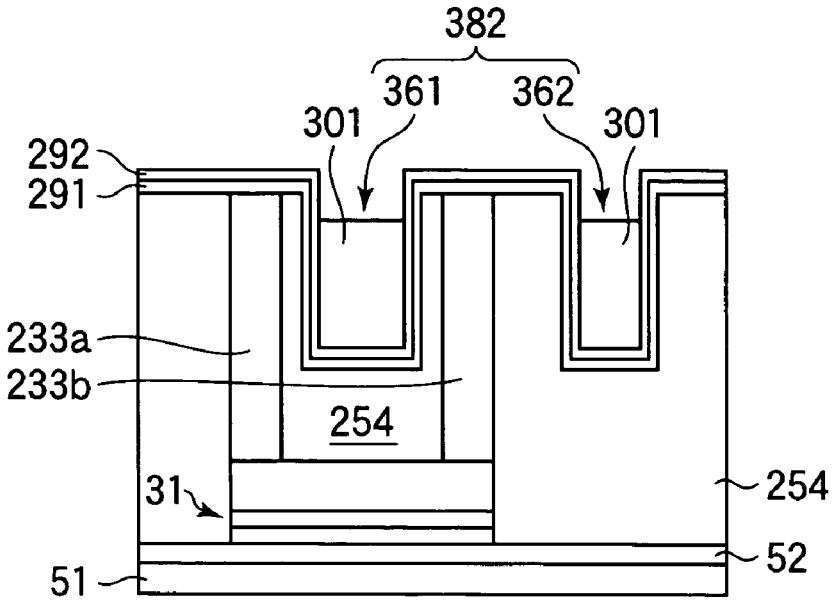
FIGS. 48A and 48B show the method of manufacturing the common mode choke coil 201 according to the second embodiment of the invention.
Figure 48B:
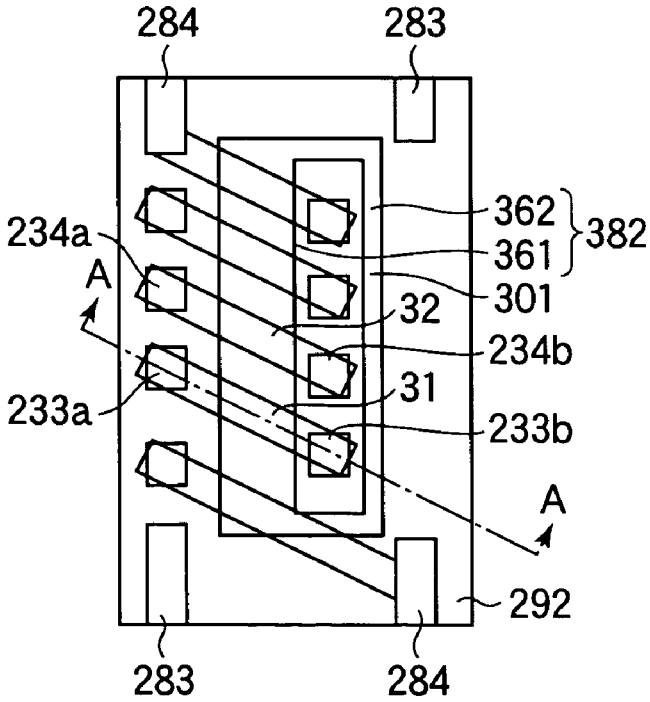

Next, as shown in FIGS. 47A and 47B, a NiFe magnetic member layer (first magnetic member layer) 301 having a thickness in the range from 5 to 10 μm is formed on the electrode film 292 in the groove portion 382 using, for example, a pattern plating process. The magnetic member layer 301 may be formed from a material having high permeability other than NiFe. Next, as shown in FIGS. 48A and 48B, the resist layer 354 is etched away.

Figure 49A:
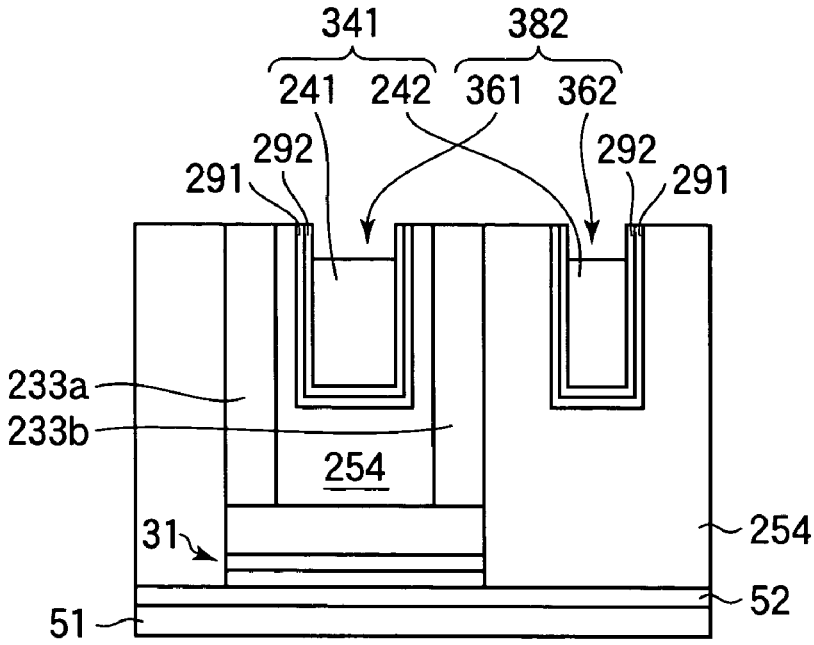
FIGS. 49A and 49B show the method of manufacturing the common mode choke coil 201 according to the second embodiment of the invention.
Figure 49B:
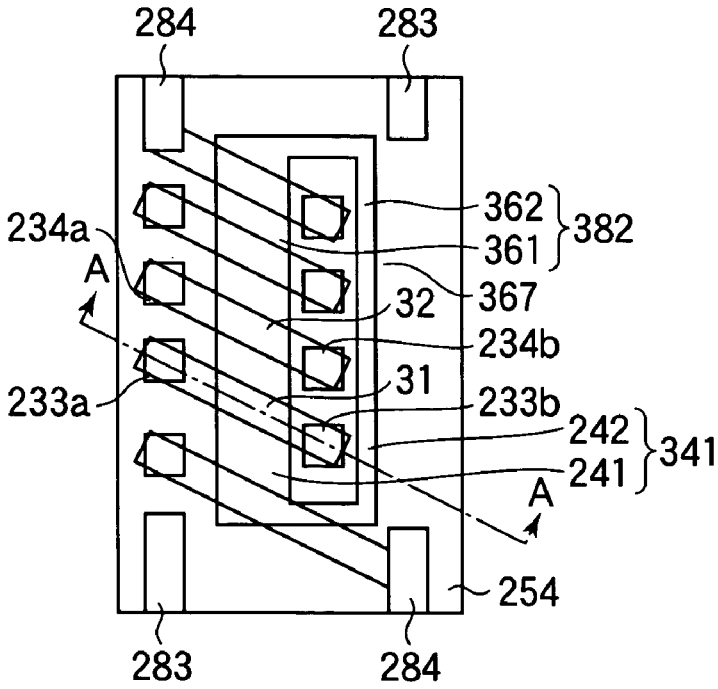

As shown in FIGS. 49A and 49B, dry etching is then performed to remove the electrode film 292 which has been exposed as a result of the removal of the resist layer 354 and to remove the electrode film 291 located under the electrode film 292. When the electrode films 291 and 292 are removed, the surface of the magnetic member layer 301 is also etched in an amount substantially equivalent to the thickness of the electrode films 291 and 292. However, since the magnetic member layer 301 is formed sufficiently thick compared to the electrode films 291 and 292, the layer is not completely removed as a result of the dry etching. Through the above-described steps, a core 241 constituted by the magnetic member layer 301 is formed in the groove portion 361, and a magnetic member part 242 having the same configuration as that of the core 241 and forming a closed magnetic path 341 in cooperation with the core 241 is also formed in the groove portion 362.

Figure 50A:
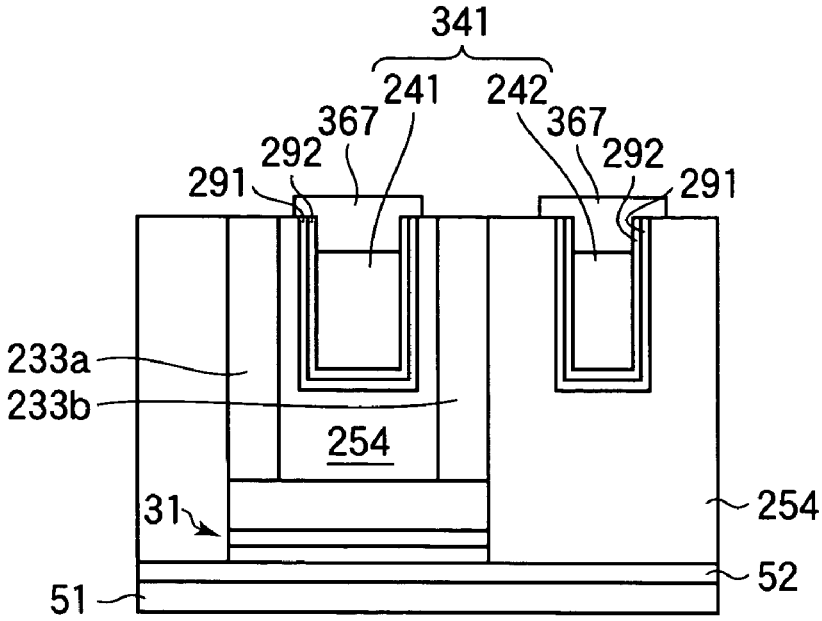
FIGS. 50A and 50B show the method of manufacturing the common mode choke coil 201 according to the second embodiment of the invention.
Figure 50B:
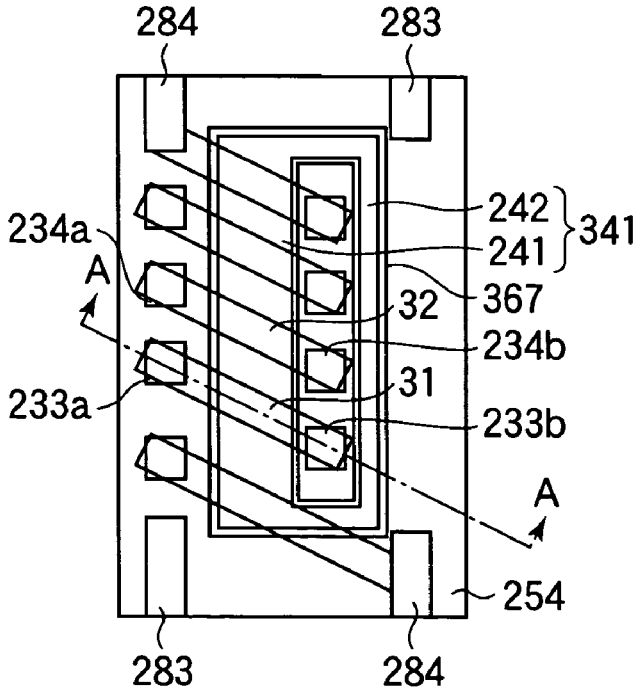
Figure 51A:
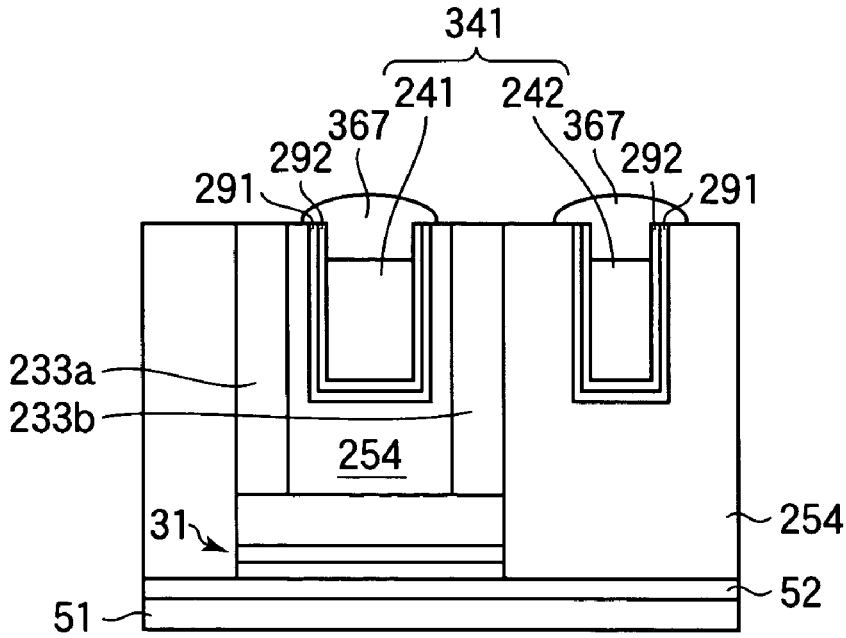
FIGS. 51A and 51B show the method of manufacturing the common mode choke coil 201 according to the second embodiment of the invention.
Figure 51B:
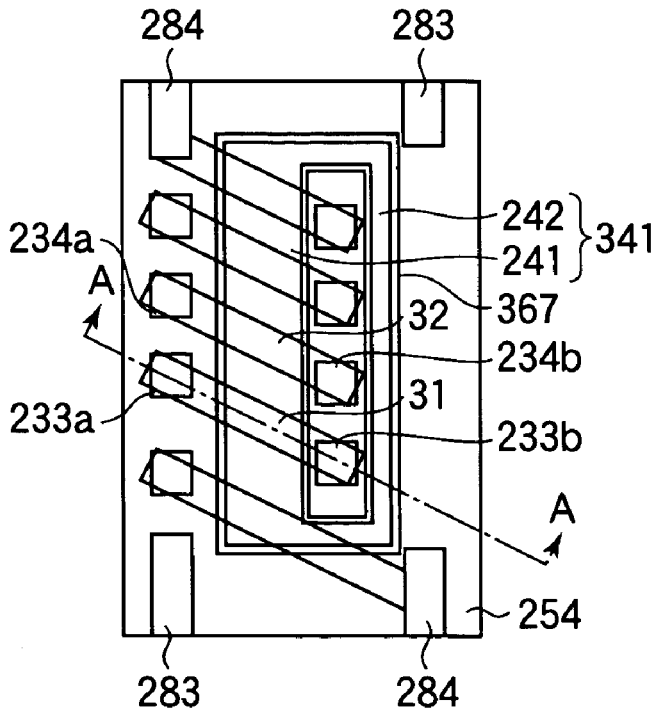

A resist is then applied throughout the surface to form a resist layer having a thickness of about 5 μm. Next, as shown in FIGS. 50A and 50B, the resist layer is patterned to form a resist layer 367 in the from of a frame covering the closed magnetic path 341 and the electrode films 291 and 292 around the closed magnetic path 341. The resist layer 367 is formed as an organic insulation film for insulating the electrode films 291 and 292 and the closed magnetic path 341 from coil top parts 235 and 236 which will be described later. As shown in FIGS. 51A and 51B, the resist layer 367 is then cured by heat to improve the insulating properties thereof.

Figure 52A:
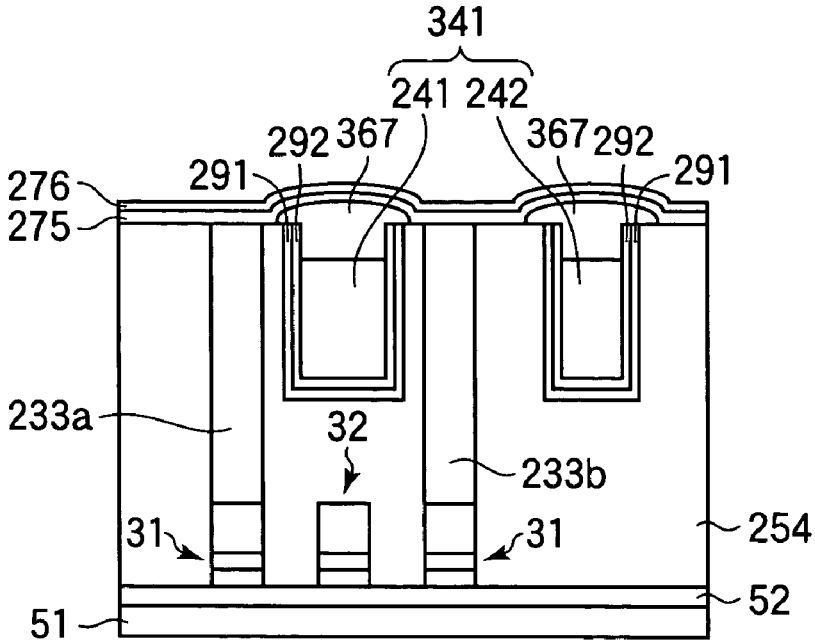
FIGS. 52A and 52B show the method of manufacturing the common mode choke coil 201 according to the second embodiment of the invention.
Figure 52B:
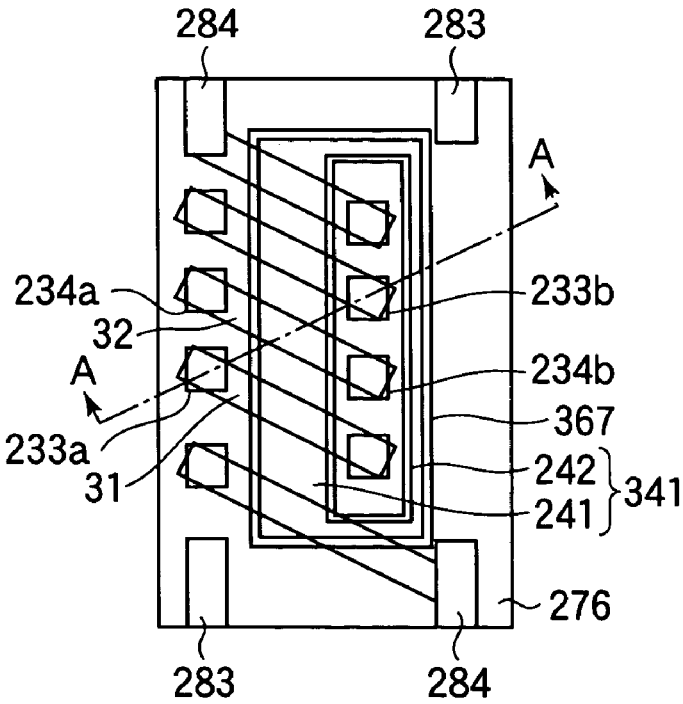

Next, as shown in FIGS. 52A and 52B, a Ti electrode film 275 having a thickness of about 10 nm is formed throughout the surface using a sputtering process, and a Cu electrode film (second intermediate electrode film) 276 having a thickness of about 100 nm is then formed on the electrode film 275 using a sputtering process. The electrode films 275 and 276 are electrically connected to the coil side parts 233*a*, 233*b*, 234*a*, and 234*b* and are insulated from the electrode films 291 and 292 and the closed magnetic path 341 by the resist layer 367.

Figure 53A:
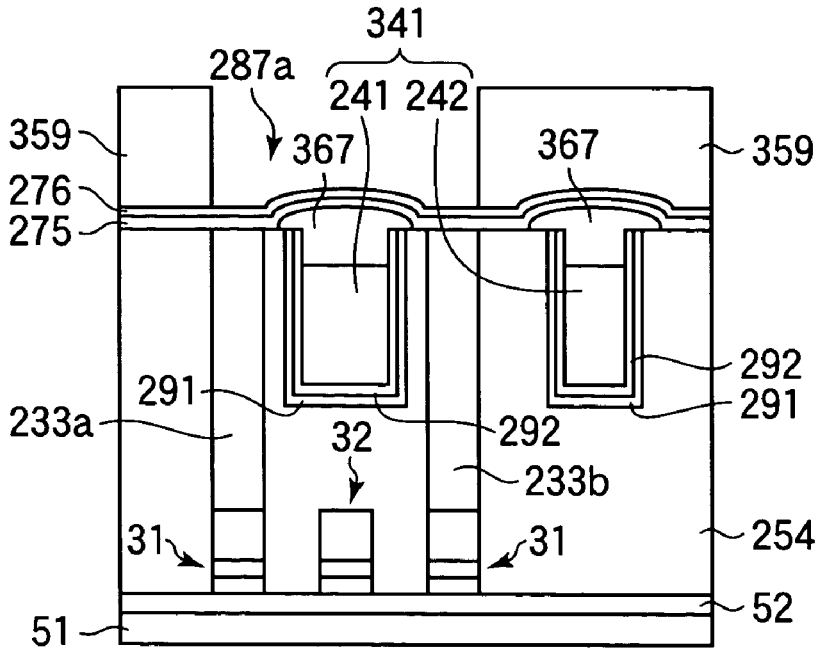
FIGS. 53A and 53B show the method of manufacturing the common mode choke coil 201 according to the second embodiment of the invention.
Figure 53B:
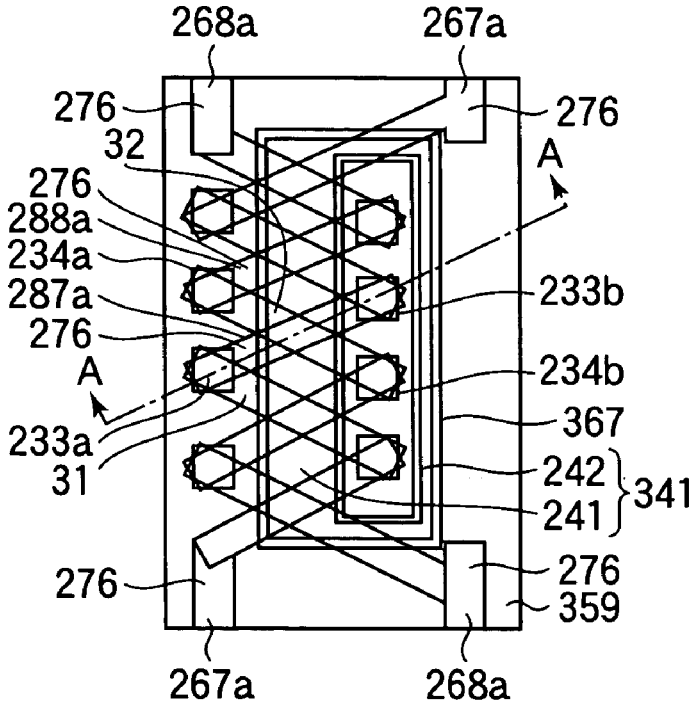

Next, a resist is applied to the electrode film 276 to form a resist layer (third resist layer) 359 having a thickness in the range from 10 to 15 μm. Next, as shown in FIGS. 53A and 53B, the resist layer 359 is patterned to form a plurality of openings (third openings) 287*a* and 288*a* for exposing the electrode film 276 in the form of elongate strips and to form openings 267*a* and 268*a* for exposing the electrode film 276 on the conductive layers 283 and 284 formed in the openings 263*a* and 264*a*. As a result, when the element forming surface is viewed in the normal direction thereof, the openings 287*a* and the openings 288*a* are alternately formed in parallel at substantially equal intervals, each opening 287*a* exposing the electrode film 276 on a coil side part 233*a* at one end thereof and exposing, at another end thereof, the electrode film 276 on the coil side part 233*b* disposed on a coil bottom part 31 extending adjacent to the coil bottom part 31 directly under the above-mentioned coil side part 233*a* so as to sandwich a coil bottom part 32 between them, each opening 288*a* exposing the electrode film 276 on a coil side part 234*a* at one end thereof and exposing, at another end thereof, the electrode film 276 on the coil side part 234*b* disposed on a coil bottom part 32 extending adjacent to the coil bottom part 32 directly under the above-mentioned coil side part 234*a* so as to sandwich a coil bottom part 31 between them. The openings 287*a* are formed to extend across the coil bottom parts 32 and to face the bottom parts with the core 241 sandwiched between them when the element forming region is viewed in the normal direction thereof. The openings 288*a* are formed to extend across the coil bottom parts 31 and to face the bottom parts with the core 241 sandwiched between them, when viewed in the same direction. The openings 287*a* disposed near the shorter sides of the element forming region are formed in connection with the respective openings 267*a* at one end thereof.

Figure 54A:
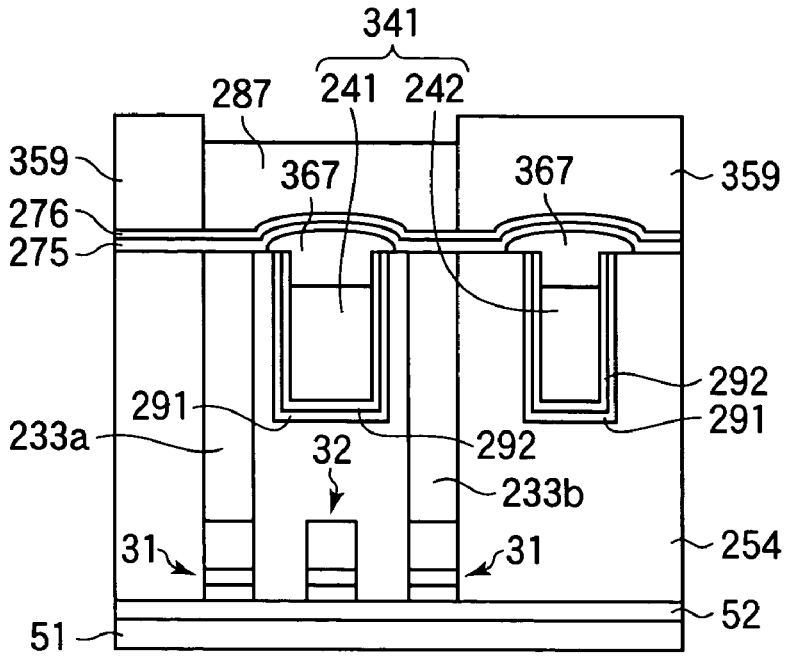
FIGS. 54A and 54B show the method of manufacturing the common mode choke coil 201 according to the second embodiment of the invention.
Figure 54B:
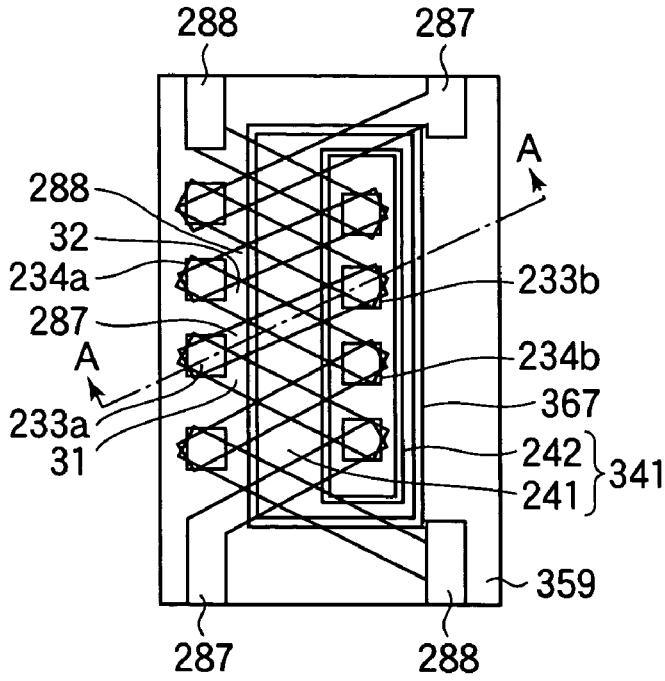
Figure 55A:
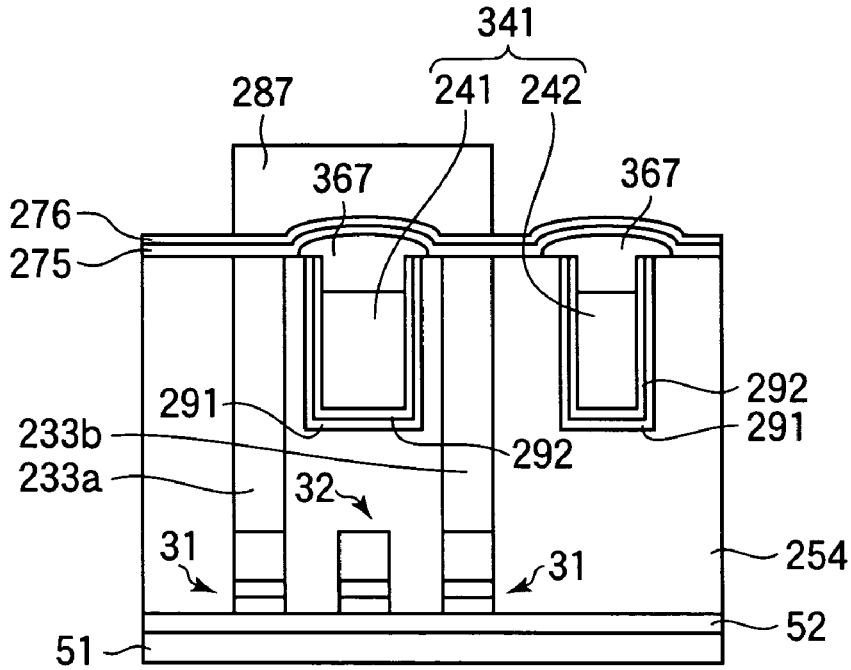
FIGS. 55A and 55B show the method of manufacturing the common mode choke coil 201 according to the second embodiment of the invention.
Figure 55B:
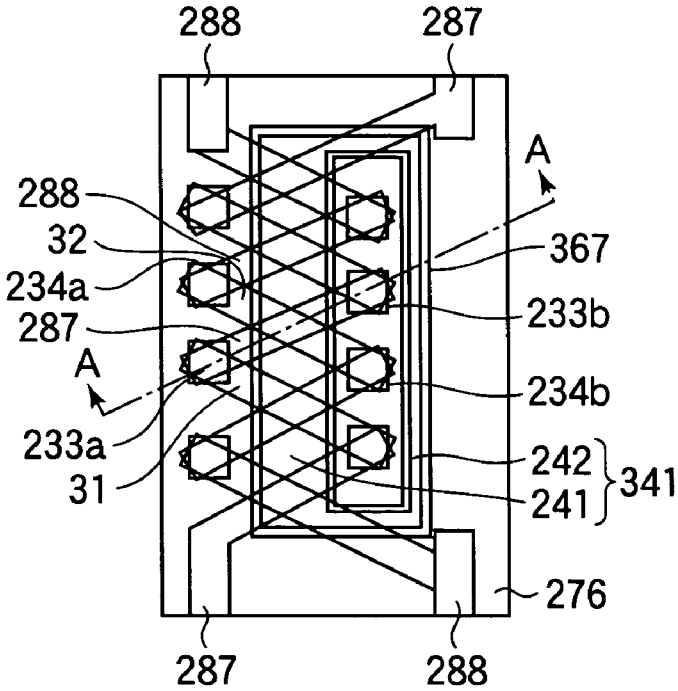
Figure 56A:
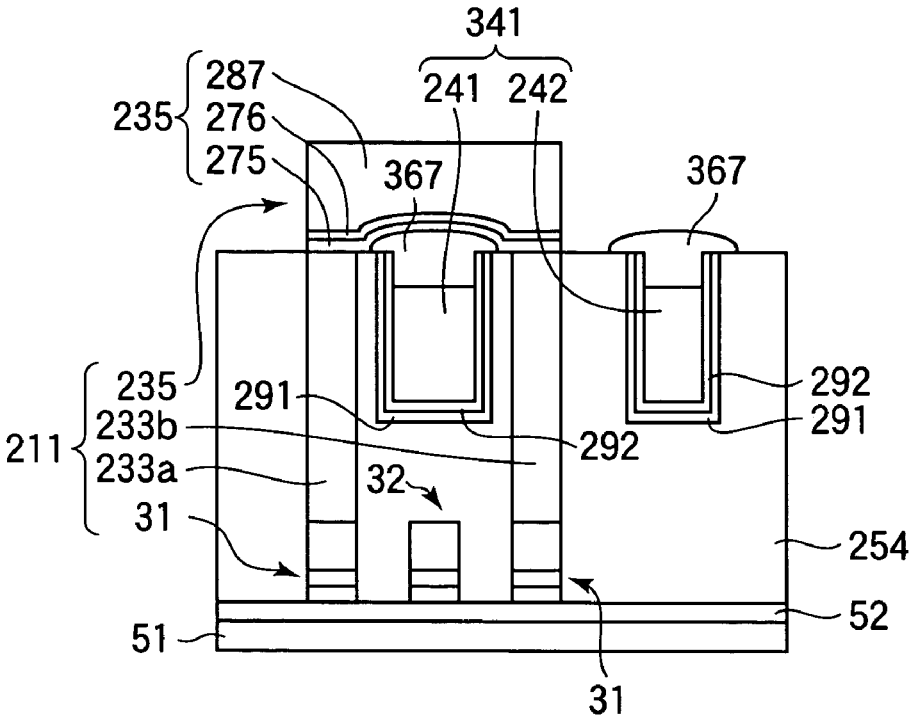
FIGS. 56A and 56B show the method of manufacturing the common mode choke coil 201 according to the second embodiment of the invention.
Figure 56B:
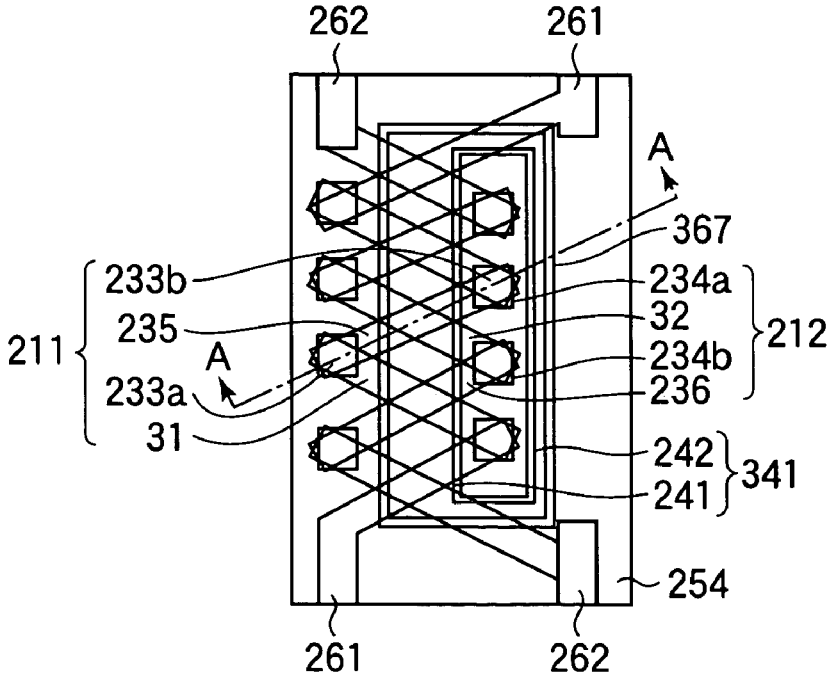

Next, as shown in FIGS. 54A and 54B, Cu conductive layers (third conductive layers) 287 having a thickness in the range from 7 to 10 μm are formed on the electrode film 276 in the openings 267*a* and 287*a*, and conductive layers (third conductive layers) 288 are formed from the same material to the same thickness on the electrode film 276 in the openings 268*a* and 288*a*. The conductive layers 287 and 288 are simultaneously formed using a pattern plating process and are each electrically connected to the electrode film 276. Next, as shown in FIGS. 55A and 55B, the resist layer 359 is etched away. Next, as shown in FIGS. 56A and 56B, the electrode film 276 which has been exposed as a result of the removal of the resist layer 359 and the electrode film 275 under the electrode film 276 are removed. Thus, coil top parts 235 having a multi-layer structure are provided by forming the electrode films 275 and 276 and the conductive layers 287 one over another, and coil top parts 236 having a multi-layer structure are provided by forming the electrode films 275 and 276 and the conductive layers 288 one over another.

Through the above-described steps, a first helical coil unit 211 is formed, which includes one coil having two turns each constituted by a coil bottom part 31, a coil side part 233*a*, a coil top part 235, and a coil side part 233*b*. At the same time, a second helical coil unit 212 is formed, which includes one coil having two turns each constituted by a coil bottom part 32, a coil side part 234*a*, a coil top part 236, and a coil side part 234*b*. The first and second helical coil units 211 and 212 are formed in a double spiral structure. External electrode connecting parts 261 having a multi-layer structure constituted by the conductive layers 81, 283, and 287 are simultaneously formed in the openings 61*a*, 263*a*, and 267*a*, and external electrode connecting parts 262 having a multi-layer structure constituted by the conductive layers 82, 284, and 288 are simultaneously formed in the openings 62*a*, 264*a*, and 268*a*.

The coil top parts 235 and 236 are alternately disposed in parallel. When the element forming region is viewed in the normal direction thereof, the coil top parts 235 are disposed to extend across the coil bottom parts 32 with the core 241 sandwiched between them, and the coil top parts 236 are disposed to extend across the coil bottom parts 31 with the core 241 sandwiched between them.

Figure 57A:
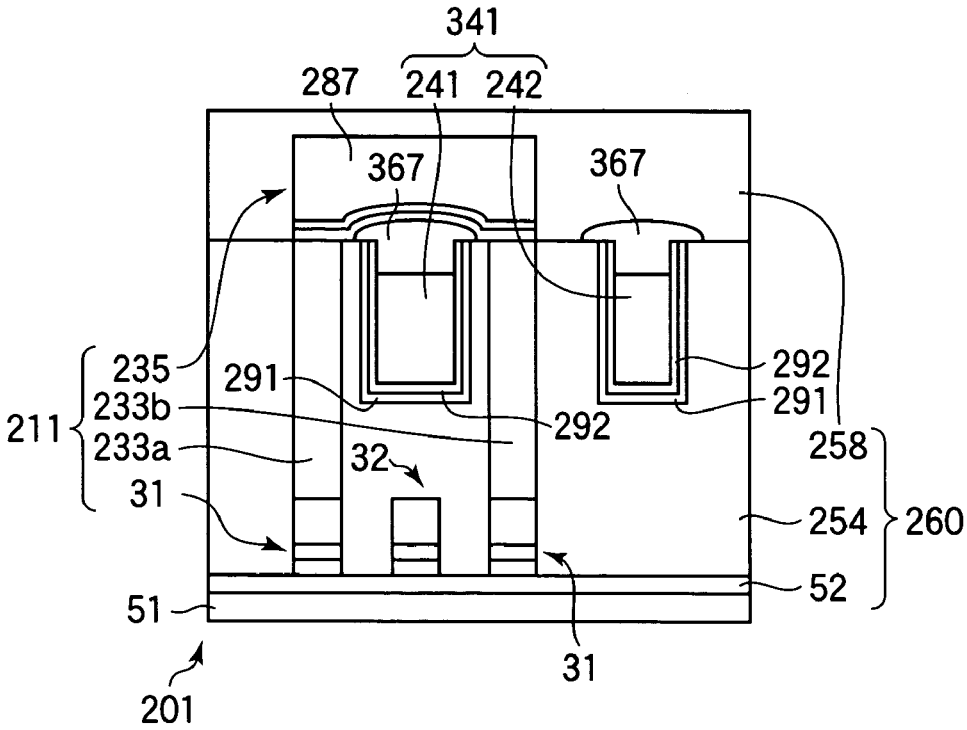
FIGS. 57A and 57B show the method of manufacturing the common mode choke coil 201 according to the second embodiment of the invention.
Figure 57B:
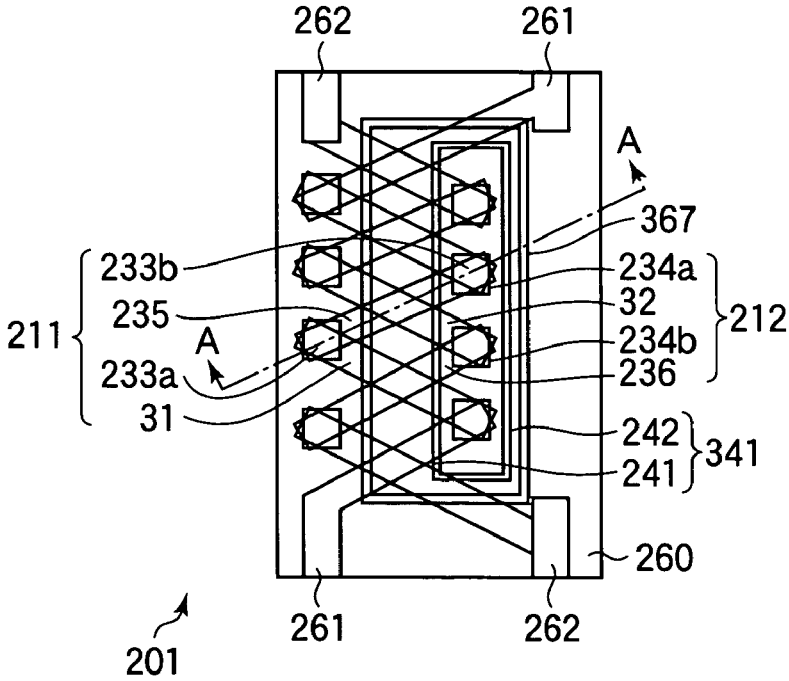

Next, as shown in FIGS. 57A and 57B, a film of alumina is formed throughout the surface using a sputtering process to provide an insulation layer 258 having a thickness of about 10 μm which is to serve as a protective film for the coil top parts 235 and 236. Referring to the material to form the insulation layer 258, an insulating material other than alumina may be used. Through the above-described steps, an insulation layer 60 having a multi-layer structure is provided by forming the insulation layers 52, 254, and 258 one over another. The first and second helical coil units 211 and 212 and the closed magnetic path 341 are enclosed in the insulation layer 60.

Next, the silicon path 51 is ground from the bottom thereof to achieve a desired thickness or to remove the substrate completely. The wafer is then cut along predetermined cutting lines to divide a plurality of the common mode choke coils 201 formed on the wafer into each element forming region in the form of a chip. The external electrode connecting parts 261 are partially exposed on an outer surface of the insulation layer 260. Although not shown, external electrodes are then formed on the cut surfaces in electrical connection with the external electrode connecting parts 261 and 262 exposed on the cut surfaces. Next, chamfering is performed on corners of the chip as occasion demands to complete a common mode choke coil 201.

As described above, according to the method of manufacturing a common mode choke coil according to the present embodiment, since the conductive layers 283 and 284 constituting the coil side parts are formed at one pattern plating step, the number of manufacturing steps can be smaller than that of the method of manufacturing a common mode choke coil of the first embodiment in which such conductive layers are formed at two pattern plating steps. It is therefore possible to achieve a reduction in the manufacturing cost of a common mode choke coil.

Third Embodiment

Figure 58:
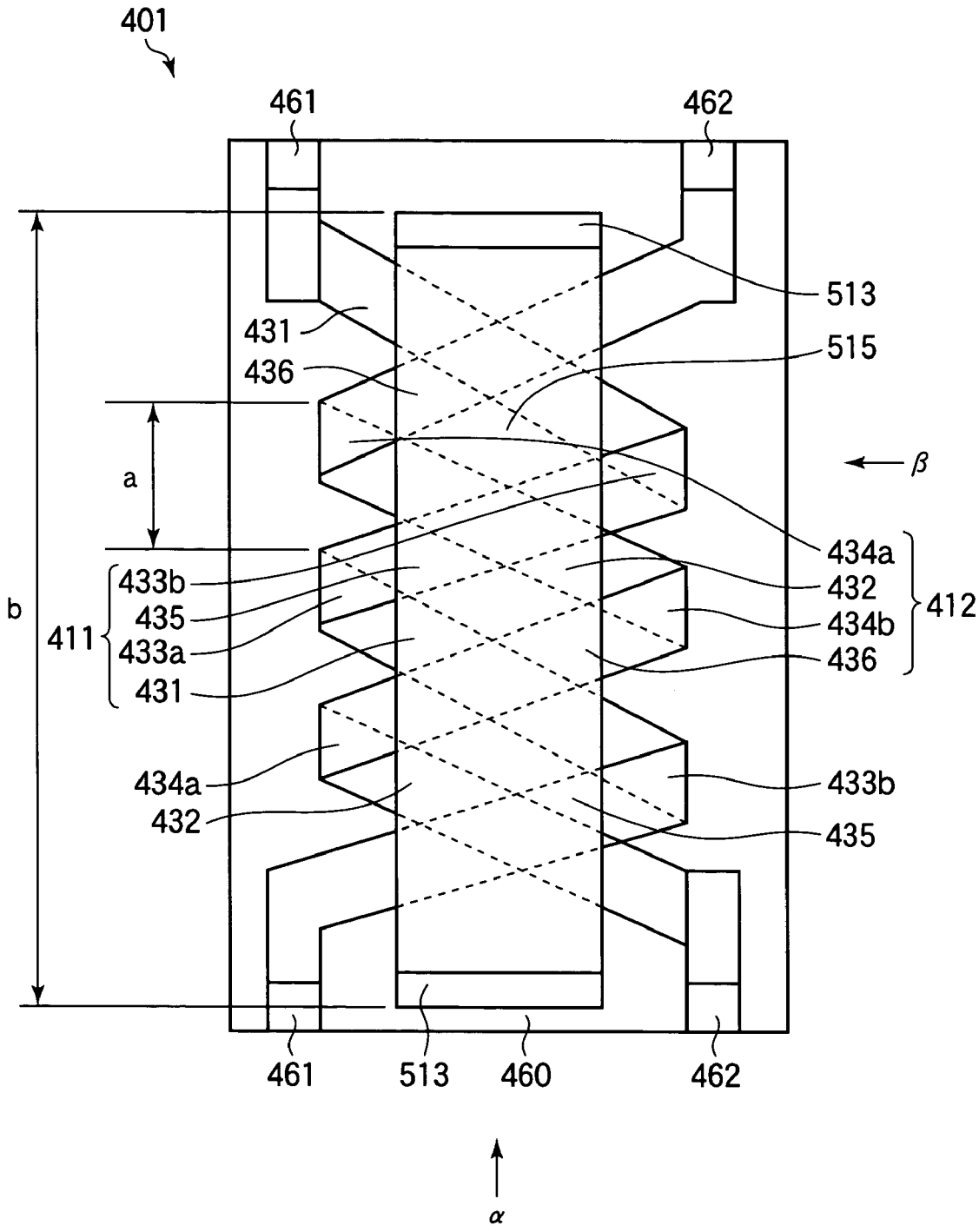
FIG. 58 is a plan view of a common mode choke coil 401 according to a third embodiment of the invention.
Figure 59:
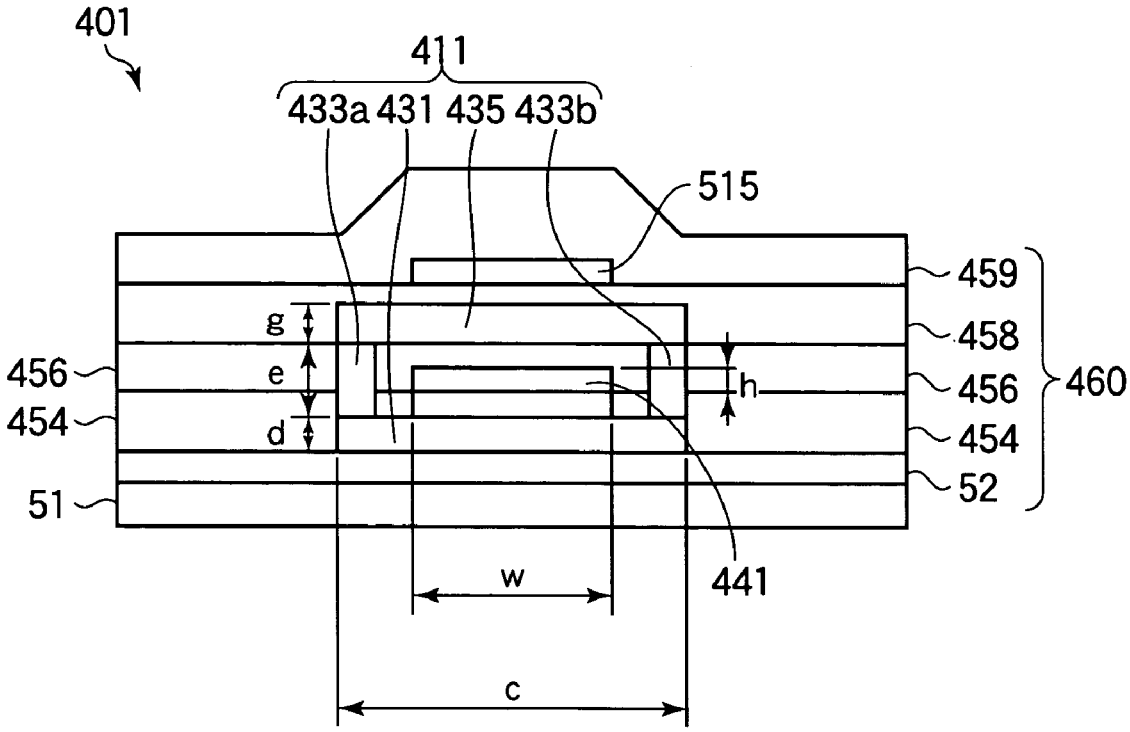
FIG. 59 is a front view of the common mode choke coil 401 according to the third embodiment of the invention.
Figure 60:
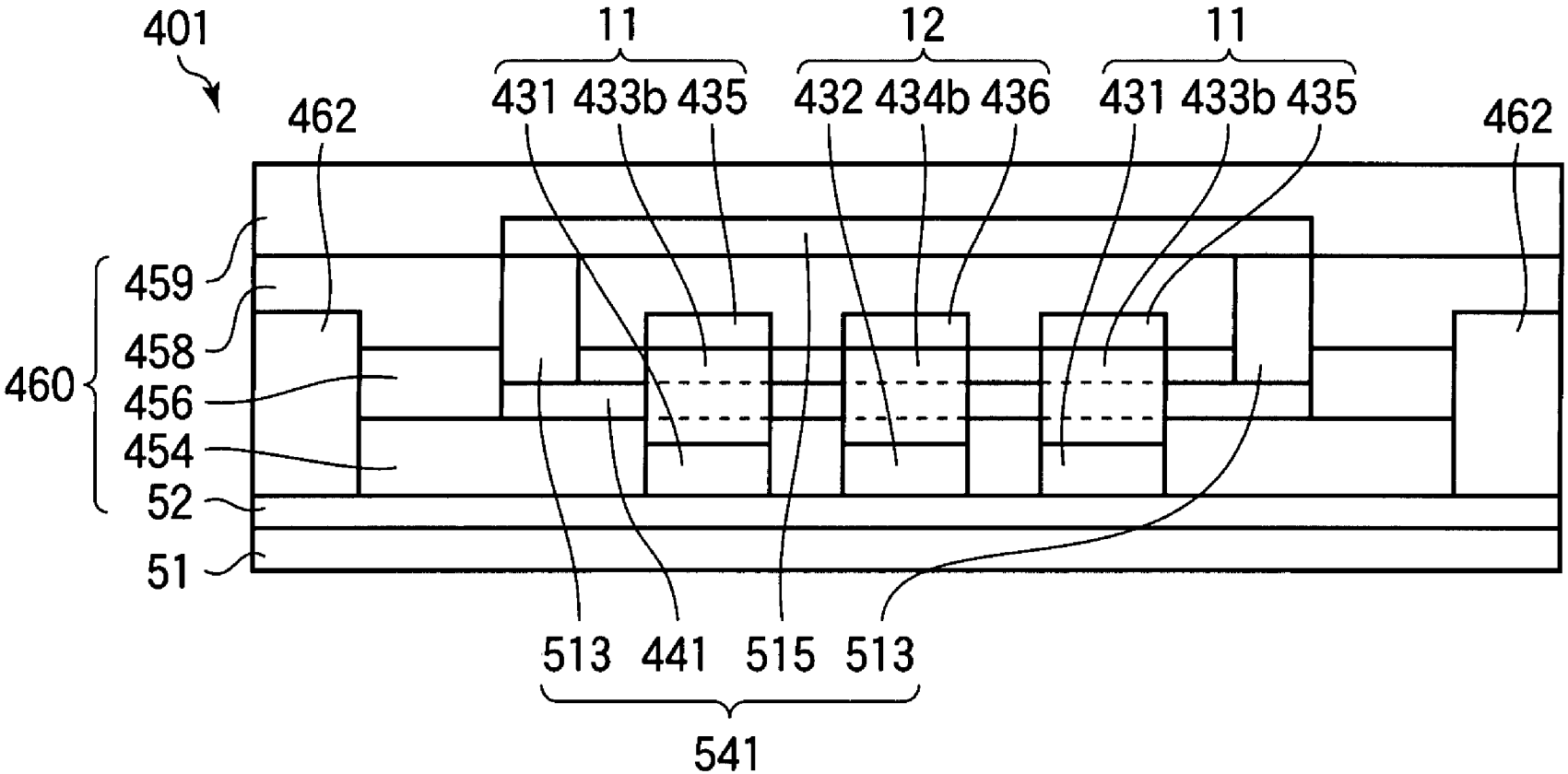
FIG. 60 is a side view of the common mode choke coil 401 according to the third embodiment of the invention.

A common mode choke coil and a method of manufacturing the same according to a third embodiment of the invention will now be described with reference to FIGS. 58 to 104C. First, a common mode choke coil 401 according to the present embodiment will be described with reference to FIGS. 58 to 60. FIG. 58 is a plan view of the common mode choke coil 401 of the present embodiment showing an internal structure of the same. FIG. 59 is a front view of the common mode choke coil 401 taken in the direction indicated by α in FIG. 58 to show the internal structure. For easier understanding, FIG. 59 shows a coil bottom part 431 and a coil top part 435 in one and the same plane, although they are not formed in one and the same plane in practice. FIG. 60 is a side view of the common mode choke coil 401 taken in the direction indicated by β in FIG. 58 to show the internal structure. In FIGS. 58 and 60, hidden outlines are represented by broken lines.

In comparison to the common mode choke coil 1 of the first embodiment, the common mode choke coil 401 of the present embodiment is characterized in that a closed magnetic path 541 is formed substantially orthogonally to a surface on which coil bottom parts 431 and 432 are formed.

As shown in FIGS. 58 to 60, the common mode choke coil 401 has a general outline in the form of a rectangular parallelepiped provided by forming an insulation layer 460, a first helical coil unit 411, a second helical coil unit 412, and a closed magnetic path 541 on a silicon path 51 made of a single-crystal silicon using a thin-film forming technique.

As shown in FIG. 60, the closed magnetic path 541 has an elongate frame-like shape when the common mode choke coil 401 is viewed from the side thereof, and it is formed in the insulation layer 460. The closed magnetic path 541 has a core 441 in the form of a rectangular parallelepiped which constitutes a bottom part of the closed magnetic path 541, closed magnetic path side parts 513 formed on both ends of the core 441, and a closed magnetic path top part 515 connected to the closed magnetic path side parts 513 at both ends thereof.

Each of the first and second helical coil units 411 and 412 is helically (spirally) wound around the core 441 and formed in the insulation layer 460. The first and second helical coil units 411 and 412 are formed such that their axes of spiral are substantially parallel to the substrate surface of the silicon substrate 51. The axes of spiral of the first and second helical coil units 411 and 412 substantially coincide with each other.

The first helical coil unit 411 includes one coil having n turns (two turns in FIG. 58), each turn being constituted by a coil bottom part 431, a coil side part 433*a*, a coil top part 435, and a coil side part 433*b* which are each formed, for example, like a rectangular parallelepiped. Similarly, the second helical coil unit 412 includes one coil having n turns (two turns in FIG. 58), each turn being constituted by a coil bottom part 432, a coil side part 434*a*, a coil top part 436, and a coil side part 434*b* which are each formed, for example, like a rectangular parallelepiped. The coil bottom parts 431 and the coil bottom parts 432 are alternately disposed at equal intervals under the core 441 (on the side of the silicon substrate 51), and the coil top parts 435 and the coil top parts 436 are alternately disposed at equal intervals between the core 441 and the closed magnetic path top part 515.

For example, an interval a between one turn of the first helical coil unit 411 and one turn of the second helical coil unit 412 adjacent to the one turn of the coil is in the range from 10 to 50 μm. For example, the first and second helical coil units 411 and 412 are formed from Cu to provide the coils with a low resistance. As shown in FIG. 59, one turn of the coil of the first helical coil unit 411 is formed in a rectangular shape when viewed in the direction of the axis of spiral. An internal diameter e of the first helical coil unit 411 in a direction perpendicular to the substrate surface of the silicon path 51 is, for example, in the range from 5 to 30 μm. Similarly, one turn of the coil of the second helical coil unit 412 is formed in a rectangular shape. An inner diameter e of the second helical coil unit 412 in the direction perpendicular to the substrate surface of the silicon path 51 is, for example, in the range from 5 to 30 μm. The first and second helical coils 411 and 412 are formed to have a section of a constant size in a direction orthogonal to the direction of a current flowing through them.

As shown in FIGS. 58 and 59, the coil bottom parts 431 are formed as a plurality of elongate features whose longer sides have a length c, for example, in the range from 20 to 300 μm and which have a thickness d, for example, in the range from 2 to 10 μm. The coil bottom parts 431 are disposed in parallel on a bottom insulation layer 52 at equal intervals. The coil bottom parts 431 are disposed in parallel at a predetermined angle to the shorter sides of the silicon substrate 51.

A coil side part 433*a* having a height equal to the inner diameter e of the first helical coil unit 411 is formed on one end of a coil bottom part 431 (the left end in FIGS. 58 and 59) in the longitudinal direction of the coil bottom part 431, and a coil side part 433*b* having a height substantially equal to that of the coil side part 433*a* is formed on another end of the same (the right end in FIGS. 58 and 59).

A plurality of elongate coil top parts 435 having, for example, substantially the same shape as the coil bottom parts 431 (having a length c in the range from 20 to 300 μm along the longer sides thereof and a thickness g in the range from 2 to 10 μm) are disposed in parallel at equal intervals on the coil side parts 433*a* and 433*b*. As shown in FIG. 58, one end of a coil top part 435 is electrically connected to a coil side part 433*a*, and another end of the top coil part 435 is electrically connected to a coil side part 433*b* formed on one end of a coil bottom part 431 which extends adjacent to the coil bottom part 431 directly under the above-mentioned coil side part 433*a* so as to sandwich a coil bottom part 432 between them.

The coil bottom parts 432 are disposed between the coil bottom parts 431 substantially in parallel with the coil bottom parts 431. The coil bottom parts 432 are formed from the same material and in the same shape as the coil bottom parts 431 at the same time using the same method of formation. A coil side part 434*a* is formed on one end of a coil bottom part 432 (the left end in FIGS. 58 and 59) in the longitudinal direction of the same, and a coil side part 434*b* is formed on another end of the part 432 (the right end in FIGS. 58 and 59). The coil side parts 434*a* and 434*b* are formed from the same material and in the same shape as the coil side parts 433*a* and 433*b* at the same time using the same method of formation. The coil side parts 434*a* are disposed at equal intervals on a straight line so as to alternate with the coil side parts 433*a*, and the coil side parts 434*b* are disposed at equal intervals on a straight line so as to alternate with the coil side parts 433*b*.

A plurality of elongate coil top parts 436 is disposed in parallel at equal intervals on the coil side parts 434*a* and 434*b*. The coil top parts 436 are disposed between the coil top parts 435 substantially in parallel with the coil top parts 435. The coil top parts 436 are formed from the same material and in the same shape as the coil top parts 435 at the same time using the same method of formation. As shown in FIG. 58, one end of a coil top part 436 is electrically connected to a coil side part 434*a*, and another end of the top coil part 436 is electrically connected to a coil side part 434*b* formed on one end of a coil bottom part 432 which extends adjacent to the coil bottom part 432 directly under the above-mentioned coil side part 434*a* so as to sandwich a coil bottom part 431 between them. As shown in FIG. 58, when the substrate surface of the silicon path 51 is viewed in the normal direction thereof, the coil top parts 435 extend across the coil bottom parts 432 at a predetermined angle to them, and the coil top parts 436 extend across the coil bottom parts 431 at a predetermined angle to them.

As shown in FIGS. 58 to 60, the core 441 is disposed to extend through the first and second helical coil units 411 and 412 on the side of the inner circumferences of the coils, the core 441 being in the form of a rectangular parallelepiped having, for example, an overall length b in the range from 100 to 300 μm, a width w in the range from 10 to 200 μm, and a thickness h in the range from 5 to 10 μm. The core 441 is formed to extend substantially coaxially with the axes of spiral of the first and second helical coil units 411 and 412. The core 441 extends across the coil bottom parts 431 and 432 and the coil top parts 435 and 436 at a predetermined angle to them when the substrate surface of the silicon path 51 is viewed in the normal direction thereof. The core 441 is formed from a material having high permeability such as NiFe. Since the core 441 is formed from a material having high permeability, the common mode choke coil 401 has a high inductance value, and it can therefore be provided with improved electrical characteristics such as impedance characteristics.

As shown in FIGS. 58 and 60, each of the two closed magnetic path side parts 513 is formed like a rectangular parallelepiped, and they are disposed opposite to each other outside the first and second helical coil units 411 and 412. The closed magnetic path top part 515 formed in substantially the same shape as that of the core 441 is stretched between the two closed magnetic path side parts 513 and disposed to face the core 441.

The closed magnetic path side parts 513 and the closed magnetic path top part 515 are formed from the same material as the core 441, and they cooperate with the core 441 to form an annular closed magnetic path 541. The closed magnetic path 541 is formed substantially orthogonally to the surface on which the coil bottom parts 431 are formed. The coil side parts 433*a*, 433*b*, 434*a*, and 434*b* are disposed on both sides of the closed magnetic path 541 when the substrate surface of the silicon path 51 is viewed in the normal direction thereof. Since the closed magnetic path 541 is formed in an annular shape from a material having high permeability, the leakage of magnetic flux can be prevented.

As shown in FIG. 59, the insulation layer 460 is provided by forming the insulation layer (bottom insulation layer) 52, an insulation layer 454, an insulation layer 456, an insulation layer 458, and an insulation layer 459 one over another in the order listed on the silicon substrate 51. For example, each of the insulation layers 52, 454, 456, 458, and 459 is formed from alumina ($Al_2O_3$). The coil bottom parts 431 and 432 are formed on the insulation layer 52. The core 441 is formed on the insulation layer 454. The coil top parts 435 and 436 are formed on the insulation layer 456. The closed magnetic path top part 515 is formed on the insulation layer 458. As thus described, the common mode choke coil 401 has a multi-layer structure in which the features such as the core 441 and coil bottom parts 431 and the insulation layers 452 to 459 are formed one over another.

As shown in FIG. 58, each of two ends of the first helical coil unit 411 is electrically connected to an external electrode connecting part 461 in the form of a rectangular parallelepiped. Similarly, each of two ends of the second helical coil unit 412 is electrically connected to an external electrode connecting part 462 in the form of a rectangular parallelepiped. The external electrode connecting parts 461 and 462 are formed such that they are partially exposed on each of a pair of outer surfaces of the insulation layer 460 opposite to each other. Although not shown, external electrodes are formed on the sides of the common mode choke coil 401 so as to cover the exposed parts of the external electrode connecting parts 461 and 462. The common mode choke coil 401 is solder-mounted to a printed circuit board (PCB) using the external electrodes.

As described above, the common mode choke coil 401 of the present embodiment is similar to the common mode choke coil 1 of the first embodiment in that the first and second helical coil units 411 and 412 are formed such that their axes of spiral are substantially in parallel with the substrate surface of the silicon substrate 51. An increase in the number of turns of the coil therefore results in substantially no change in the thickness of the coil. Therefore, even if the common mode choke coil 401 has a great number of turns, it can be provided with a profile lower than that of a common mode choke coil whose axis of spiral is oriented perpendicularly to a substrate surface of a silicon path 51 thereof. Since the common mode choke coil 401 has helical coils, the coil 401 can be made smaller than a common mode choke coil having spiral coil extending in one plane even if it has a great number of turns. Further, since the closed magnetic path 541 is formed in a plane which is substantially orthogonal to the substrate surface of the silicon path 51, the mounting area of the common mode choke coil 401 can be smaller than that of the common mode choke coil 1.

A method of manufacturing a common mode choke coil 401 according to the present embodiment will now be described with reference to FIGS. 61A to 104C. While a multiplicity of common mode choke coils 401 are simultaneously formed on a wafer, FIGS. 61A to 104C show an element forming region of one common mode choke coil 401. FIGS. 61 to 104 having a suffix A are sectional views taken along lines A-A in FIGS. 61 to 104 having a suffix B. FIGS. 61 to 104 having a suffix B are plan views showing the method of manufacturing a common mode choke coil 401. FIG. 104C is a sectional view taken along a line B-B in FIG. 104B.

Figure 61A:
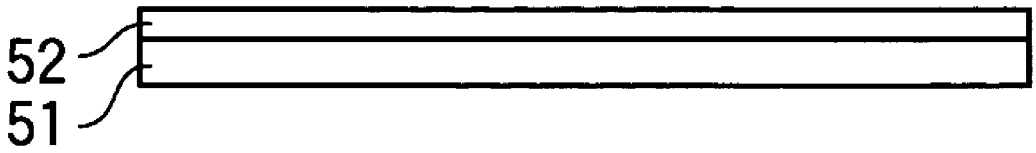
FIGS. 61A and 61B show a method of manufacturing the common mode choke coil 401 according to the third embodiment of the invention.
Figure 61B:
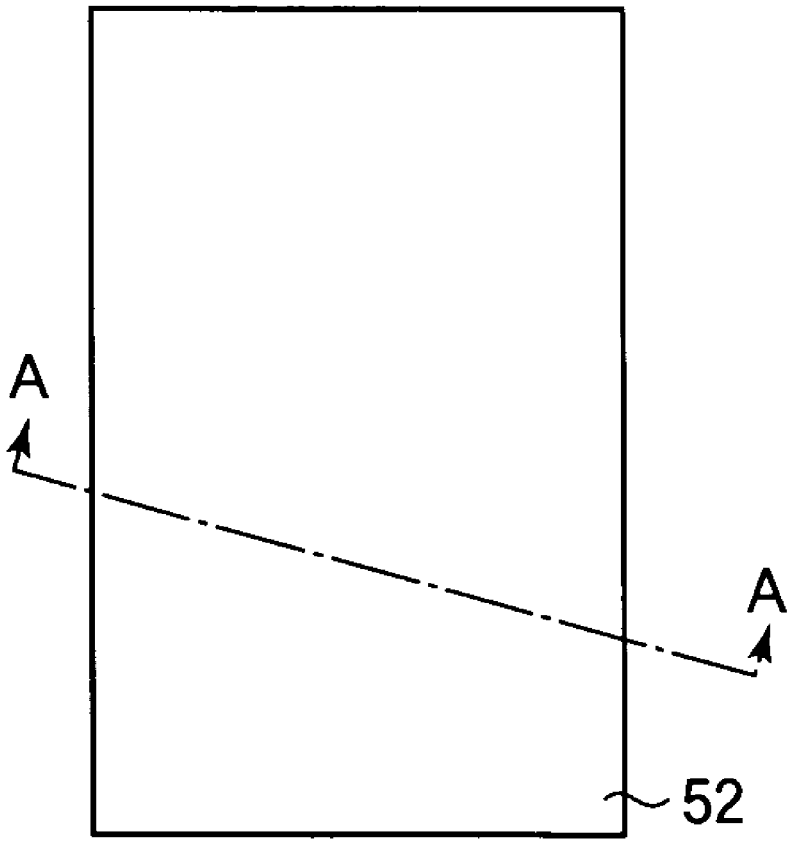

First, as shown in FIGS. 61A and 61B, a film of alumina ($Al_2O_3$) is formed on a silicon path 51 having a thickness of about 0.8 mm formed from a single-crystal silicon using, for example, a sputtering process to provide an insulation layer (bottom insulation layer) 52 having a thickness of about 3 μm. It is not required to form the insulation layer 52 when an insulated substrate having a sufficiently smooth surface is used. Although an organic insulating material may be used to form the insulation layer 52, alumina is preferred because it can easily form a planar surface compared to an organic insulating material. Each of insulation layers to be described later is formed using the same method as for the insulation layer 52.

Figure 62A:
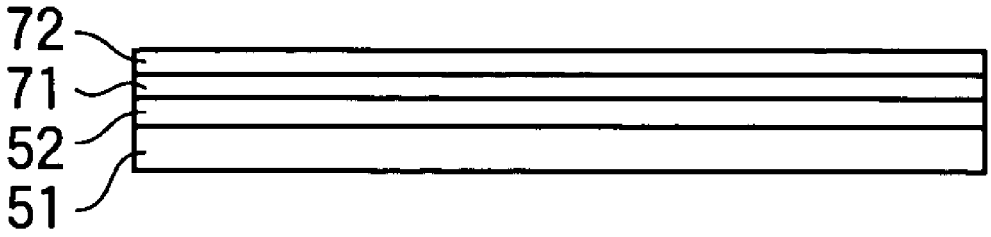
FIGS. 62A and 62B show the method of manufacturing the common mode choke coil 401 according to the third embodiment of the invention.
Figure 62B:
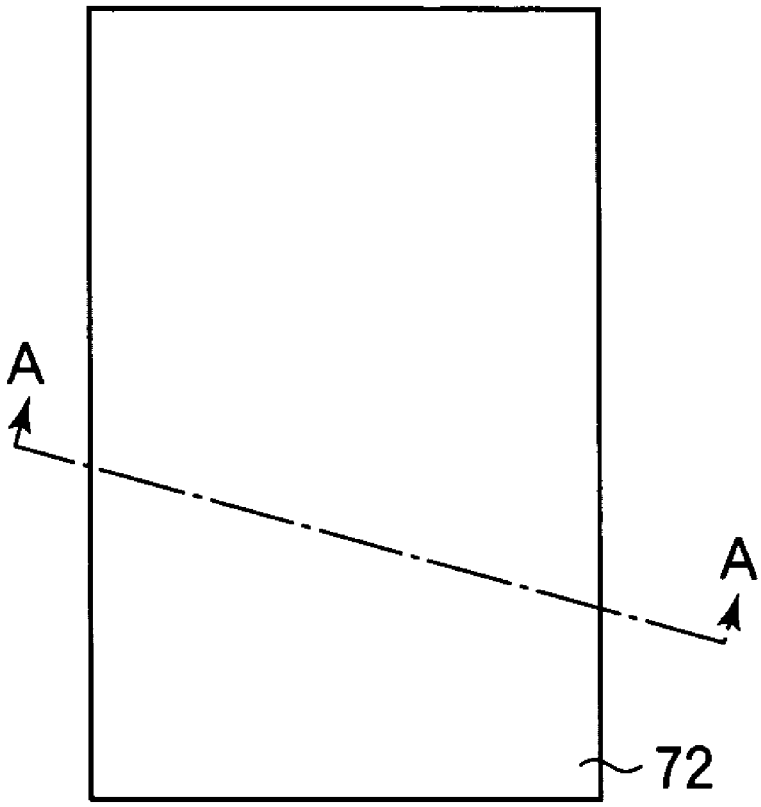

Next, as shown in FIG. 62A, a titanium (Ti) electrode film 71 having a thickness of about 10 nm is formed on the insulation layer 52 using, for example, a sputtering process. The electrode film 71 is used as a buffer film for improving adhesion of a Cu electrode film 72 which will be described later. The buffer film may be formed from other metal materials such as chromium (Cr). Next, as shown in FIGS. 62A and 62B, a Cu electrode film (first electrode film) 72 having a thickness of about 100 nm is formed on the electrode film 71 using, for example, a sputtering process. The electrode film 72 is used as an electrode film for plating the patterns of conductive layers 481 and 482 which will be described later. Each of electrode films to be described later is formed using the same method as for the electrode films 71 and 72.

Figure 63A:
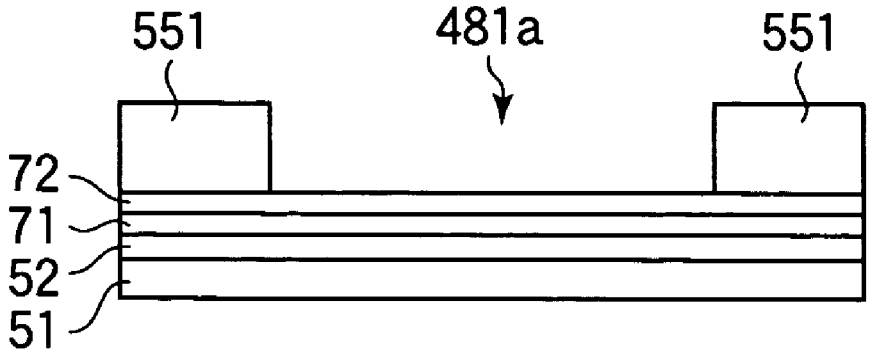
FIGS. 63A and 63B show the method of manufacturing the common mode choke coil 401 according to the third embodiment of the invention.
Figure 63B:
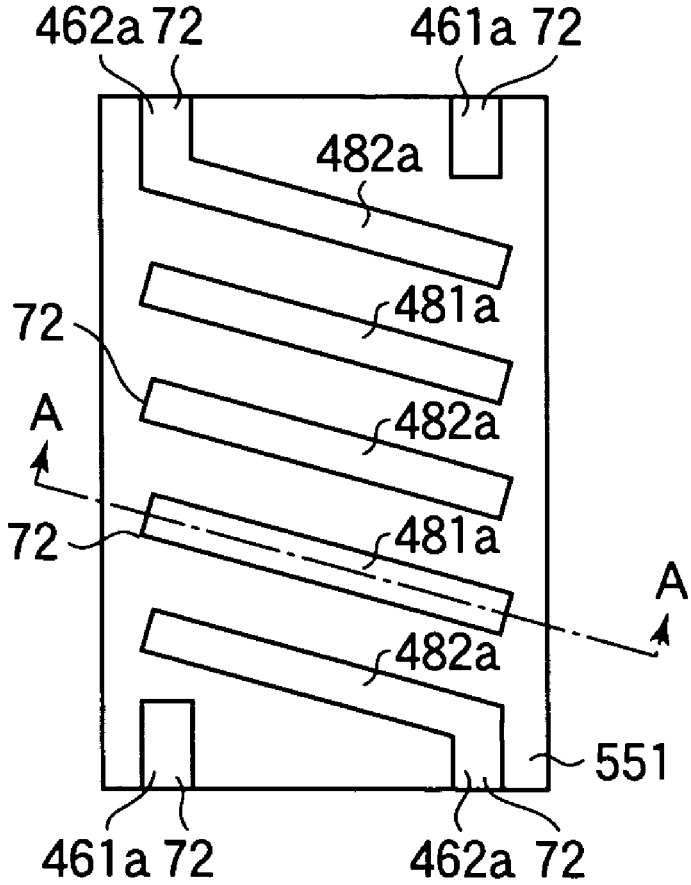

Next, a resist is applied to the electrode film 72 using, for example, a spin coat process to form a resist layer (first resist layer) 551 having a thickness in the range from 10 to 15 μm. Each of resist layers to be described later is formed using the same method as for the resist layer 551. Next, as shown in FIGS. 63A and 63B, the resist layer 551 is patterned to form openings 461*a* and 462*a* and openings (first openings) 481*a* and 482*a* for exposing the electrode film 72 in the resist layer 551. The openings 461*a* and 462*a* are formed in parallel on each of shorter sides of the element forming region in positions inside and near longer sides of the outer circumference of the region. A plurality of elongate openings 481*a* and 482*a* are alternately formed in parallel at substantially equal intervals. The openings 481*a* and 482*a* are formed at a predetermined angle to the shorter sides of the element forming region. The two openings 482*a* disposed near the shorter sides are formed such that they are connected to the openings 462*a* at one end thereof.

Figure 64A:
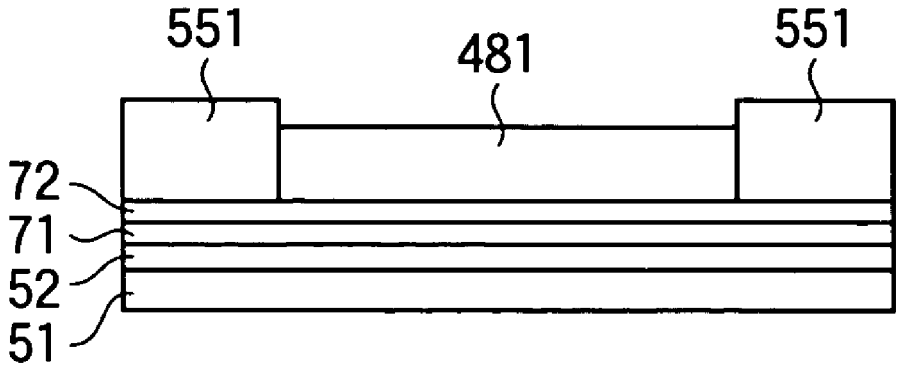
FIGS. 64A and 64B show the method of manufacturing the common mode choke coil 401 according to the third embodiment of the invention.
Figure 64B:
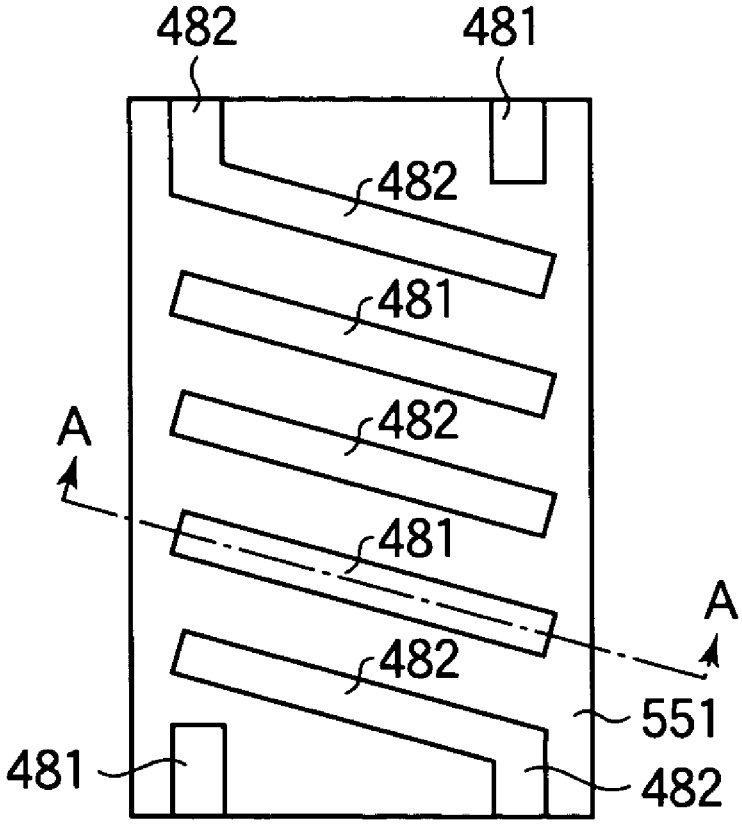
Figure 65A:
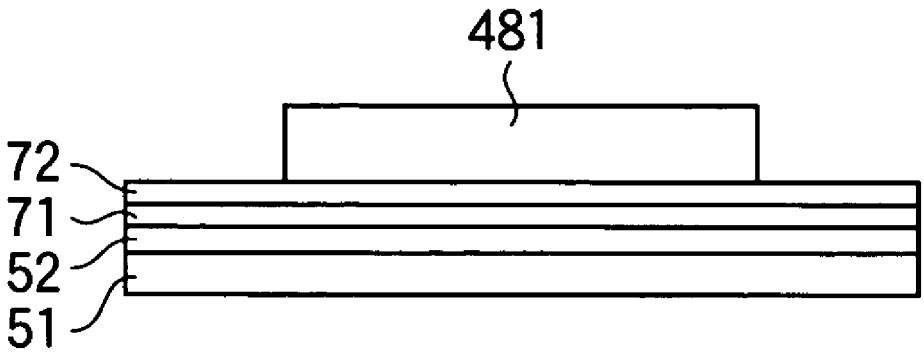
FIGS. 65A and 65B show the method of manufacturing the common mode choke coil 401 according to the third embodiment of the invention.
Figure 65B:
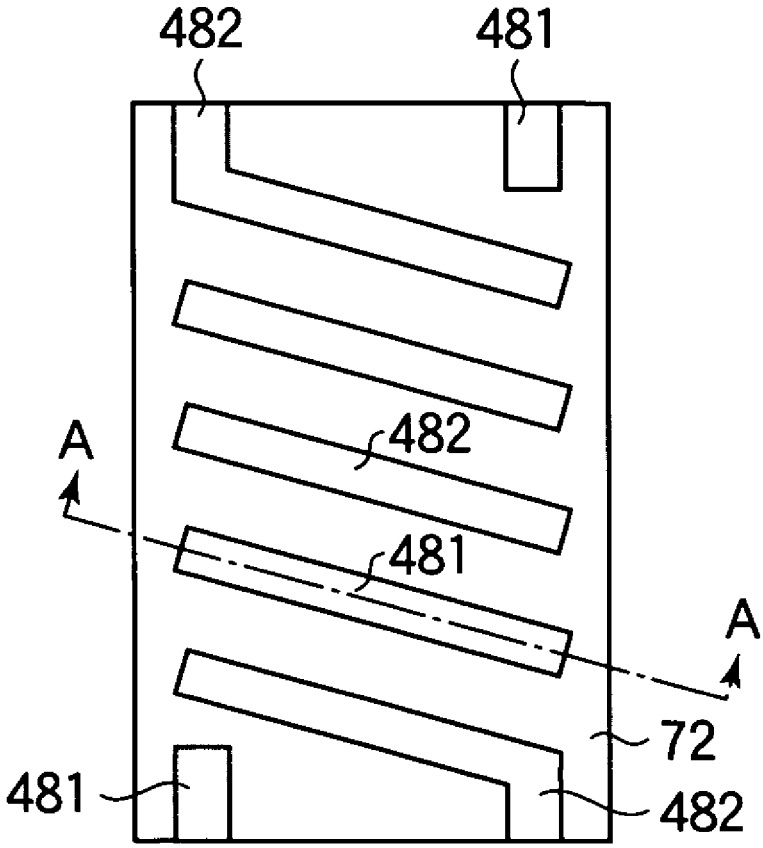

Next, as shown in FIGS. 64A and 64B, Cu electrode layers (first conductive layers) 481 having a thickness in the range from 7 to 10 μm are formed on the electrode film 72 in the openings 461*a* and 481*a*, and conductive layers (first conductive layers) 482 having the same thickness are formed from the same material on the electrode film 72 in the openings 462*a* and 482*a*. The conductive layers 481 and 482 are simultaneously formed using, for example, a pattern plating process and are each electrically connected to the electrode film 72 under the same. Cu is used to form the conductive layers 481 and 482 in order that first and second helical coil units 411 and 412 to be finally formed will have a low resistance. Each of Cu electrodes to be described later is formed and patterned using the same method as for the conductive layers 481 and 482. As shown in FIGS. 65A and 65B, the resist layer 551 is then etched away.

Figure 66A:
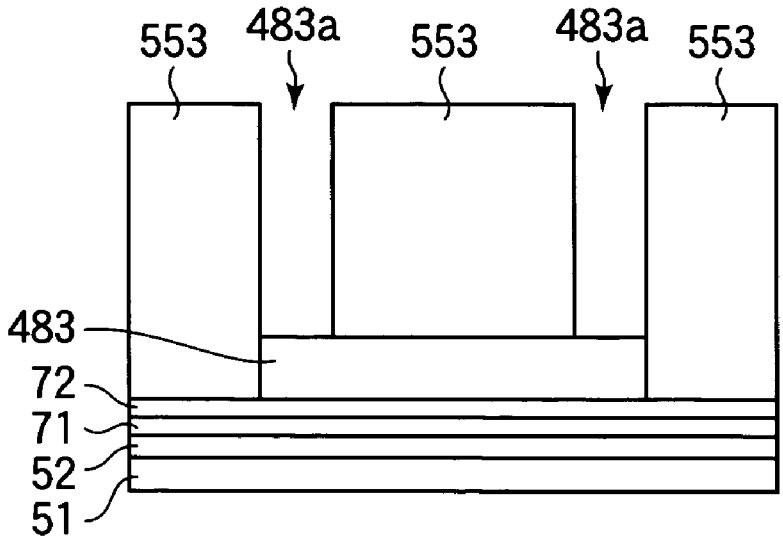
FIGS. 66A and 66B show the method of manufacturing the common mode choke coil 401 according to the third embodiment of the invention.
Figure 66B:
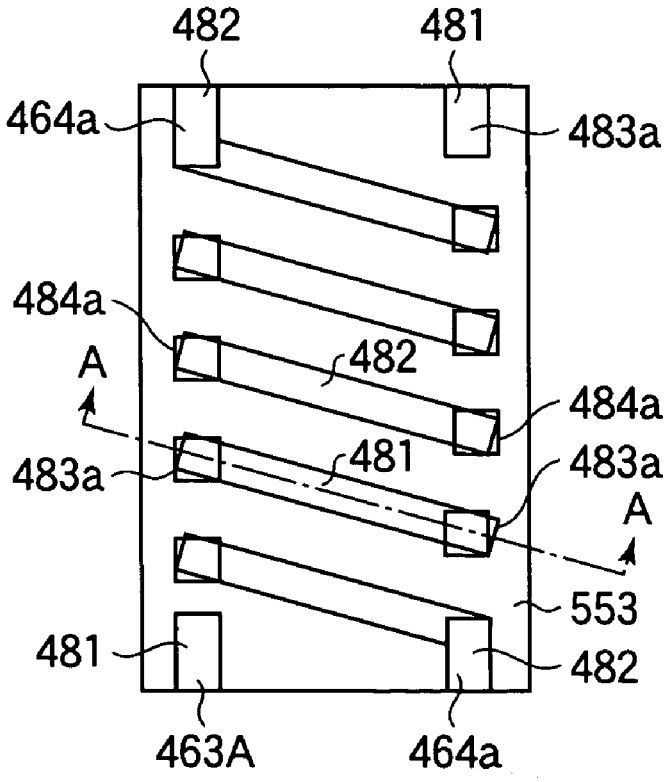
Figure 67A:
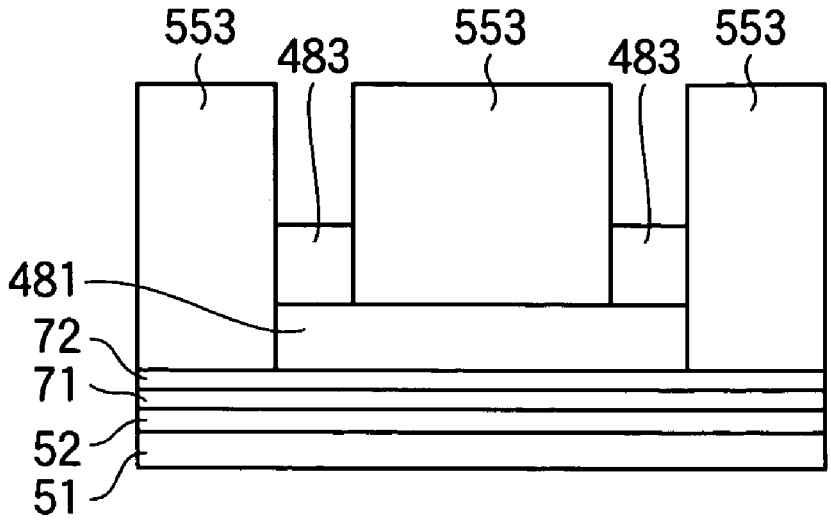
FIGS. 67A and 67B show the method of manufacturing the common mode choke coil 401 according to the third embodiment of the invention.
Figure 67B:
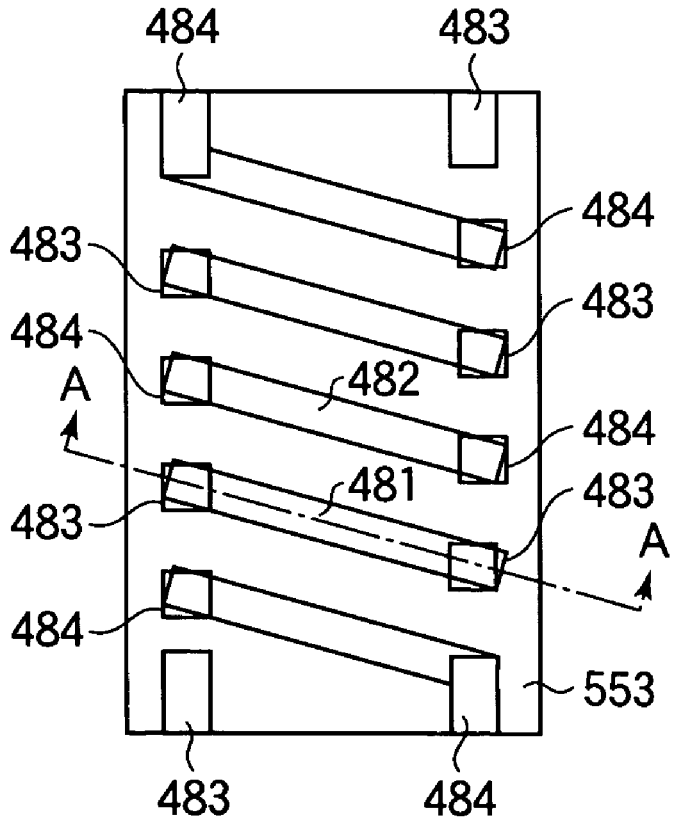

Next, a resist is applied throughout the resultant surface to form a resist layer (second resist layer) 553 having a thickness in the range from 15 to 20 μm. Next, as shown in FIGS. 66A and 66B, the resist layer 553 is patterned to form the resist layer 553 with a plurality of openings (second openings) 483*a* and 484*a* for exposing both ends of the conductive layers 481 and 482 formed in the openings 481*a* and 482*a* and openings 463*a* and 464*a* for exposing the conductive layers 481 and 482 formed in the openings 461*a* and 462*a*. As shown in FIG. 66B, the plurality of openings 483*a* and 484*a* formed above one end of the plurality of respective conductive layers 481 and 482 are alternately disposed on a straight line at equal intervals, and the plurality of openings 483*a* and 484*a* formed above another end of the respective layers are alternately disposed on a straight line at equal intervals. Next, as shown in FIGS. 67A and 67B, Cu conductive layers (second conductive layers) 483 having a thickness of about 3 μm are formed on the conductive layers 481 in the openings 463*a* and 483*a*, and conductive layers (second conductive layers) 484 are formed from the same material with the same thickness on the conductive layers 482 in the openings 464*a* and 484*a*. The conductive layers 483 and 484 are simultaneously formed using a pattern plating process. Thus, the conductive layers 483 are electrically connected to the conductive layers 481 located under the same, and the conductive layers 484 are electrically connected to the conductive layers 482 located under the same.

Figure 68A:
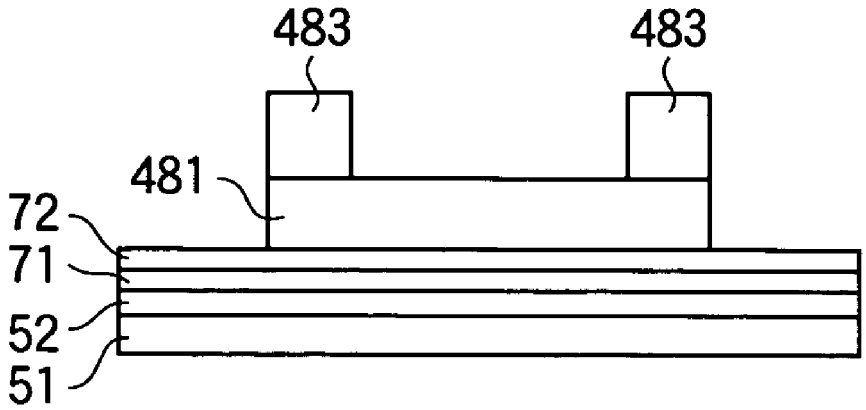
FIGS. 68A and 68B show the method of manufacturing the common mode choke coil 401 according to the third embodiment of the invention.
Figure 68B:
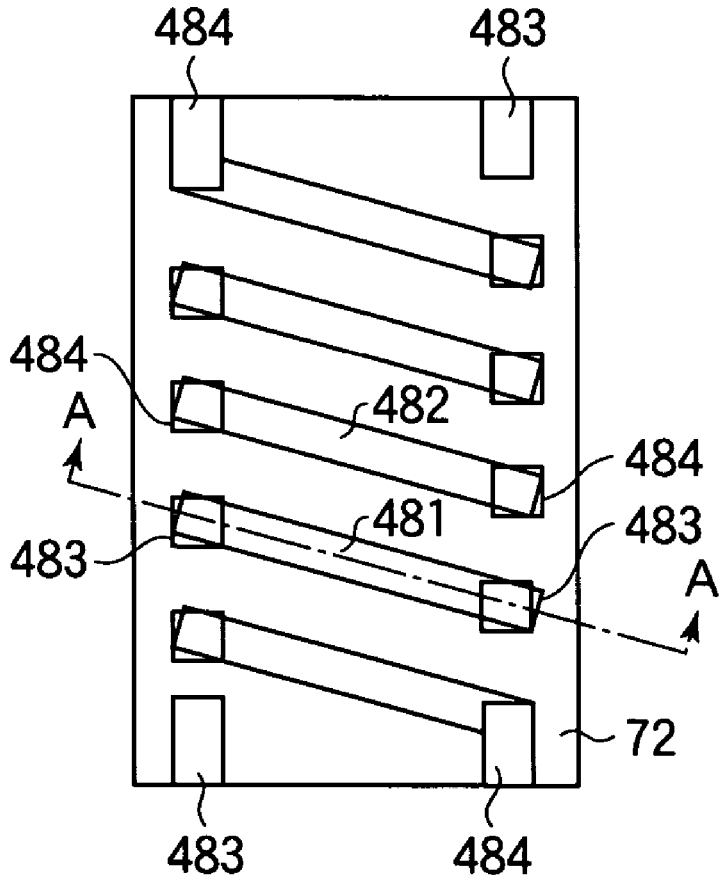
Figure 69A:
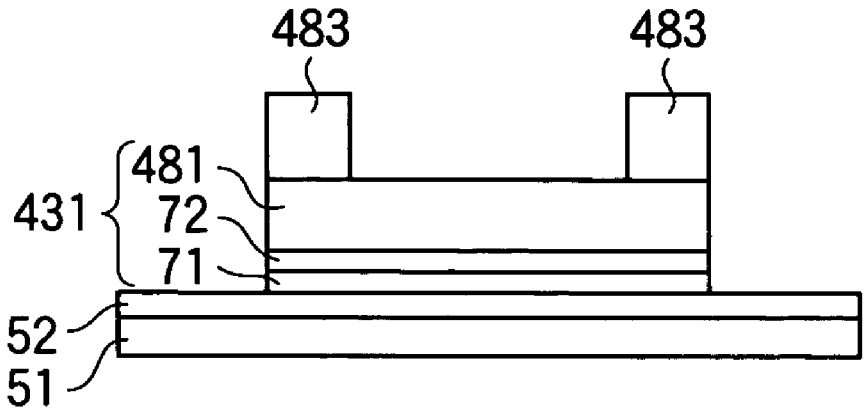
FIGS. 69A and 69B show the method of manufacturing the common mode choke coil 401 according to the third embodiment of the invention.
Figure 69B:
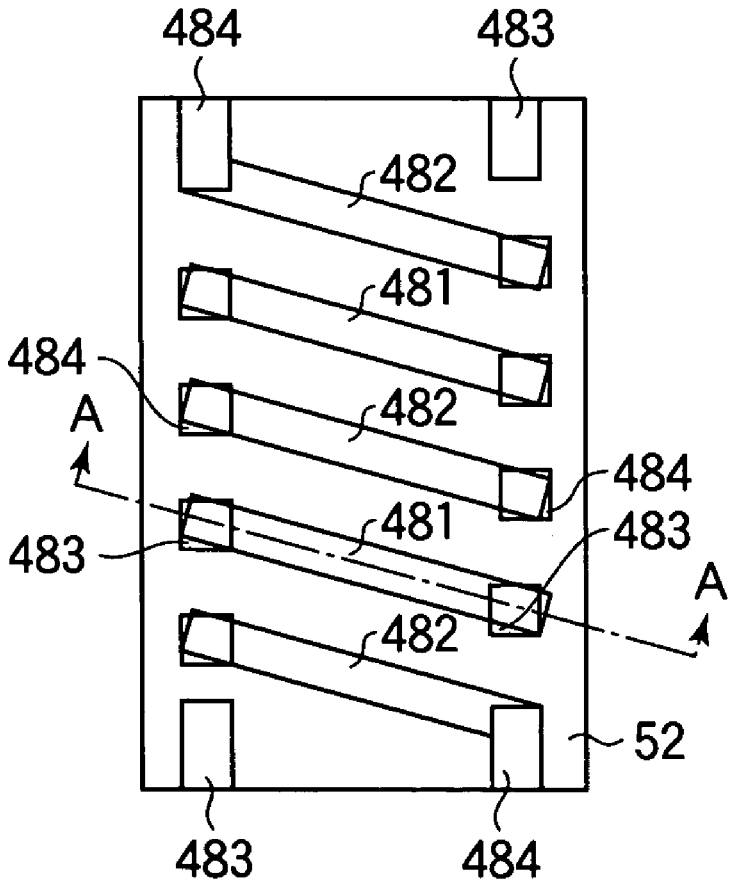

Next, as shown in FIGS. 68A and 68B, the resist layer 553 is etched away. As shown in FIGS. 69A and 69B, dry etching (milling) is then performed to remove the electrode film 72 which has been exposed as a result of the removal of the resist layer 553 and to remove the electrode film 71 located under the electrode film 72. When the electrode films 71 and 72 are removed, the surfaces of the conductive layers 481 to 484 are also etched in an amount substantially equivalent to the thickness of the electrode films 71 and 72. However, since the conductive layers 481 to 484 are formed sufficiently thick compared to the electrode films 71 and 72, the layers are not completely removed as a result of the dry etching. Each of electrode films to be described later is removed using the same method as for the electrode films 71 and 72. Through the above-described steps, coil bottom parts 431 having a multi-layer structure are provided by forming the electrode films 71 and 72 and the conductive layers 481 one over another, and coil bottom parts 432 having a multi-layer structure are provided by forming the electrode films 71 and 72 and the conductive layers 482 one over another. The coil bottom parts 431 and 432 are alternately formed in parallel on the silicon substrate 51.

Figure 70A:
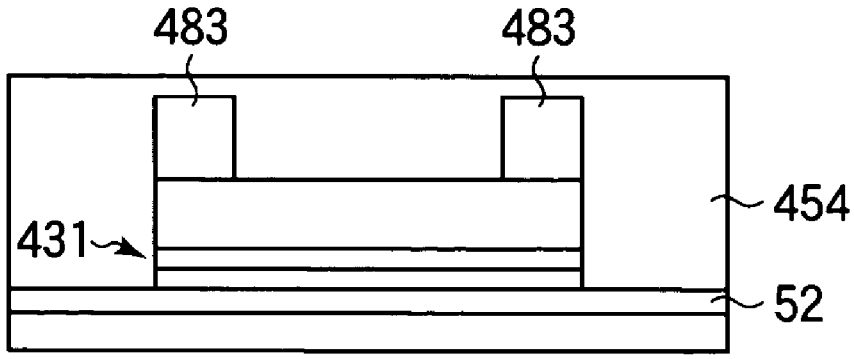
FIGS. 70A and 70B show the method of manufacturing the common mode choke coil 401 according to the third embodiment of the invention.
Figure 70B:
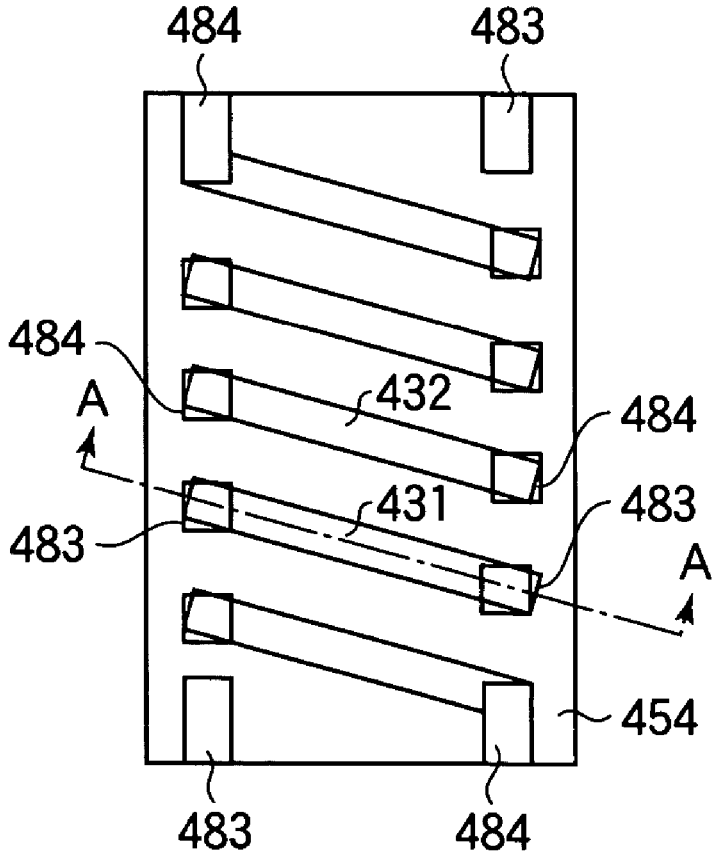
Figure 71A:
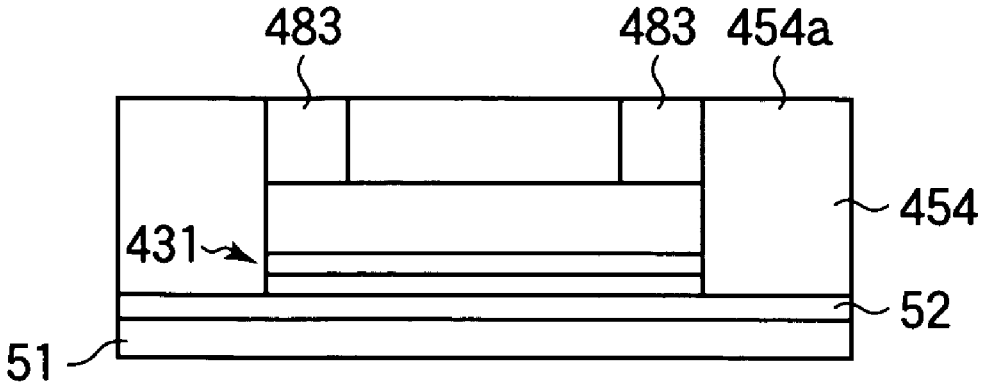
FIGS. 71A and 71B show the method of manufacturing the common mode choke coil 401 according to the third embodiment of the invention.
Figure 71B:
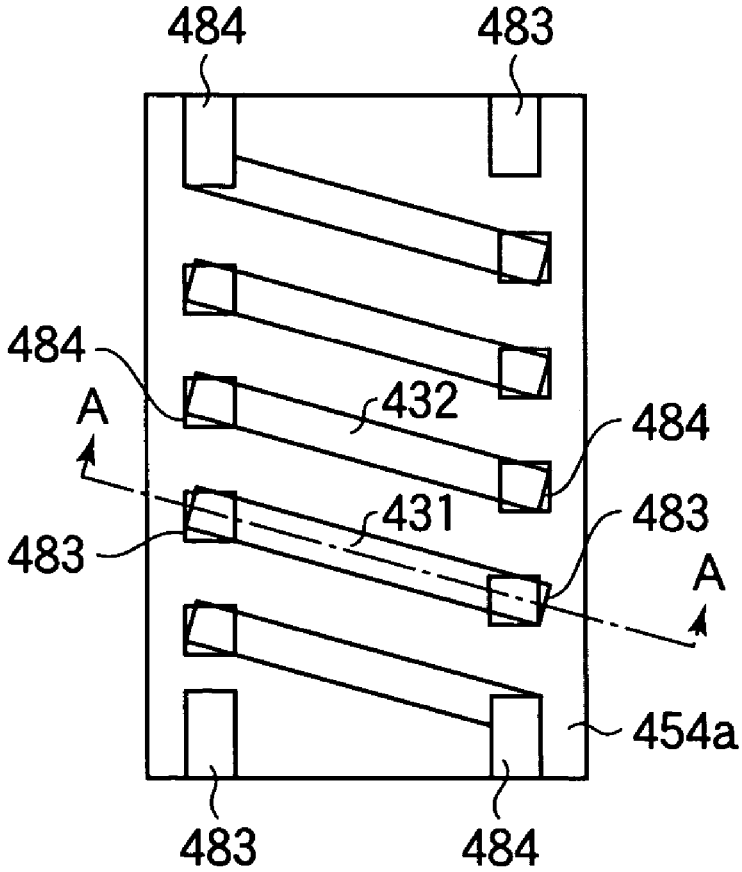

Next, as shown in FIGS. 70A and 70B, a film of alumina is formed throughout the resultant surface using a sputtering process to provide an insulation layer (first insulation layer) 454 having a thickness in the range from 10 to 13 μm. As shown in FIGS. 71A and 71B, a CMP (chemical mechanical polishing) process is then performed to polish the surface of the insulation layer 454 until the tops of the conductive layers 483 and 484 are exposed, whereby a planar surface (CMP surface) 454*a* is formed. Visual observation is conducted to check whether the conductive layers 483 and 484 have been exposed or not.

Figure 72A:
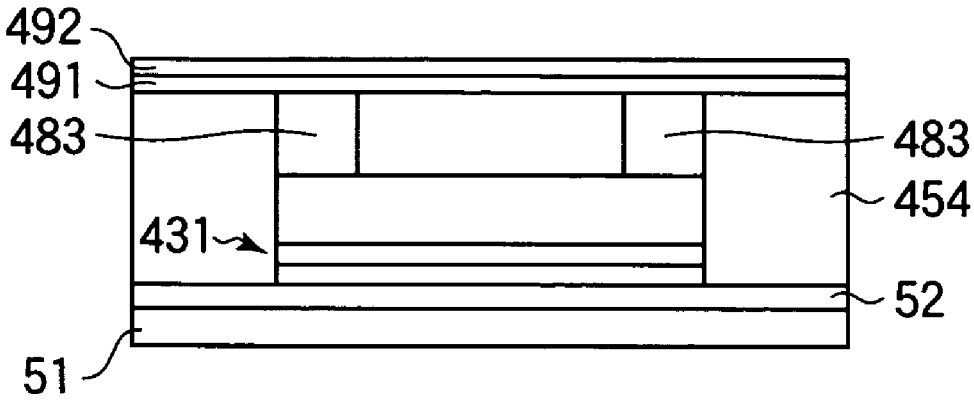
FIGS. 72A and 72B show the method of manufacturing the common mode choke coil 401 according to the third embodiment of the invention.
Figure 72B:
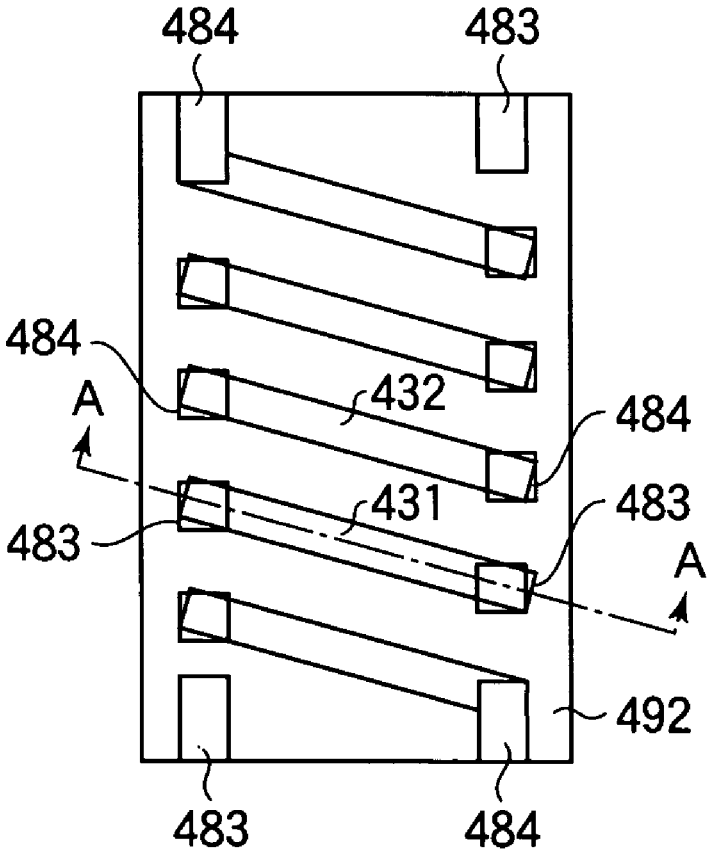

Next, as shown in FIGS. 72A and 72B, a Ti electrode film 491 having a thickness of about 10 nm is formed on the planar surface 454*a* of the insulation layer 454 using a sputtering process, and a NiFe electrode film (first intermediate electrode film) 492 having a thickness of about 100 nm is formed on the electrode film 491 using a sputtering process. Like the electrode film 71, the electrode film 491 is formed as a buffer film for improving the adhesion of the electrode film 492. The electrode film 492 is used as an electrode film for plating the pattern of a magnetic member layer 501 which will be described later.

Figure 73A:
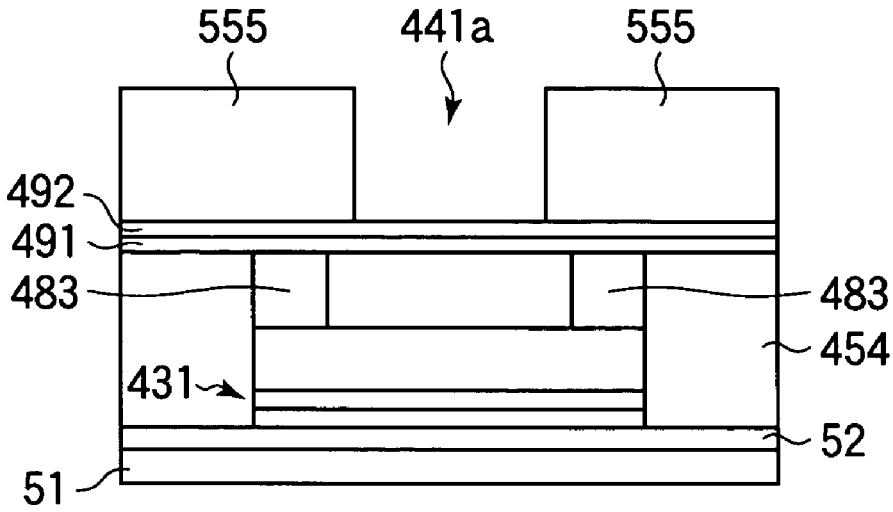
FIGS. 73A and 73B show the method of manufacturing the common mode choke coil 401 according to the third embodiment of the invention.
Figure 73B:
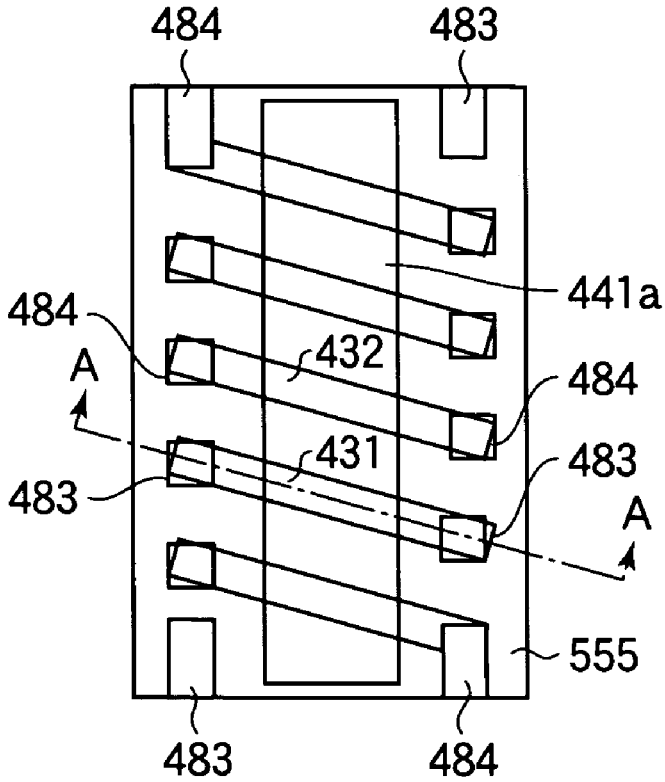

A resist is then applied to the electrode film 492 to form a resist layer (first intermediate resist layer) 555 having a thickness in the range from 8 to 13 μm. Next, as shown in FIGS. 73A and 73B, the resist layer 555 is patterned to form an opening (first intermediate opening) 441*a* for exposing the electrode film 492 in the resist layer 555. The opening 441*a* is formed in a rectangular shape when the element forming region is viewed in the normal direction thereof. The opening is disposed between the conductive layers 483 and 484 on both ends of the coil bottom parts 431 and 432 so as to extend across the coil bottom parts 431 and 432 at a predetermined angle to them.

Figure 74A:
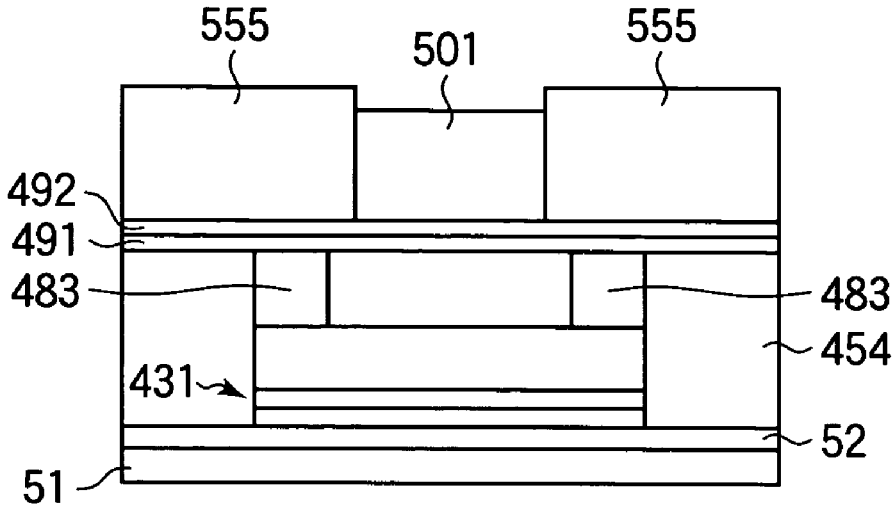
FIGS. 74A and 74B show the method of manufacturing the common mode choke coil 401 according to the third embodiment of the invention.
Figure 74B:
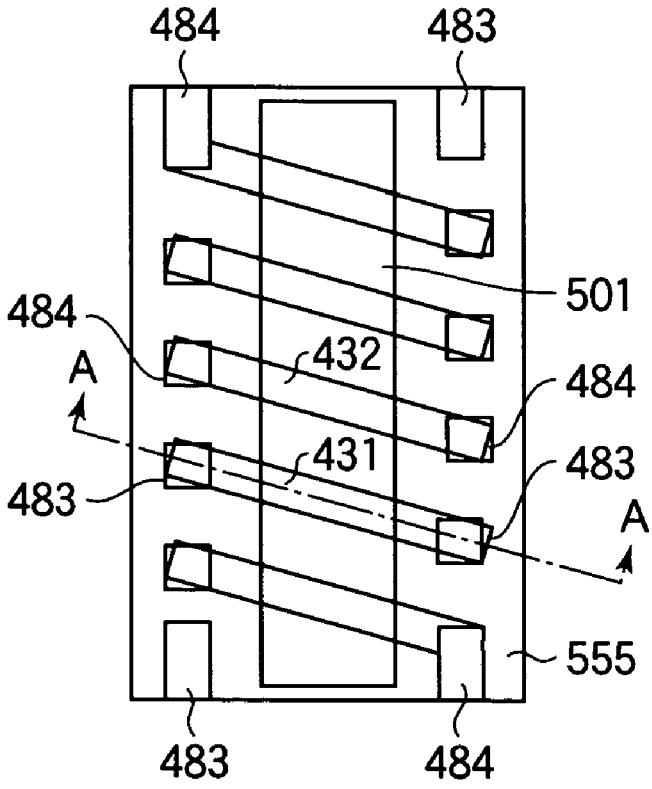
Figure 75A:
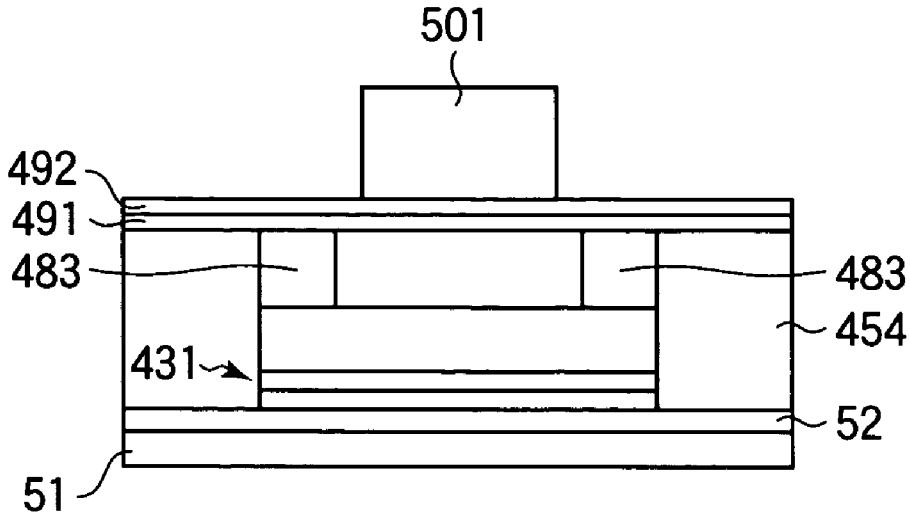
FIGS. 75A and 75B show the method of manufacturing the common mode choke coil 401 according to the third embodiment of the invention.
Figure 75B:
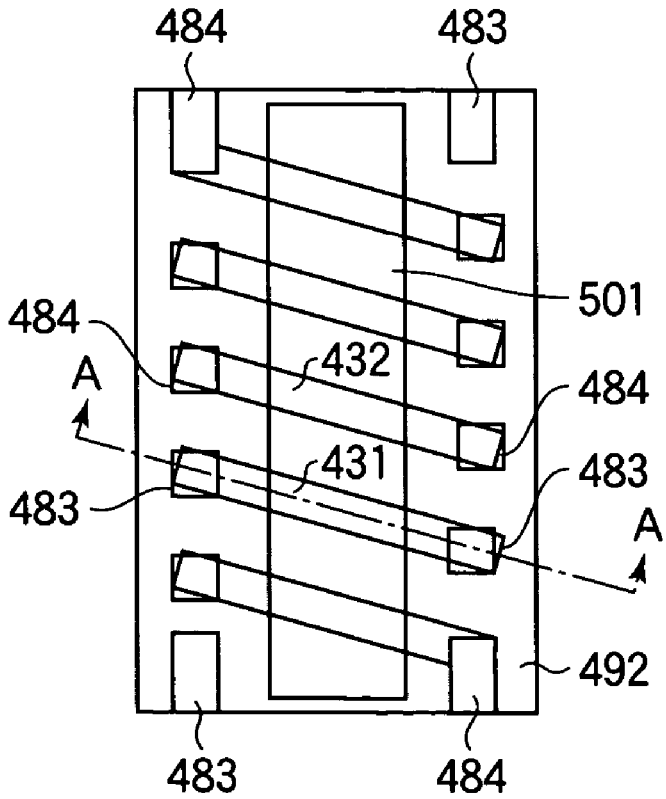

Next, as shown in FIGS. 74A and 74B, a NiFe magnetic member layer (first magnetic member layer) 501 having a thickness in the range from 5 to 10 μm is formed on the electrode film 492 in the opening 441*a* using, for example, a pattern plating process. The magnetic member layer 501 may be formed from a material having high permeability other than NiFe. Next, as shown in FIGS. 75A and 75B, the resist layer 555 is etched away.

Figure 76A:
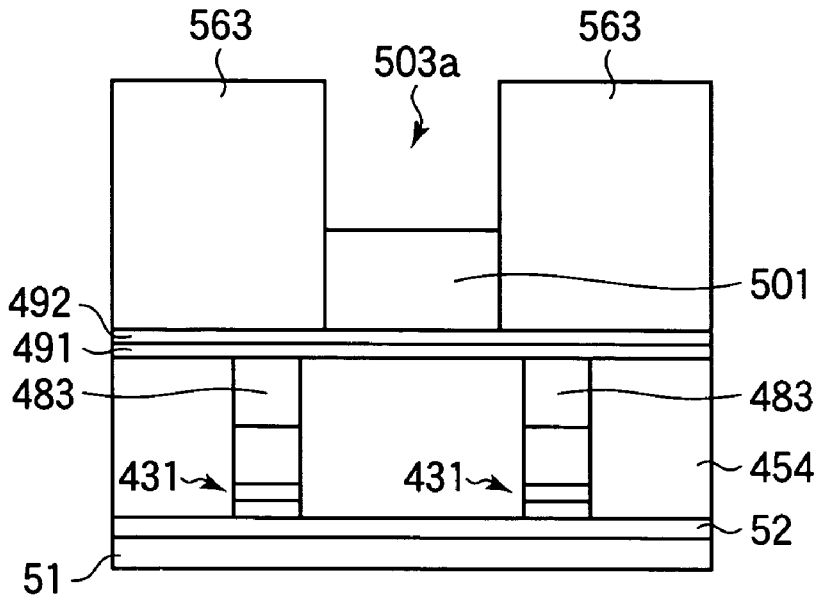
FIGS. 76A and 76B show the method of manufacturing the common mode choke coil 401 according to the third embodiment of the invention.
Figure 76B:
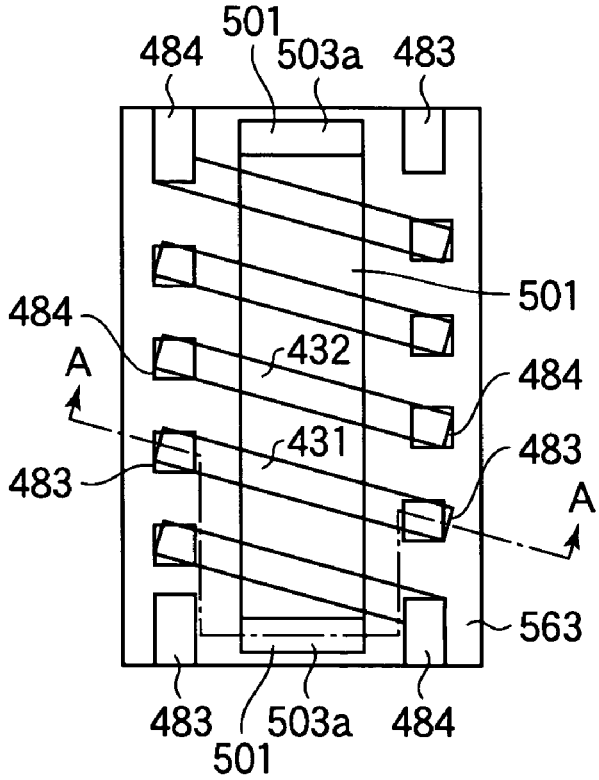
Figure 77A:
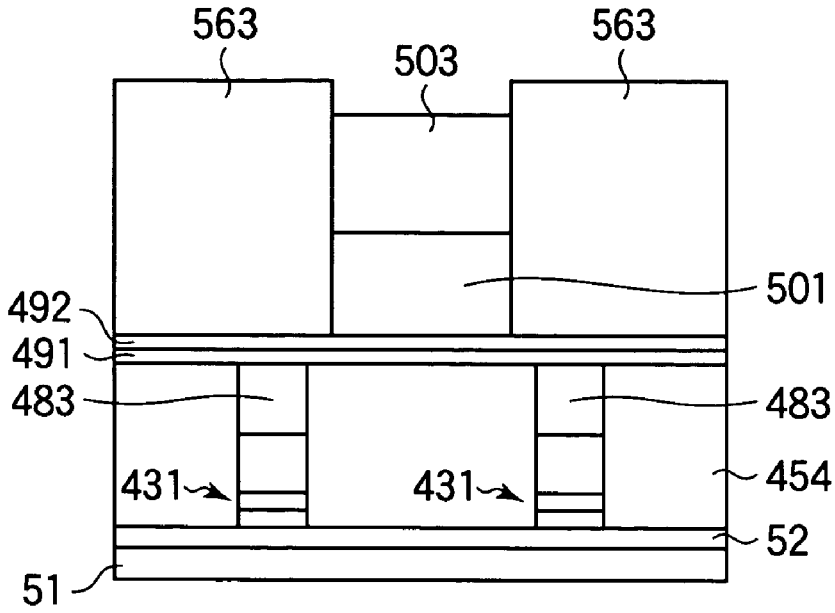
FIGS. 77A and 77B show the method of manufacturing the common mode choke coil 401 according to the third embodiment of the invention.
Figure 77B:
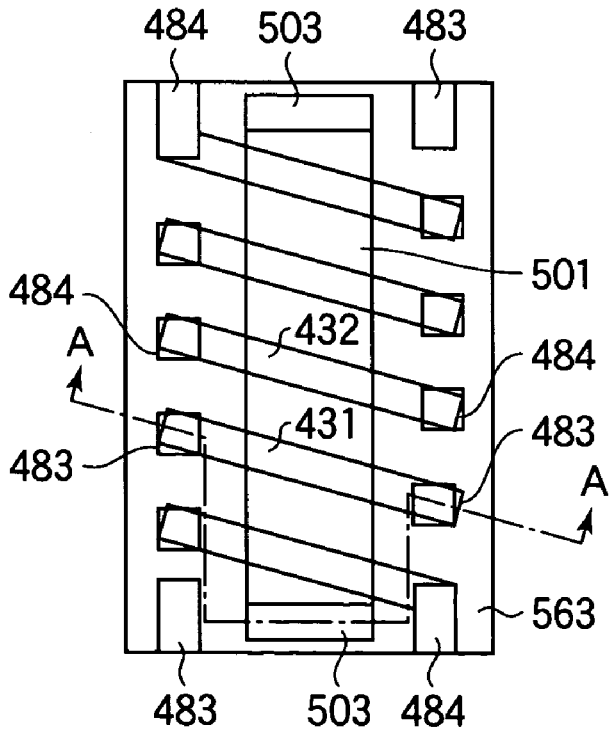

Next, a resist is applied throughout the surface to form a resist layer (third intermediate resist layer) 563 having a thickness in the range from 10 to 15 μm. Next, as shown in FIGS. 76A and 76B, the resist layer 563 is patterned to form openings (third intermediate openings) 503*a* for exposing both ends of the magnetic member layer 501 in the resist layer 563. When the element forming region is viewed in the normal direction thereof, the openings 503*a* are formed in a rectangular shape outside the coil bottom parts 431 and 432. Next, as shown in FIGS. 77A and 77B, NiFe magnetic member layers (second magnetic member layers) 503 having a thickness of about 3 μm are formed on the magnetic member layer 501 in the openings 503*a* using a pattern plating process.

Figure 78A:
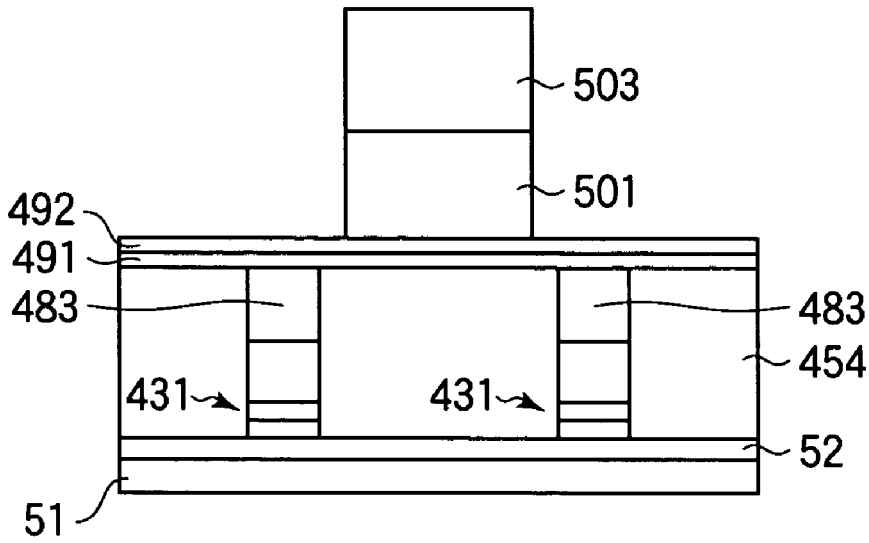
FIGS. 78A and 78B show the method of manufacturing the common mode choke coil 401 according to the third embodiment of the invention.
Figure 78B:
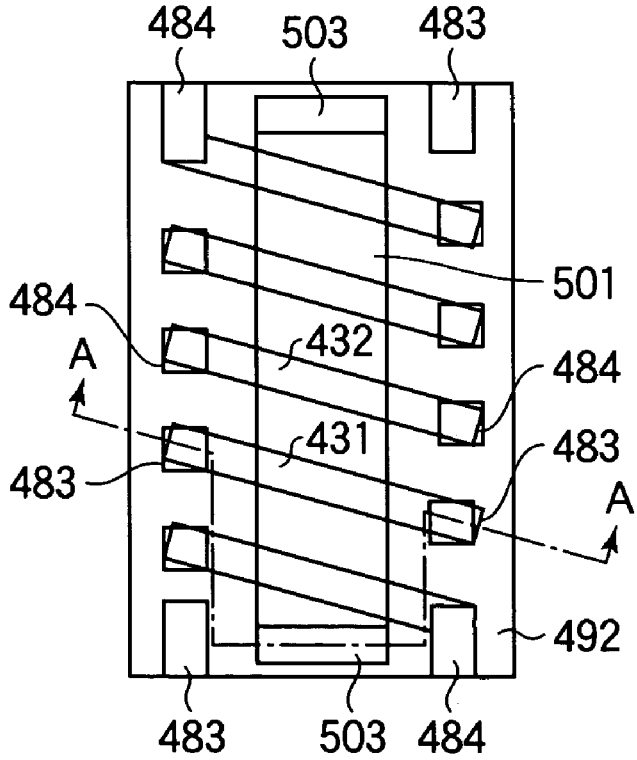
Figure 79A:
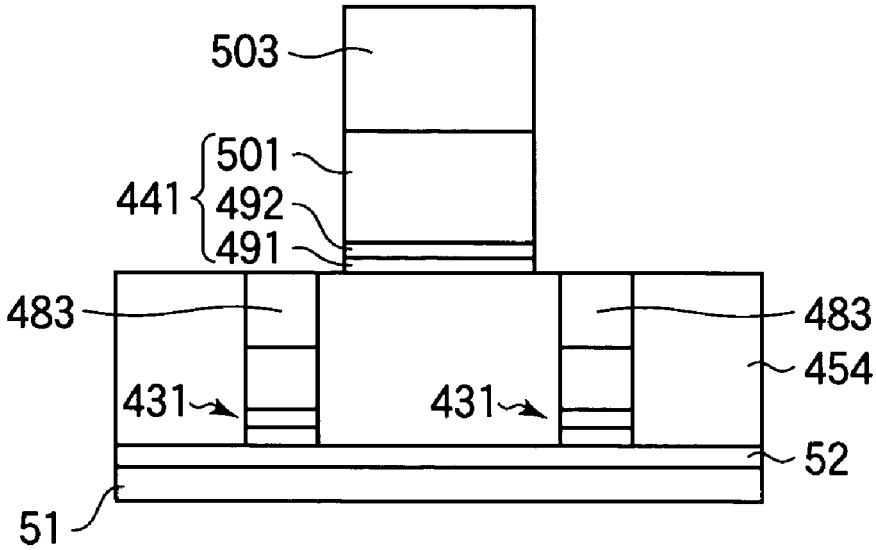
FIGS. 79A and 79B show the method of manufacturing the common mode choke coil 401 according to the third embodiment of the invention.
Figure 79B:
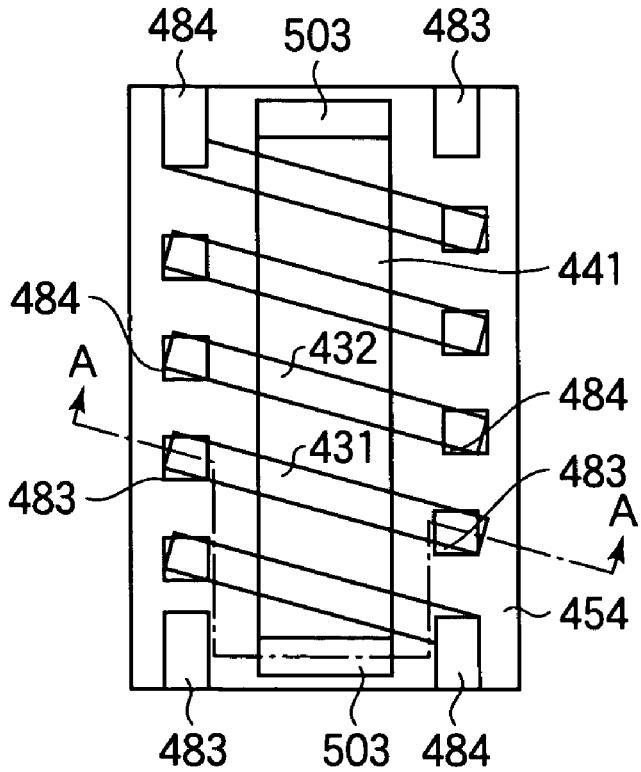

Next, as shown in FIGS. 78A and 78B, the resist layer 563 is etched away. As shown in FIGS. 79A and 79B, dry etching (milling) is then performed to remove the electrode film 492 which has been exposed as a result of the removal of the resist layer 563 and to remove the electrode film 491 located under the electrode film 492. When the electrode films 491 and 492 are removed, the surfaces of the magnetic member layers 501 and 503 are also etched in an amount substantially equivalent to the thickness of the electrode films 491 and 492. However, since the magnetic member layers 501 and 503 are formed sufficiently thick compared to the electrode films 491 and 492, the layers are not completely removed as a result of the dry etching. Through the above-described steps, a core 441 having a multi-layer structure is provided by forming the electrode films 491 and 492 and the magnetic member layer 501 one over another.

Figure 80A:
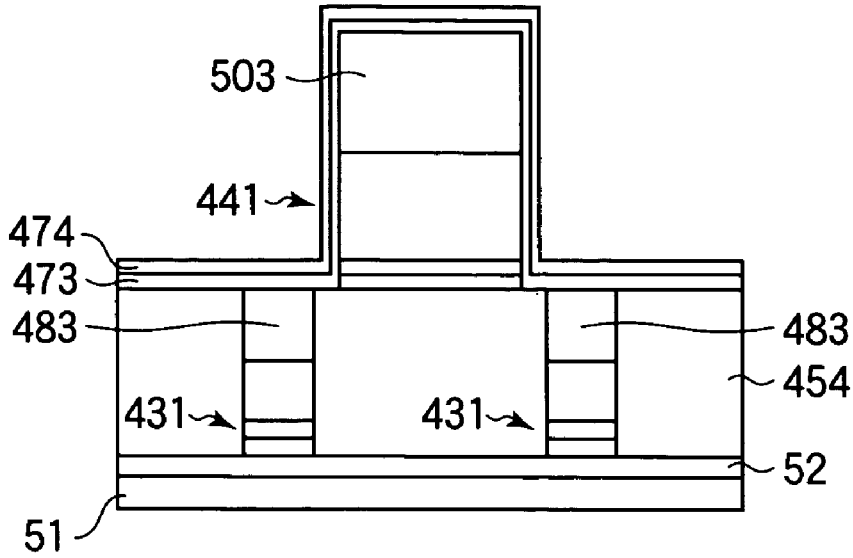
FIGS. 80A and 80B show the method of manufacturing the common mode choke coil 401 according to the third embodiment of the invention.
Figure 80B:
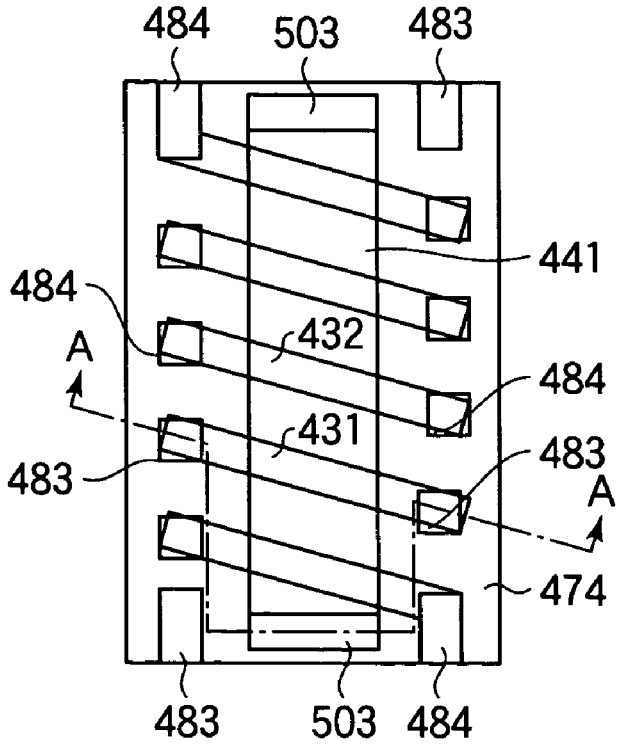

Next, as shown in FIGS. 80A and 80B, a Ti electrode film 473 having a thickness of about 10 nm is formed throughout the surface using a sputtering process, and a Cu electrode film (second intermediate electrode film) 474 having a thickness of about 100 nm is then formed on the electrode film 473 using a sputtering process. The electrode films 473 and 474 are electrically connected to the conductive layers 483 and 484 located under the same.

Figure 81A:
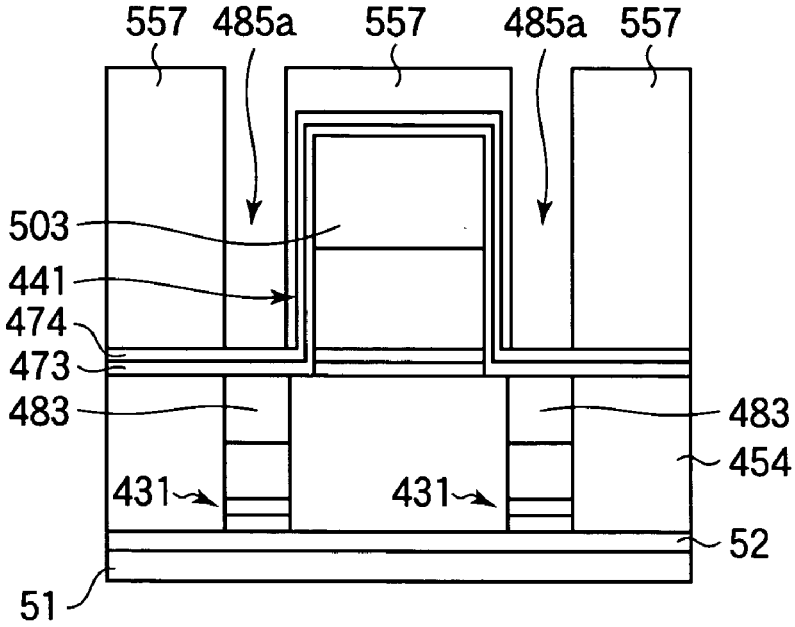
FIGS. 81A and 81B show the method of manufacturing the common mode choke coil 401 according to the third embodiment of the invention.
Figure 81B:
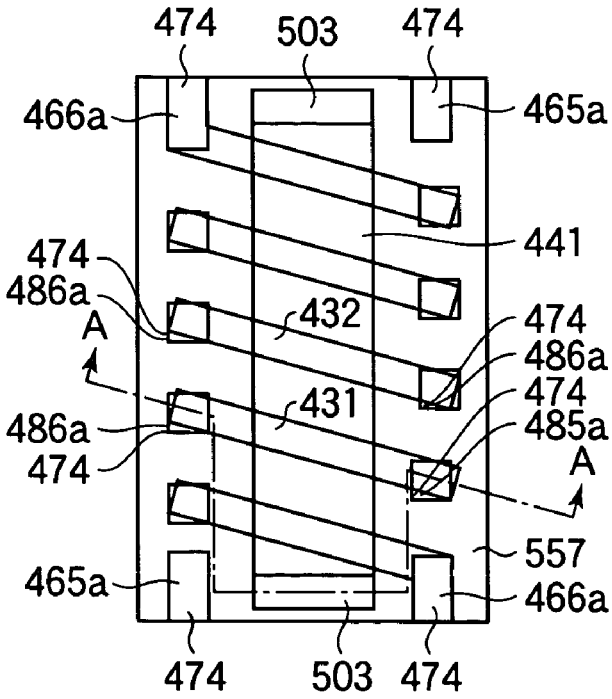

Next, a resist is applied to the electrode film 474 to form a resist layer (second intermediate resist layer) 557 having a thickness in the range from 15 to 23 μm. Next, as shown in FIGS. 81A and 81B, the resist layer 557 is patterned to form the resist layer 557 with openings (second intermediate openings) 485*a* and 486*a* for exposing the electrode film 474 on the conductive layers 483 and 484 formed in the openings 483*a* and 484*a* and openings 465*a* and 466*a* for exposing the electrode film 474 on the conductive layers 483 and 484 formed in the openings 463*a* and 464*a*.

Figure 82A:
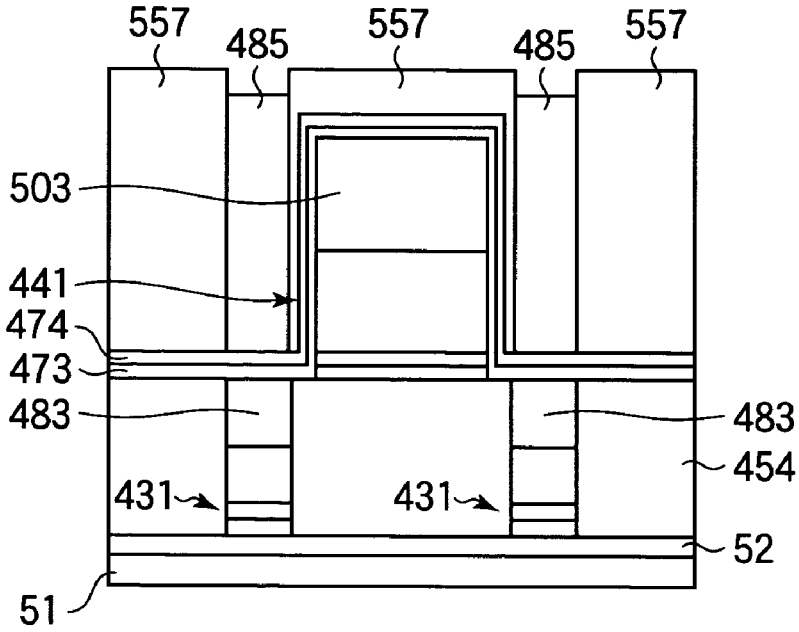
FIGS. 82A and 82B show the method of manufacturing the common mode choke coil 401 according to the third embodiment of the invention.
Figure 82B:
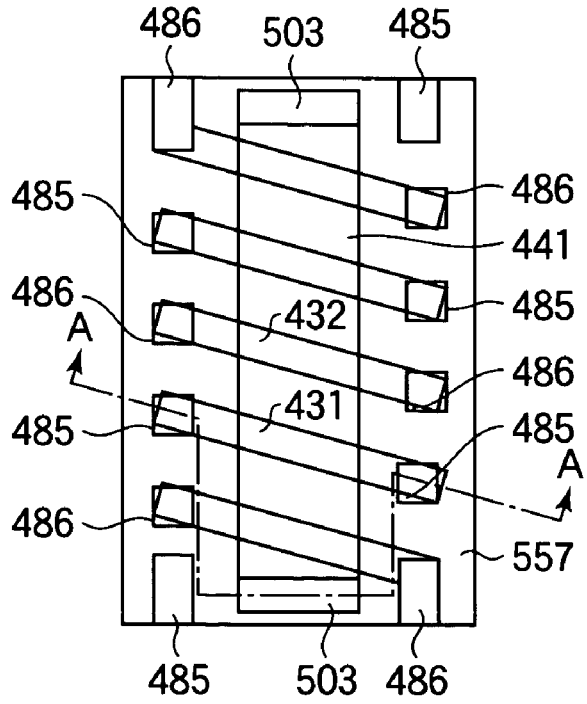
Figure 83A:
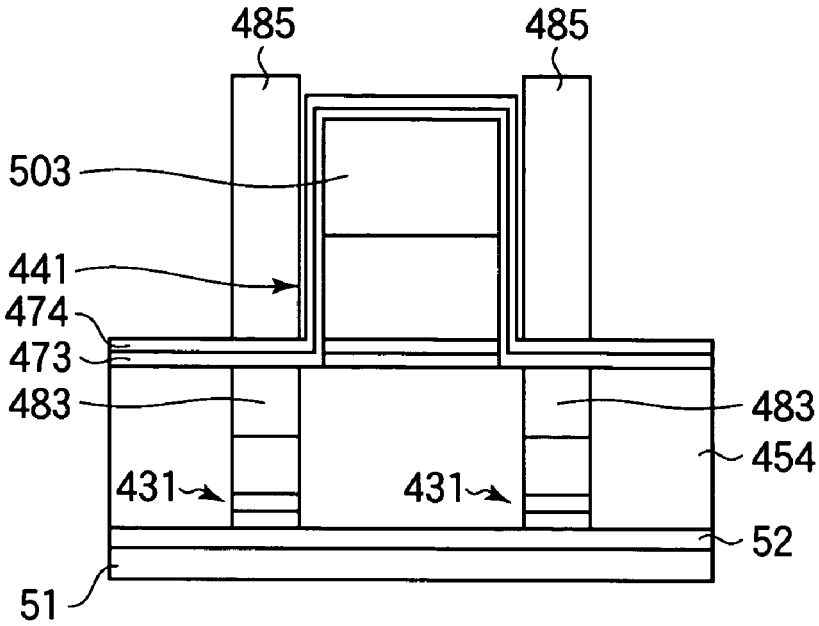
FIGS. 83A and 83B show the method of manufacturing the common mode choke coil 401 according to the third embodiment of the invention.
Figure 83B:
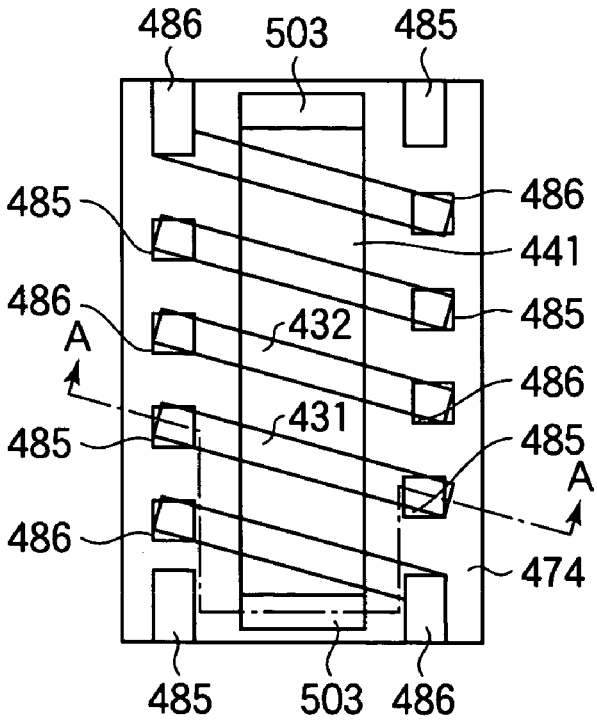
Figure 84A:
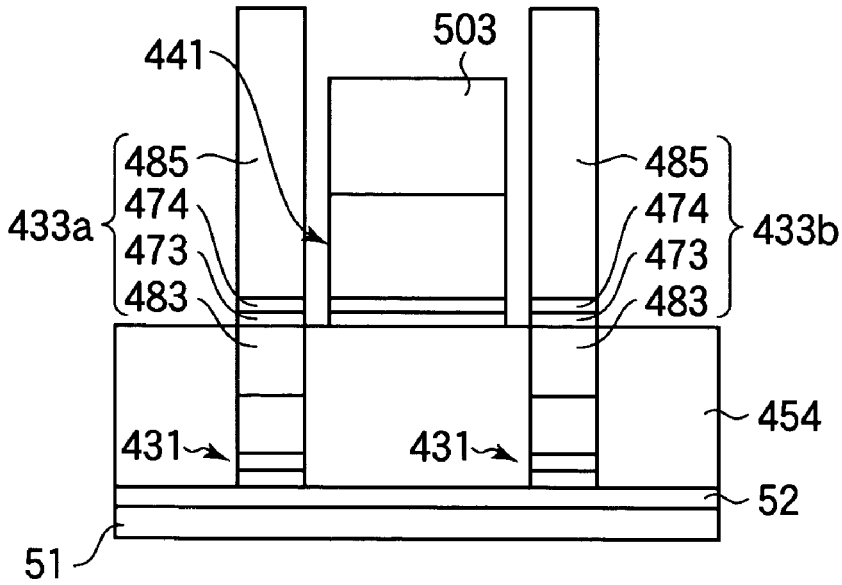
FIGS. 84A and 84B show the method of manufacturing the common mode choke coil 401 according to the third embodiment of the invention.
Figure 84B:
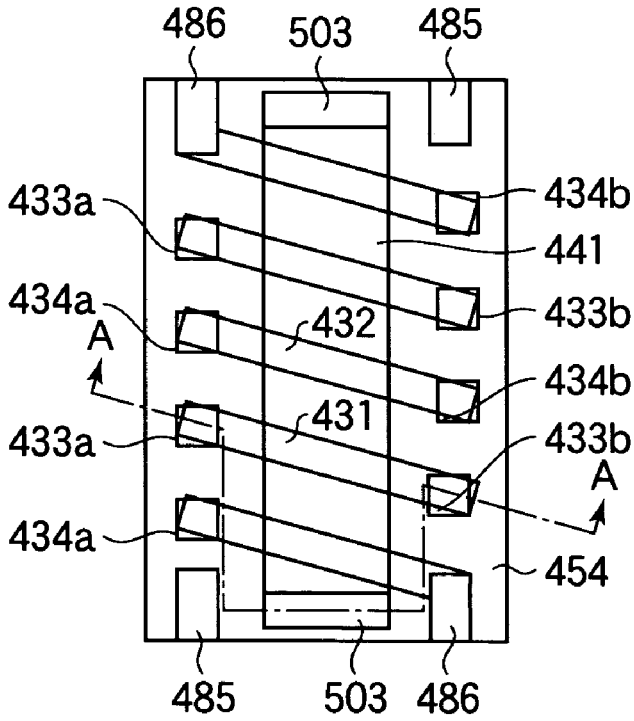

Next, as shown in FIGS. 82A and 82B, Cu conductive layers (first intermediate conductive layers) 485 having a thickness in the range from 10 to 18 μm are formed on the electrode film 474 in the openings 465*a* and 485*a*, and conductive layers (first intermediate conductive layers) 486 are formed from the same material with the same thickness on the electrode film 474 in the openings 466*a* and 486*a*. The conductive layers 485 and 486 are formed using a pattern plating process and are each electrically connected to the electrode film 474 located under the same. Next, as shown in FIGS. 83A and 83B, the resist layer 557 is etched away. As shown in FIGS. 84A and 84B, dry etching is then performed to remove the electrode film 474 exposed as a result of the removal of the resist layer 557 and to remove the electrode film 473 under the electrode film 474. Through the above-described steps, coil side parts 433*a* and 433*b* having a multi-layer structure are provided by forming the conductive layers 483, the electrode films 473 and 474, and the conductive layers 485 one over another, and coil side parts 434*a* and 434*b* having a multi-layer structure are provided by forming the conductive layers 484, the electrode films 473 and 474, and the conductive layers 486 one over another. Referring to FIG. 84B, the coil side parts 433*a* and 434*a* are alternately disposed on the left side to align on a straight line at equal intervals, and the coil side parts 433*b* and 434*b* are alternately disposed on the right side to align on a straight line at equal intervals.

Figure 85A:
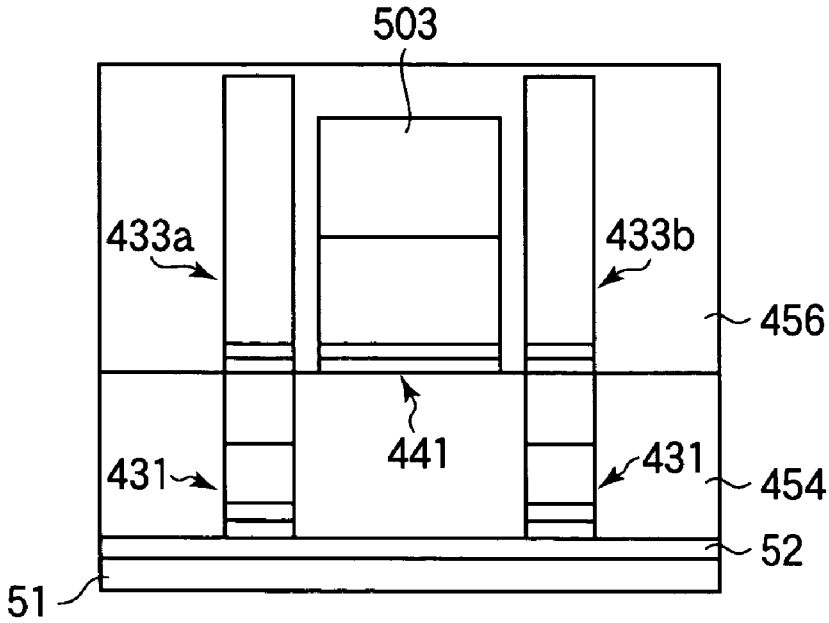
FIGS. 85A and 85B show the method of manufacturing the common mode choke coil 401 according to the third embodiment of the invention.
Figure 85B:
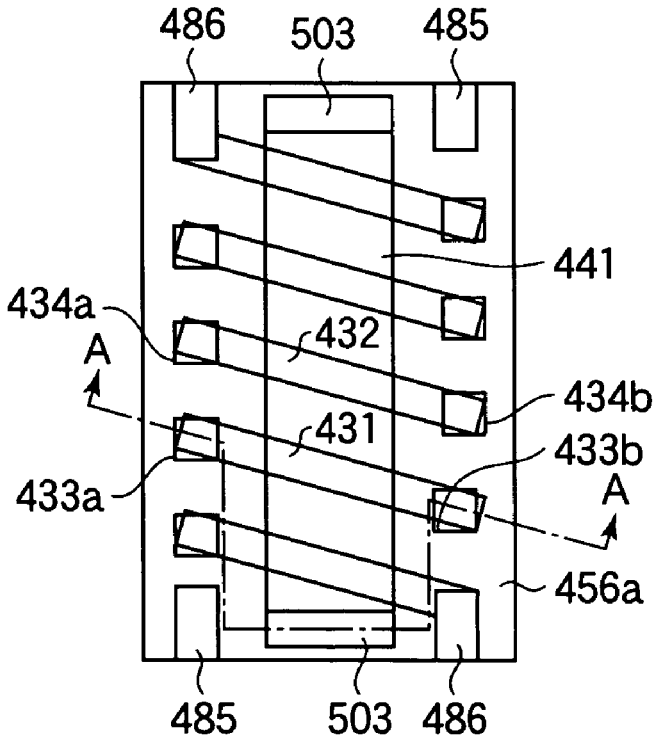
Figure 86A:
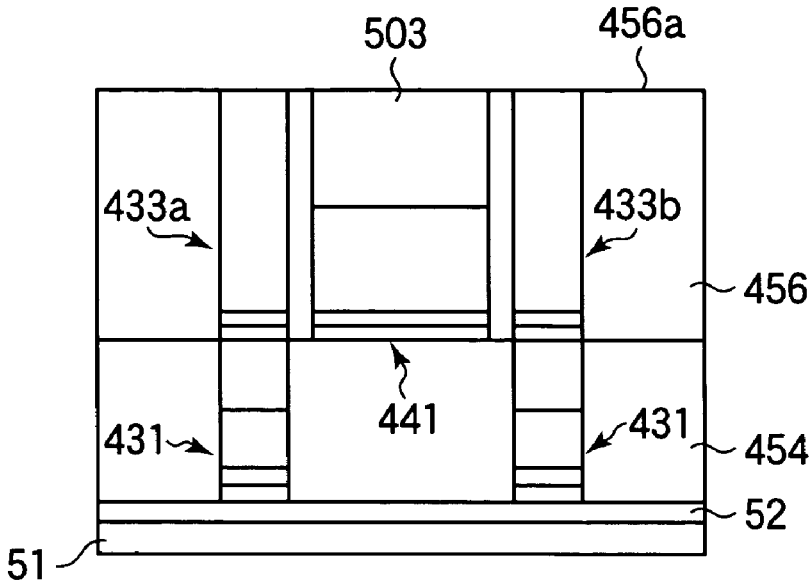
FIGS. 86A and 86B show the method of manufacturing the common mode choke coil 401 according to the third embodiment of the invention.
Figure 86B:
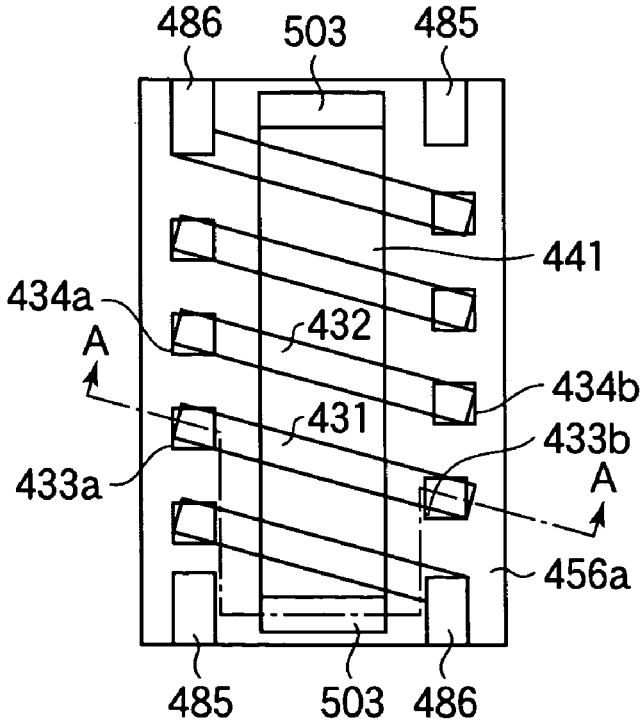

Next, as shown in FIGS. 85A and 85B, a film of alumina is formed throughout the resultant surface using a sputtering process to provide an insulation layer (second insulation layer) 456 having a thickness in the range from 10 to 18 μm. As shown in FIGS. 86A and 86B, a CMP process is then performed to polish the surface of the insulation layer 456 until the magnetic member layers 503 are exposed, whereby a planar surface 456*a* is formed. At this time, the coil side parts 433*a*, 433*b*, 434*a*, and 434*b* and the conductive layers 485 and 486 formed in the openings 465*a* and 466*a* are also polished and their surfaces are exposed on the planar surface 456*a*.

Figure 87A:
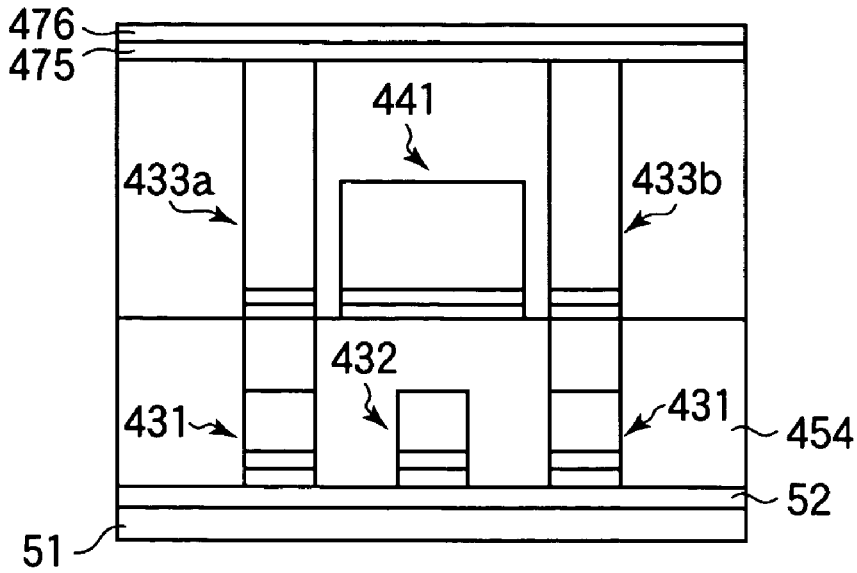
FIGS. 87A and 87B show the method of manufacturing the common mode choke coil 401 according to the third embodiment of the invention.
Figure 87B:
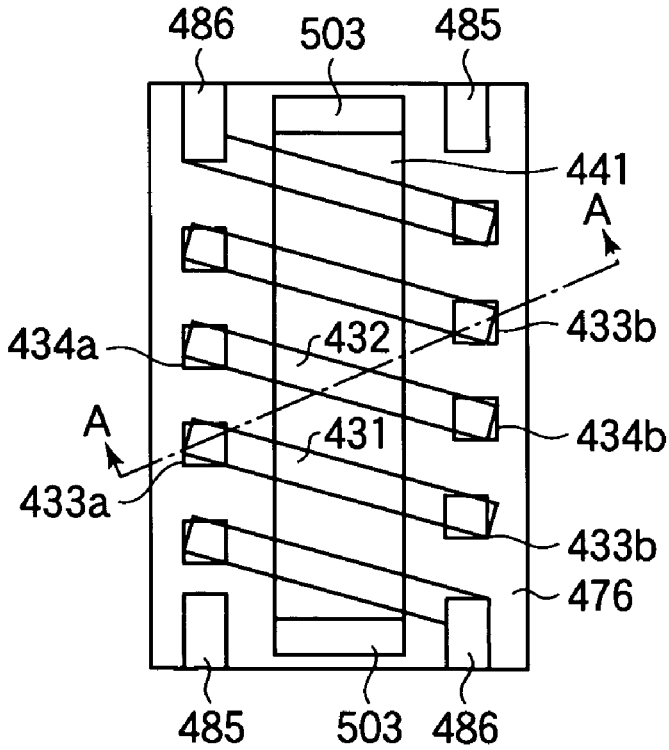

Next, as shown in FIGS. 87A and 87B, a Ti electrode film 475 having a thickness of about 10 nm is formed on the planar surface 456*a* of the insulation layer 456 using a sputtering process, and a Cu electrode film (second electrode film) 476 having a thickness of about 100 nm is formed on the electrode film 475 using a sputtering process. The electrode films 475 and 476 are electrically connected to the conductive layers 483 through the electrode films 473 and 474 and the conductive layers 485 and are electrically connected to the conductive layers 484 through the electrode films 473 and 474 and the conductive layers 486.

Figure 88A:
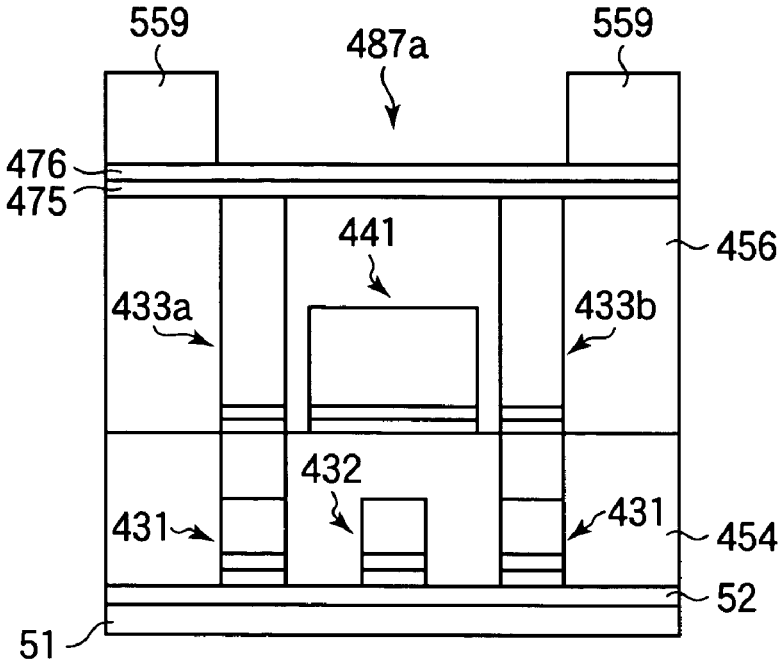
FIGS. 88A and 88B show the method of manufacturing the common mode choke coil 401 according to the third embodiment of the invention.
Figure 88B:
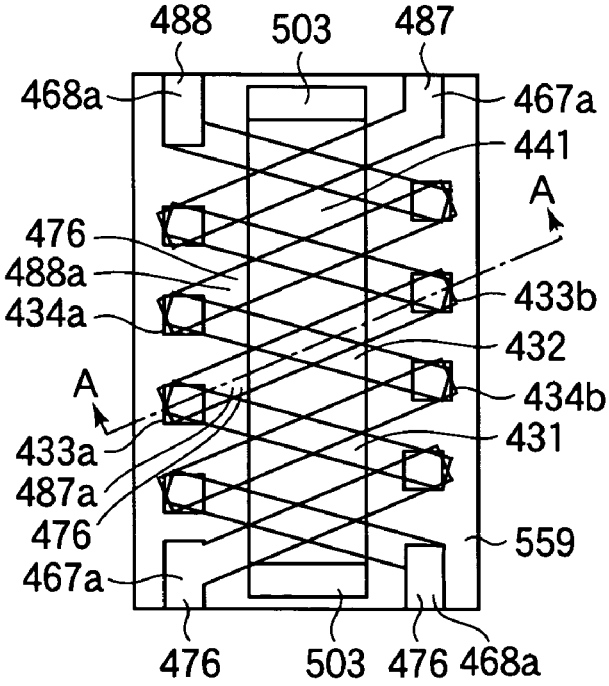

A resist is then applied to the electrode film 476 to form a resist layer (third resist layer) 559 having a thickness in the range from 10 to 15 μm. Next, as shown in FIGS. 88A and 88B, the resist layer 559 is patterned to form a plurality of openings (third openings) 487*a* and 488*a* for exposing the electrode film 476 in the form of elongate strips and to form openings 467*a* and 468*a* for exposing the electrode film 476 on the conductive layers 485 and 486 formed in the openings 465*a* and 466*a*. As a result, when the element forming region is viewed in the normal direction thereof, the openings 487*a* and the openings 488*a* are alternately formed in parallel at substantially equal intervals, each opening 487*a* exposing the electrode film 476 on a coil side part 433*a* at one end thereof and exposing, at another end thereof, the electrode film 476 on the coil side part 433*b* on a coil bottom part 431 extending adjacent to the coil bottom part 431 directly under the above-mentioned coil side 433*a* so as to sandwich a coil bottom part 432 between them, each opening 488*a* exposing the electrode film 476 on a coil side part 434*a* at one end thereof and exposing, at another end thereof, the electrode film 476 on the coil side part 434*b* on a coil bottom part 432 extending adjacent to the coil bottom part 432 directly under the above-mentioned coil side part 434*a* so as to sandwich a coil bottom part 431 between them. The openings 487*a* are formed to extend across the coil bottom parts 432 and to face the bottom parts with the core 441 sandwiched between them when the element forming region is viewed in the normal direction thereof. The openings 488*a* are formed to extend across the coil bottom parts. 431 and to face the bottom parts 431 with the core 441 sandwiched between them, when viewed in the same direction. The openings 487*a* disposed near the shorter sides of the element forming region are formed in connection with the respective openings 467*a* at one end thereof.

Figure 89A:
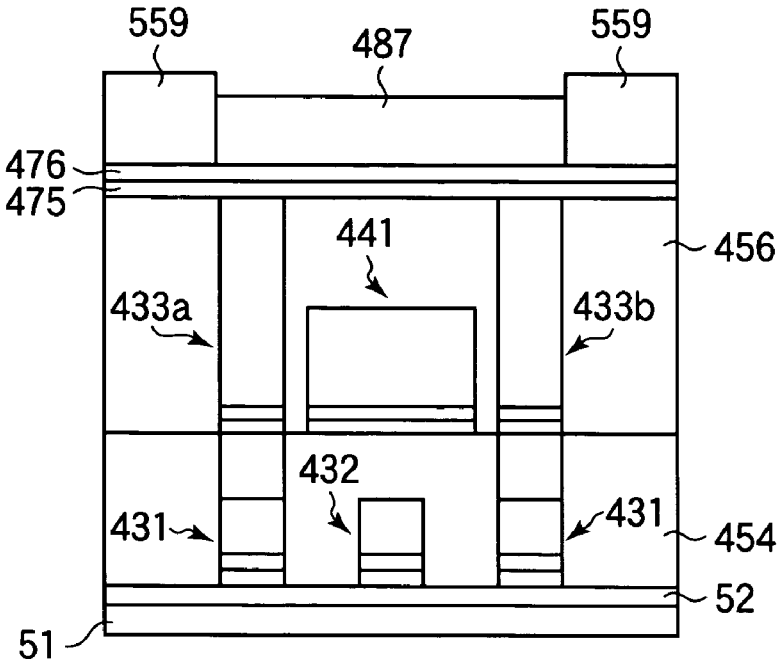
FIGS. 89A and 89B show the method of manufacturing the common mode choke coil 401 according to the third embodiment of the invention.
Figure 89B:
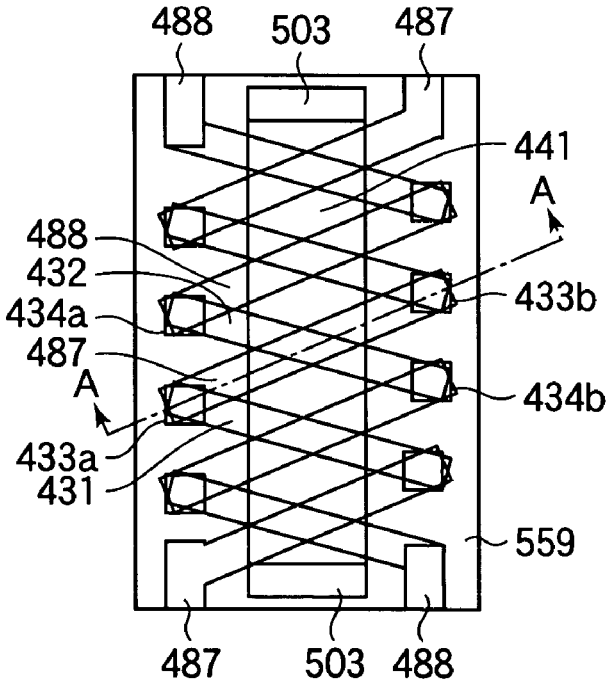
Figure 90A:
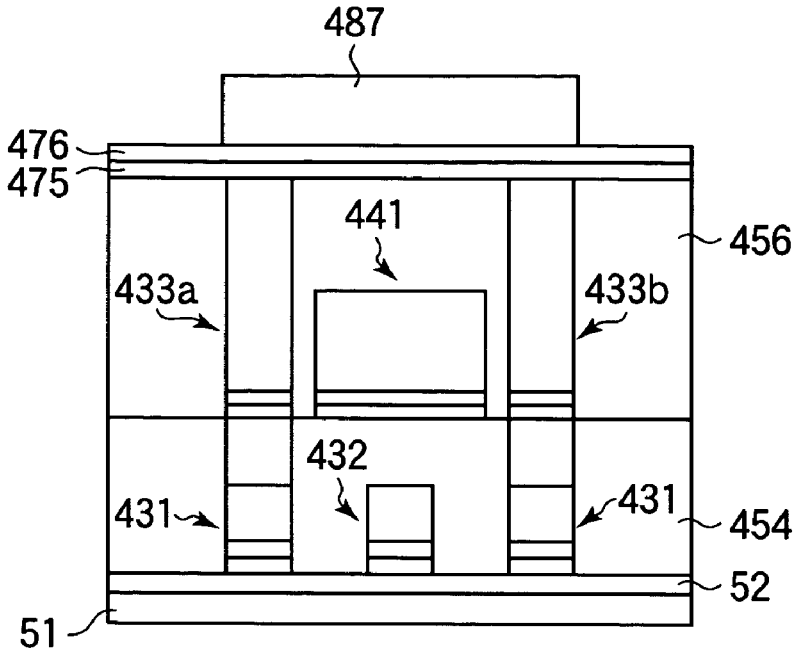
FIGS. 90A and 90B show the method of manufacturing the common mode choke coil 401 according to the third embodiment of the invention.
Figure 90B:
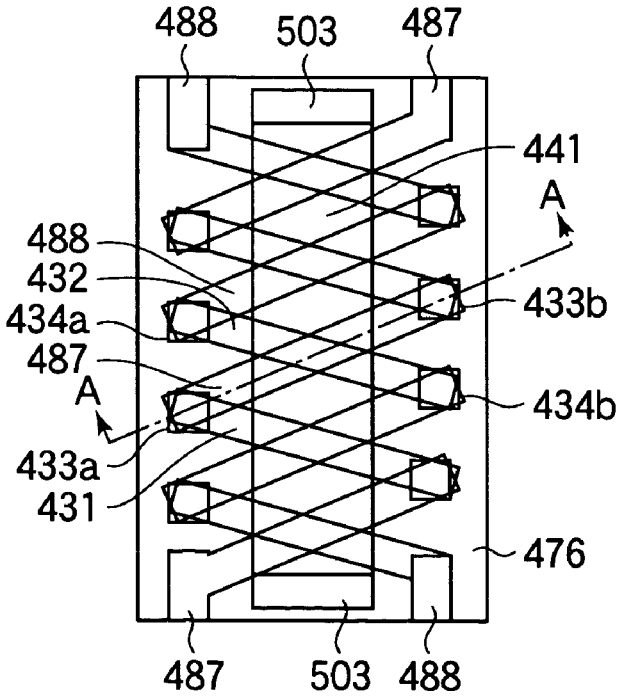
Figure 91A:
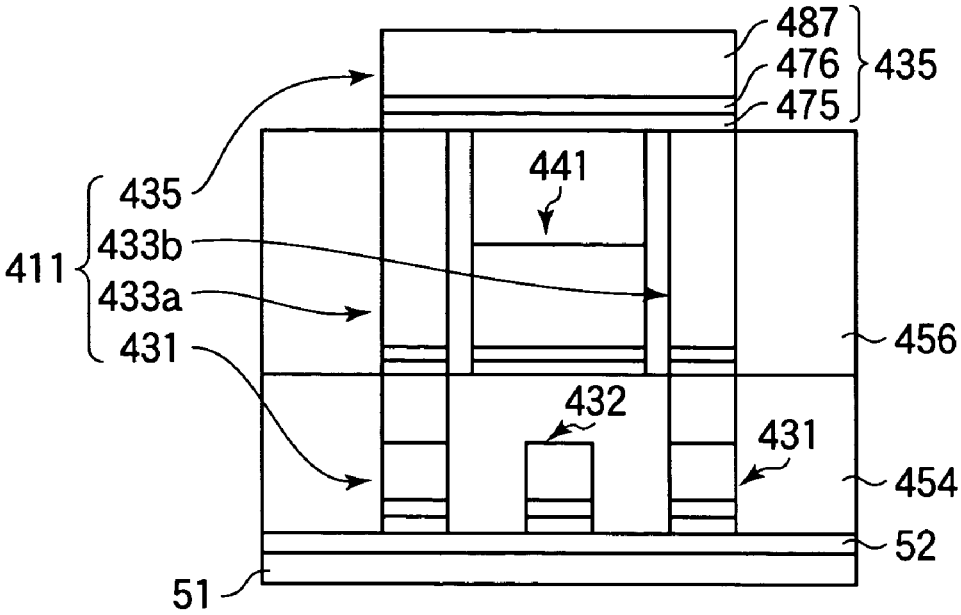
FIGS. 91A and 91B show the method of manufacturing the common mode choke coil 401 according to the third embodiment of the invention.
Figure 91B:
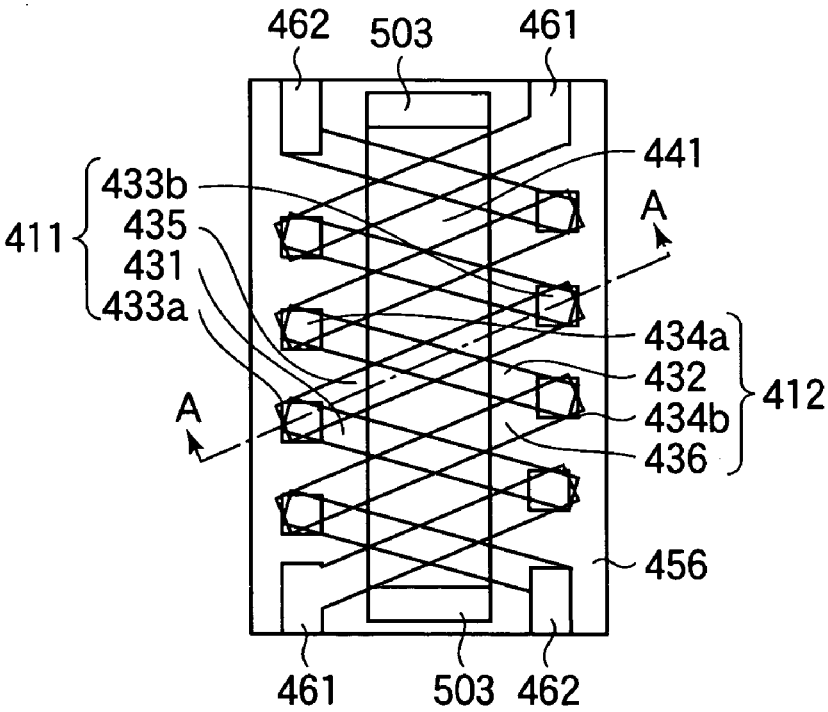

Next, as shown in FIGS. 89A and 89B, Cu conductive layers (third conductive layers) 487 having a thickness in the range from 7 to 10 μm are formed on the electrode film 476 in the openings 467*a* and 487*a*, and conductive layers (third conductive layers) 488 are formed from the same material to the same thickness on the electrode film 476 in the openings 468*a* and 488*a*. The conductive layers 487 and 488 are simultaneously formed using a pattern plating process and are each electrically connected to the electrode film 476 under the same. Next, as shown in FIGS. 90A and 90B, the resist layer 559 is etched away. Next, as shown in FIGS. 91A and 91B, the electrode film 476 which has been exposed as a result of the removal of the resist layer 559 and the electrode film 475 under the electrode film 476 are removed. Thus, coil top parts 435 having a multi-layer structure are provided by forming the electrode films 475 and 476 and the conductive layers 487 one over another, and coil top parts 436 having a multi-layer structure are provided by forming the electrode films 475 and 476 and the conductive layers 488 one over another.

Through the above-described steps, a first helical coil unit 411 is formed, which includes one coil having two turns each constituted by a coil bottom part 431, a coil side part 433*a*, a coil top part 435, and a coil side part 433*b*. At the same time, a second helical coil unit 412 is formed, which includes one coil having two turns each constituted by a coil bottom part 432, a coil side part 434*a*, a coil top part 436, and a coil side part 434*b*. The first and second helical coil units 411 and 412 are formed in a double spiral structure. External electrode connecting parts 461 having a multi-layer structure constituted by the conductive layers 481, 483, 485, and 487 are simultaneously formed in the openings 461*a*, 463*a*, 465*a*, and 467*a*, and external electrode connecting parts 462 having a multi-layer structure constituted by the conductive layers 482, 484, 486, and 488 are simultaneously formed in the openings 462*a*, 464*a*, 466*a*, and 468*a*.

The coil top parts 435 and 436 are alternately disposed in parallel. When the element forming region is viewed in the normal direction thereof, the coil top parts 435 are disposed to extend across the coil bottom parts 432 with the core 441 sandwiched between them, and the coil top parts 436 are disposed to extend across the coil bottom parts 431 with the core 441 sandwiched between them.

Figure 92A:
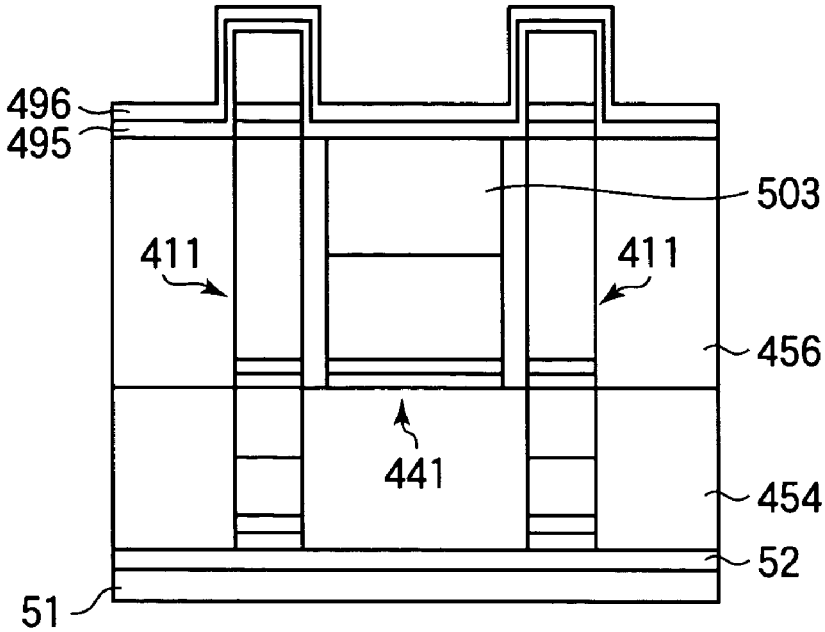
FIGS. 92A and 92B show the method of manufacturing the common mode choke coil 401 according to the third embodiment of the invention.
Figure 92B:
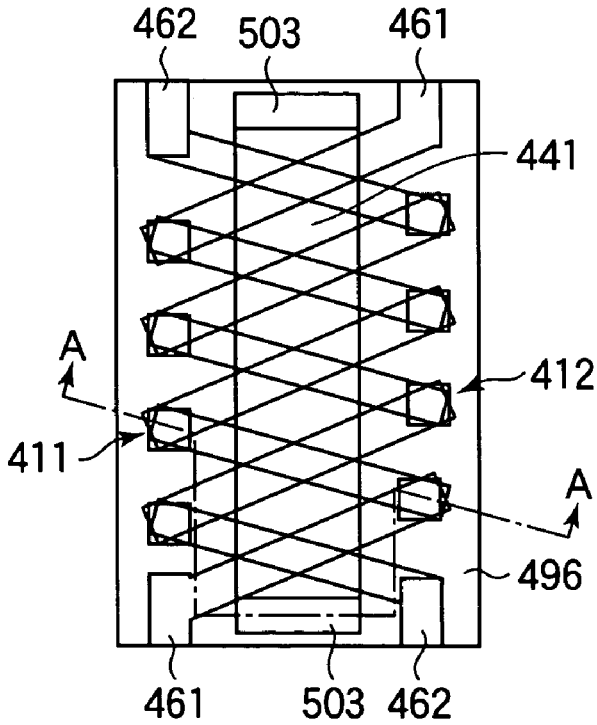

Next, as shown in FIGS. 92A and 92B, a Ti electrode film 495 having a thickness of about 10 nm is formed throughout the surface using a sputtering process, and a NiFe electrode film (third electrode film) 496 having a thickness of about 100 nm is formed on the electrode film 495 using a sputtering process.

Figure 93A:
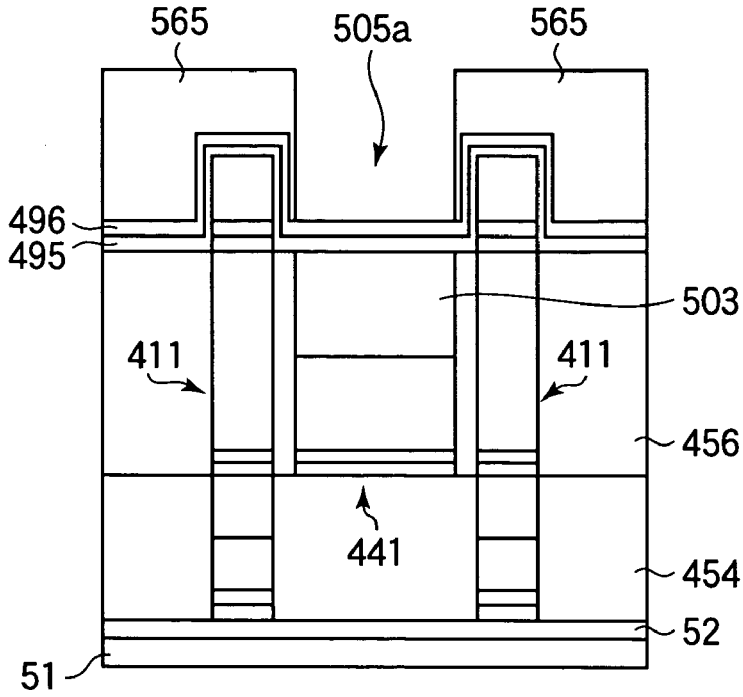
FIGS. 93A and 93B show the method of manufacturing the common mode choke coil 401 according to the third embodiment of the invention.
Figure 93B:
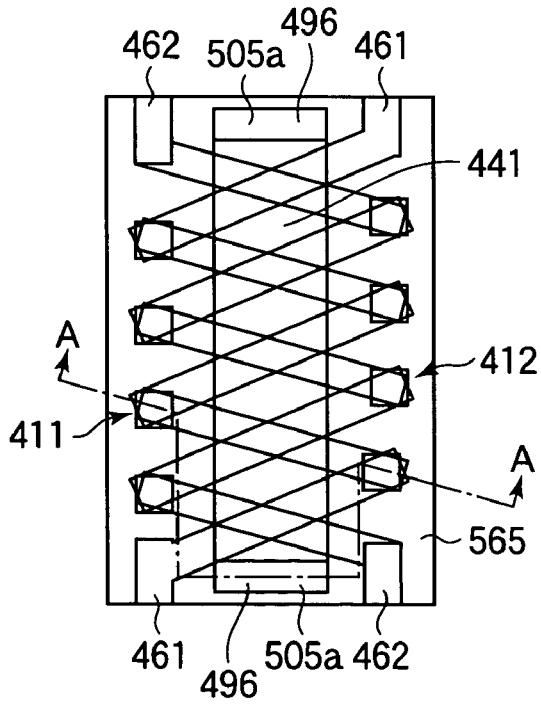
Figure 94A:
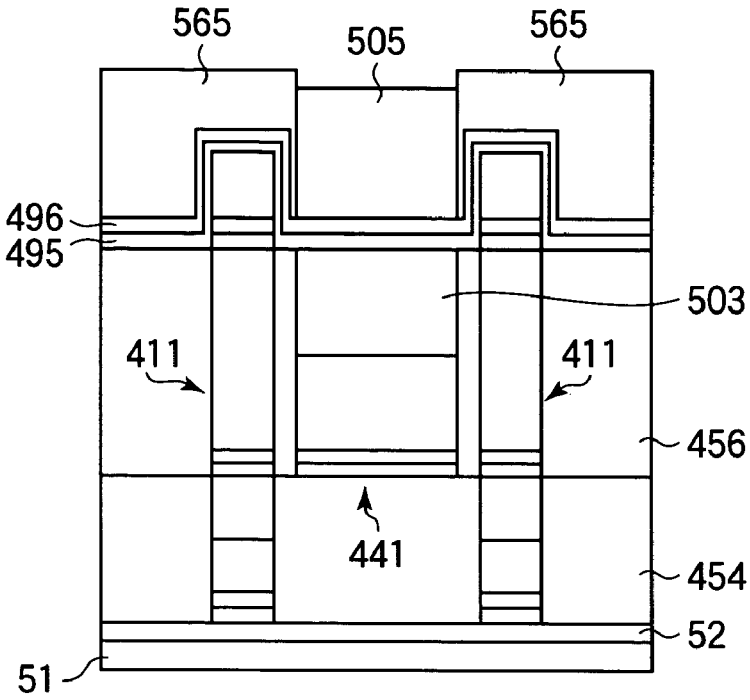
FIGS. 94A and 94B show the method of manufacturing the common mode choke coil 401 according to the third embodiment of the invention.
Figure 94B:
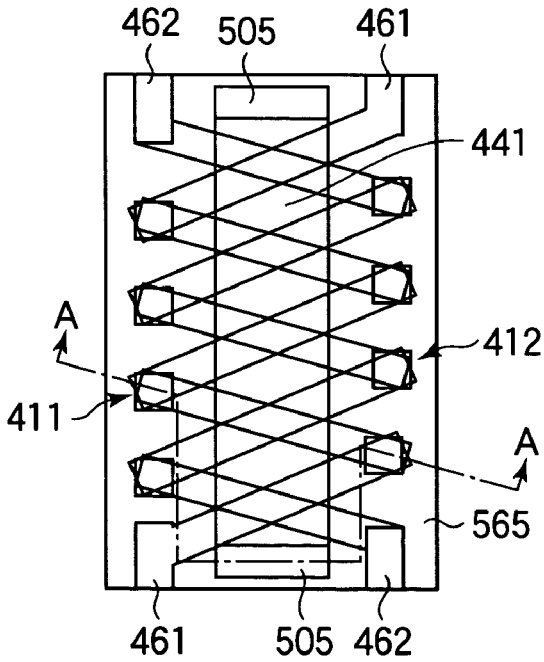

A resist is then applied to the electrode film 496 to form a resist layer (fourth resist layer) 565 having a thickness in the range from 13 to 16 μm. Next, as shown in FIGS. 93A and 93B, the resist layer 565 is patterned to form openings (fourth openings) 505*a* for exposing the electrode film 496 on the magnetic member layers 503 in the resist layer 565. Next, as shown in FIGS. 94A and 94B, NiFe magnetic member layers (third magnetic member layers) 505 having a thickness in the range from 10 to 13 μm are formed on the electrode film 496 in the openings 505*a* using a pattern plating process.

Figure 95A:
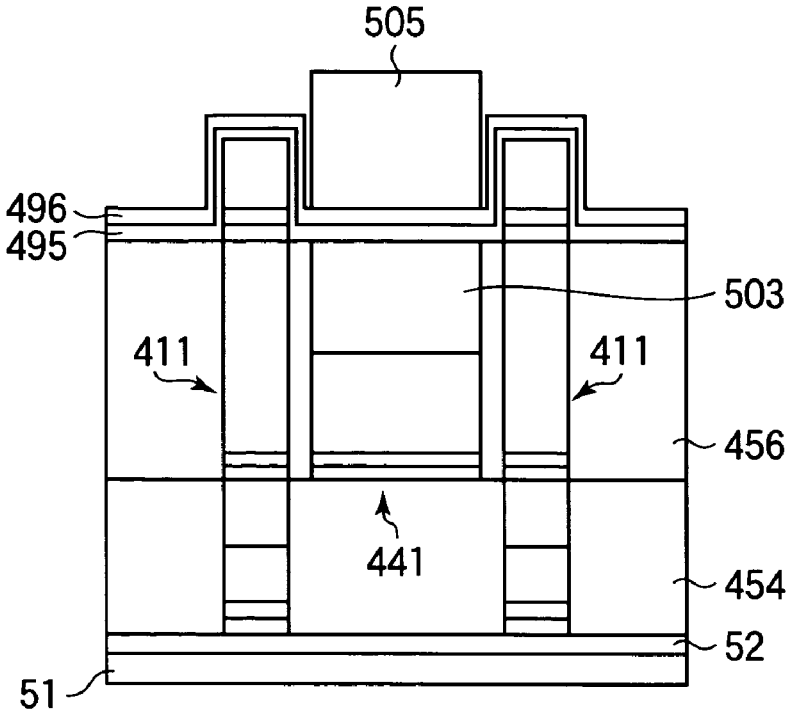
FIGS. 95A and 95B show the method of manufacturing the common mode choke coil 401 according to the third embodiment of the invention.
Figure 95B:
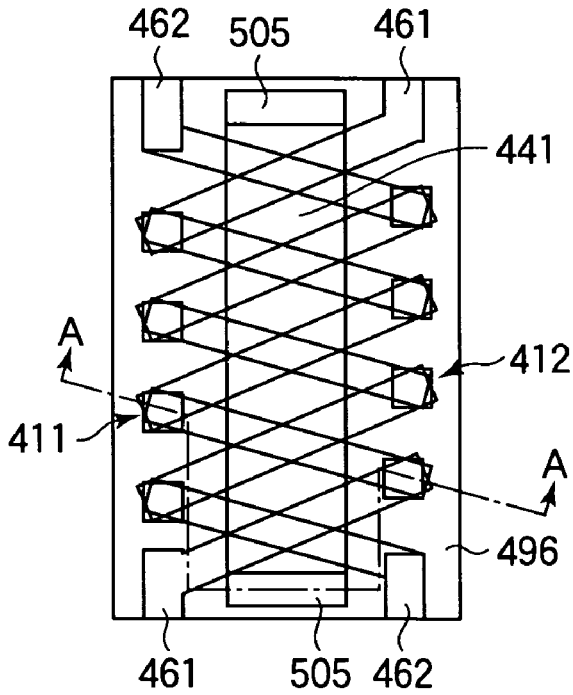
Figure 96A:
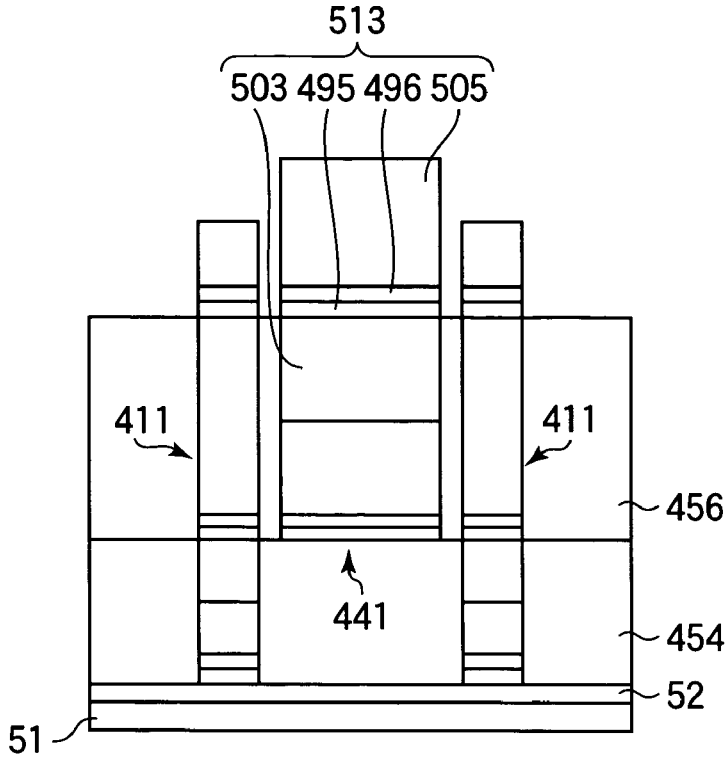
FIGS. 96A and 96B show the method of manufacturing the common mode choke coil 401 according to the third embodiment of the invention.
Figure 96B:
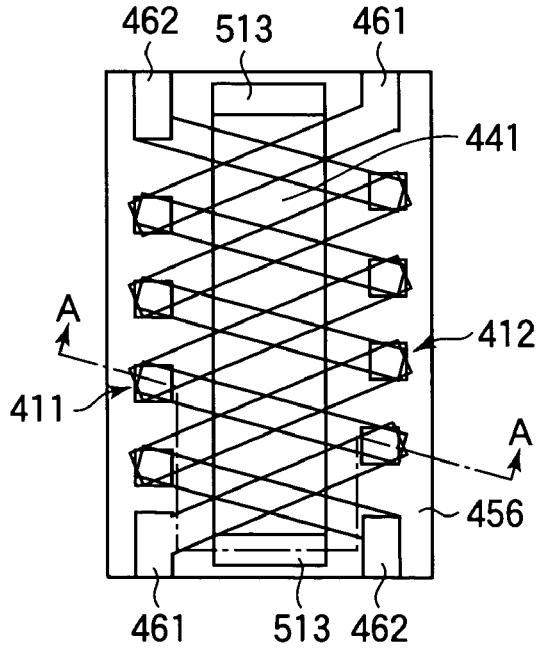

Next, as shown in FIGS. 95A and 95B, the resist layer 565 is etched away. As shown in FIGS. 96A and 96B, dry etching (milling) is then performed to remove the electrode film 496 which has been exposed as a result of the removal of the resist layer 565 and to remove the electrode film 495 located under the electrode film 496. When the electrode films 495 and 496 are removed, the surfaces of the magnetic member layers 505 are also etched in an amount substantially equivalent to the thickness of the electrode films 495 and 496. However, since the magnetic member layers 505 are formed sufficiently thick compared to the electrode films 495 and 496, the layers are not completely removed as a result of the dry etching. Thus, closed magnetic path side parts 513 having a multi-layer structure are provided by forming the magnetic member layers 503, the electrode films 495 and 496, and the magnetic member layers 505 one over another.

Figure 97A:
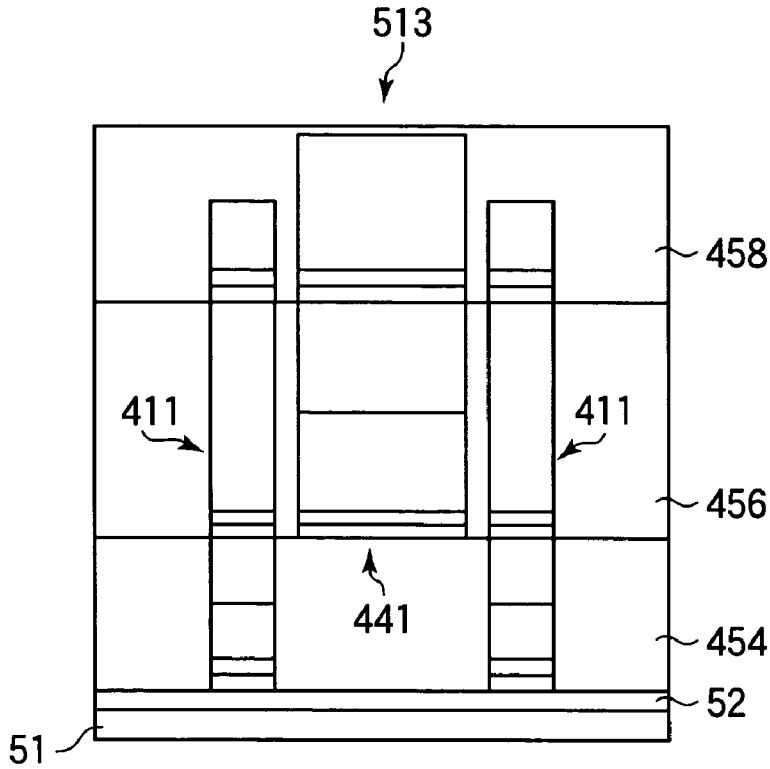
FIGS. 97A and 97B show the method of manufacturing the common mode choke coil 401 according to the third embodiment of the invention.
Figure 97B:
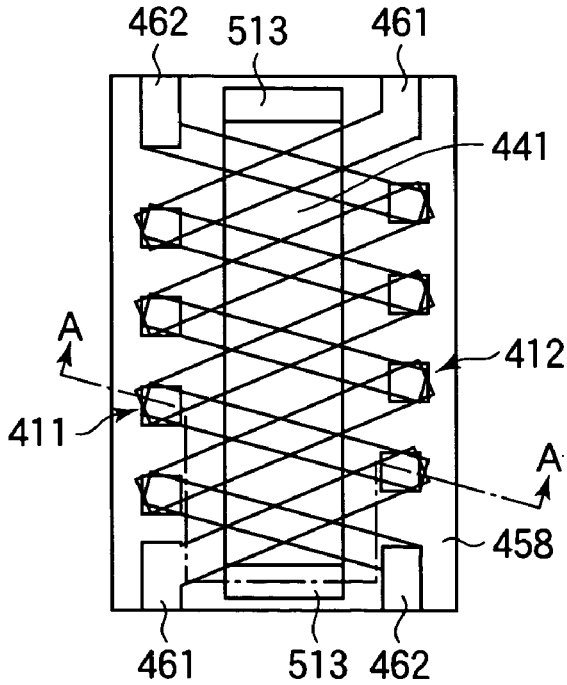
Figure 98A:
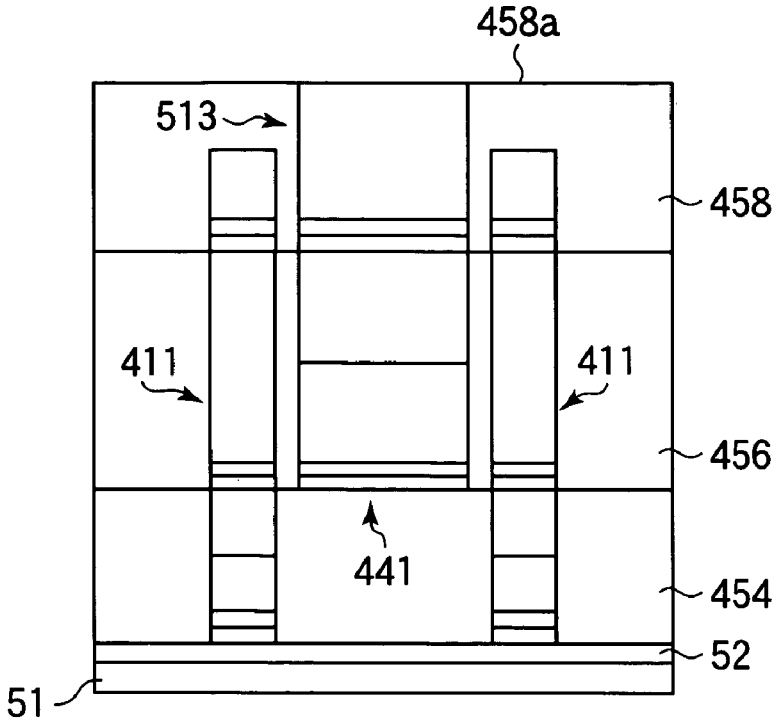
FIGS. 98A and 98B show the method of manufacturing the common mode choke coil 401 according to the third embodiment of the invention.
Figure 98B:
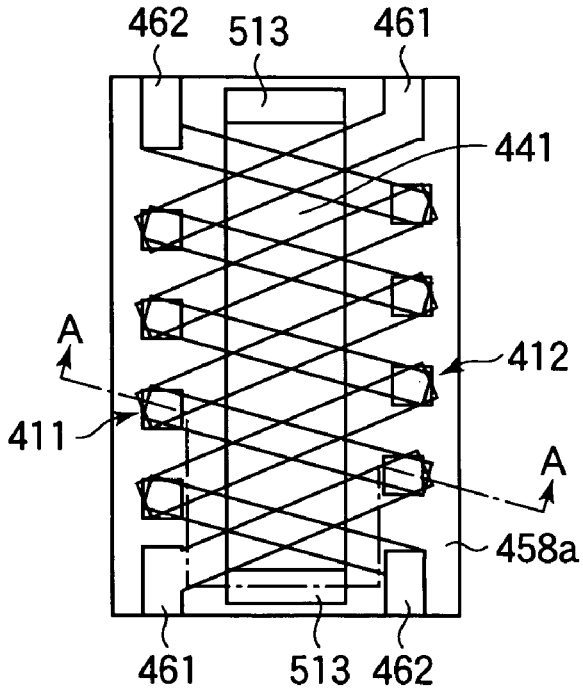

Next, as shown in FIGS. 97A and 97B, a film of alumina is formed throughout the surface using a sputtering process to provide an insulation layer (third insulation layer) 458 having a thickness in the range from 13 to 16 μm. As shown in FIGS. 98A and 98B, a CMP process is then performed to polish the insulation layer 458 until the closed magnetic path side parts 513 are exposed, whereby a planar surface 458*a* is formed.

Figure 99A:
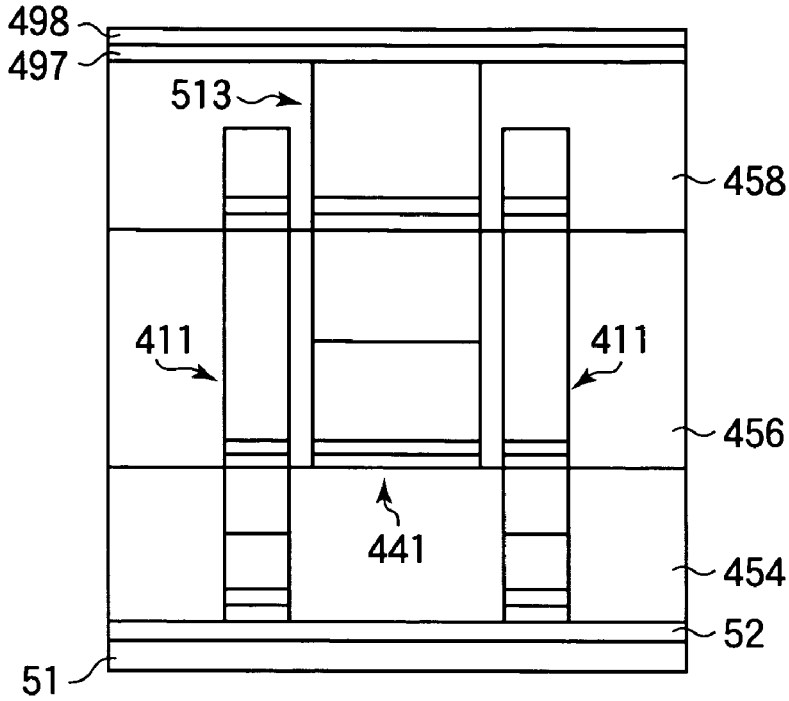
FIGS. 99A and 99B show the method of manufacturing the common mode choke coil 401 according to the third embodiment of the invention.
Figure 99B:
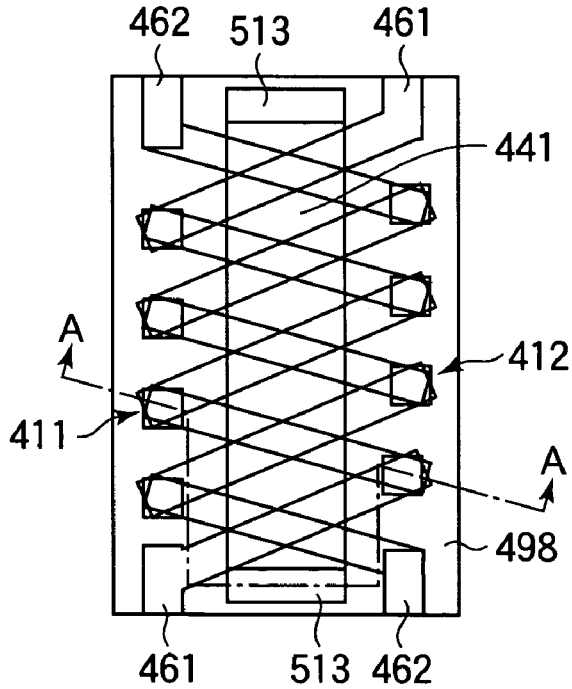

Next, as shown in FIGS. 99A and 99B, a Ti electrode film 497 having a thickness of about 10 nm is formed throughout the surface using a sputtering process, and a NiFe electrode film (fourth electrode film) 498 having a thickness of about 100 nm is formed on the electrode film 497 using a sputtering process.

Figure 100A:
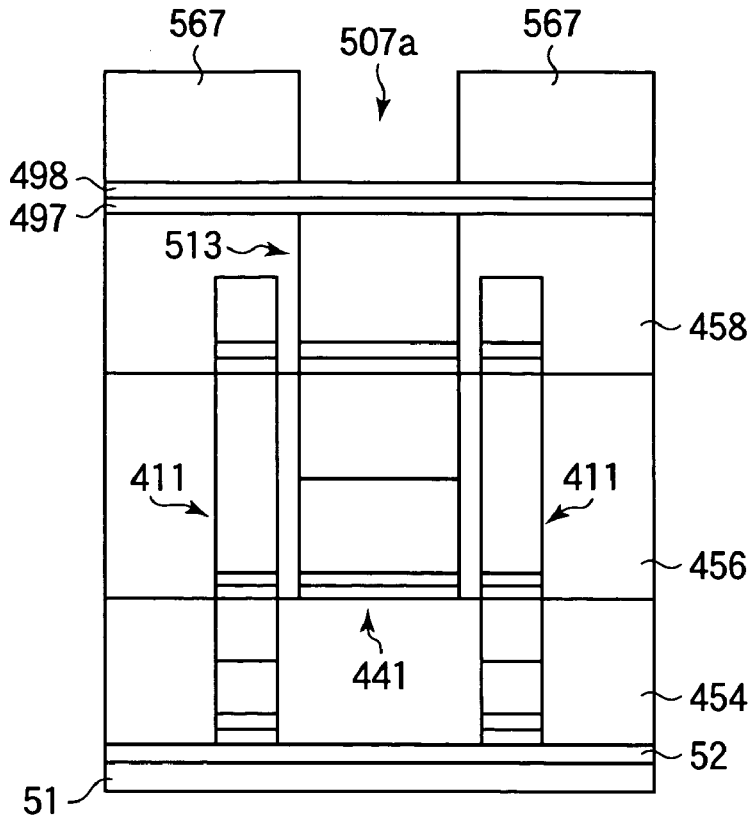
FIGS. 100A and 100B show the method of manufacturing the common mode choke coil 401 according to the third embodiment of the invention.
Figure 100B:
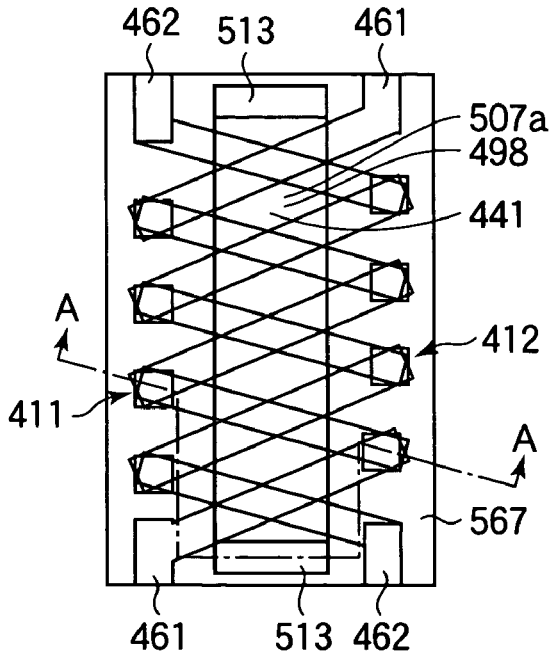
Figure 101A:
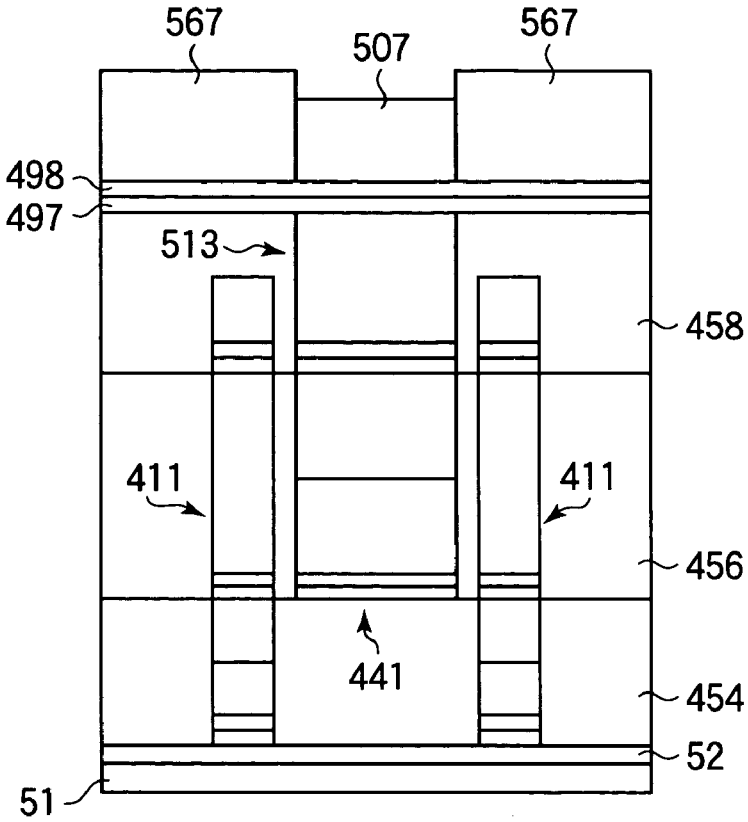
FIGS. 101A and 101B show the method of manufacturing the common mode choke coil 401 according to the third embodiment of the invention.
Figure 101B:
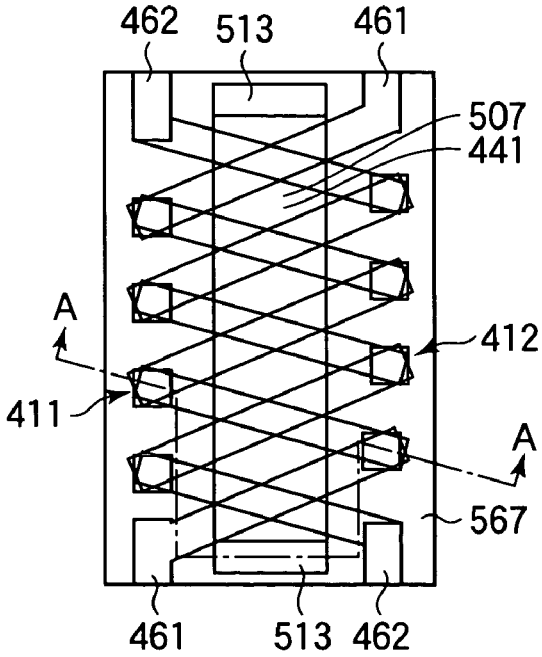

A resist is then applied to the electrode film 498 to form a resist layer (fifth resist layer) 567 having a thickness in the range from 8 to 13 μm. Next, as shown in FIGS. 100A and 100B, the resist layer 567 is patterned to form an opening (fifth opening) 507*a* in the resist layer 567. When the element forming region is viewed in the normal direction thereof, the opening 507*a* is formed in substantially the same size as the core 441 such that the electrode film 498 located on the closed magnetic path side parts 513 will be exposed at both sides of the opening. As shown in FIGS. 100A and 101B, a NiFe magnetic member layer (fourth magnetic member layer) 507 having a thickness in the range from 5 to 10 μm is then formed on the electrode film 498 in the opening 507*a* using a pattern plating process.

Figure 102A:
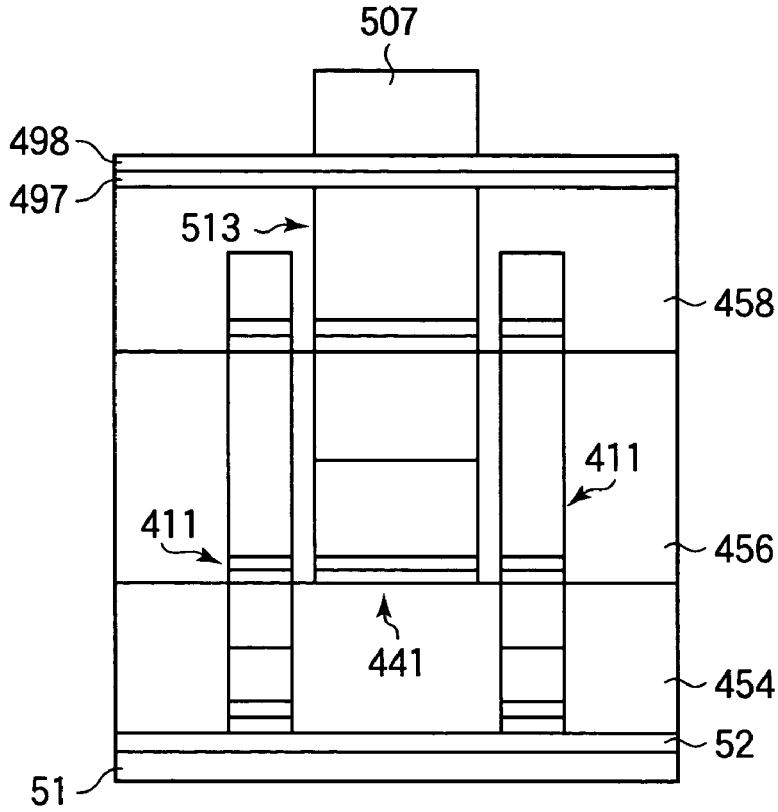
FIGS. 102A and 102B show the method of manufacturing the common mode choke coil 401 according to the third embodiment of the invention.
Figure 102B:
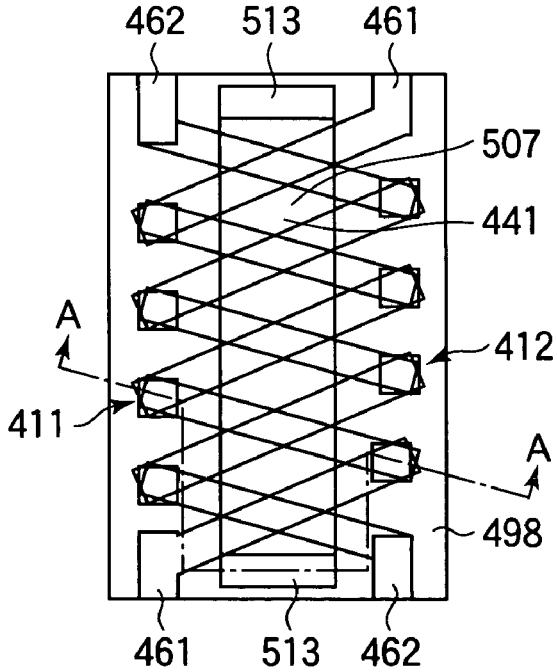
Figure 103A:
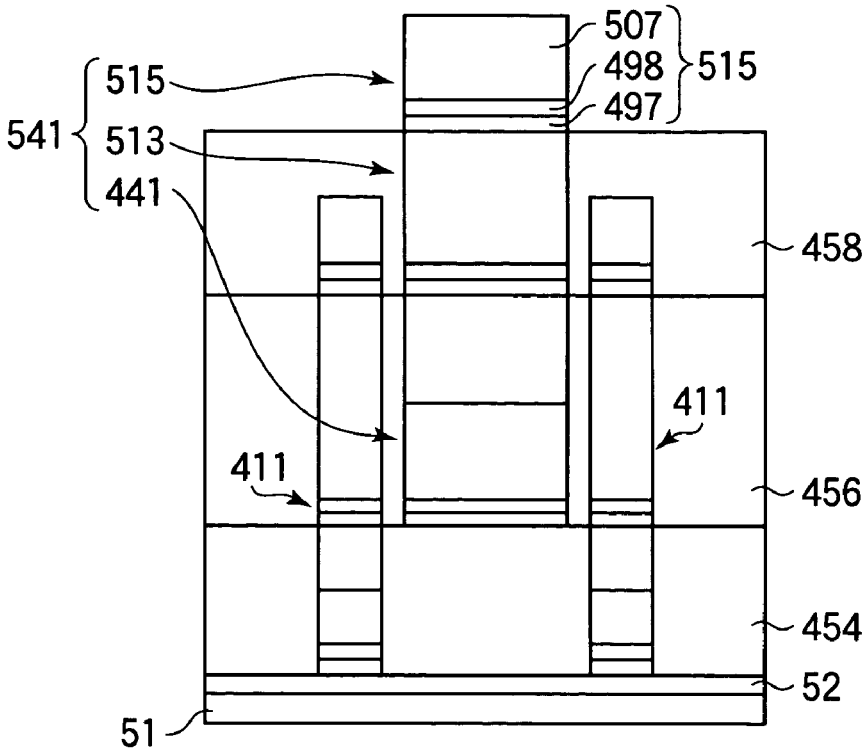
FIGS. 103A and 103B show the method of manufacturing the common mode choke coil 401 according to the third embodiment of the invention.
Figure 103B:
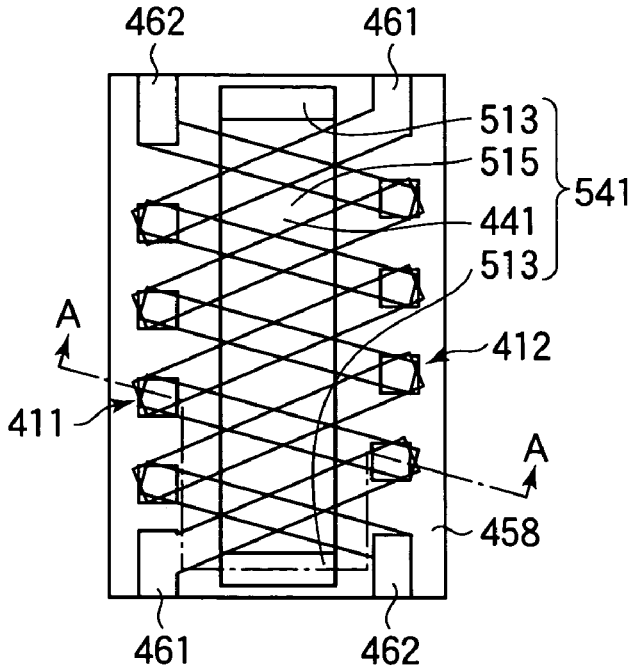

Next, as shown in FIGS. 102A and 102B, the resist layer 567 is etched away. As shown in FIGS. 103A and 103B, dry etching (milling) is then performed to remove the electrode film 498 which has been exposed as a result of the removal of the resist layer 567 and to remove the electrode film 497 located under the electrode film 498. When the electrode films 497 and 498 are removed, the surface of the magnetic member layer 507 is also etched in an amount substantially equivalent to the thickness of the electrode films 497 and 498. However, since the magnetic member layer 507 is formed sufficiently thick compared to the electrode films 497 and 498, the layer is not completely removed as a result of the dry etching. Thus, a closed magnetic path top part 515 having a multi-layer structure is provided by forming the electrode films 497 and 498 and the magnetic member layer 507 one over another. The closed magnetic path top part 515 is formed to face the core 441 with the coil top parts 435 and 436 interposed between them.

Through the above-described steps, a closed magnetic path 541 is formed, the closed magnetic path 541 being constituted by the core 441, the closed magnetic path top part 515 and the two closed magnetic path side parts 513. The closed magnetic path 541 is formed substantially orthogonally to the element forming region.

Figure 104A:
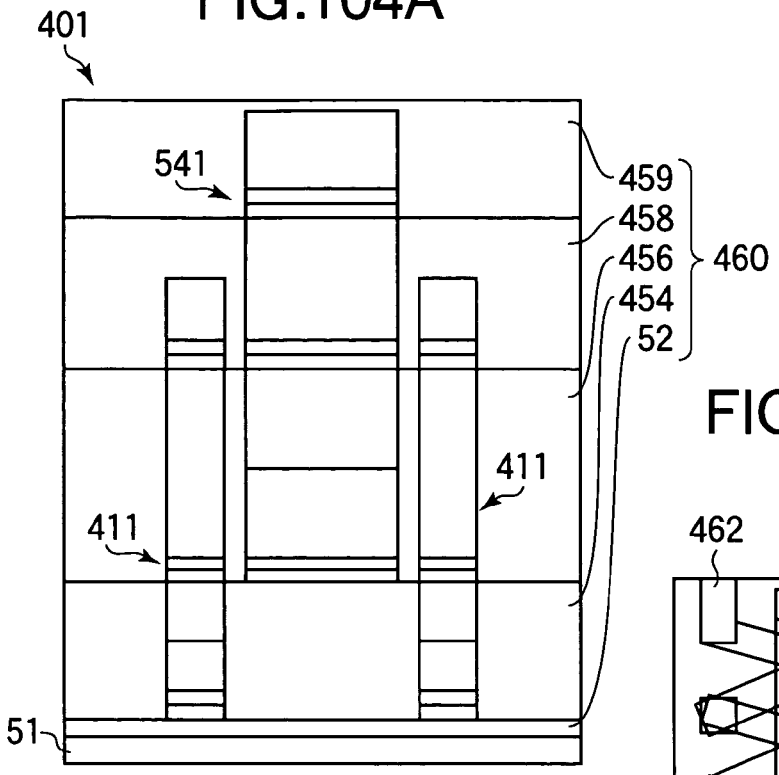
FIGS. 104A, 104B, and 104C show the method of manufacturing the common mode choke coil 401 according to the third embodiment of the invention.
Figure 104B:
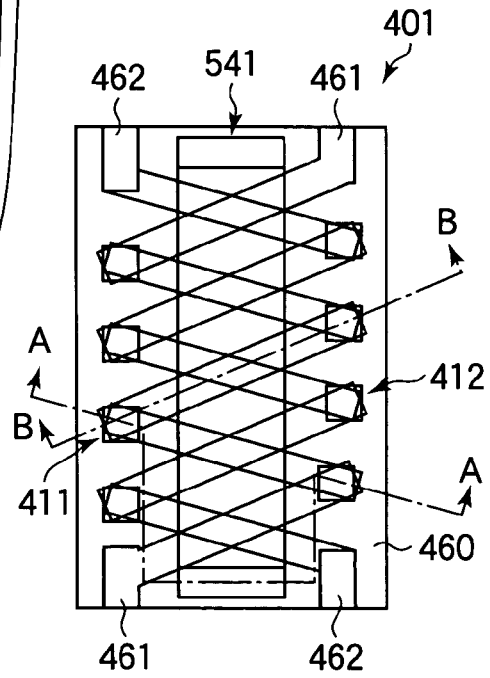
Figure 104C:
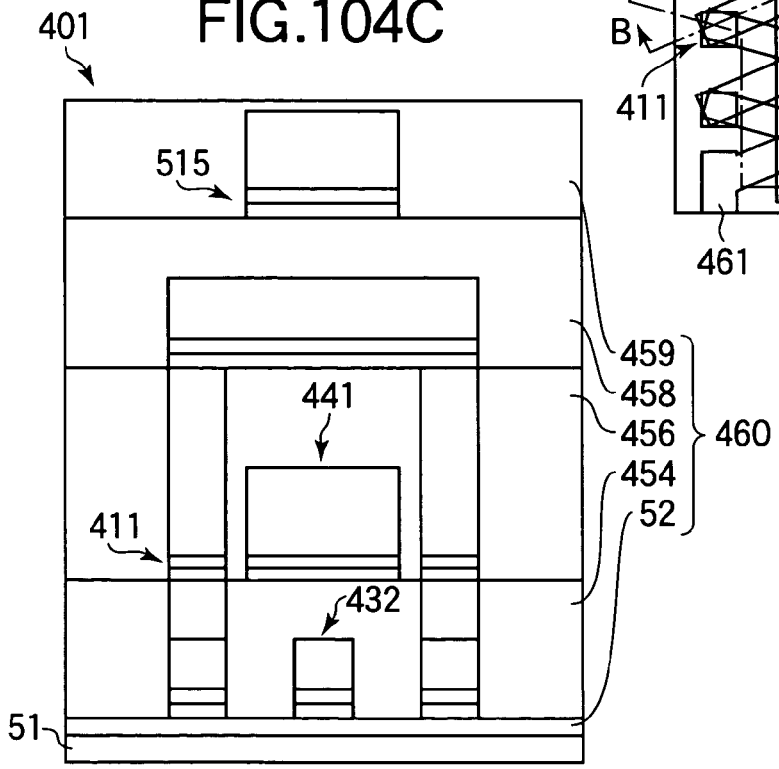

Next, as shown in FIGS. 104A, 104B, and 104C, a film of alumina is formed throughout the surface using a sputtering process to form an insulation layer 459 having a thickness of about 10 μm which is to serve as a protective film. FIG. 104A is a sectional view taken along the line A-A in FIG. 104B, and FIG. 104C is a sectional view taken along the line B-B in FIG. 104B. The insulation layer 459 may be formed from an insulating material other than alumina. Through the above-described steps, an insulation layer 460 having a multi-layer structure is provided by forming the insulation layers 52, 454, 456, 458, and 459 one over another. The first and second helical coil units 411 and 412 and the closed magnetic path 541 are enclosed in the insulation layer 460.

Next, the silicon path 51 is ground from the bottom thereof to achieve a desired thickness or to remove the substrate completely. The wafer is then cut along predetermined cutting lines to divide a plurality of the common mode choke coils 401 formed on the wafer into each element forming region in the form of a chip. The external electrode connecting parts 461 and 462 are partially exposed on an outer surface of the insulation layer 460. Although not shown, external electrodes are then formed on the cut surfaces in electrical connection with the external electrode connecting parts 461 and 462 exposed on the cut surfaces. Next, chamfering is performed on corners of the chip to complete a common mode choke coil 401.

As described above, the method of manufacturing the common mode choke coil 401 of the present embodiment is similar to the method of manufacturing the common mode choke coil 1 of the first embodiment in that the first and second helical coil units 411 and 412 having axes of spiral substantially in parallel with the substrate surface and the closed magnetic path 541 can be formed at a series of manufacturing steps using thin film formation techniques. Therefore, a step for bonding a magnetic substrate is not required for the common mode choke coil 401 of the present embodiment. The number of manufacturing steps is thus reduced to allow a reduction in manufacturing cost.

Fourth Embodiment

A common mode choke coil according to a fourth embodiment of the invention will now be described with reference to FIGS. 105A to 136C. A common mode choke coil 601 of the present embodiment is characterized by the method of manufacturing the same. The configuration of a common mode choke coil 601 completed by the method of manufacturing will not be described because it is similar to that of the common mode choke coil 401 of the third embodiment. Elements having functions and effects like those of the elements in the third embodiment are indicated by like reference numerals and will not be described in detail.

A method of manufacturing a common mode choke coil 601 according to the present embodiment will now be described with reference to FIGS. 105A to 136C. FIGS. 105A to 136C show an element forming region of one common mode choke coil 601. FIGS. 105 to 136 having a suffix A are sectional views taken along lines A-A in FIGS. 105 to 136 having a suffix B. FIGS. 105 to 136 having a suffix B are plan views showing the method of manufacturing a common mode choke coil 601.

First, an insulation layer (bottom insulation layer) 52 and Cu conductive layers 481 and 482 are formed on a silicon path 51 using the same manufacturing method as for the common mode choke coil 401 of the third embodiment (see FIGS. 61A to 65B).

Figure 105A:
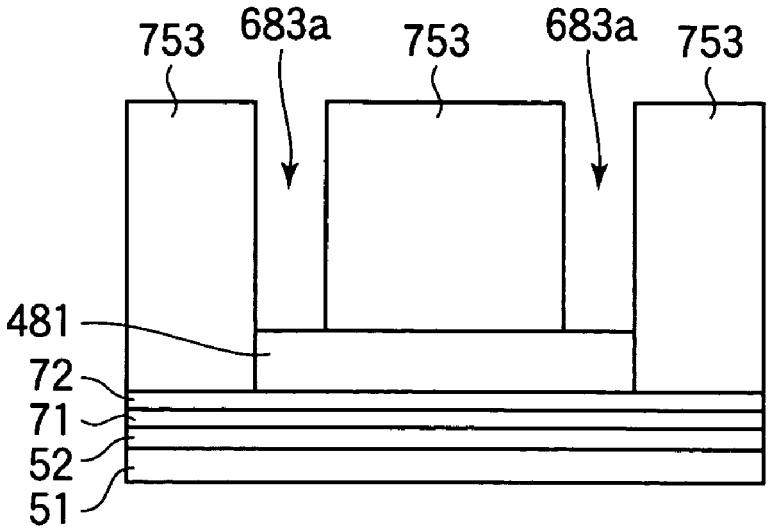
FIGS. 105A and 105B show a method of manufacturing a common mode choke coil 601 according to a fourth embodiment of the invention.
Figure 105B:
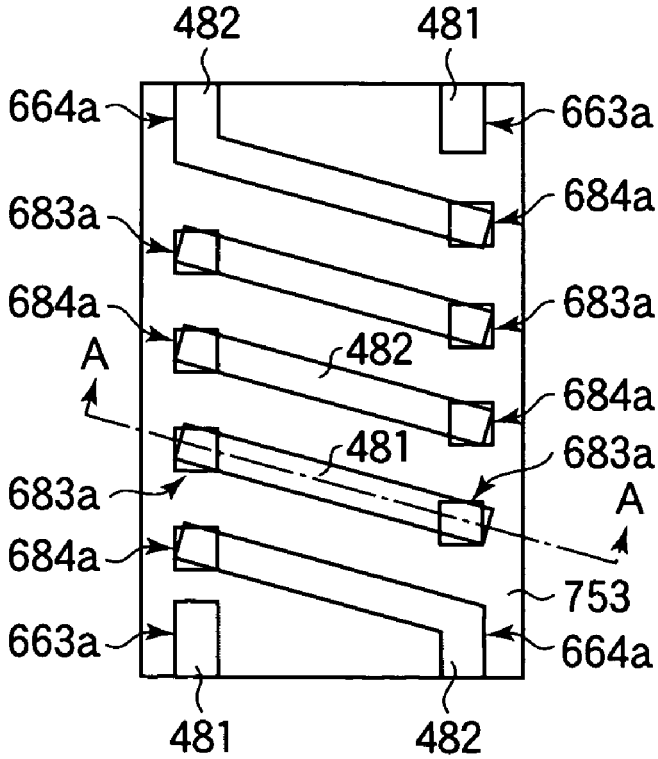
Figure 106A:
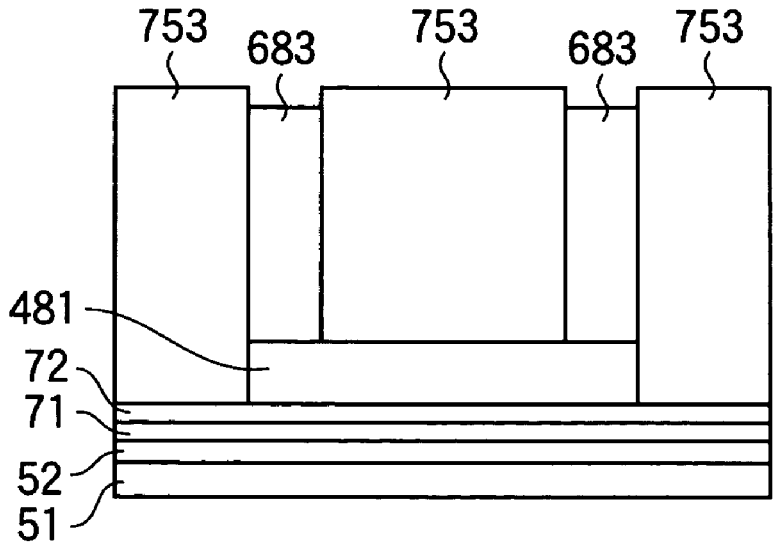
FIGS. 106A and 106B show the method of manufacturing the common mode choke coil 601 according to the fourth embodiment of the invention.
Figure 106B:
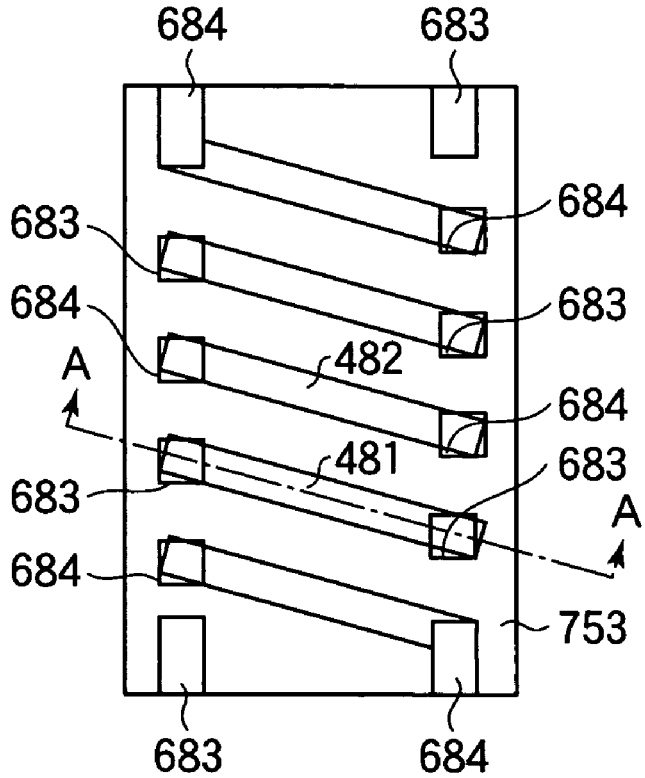

Next, a resist is applied throughout the resultant surface to form a resist layer (second resist layer) 753 having a thickness in the range from 20 to 30 μm. Next, as shown in FIGS. 105A and 105B, the resist layer 753 is patterned to form the resist layer 753 with openings (second openings) 683*a* and 684*a* for exposing both ends of a plurality of conductive layers 481 and 482 formed in an elongate shape, respectively, and openings 663*a* and 664*a* for exposing the conductive layers 481 and 482 formed in parallel on each of shorter sides of the outer circumference of the element forming region in positions near the longer sides of the region. As shown in FIG. 105B, the plurality of openings 683*a* and 684*a* formed above one end of the plurality of respective conductive layers 481 and 482 are alternately disposed on a straight line at equal intervals, and the plurality of openings 683*a* and 684*a* formed above another end of the respective layers are alternately disposed on a straight line at equal intervals. Next, as shown in FIGS. 106A and 106B, Cu conductive layers (second conductive layers) 683 having a thickness in the range from about 10 μm to about 18 μm are formed on the conductive layers 481 in the openings 663*a* and 683*a*, and conductive layers (second conductive layers) 684 are formed from the same material with the same thickness on the conductive layers 482 in the openings 664*a* and 684*a*. The conductive layers 683 and 684 are simultaneously formed using, for example, a pattern plating process. Thus, the conductive layers 683 are electrically connected to the conductive layers 481 located under the same, and the conductive layers 684 are electrically connected to the conductive layers 482 located under the same.

Figure 107A:
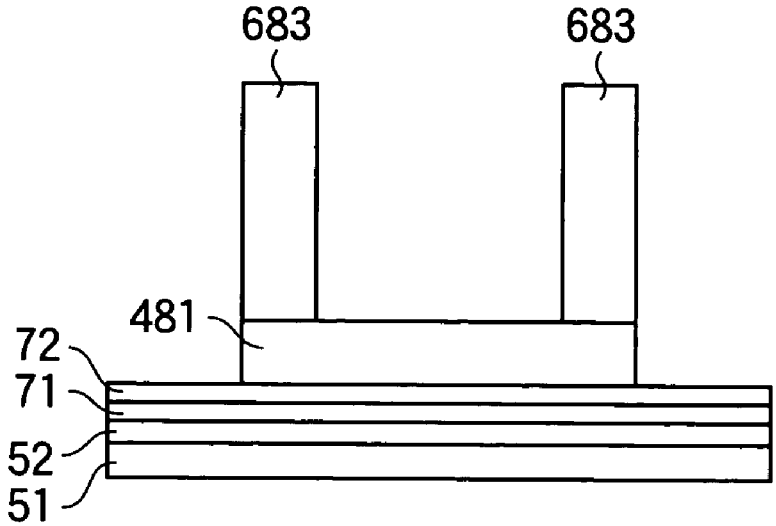
FIGS. 107A and 107B show the method of manufacturing the common mode choke coil 601 according to the fourth embodiment of the invention.
Figure 107B:
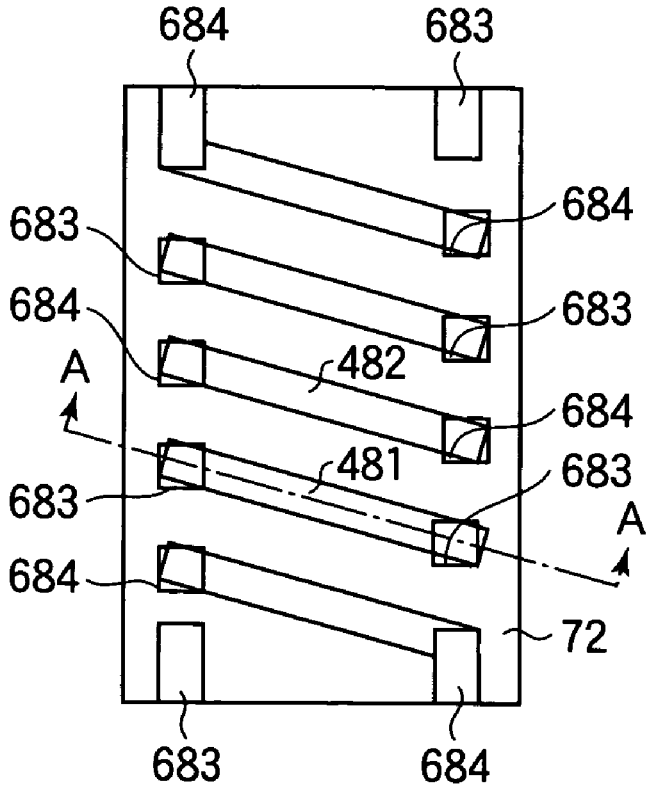
Figure 108A:
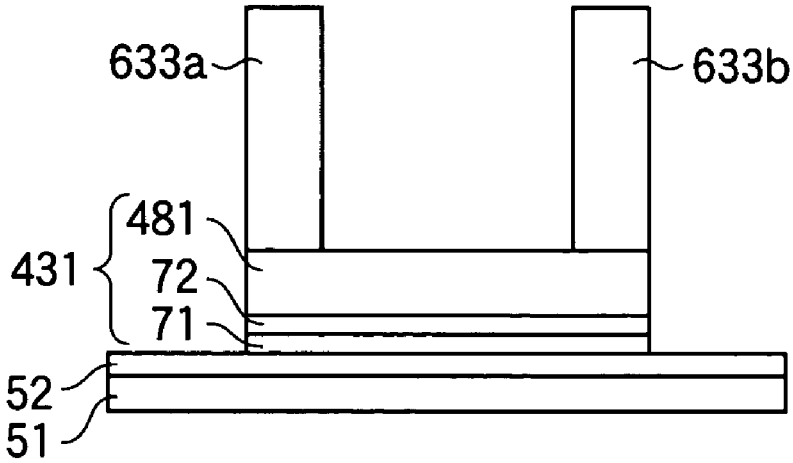
FIGS. 108A and 108B show the method of manufacturing the common mode choke coil 601 according to the fourth embodiment of the invention.
Figure 108B:
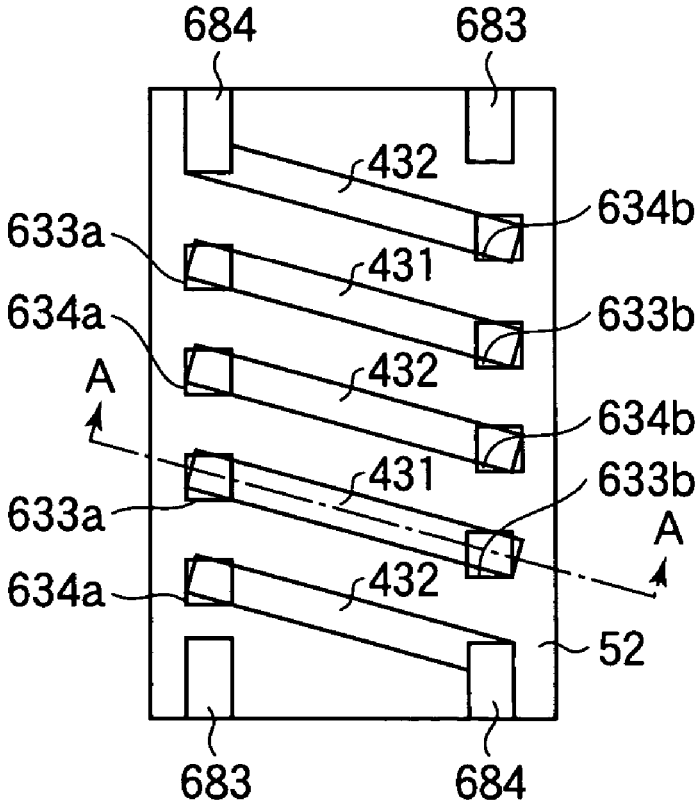

Next, as shown in FIGS. 107A and 107B, the resist layer 753 is etched away. As shown in FIGS. 108A and 108B, dry etching (milling) is then performed to remove an electrode film 72 which has been exposed as a result of the removal of the resist layer 753 and to remove an electrode film 71 located under the electrode film 72. When the electrode films 71 and 72 are removed, the surfaces of the conductive layers 481, 482, 683, and 684 are also etched in an amount substantially equivalent to the thickness of the electrode films 71 and 72. Since the conductive layers 481, 482, 683, and 684 are formed sufficiently thick compared to the electrode films 71 and 72, the layers are not completely removed as a result of the dry etching. Each of electrode films to be described later is removed using the same method as for the electrode films 71 and 72. Through the above-described steps, coil bottom parts 431 having a multi-layer structure are provided by forming the electrode films 71 and 72 and the conductive layers 481 one over another, and coil bottom parts 432 having a multi-layer structure are provided by forming the electrode films 71 and 72 and the conductive layers 482 one over another. The coil bottom parts 431 and 432 are alternately formed in parallel on the silicon substrate 51. At the same time, coil side parts 633*a* and 633*b* constituted by the conductive layers 683 are provided on both ends of the coil bottom parts 431 respectively, and coil side parts 634*a* and 634*b* constituted by the conductive layers 684 are provided on both ends of the coil bottom parts 432 respectively. Referring to FIG. 108B, the coil side parts 633*a* and 634*a* are alternately disposed on the left side to align on a straight line at equal intervals, and the coil side parts 633*b* and 634*b* are alternately disposed on the right side to align on a straight line at equal intervals.

Figure 109A:
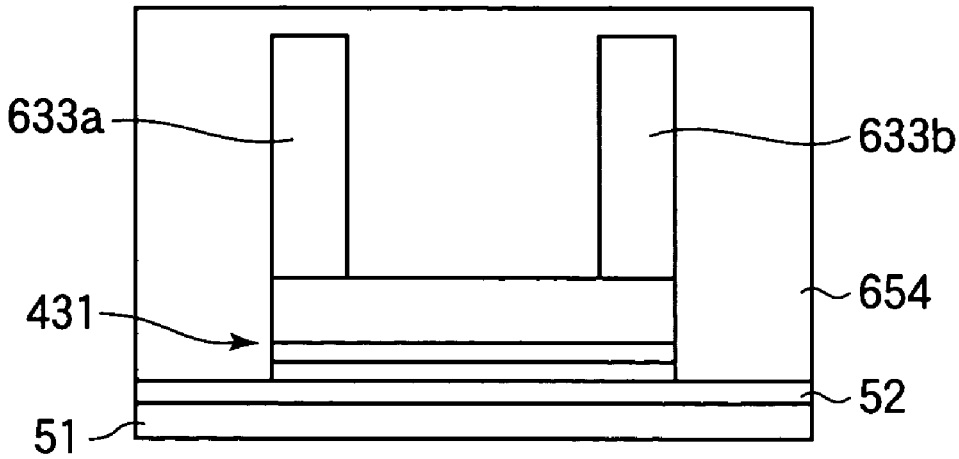
FIGS. 109A and 109B show the method of manufacturing the common mode choke coil 601 according to the fourth embodiment of the invention.
Figure 109B:
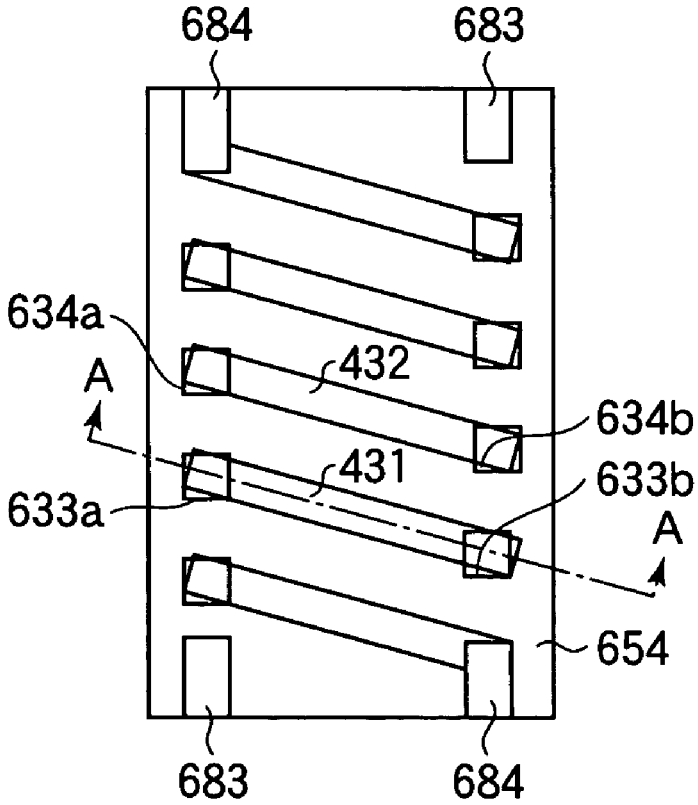
Figure 110A:
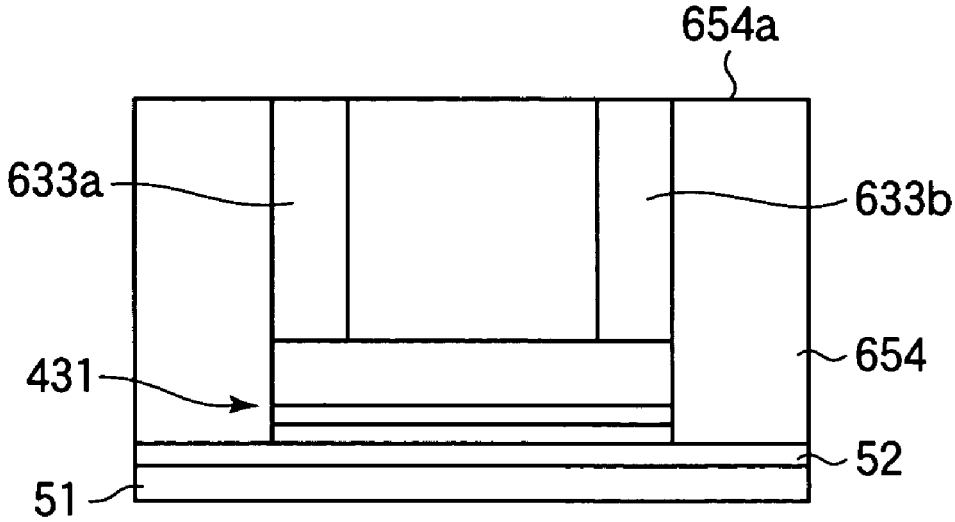
FIGS. 110A and 110B show the method of manufacturing the common mode choke coil 601 according to the fourth embodiment of the invention.
Figure 110B:
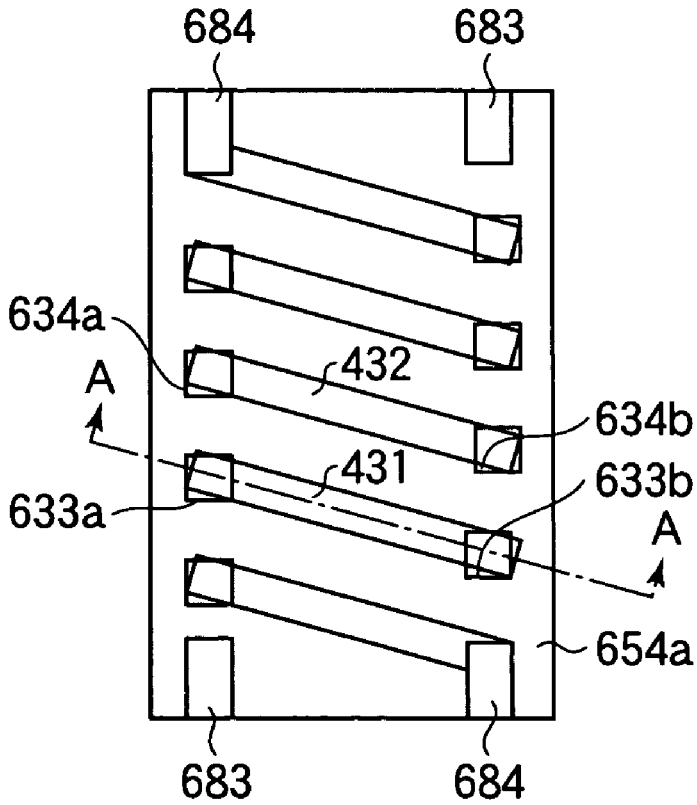

Next, as shown in FIGS. 109A and 109B, a film of alumina is formed throughout the resultant surface using a sputtering process to provide an insulation layer (first insulation layer) 654 having a thickness in the range from 17 to 28 μm. As shown in FIGS. 110A and 110B, a CMP (chemical mechanical polishing) process is then performed to polish the surface of the insulation layer 654 until the tops of the coil side parts 633*a*, 633*b*, 634*a*, and 634*b* are exposed, whereby a planar surface (CMP surface) 654*a* is formed. Visual observation is conducted to check whether the coil side parts 633*a*, 633*b*, 634*a*, and 634*b* have been exposed or not.

Figure 111A:
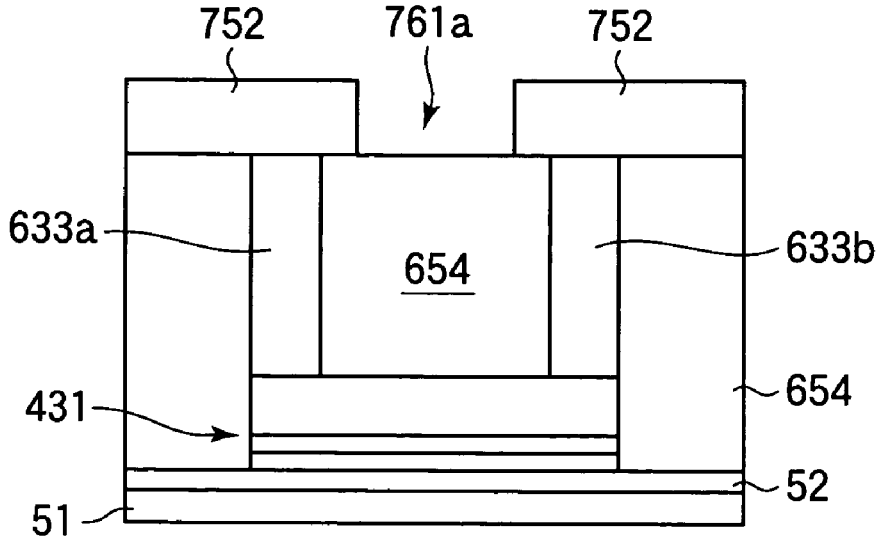
FIGS. 111A and 111B show the method of manufacturing the common mode choke coil 601 according to the fourth embodiment of the invention.
Figure 111B:
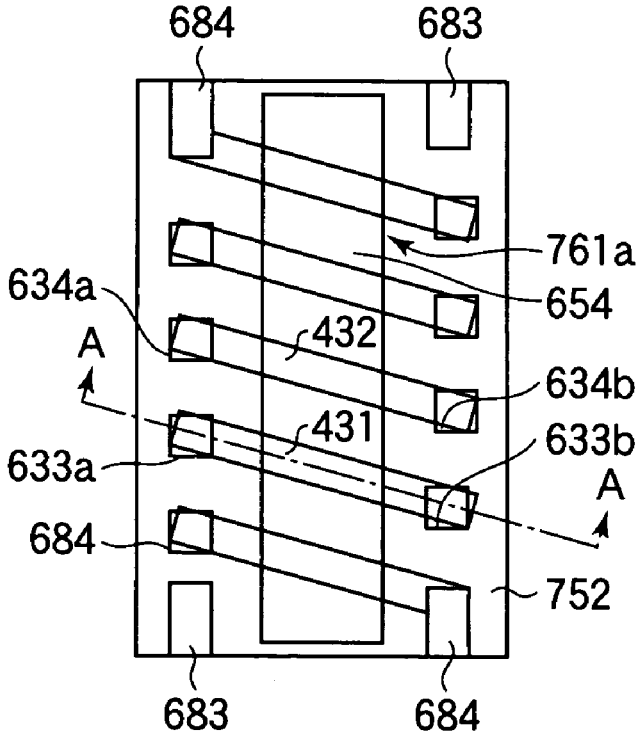

A resist is then applied throughout the resultant surface to form a resist layer (first intervening resist layer) 752 having a thickness of about 3 μm. Next, as shown in FIGS. 111A and 111B, the resist layer 752 is patterned to form an opening (first intervening opening) 761*a* for exposing the insulation layer 654 in the resist layer 752. When the element forming region is viewed in the normal direction thereof, the opening 761*a* is formed like a rectangular shape and is disposed between the coil side parts 633*a*, 634*a* and the coil side parts 633*b* and 634*b* so as to extend across the coil bottom parts 431 and 432 at a predetermined angle.

Figure 112A:
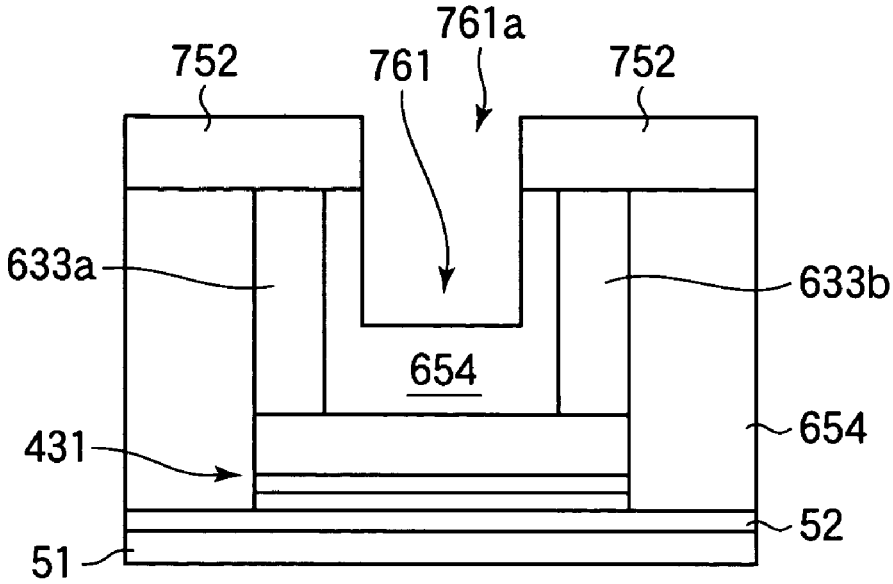
FIGS. 112A and 112B show the method of manufacturing the common mode choke coil 601 according to the fourth embodiment of the invention.
Figure 112B:
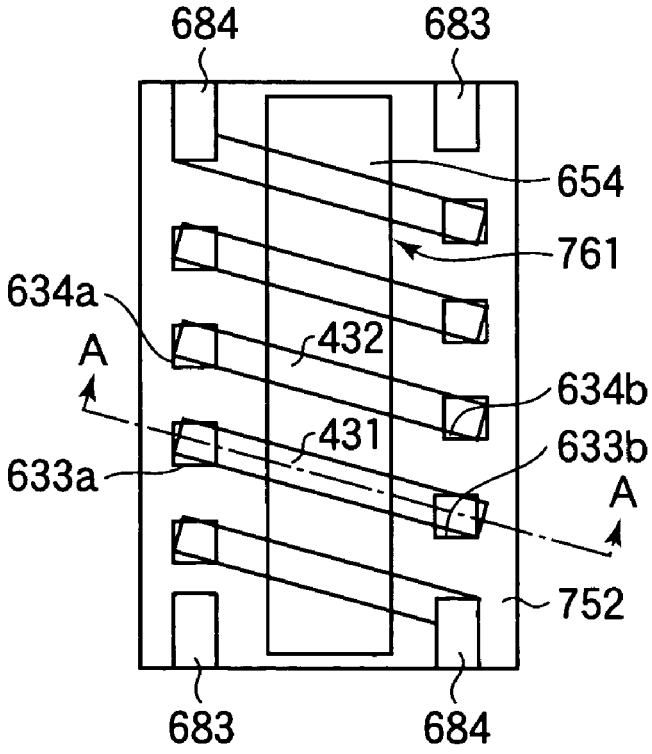
Figure 113A:
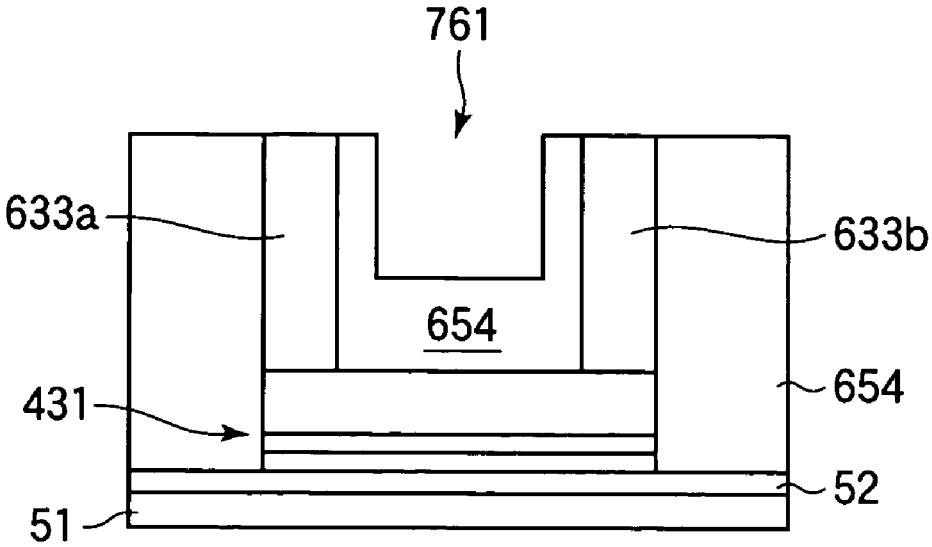
FIGS. 113A and 113B show the method of manufacturing the common mode choke coil 601 according to the fourth embodiment of the invention.
Figure 113B:
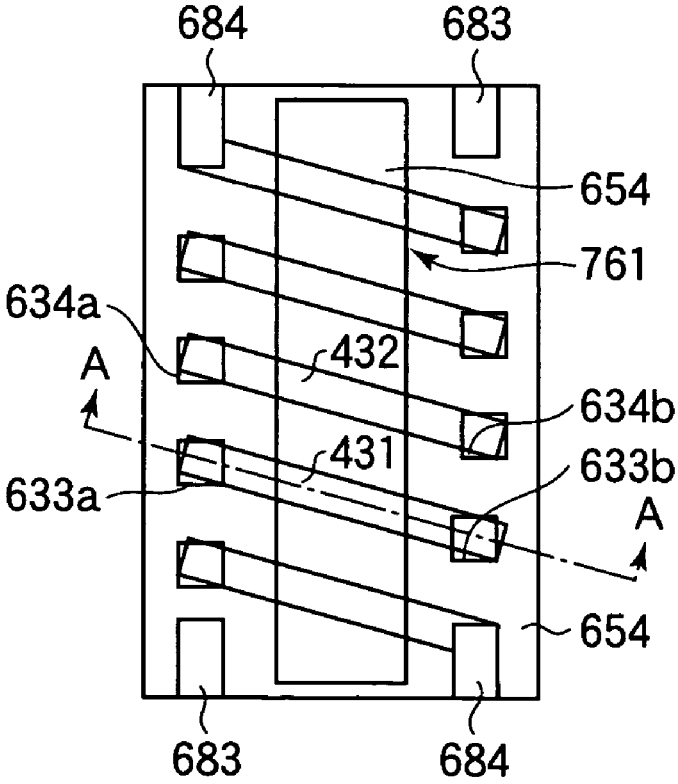

Next, as shown in FIGS. 112A and 112B, the insulation layer 654 exposed in the opening 761*a* is etched by performing reactive ion etching (RIE) to form a groove 761 having substantially the same shape as the opening 761*a* and a depth in the range from 8 to 13 μm on the insulation layer 654. The process is carried out such that the coil bottom parts 431 and 432 are not exposed on the bottom of the groove 761 and such that the coil side parts 633*a*, 633*b*, 634*a*, and 634*b* are not exposed on sides of the groove 761. Next, as shown in FIGS. 113A and 113B, the resist layer 752 is etched away.

Figure 114A:
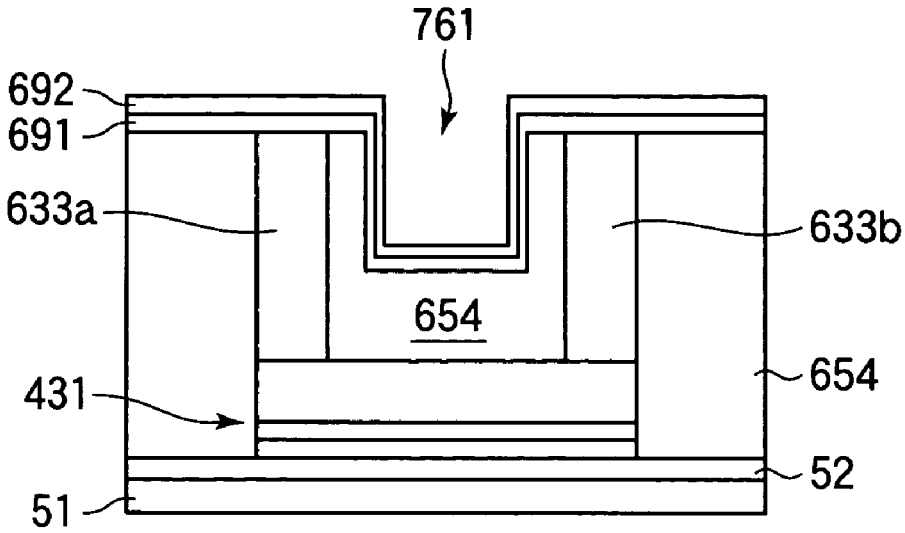
FIGS. 114A and 114B show the method of manufacturing the common mode choke coil 601 according to the fourth embodiment of the invention.
Figure 114B:
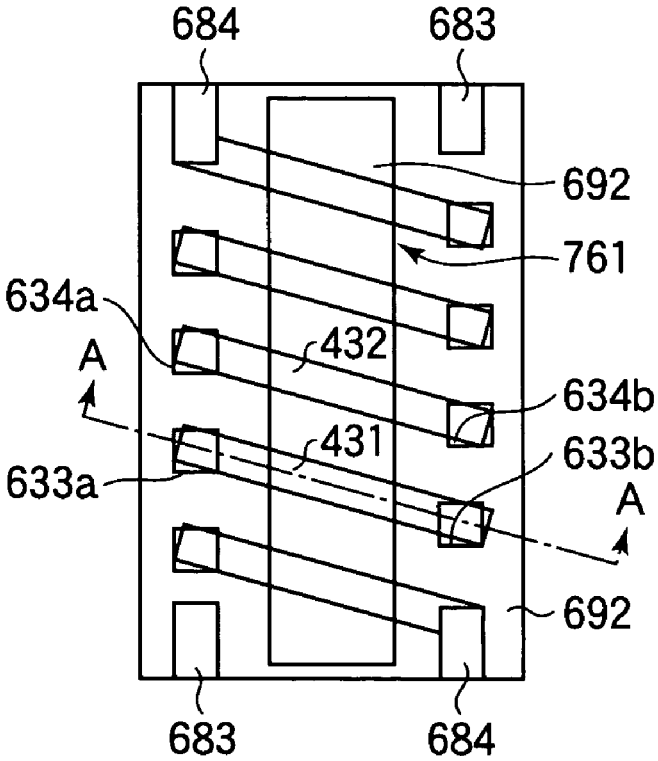

Next, as shown in FIGS. 114A and 114B, a Ti electrode film 691 having a thickness of about 10 nm is formed throughout the resultant surface using a sputtering process, and a NiFe electrode film (first intervening electrode film) 692 having a thickness of about 100 nm is then formed on the electrode film 691 using a sputtering process. The electrode films 691 and 692 are also formed on the sides of the groove 761 to a thickness smaller than that of the electrode films 691 and 692 formed on the bottom of the groove 761. The electrode film 691 is formed as a buffer film for improving the adhesion between the electrode film 692 and the insulation layer 654. The electrode film 692 is also used as an electrode film for plating the pattern of a magnetic member layer 701 which will be described later.

Figure 115A:
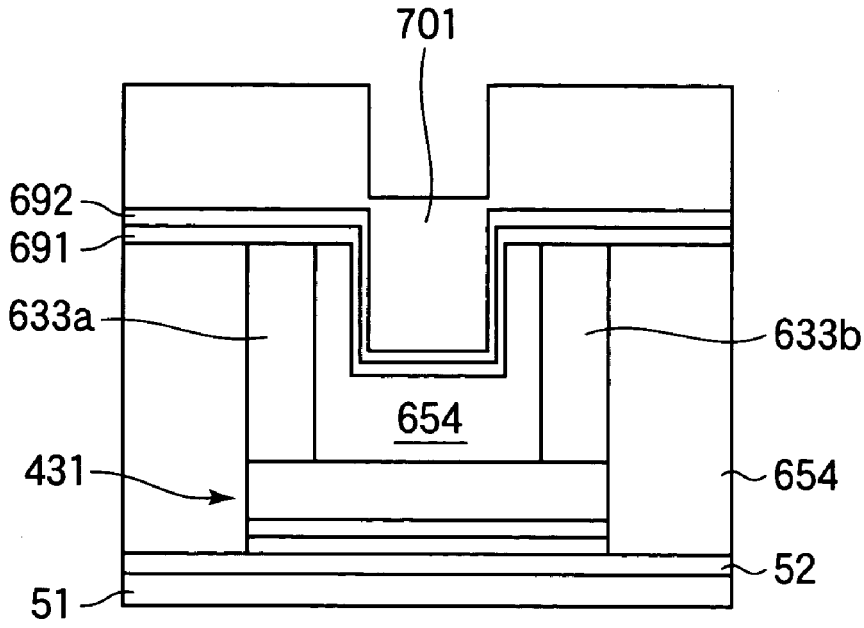
FIGS. 115A and 115B show the method of manufacturing the common mode choke coil 601 according to the fourth embodiment of the invention.
Figure 115B:
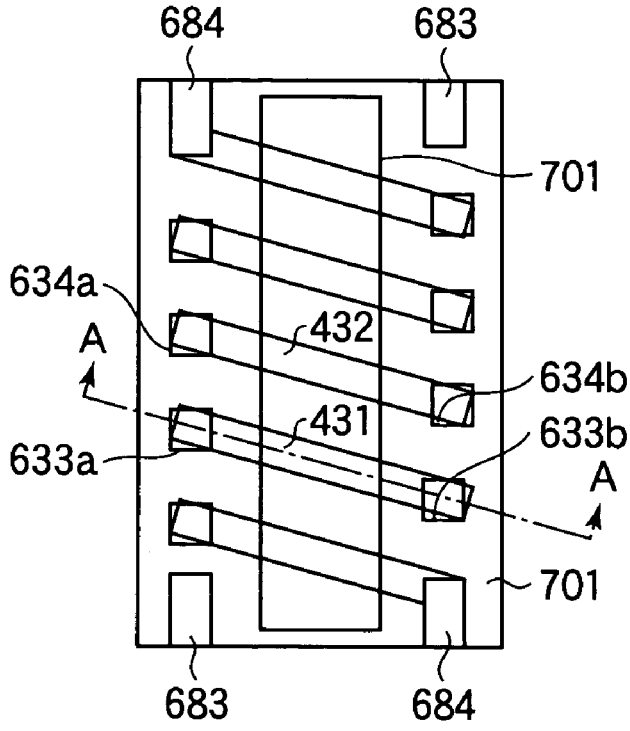

Next, as shown in FIGS. 115A and 115B, a NiFe magnetic member layer (first magnetic member layer) 701 having a thickness in the range from 7 to 10 μm is formed on the electrode film 692 using, for example, a pattern plating process. The magnetic member layer 701 may be formed from a material having high permeability other than NiFe.

Figure 116A:
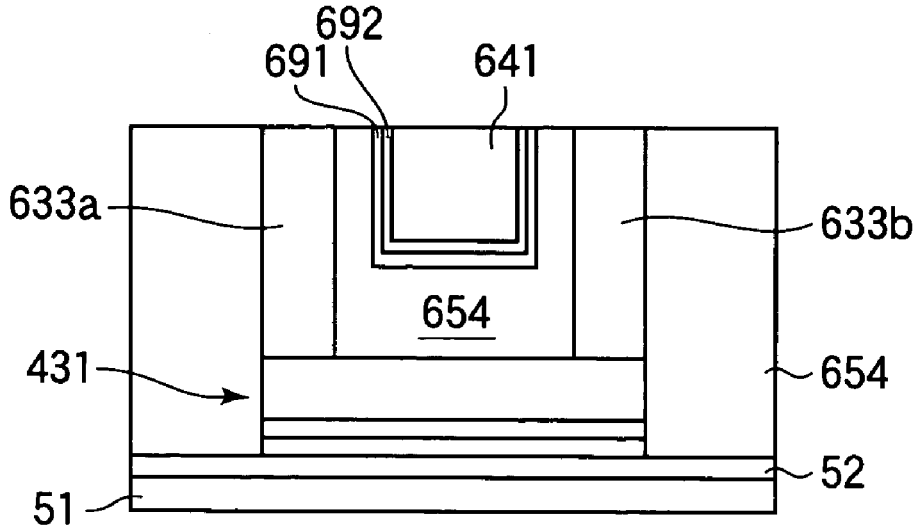
FIGS. 116A and 116B show the method of manufacturing the common mode choke coil 601 according to the fourth embodiment of the invention.
Figure 116B:
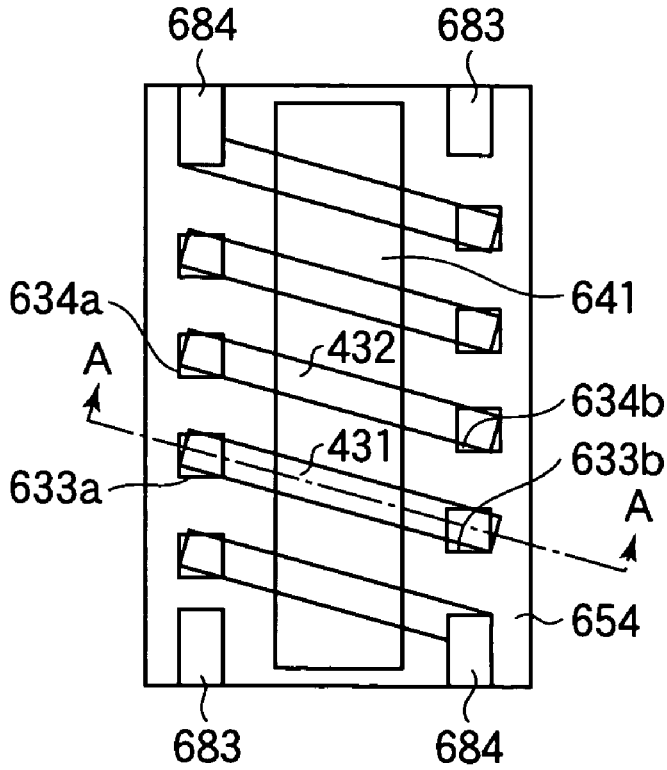

Next, as shown in FIGS. 116A and 116B, a CMP process is performed to polish the magnetic member layer 701 and the electrode films 692 and 691 until the top of the insulation layer 654 is exposed. As a result, parts of the electrode films 691 and 692 and the magnetic member layer 701 formed outside the groove 761 are removed. Through the above-described steps, a core 641 constituted by the magnetic member layer 701 is formed in the groove 761.

Figure 117A:
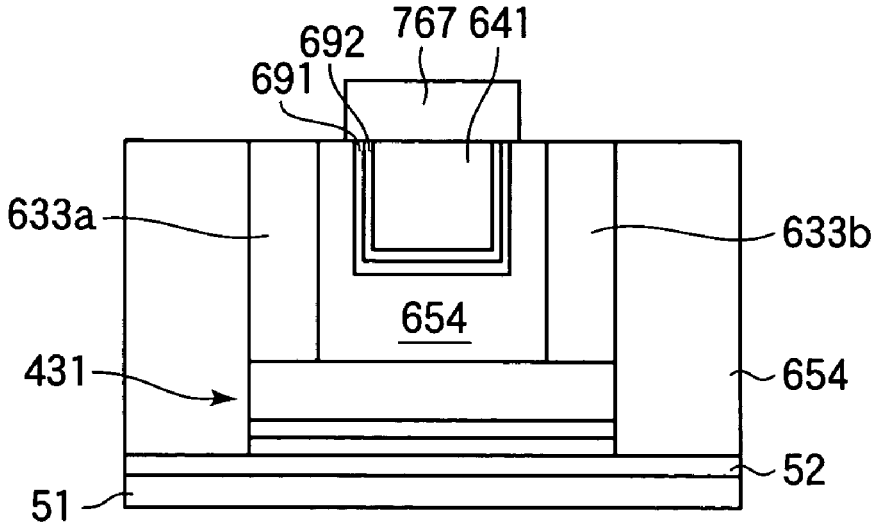
FIGS. 117A and 117B show the method of manufacturing the common mode choke coil 601 according to the fourth embodiment of the invention.
Figure 117B:
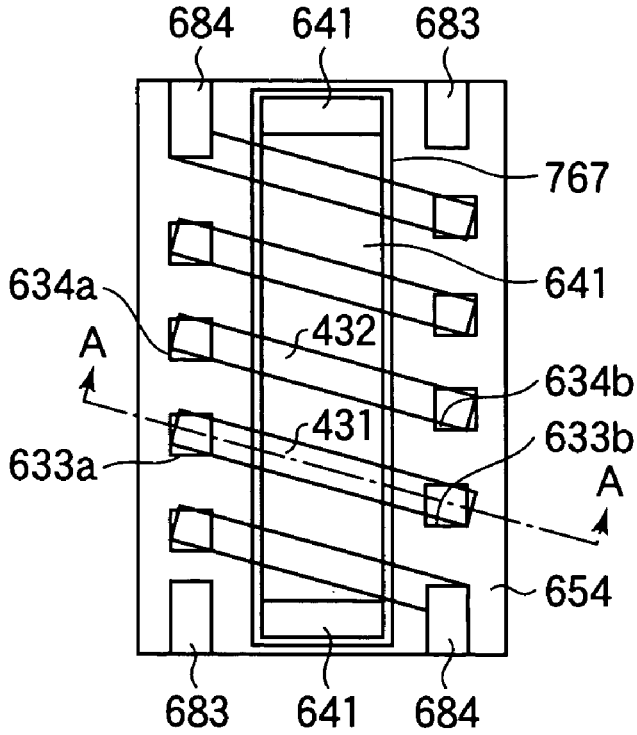
Figure 118A:
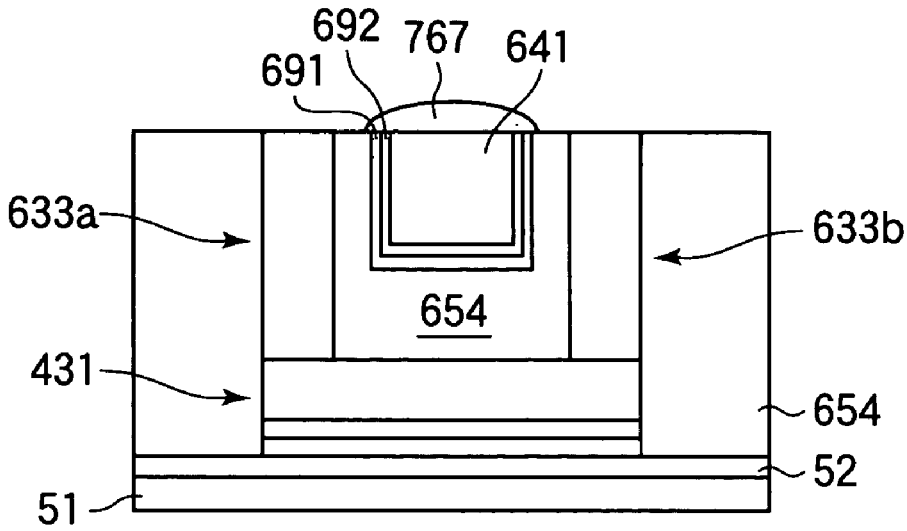
FIGS. 118A and 118B show the method of manufacturing the common mode choke coil 601 according to the fourth embodiment of the invention.
Figure 118B:
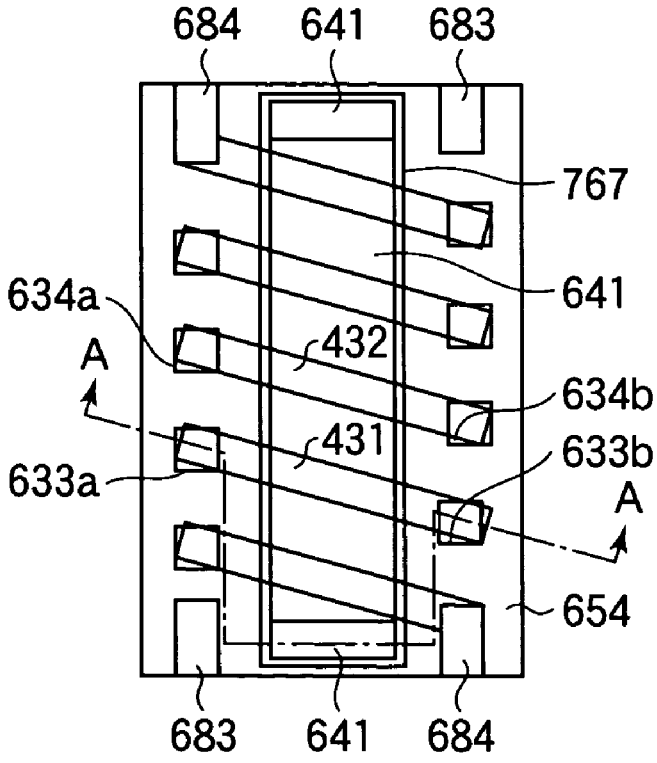

A resist is then applied throughout the resultant surface to form a resist layer having a thickness of about 5 μm. Next, as shown in FIGS. 117 and 117B, the resist layer is patterned to form a resist layer 767 in the form of a rectangular parallelepiped on the core 641 and the electrode films 291 and 292, both end portions of the core 641 constituting the shorter sides of the core and the electrode films 291 and 292 around the end portions being exposed outside the resist layer. The resist layer 767 is used as an organic insulation film for insulating the electrode films 691 and 692 and the core 641 from coil top parts 635 and 636 which will be described later. Next, as shown in FIGS. 118A and 118B, the resist layer 767 is cured by heat to improve insulating properties.

Figure 119A:
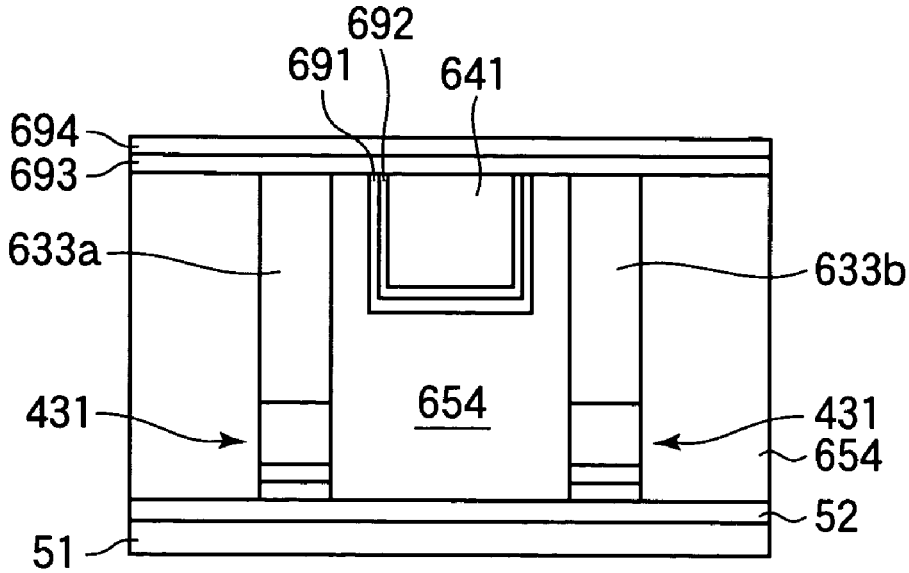
FIGS. 119A and 119B show the method of manufacturing the common mode choke coil 601 according to the fourth embodiment of the invention.
Figure 119B:
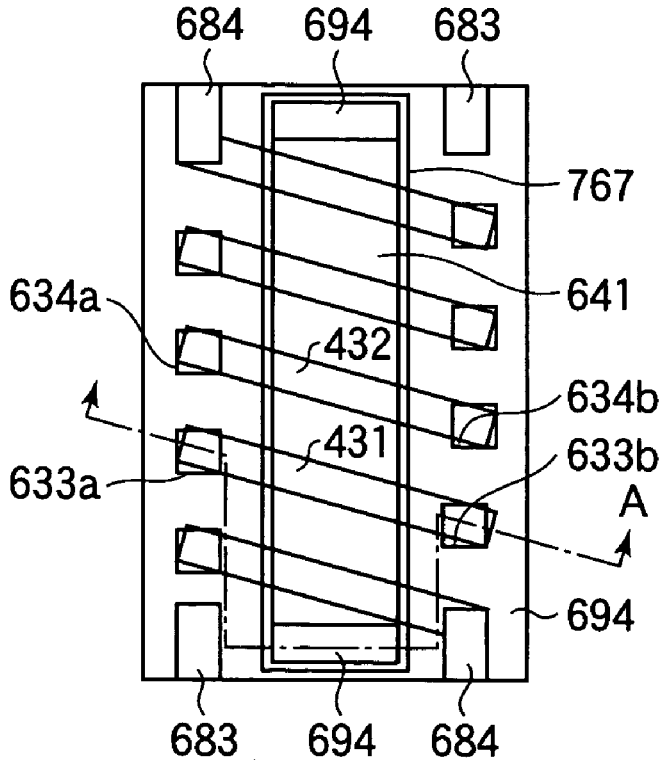

As shown in FIGS. 119A and 119B, a Ti electrode film 693 having a thickness of about 10 nm is formed throughout the surface using a sputtering process, and a NiFe electrode film (second intervening electrode films) 694 having a thickness of about 100 nm is then formed on the electrode film 693 using a sputtering process.

Figure 120A:
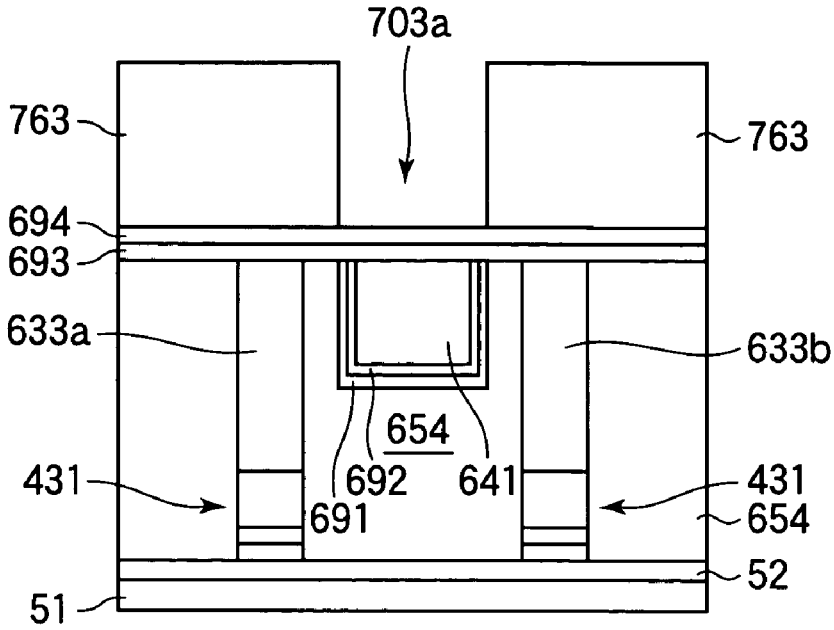
Figure 120B:
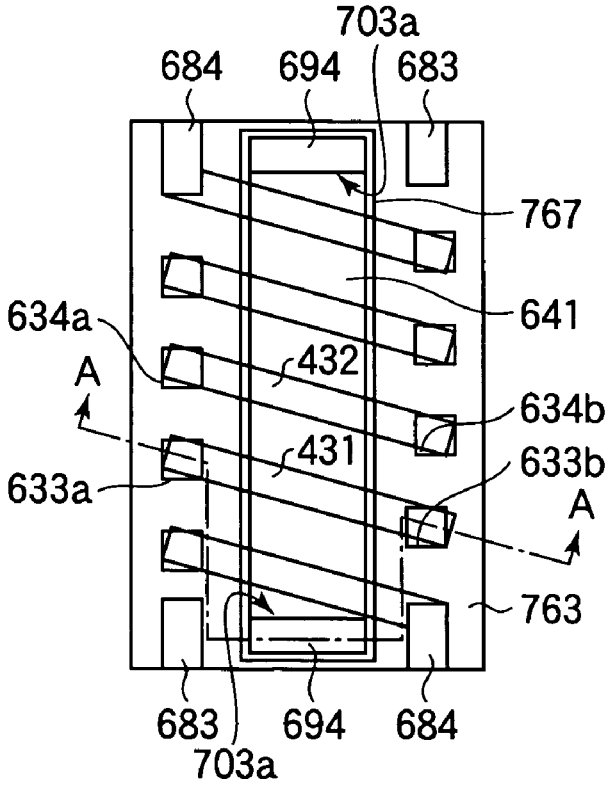
Figure 121A:
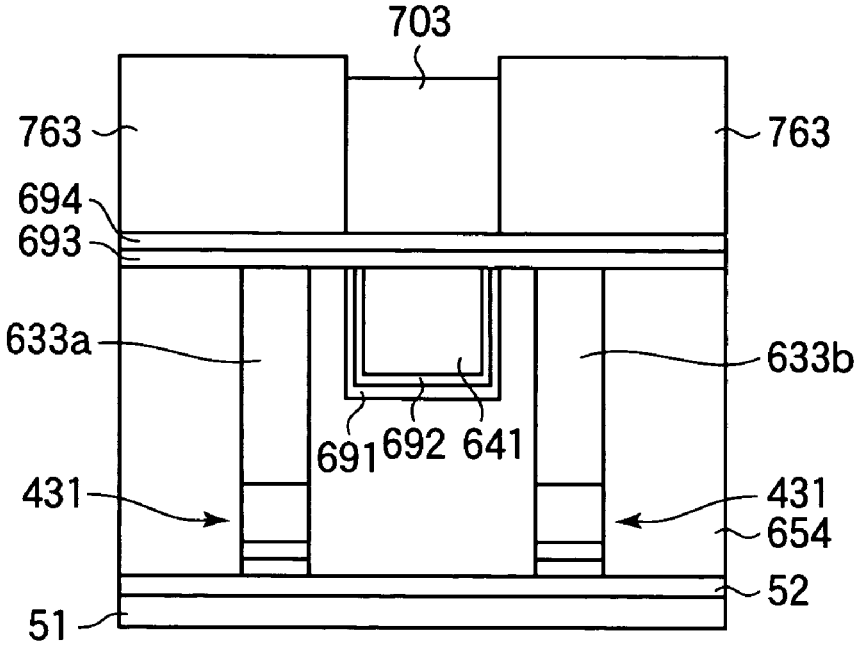
Figure 121B:
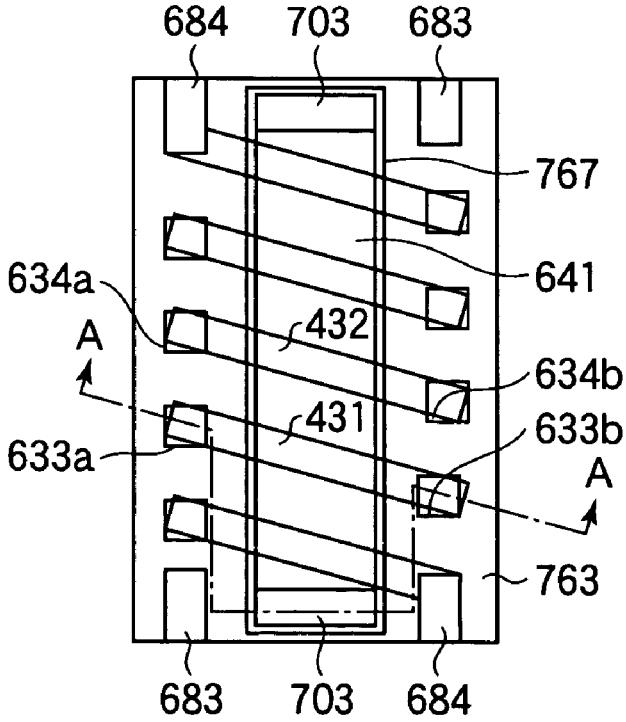

A resist is then applied throughout the surface to form a resist layer (second intervening resist layer) 763 having a thickness in the range from 10 to 15 μm. Next, as shown in FIGS. 120A and 120B, the resist layer 763 is patterned to form the resist layer 763 with openings (second intervening openings) 703*a* for exposing the electrode film 694 on both end portions of the core 641. When the element forming region is viewed in the normal direction thereof, the openings 703*a* are formed in a rectangular shape outside the coil bottom parts 431 and 432. Next, as shown in FIGS. 121A and 121B, NiFe magnetic member layers (second magnetic member layers) 703 having a thickness in the range from 10 to 15 μm are formed on the electrode film 694 in the openings 703*a* using a pattern plating process.

Figure 122A:
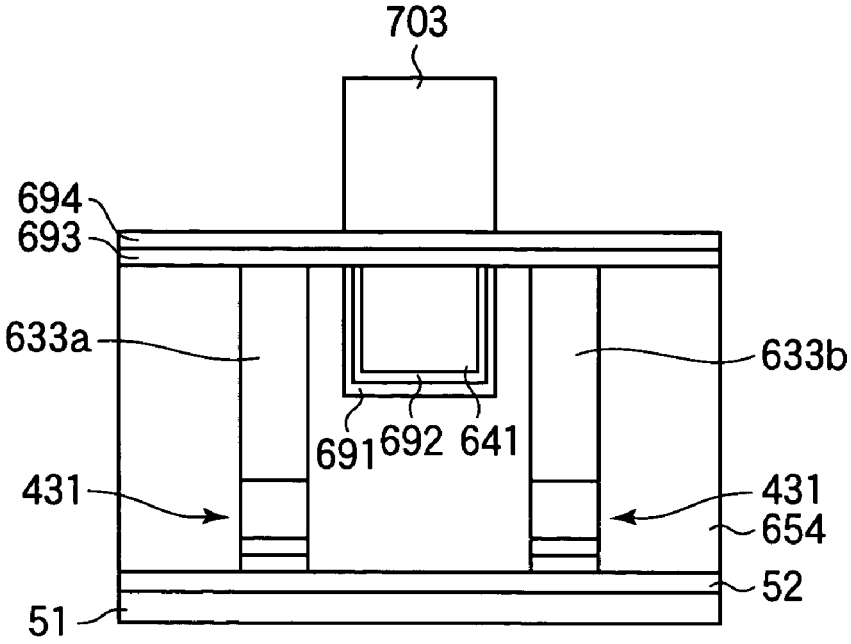
Figure 122B:
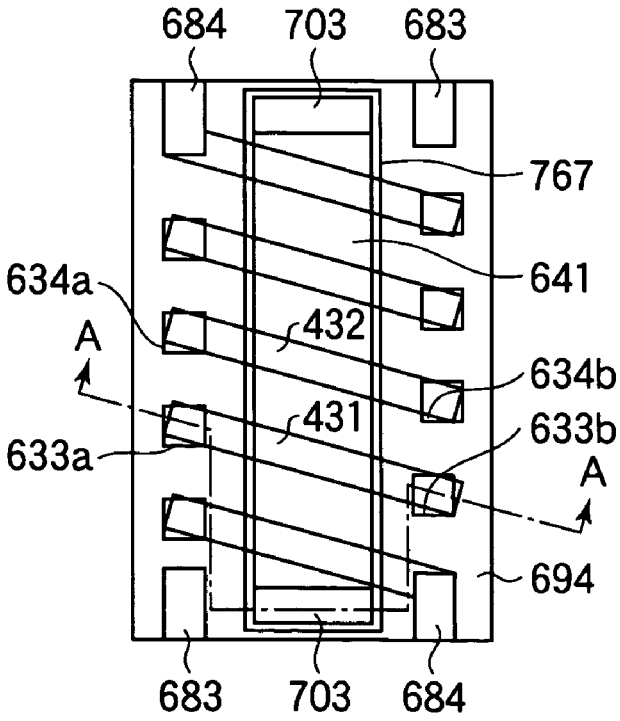
Figure 123A:
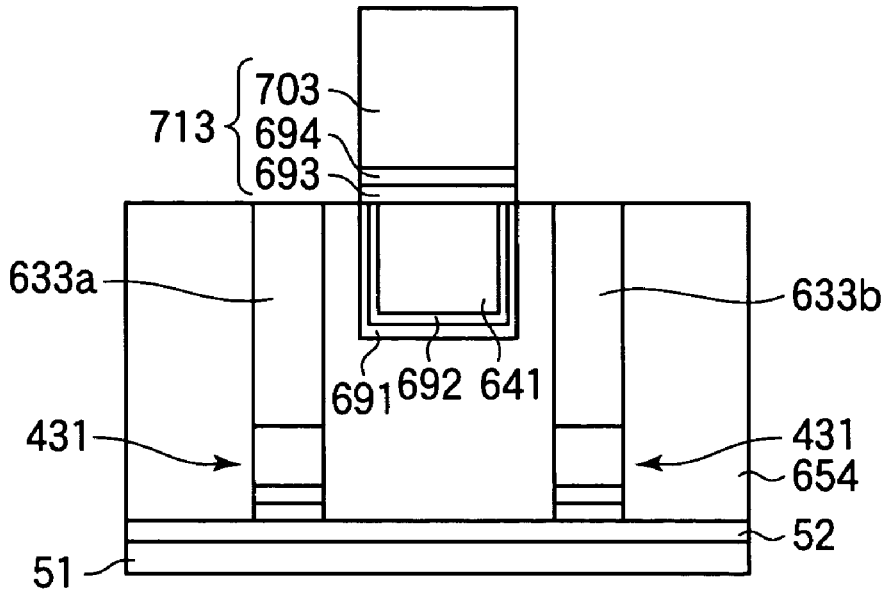
Figure 123B:
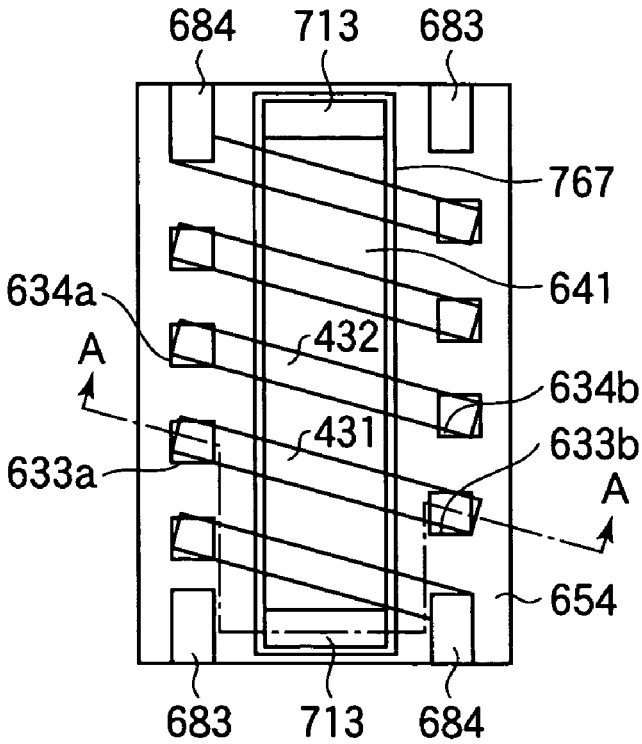

Next, as shown in FIGS. 122A and 122B, the resist layer 763 is etched away. As shown in FIGS. 123A and 123B, dry etching (milling) is then performed to remove the electrode film 694 which has been exposed as a result of the removal of the resist layer 763 and the electrode film 693 under the electrode film 694. Through the above-described steps, a closed magnetic path side parts 713 are provided by forming the electrode films 693 and 694 and the magnetic member layers 703 one over another.

Figure 124A:
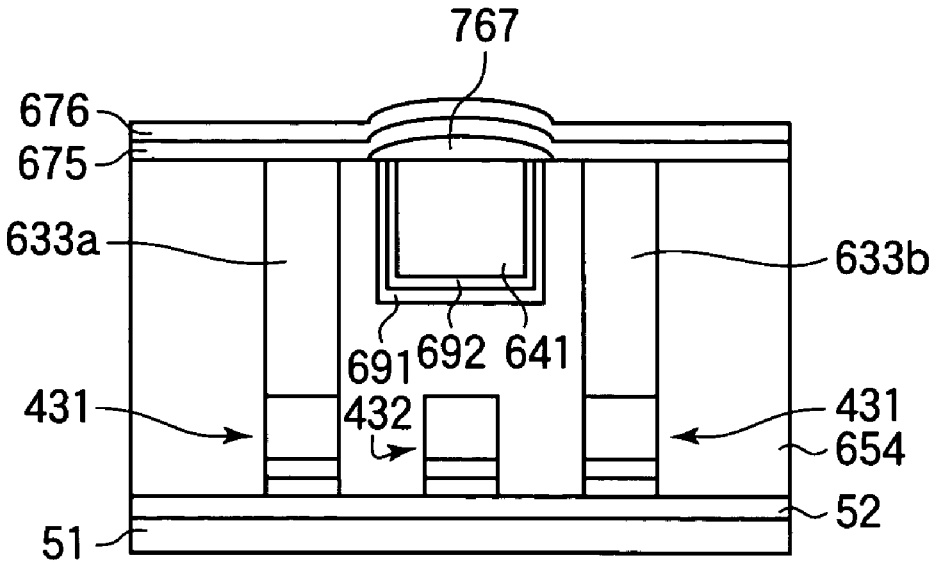
Figure 124B:
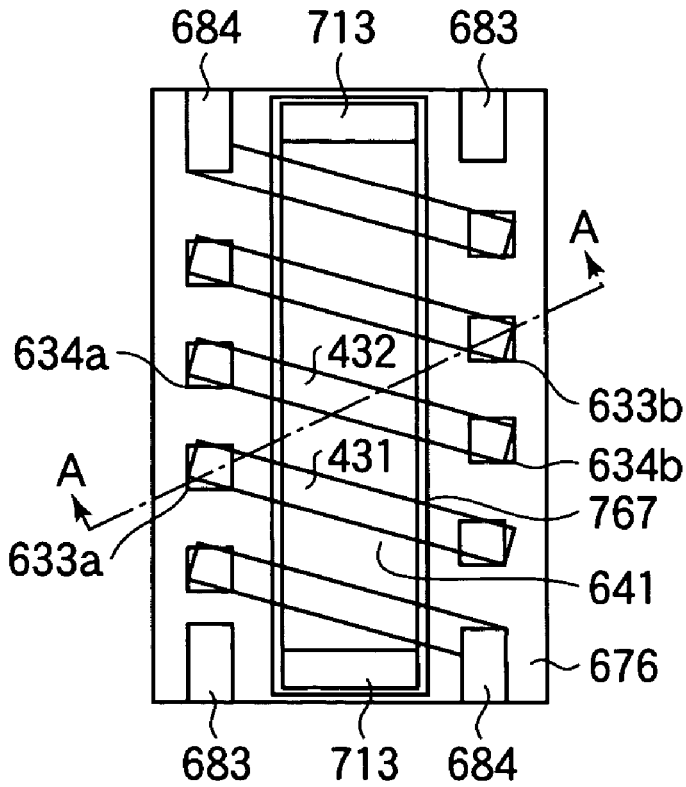

Next, as shown in FIGS. 124A and 124B, a Ti electrode film 675 having a thickness of about 10 nm is formed throughout the surface using a sputtering process, and a Cu electrode film (second electrode film) 676 having a thickness of about 100 nm is then formed on the electrode film 675 using a sputtering process. The electrode films 675 and 676 are electrically connected to the coil side parts 633*a*, 633*b*, 634*a*, and 634*b* and are insulated from the electrode films 691 and 692 and the core 641 by the resist layer 767.

Figure 125A:
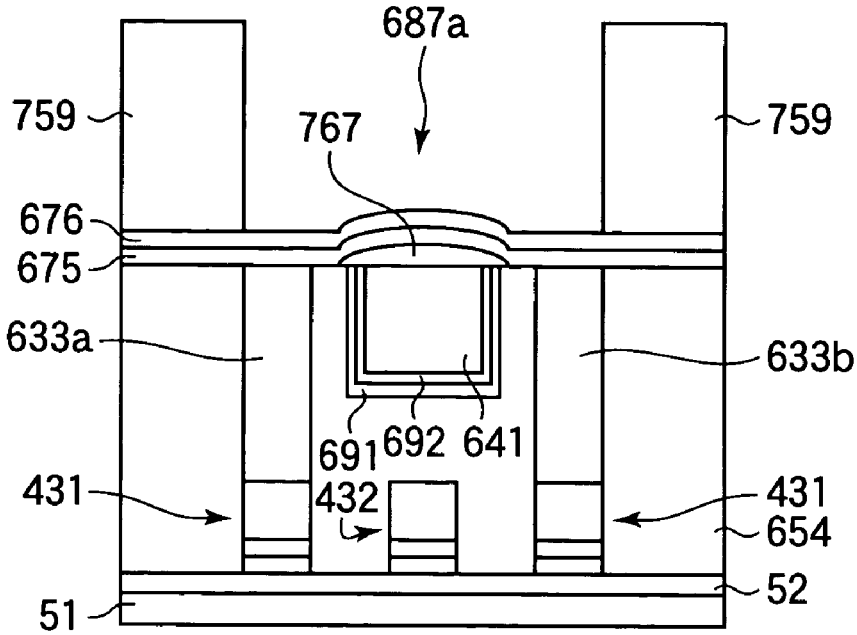
Figure 125B:
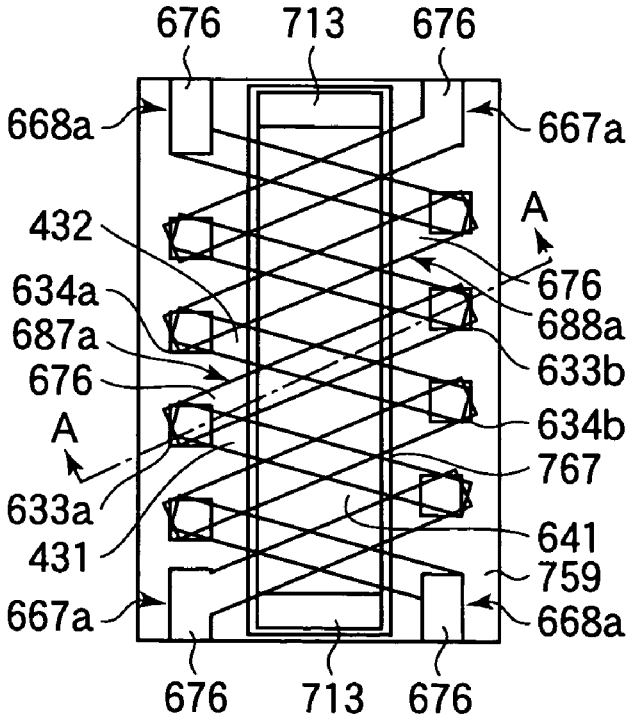

Next, a resist is applied to the electrode film 676 to form a resist layer (third resist layer) 759 having a thickness in the range from 10 to 15 μm. Next, as shown in FIGS. 125A and 125B, the resist layer 759 is patterned to form a plurality of openings (third openings) 687*a* and 688*a* for exposing the electrode film 676 in the form of elongate strips and to form openings 667*a* and 668*a* for exposing the electrode film 676 on the conductive layers 683 and 684 formed in the openings 663*a* and 664*a*. As a result, when the element forming region is viewed in the normal direction thereof, the openings 687*a* and the openings 688*a* are alternately formed in parallel at substantially equal intervals, each opening 687*a* exposing the electrode film 676 on a coil side part 633*a* at one end thereof and exposing, at another end thereof, the electrode film 676 on the coil side part 633*b* disposed on a coil bottom part 431 extending adjacent to the coil bottom part 431 directly under the above-mentioned coil side part 633*a* so as to sandwich a coil bottom part 432 between them, each opening 688*a* exposing the electrode film 676 on a coil side part 634*a* at one end thereof and exposing, at another end thereof, the electrode film 676 on the coil side part 634*b* disposed on a coil bottom part 432 extending adjacent to the coil bottom part 432 directly under the above-mentioned coil side part 634*a* so as to sandwich a coil bottom part 431 between them. The openings 687*a* are formed to extend across the coil bottom parts 432 and to face the bottom parts with the core 641 sandwiched between them when the element forming region is viewed in the normal direction thereof. The openings 688*a* are formed to extend across the coil bottom parts 431 and to face the bottom parts with the core 641 sandwiched between them, when viewed in the same direction. The openings 687*a* disposed near the shorter sides of the element forming region are formed in connection with the respective openings 667*a* at one end thereof.

Figure 126A:
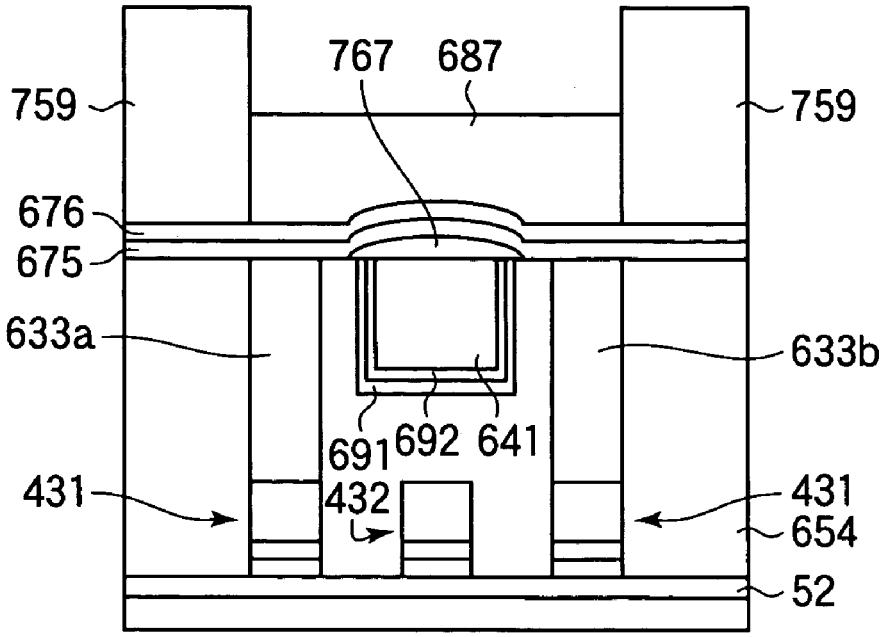
Figure 126B:
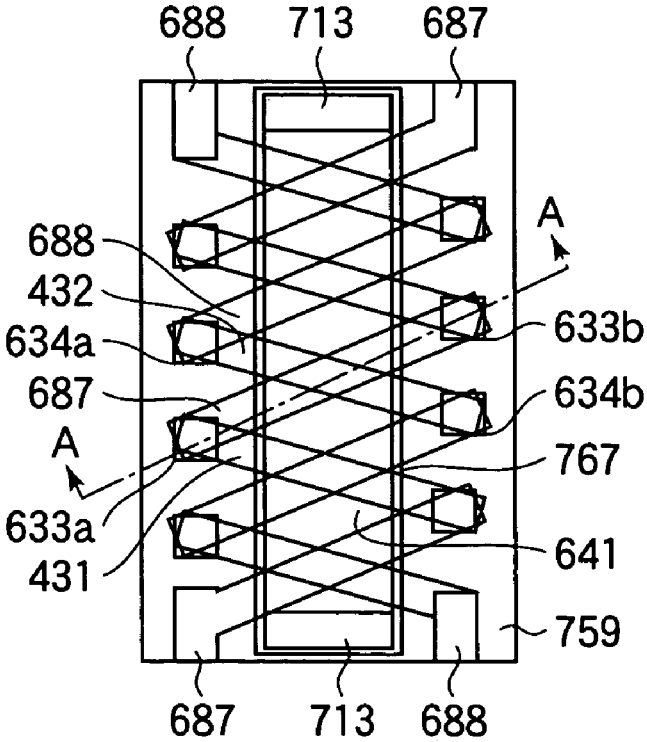
Figure 127A:
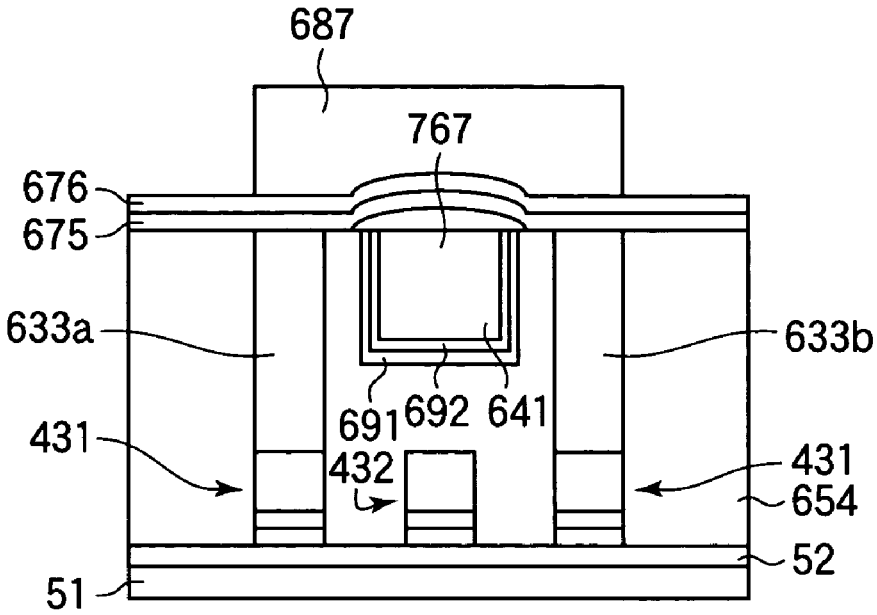
Figure 127B:
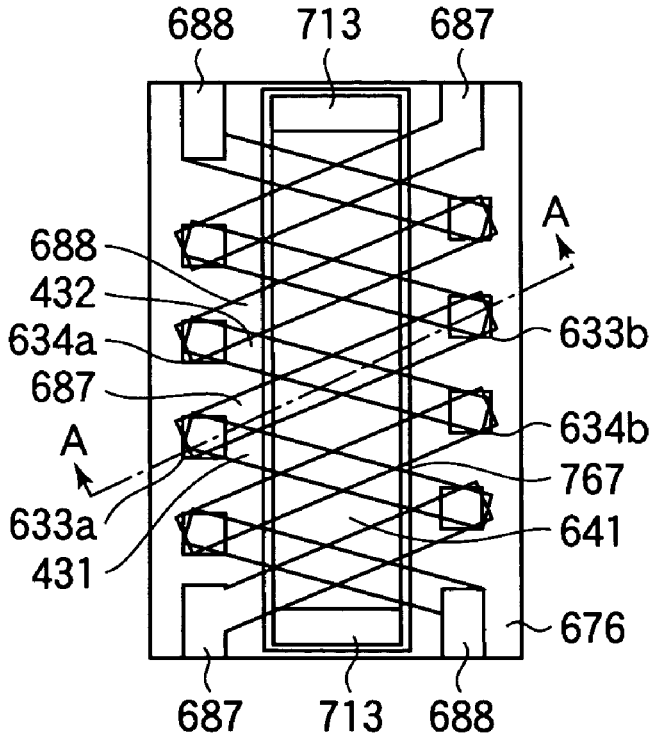
Figure 128A:
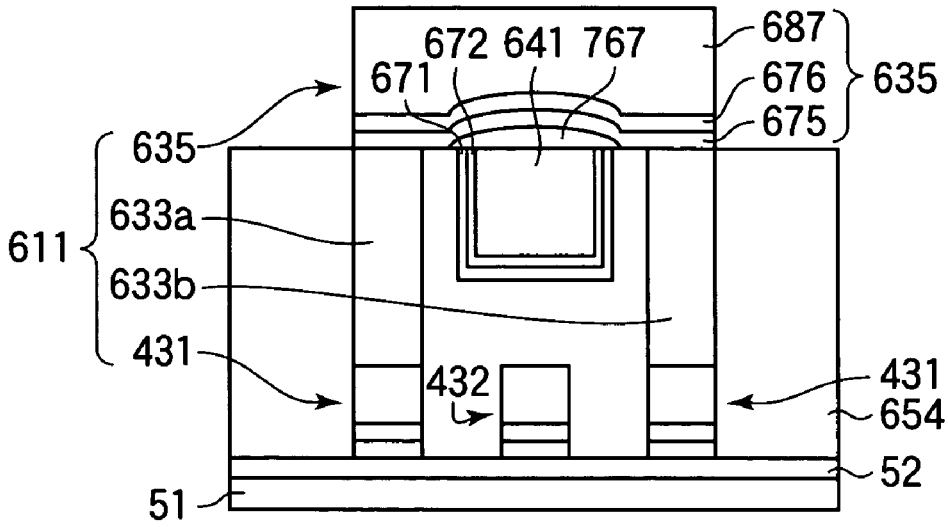
Figure 128B:
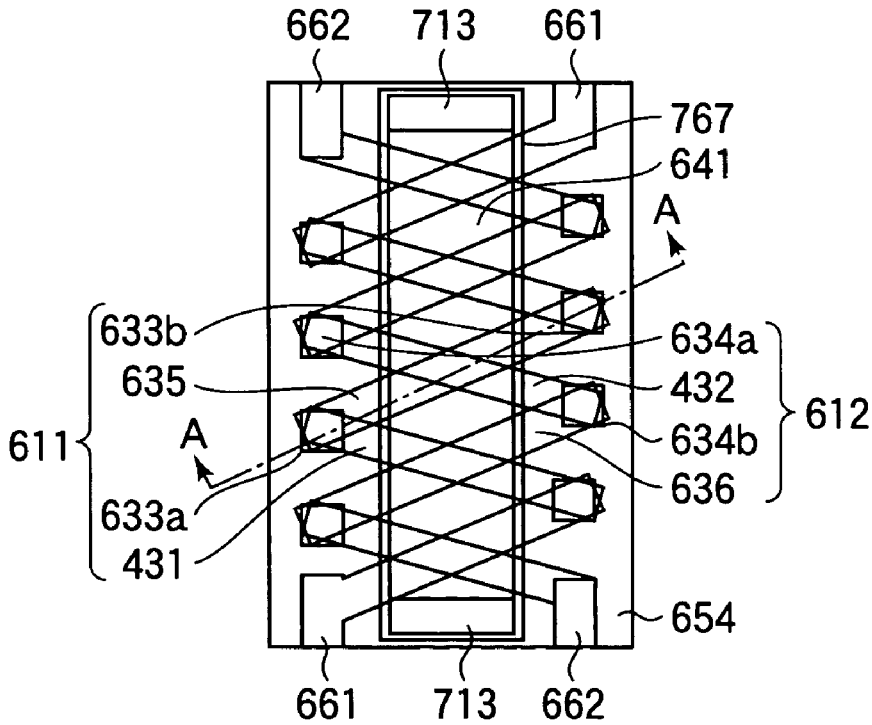

Next, as shown in FIGS. 126A and 126B, Cu conductive layers third conductive layers) 687 having a thickness in the range 7 to 10 μm are formed on the electrode film 676 in the openings 667*a* and 687*a*, and conductive layers (third conductive layers) 688 are formed from the same material to the same thikness on the electrode film 676 in the openings 668*a* and 688*a*. The conductive layers 687 and 688 are simultaneously formed using a pattern plating process and are each electrically connected to the electrode film 676. Next, as shown in FIGS. 127A and 127B, the resist layer 759 is etched away. Next, as shown in FIGS. 128A and 128B, the electrode film 676 which has been exposed as a result of the removal of the resist layer 759 and the electrode film 675 under the electrode film 676 are removed. Thus, coil top parts 635 having a multi-layer structure are provided by forming the electrode films 675 and 676 and the conductive layers 687 one over another, and coil top parts 636 having a multi-layer structure are provided by forming the electrode films 675 and 676 and the conductive layers 688 one over another.

Through the above-described steps, a first helical coil unit 611 is formed, which includes one coil having two turns each constituted by a coil bottom part 431, a coil side part 633*a*, a coil top part 635, and a coil side part 633*b*. At the same time, a second helical coil unit 612 is formed, which includes one coil having two turns each constituted by a coil bottom part 432, a coil side part 634*a*, a coil top part 636, and a coil side part 634*b*. The first and second helical coil units 611 and 612 are formed in a double spiral structure. External electrode connecting parts 661 having a multi-layer structure constituted by the conductive layers 481, 683, and 687 are simultaneously formed in the openings 461*a*, 663*a*, and 667*a*, and external electrode connecting parts 662 having a multi-layer structure constituted by the conductive layers 482, 684, and 688 are simultaneously formed in the openings 462*a*, 664*a*, and 668*a*.

The coil top parts 635 and 636 are alternately disposed in parallel. When the element forming region is viewed in the normal direction thereof, the coil top parts 635 are disposed to extend across the coil bottom parts 432 with the core 641 sandwiched between them, and the coil top parts 636 are disposed to extend across the coil bottom parts 431 with the core 641 sandwiched between them.

Figure 129A:
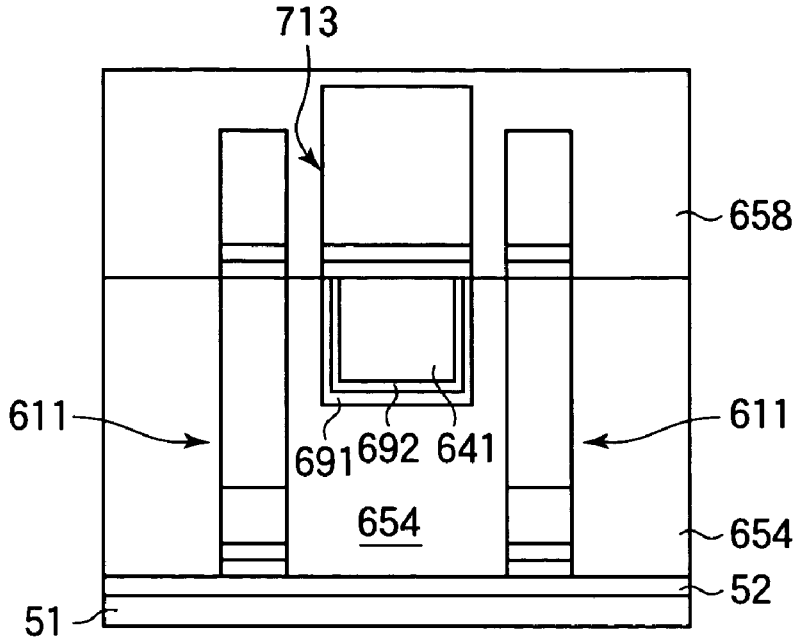
Figure 129B:
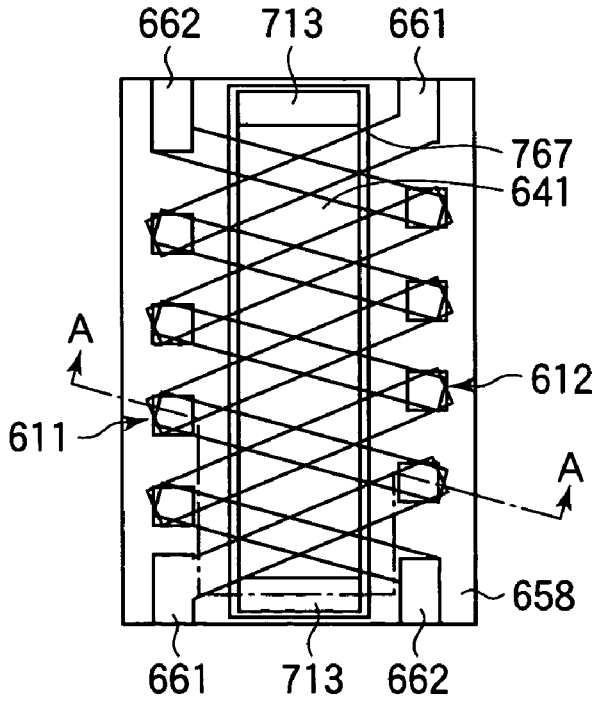
Figure 130A:
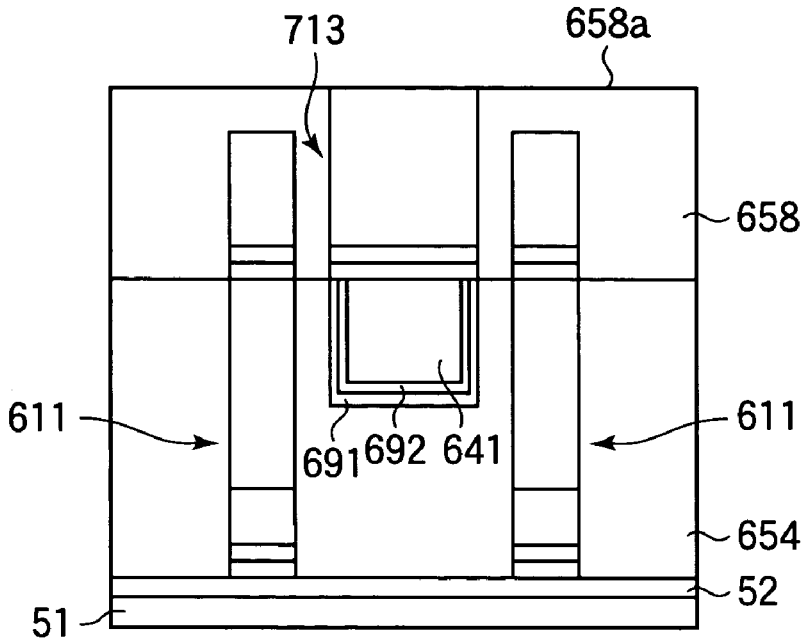
Figure 130B:
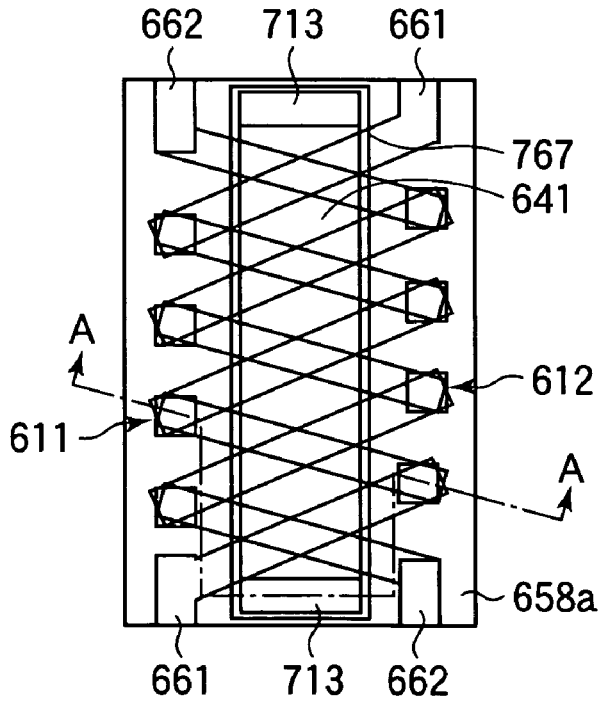

Next, as shown in FIGS. 129A and 129B, a film of alumina is formed throughout the surface using a sputtering process to provide an insulation layer (second insulation layer) 658 having a thickness in the range from 10 to 15 μm. As shown in FIGS. 130A and 130B, a CMP process is then performed to polish the insulation layer 658 until the closed magnetic path side parts 713 are exposed, whereby a planar surface 658*a* is formed.

Figure 131A:
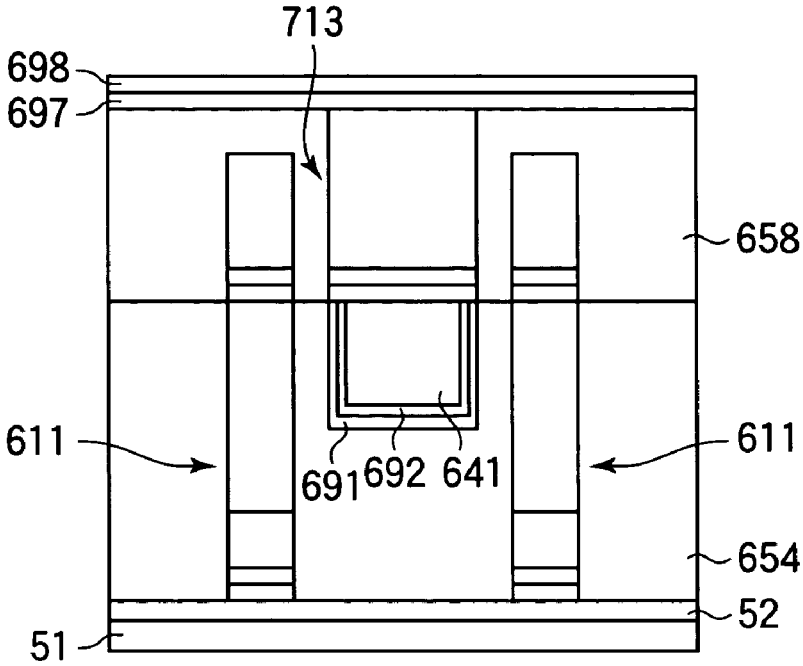
Figure 131B:
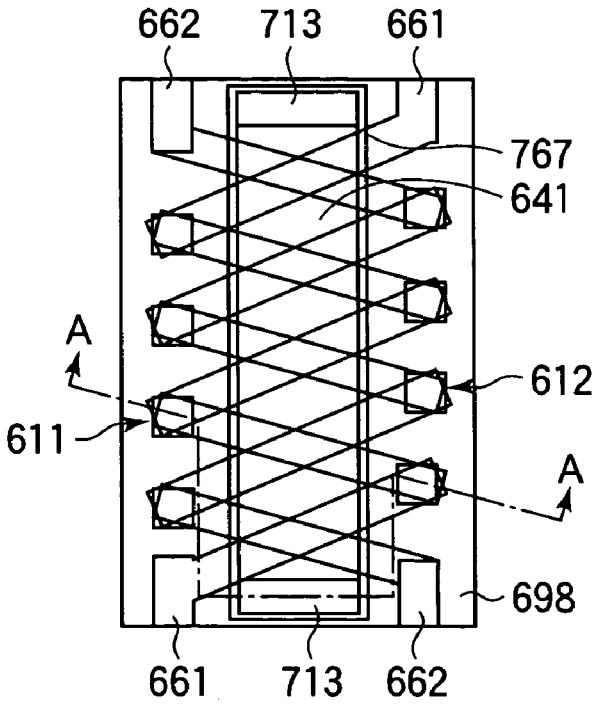

Next, as shown in FIGS. 131A and 131B, a Ti electrode film 697 having a thickness of about 10 nm is formed throughout the surface using a sputtering process, and a NiFe electrode film (third electrode film) 698 having a thickness of about 100 nm is then formed on the electrode film 697 using a sputtering process.

A resist is then applied to the electrode film 698 to form a resist layer (fourth resist layer) 767 having a thickness in the range from 7 to 12 μm. Next, as shown in FIGS. 132A and 132B, the resist layer 767 is patterned to form an opening (fourth opening) 707*a* in the resist layer 767. When the element forming region is viewed in the normal direction thereof, the opening 707*a* is formed in substantially the same size as the core 641 such that the electrode film 698 located on the closed magnetic path side parts 713 will be exposed at both sides of the opening. As shown in FIGS. 133A and 133B, a NiFe magnetic member layer (third magnetic member layer) 707 having a thickness in the range from 5 to 10 μm is then formed on the electrode film 698 in the opening 707*a* using a pattern plating process.

Next, as shown in FIGS. 134A and 134B, the resist layer 767 is etched away. As shown in FIGS. 135A and 135B, dry etching (milling) is then performed to remove the electrode film 698 which has been exposed as a result of the removal of the resist layer 767 and to remove the electrode film 697 located under the electrode film 698. When the electrode films 697 and 698 are removed, the surface of the magnetic member layer 707 is also etched in an amount substantially equivalent to the thickness of the electrode films 697 and 698. However, since the magnetic member layer 707 is formed sufficiently thick compared to the electrode films 697 and 698, the layer is not completely removed as a result of the dry etching. Thus, a closed magnetic path top part 715 having a multi-layer structure is provided by forming the electrode films 697 and 698 and the magnetic member layer 707 one over another. The closed magnetic path top part 715 is formed to face the core 641 with the coil top parts 635 and 636 interposed between them.

Through the above-described steps, a closed magnetic path 741 is formed, the closed magnetic path 741 being constituted by the core 641, the closed magnetic path top part 715 and the two closed magnetic path side parts 713. The closed magnetic path 741 is formed substantially orthogonally to the element forming region.

Next, as shown in FIGS. 136A, 136B, and 136C, a film of alumina is formed throughout the surface using a sputtering process to form an insulation layer 659 having a thickness of about 10 μm to serve as a protective film. FIG. 136A is a sectional view taken along the line A-A in FIG. 136B, and FIG. 136C is a sectional view taken along the line B-B in FIG. 136B. The insulation layer 659 may be formed from an insulating material other than alumina. Through the above-described steps, an insulation layer 660 having a multi-layer structure is provided by forming the insulation layers 52, 654, 658, and 659 one over another. The first and second helical coil units 611 and 612 and the closed magnetic path 741 are enclosed in the insulation layer 660.

Next, the silicon path 51 is ground from the bottom thereof to achieve a desired thickness or to remove the substrate completely. The wafer is then cut along predetermined cutting lines to divide a plurality of the common mode choke coils 601 formed on the wafer into each element forming region in the form of a chip. The external electrode connecting parts 661 are partially exposed on an outer surface of the insulation layer 660. Although not shown, external electrodes are then formed on the cut surfaces in electrical connection with the external electrode connecting parts 661 and 662 exposed on the cut surfaces. Next, chamfering is performed on corners of the chip to complete a common mode choke coil 601.

As described above, according to the method of manufacturing a common mode choke coil according to the present embodiment, since the conductive layers 683 and 684 constituting the coil side parts are formed at one pattern plating step, the number of manufacturing steps can be smaller than that of the method of manufacturing a common mode choke coil of the third embodiment in which such conductive layers are formed at two pattern plating steps. It is therefore possible to achieve a reduction in the manufacturing cost of a common mode choke coil.

A description will now be made with reference to FIG. 137 on the methods of manufacturing a common mode choke coil according to the first to fourth embodiments and a method of manufacturing a thin-film type common mode choke coil according to the related art. FIG. 137 shows the numbers of thin film manufacturing steps performed for common mode choke coils according to the first to fourth embodiments and the related art. Referring to FIG. 137, the names of thin film manufacturing steps are shown in the columns on the left end of the figure, and each of the columns is followed by a sequential listing of the numbers of times the manufacturing step is performed for the first to fourth embodiments and the common mode choke coil according to the related art. The total number of thin film manufacturing steps performed for each common mode choke coil is shown in a column at the bottom of the table. FIG. 137 shows the number of thin film manufacturing steps for an example of a surface mount type common mode choke coil according to the related art which is formed to have a general outline in the form of a rectangular parallelepiped by sandwiching an insulation layer and a spiral coil conductor formed by thin film forming techniques between a pair of magnetic substrates provided in a face-to-face relationship.

As shown in FIG. 137, in the case of common mode choke coils having a closed magnetic path formed substantially parallel to the surface on which coil bottom parts are formed (the first and second embodiments), the closed magnetic path is formed by one core part plating step. On the contrary, in the case of common mode choke coils having a closed magnetic path formed substantially orthogonal to the surface on which coil bottom parts are formed (the third and fourth embodiments), the closed magnetic path is formed by three core part plating steps. Therefore, the number of core part plating steps and photo-processing steps associated therewith performed in the coil manufacturing methods of the first and second embodiments is smaller than such a number of steps in the coil manufacturing methods of the third and fourth embodiments. Therefore, the total number of thin film manufacturing steps required to complete a common mode choke coil according to the coil manufacturing methods of the first and second embodiments is about two-thirds of such a number of steps required in the coil manufacturing methods according to the third and fourth embodiments.

According to the method of manufacturing a common mode choke coil of the second embodiment (the fourth embodiment), coil side parts are formed by one conductor plating step. On the contrary, according to the method of manufacturing a common mode choke coil of the first embodiment (the third embodiment), coil side parts are formed by two conductor plating steps. Since the coil manufacturing method of the second embodiment (the fourth embodiment) involves a smaller number of conductor plating steps and photo-processing steps associated therewith, the total number of thin film manufacturing steps involved in the method can be smaller than that of the coil manufacturing method of the first embodiment (the third embodiment). However, the coil manufacturing method of the second embodiment (the fourth embodiment) necessitates high-level thin film forming techniques because a groove to be used for core formation must be formed after core side parts are formed. Therefore, the coil manufacturing method of the first embodiment (the third embodiment) is more advantageous than the coil manufacturing method of the second embodiment (the fourth embodiment) in that it allows a common mode choke coil to be manufactured more easily.

The number of thin film manufacturing steps involved in the method of manufacturing a common mode choke coil according to the first embodiment is substantially the same as that in the method of manufacturing a common mode choke coil according to the related art. The methods of manufacturing a common mode choke coil according to the third and fourth embodiments involve a greater number of thin film manufacturing steps compared to the method of manufacturing a common mode choke coil according to the related art. However, the common mode choke coil according to the related art requires a bonding step for bonding a magnetic substrate onto an insulation layer enclosing a coil conductor in addition to the thin film manufacturing steps shown in FIG. 137. The total numbers of steps involved in the methods of manufacturing a common mode choke coil according to the first, third and fourth embodiments can be smaller than that of the method of manufacturing a common mode choke coil according to the related art.

Fifth Embodiment

A common mode choke coil and a method of manufacturing the same according to a fifth embodiment of the invention will now be described with reference to FIGS. 138A to 161B. In the common mode choke coils of the first to fourth embodiments, sufficient insulation may not be provided by the alumina insulation layer between the first and second helical coil units when the coil pitches of the first and second helical coil units are decreased. Under the circumstance, a common mode choke coil 801 according to the present embodiment is characterized in that insulating resist layers (organic insulation materials) 771 and 773 are provided in a gap between first and second helical coil units 11 and 12 to maintain sufficient insulation between the coil units 11 and 12 (see FIGS. 161A and 161B). The insulating resist layers 771 and 773 are heated and cured to improve the insulating properties.

The configuration of the common mode choke coil 801 will not be described in detail because the configuration is similar to that of the common mode choke coil 1 of the first embodiment except that the insulating resist layers 771 and 773 are provided. The locations to form the insulating resist layers 771 and 773 will be mentioned in the description of a method of manufacturing a common mode choke coil according to the embodiment. In the following description, elements having functions and effects like those of elements in the first embodiment are indicated by like reference numerals and will not be described in detail.

A method of manufacturing a common mode choke coil 801 according to the present embodiment will now be described with reference to FIGS. 138A to 161B. While a multiplicity of common mode choke coils coil 801 are simultaneously formed on a wafer, FIGS. 138A to 161B show an element forming region of one common mode choke coil 801. FIGS. 138 to 161 having a suffix A are sectional views taken along lines A-A in FIGS. 138 to 161 having a suffix B. FIGS. 138 to 161 having a suffix B are plan views showing the method of manufacturing a common mode choke coil 801.

First, an insulation layer (bottom insulation layer), coil bottom parts 31 and 32, and conductive layers (second conductive layers) 83 and 84 are formed on a silicon substrate 51 using a method similar to the method of manufacturing the common mode choke coil 1 of the first embodiment" (see FIGS. 4A to 12B)".

Next, a resist is applied throughout the surface to form an insulating resist layer 771 (organic insulating material) having a thickness of about 15 μm. The process is performed so as to expose surfaces of the conductive layers 83 and 84. Next, as shown in FIGS. 138A and 138B, the insulating resist layer 771 is patterned to expose the insulation layer 52 near the outer circumference of the element forming region. Thus, an insulating resist layer 771 is provided in the form of an island on each of the element forming regions of the wafer.

Next, as shown in FIGS. 139A and 139B, the insulating resist layer 771 is heated and cured to improve the insulation properties. Adjoining coil bottom parts 31 and 32 are insulated from each other by the insulating resist layer 771 formed in the gap between those parts. Similarly, adjoining conductive layers 83 and 84 are insulated from each other by the insulating resist layer 771 formed in the gap between those layers.

Next, as shown in FIGS. 140A and 140B, a film of alumina is formed throughout the surface using a sputtering process to provide an insulation layer (first insulation layer) 54 having a thickness of about 17 μm. As shown in FIGS. 141A and 141B, a CMP (chemical mechanical polishing) process is then performed to polish the surface of the insulation layer 54 until the tops of the conductive layers 83 and 84 are exposed, whereby a planar surface (CMP surface) 54*a* is formed. Visual observation is conducted to check whether the conductive layers 83 and 84 have been exposed or not.

Next, as shown in FIGS. 142A and 142B, a Ti electrode film 91 having a thickness of about 5 nm is formed on the planar surface 54*a* of the insulation layer 54 using a sputtering process, and a NiFe (permalloy) electrode film (first intermediate electrode film) 92 having a thickness of about 50 nm is formed on the electrode film 91 using a sputtering process. Like the electrode film 71, the electrode film 91 is formed as a buffer film for improving the adhesion of the electrode film 92. The electrode film 92 is used as an electrode film for plating the pattern of a magnetic member layer 101 which will be described later.

A resist is then applied to the electrode film 92 to form a resist layer (first intermediate resist layer) 155 having a thickness of about 15 μm. Next, as shown in FIGS. 143A and 143B, the resist layer 155 is patterned to form an opening (first intermediate opening) 101*a* for exposing the electrode film 92 in the resist layer 155. The opening 110*a* is formed like a rectangular window when the element forming region is viewed in the normal direction thereof, and the opening includes a rectangular opening 41*a* and an opening 42*a* which is in the form of an inverted "C". Referring to FIG. 143B, the opening 101*a* is formed such that the conductive layers 83 and 84 on the left are disposed on the side of the outer circumference of the opening and such that the conductive layers 83 and 84 on the right are disposed on the side of the inner circumference of the opening. The opening 41*a* is disposed between the conductive layers 83 and 84 on both ends of the coil bottom parts 31 and 32 so as to extend across the coil bottom parts 31 and 32 at a predetermined angle to them when the element forming region is viewed in the normal direction thereof.

Next, as shown in FIGS. 144A and 144B, a NiFe magnetic member layer (first magnetic member layer) 101 having a thickness of about 10 μm is formed on the electrode film 92 in the opening 110*a* using, for example, a pattern plating process. The magnetic member layer 101 may be formed from a material having high permeability other than NiFe. Next, as shown in FIGS. 145A and 145B, the resist layer 155 is etched away. As shown in FIGS. 146A and 146B, dry etching is then performed to remove the electrode film 92 which has been exposed as a result of the removal of the resist layer 155 and to remove the electrode film 91 located under the electrode film 92. When the electrode films 91 and 92 are removed, the surface of the magnetic member layer 101 is also etched in an amount substantially equivalent to the thickness of the electrode films 91 and 92. However, since the magnetic member layer 101 is formed sufficiently thick compared to the electrode films 91 and 92, the layer is not completely removed as a result of the dry etching. Through the above-described steps, a core 41 having a multi-layer structure is provided in the opening 41*a* by forming the electrode films 91 and 92 and the conductive magnetic member layer 101 one over another. A magnetic member part 42 having a multi-layer structure identical to that of the core 41 and forming a closed magnetic path 141 in cooperation with the core 41 is also formed in the opening 42*a*.

Next, as shown in FIGS. 147A and 147B, a Ti electrode film 73 having a thickness of about 5 nm is formed throughout the surface using a sputtering process, and a Cu electrode film (second intermediate electrode film) 74 having a thickness of about 100 nm is then formed on the electrode film 73 using a sputtering process. The electrode films 73 and 74 are electrically connected to the conductive layers 83 and 84 located under the same.

Next, a resist is applied to the electrode film 74 to form a resist layer (second intermediate resist layer) 157 having a thickness of about 20 μm. Next, as shown in FIGS. 148A and 148B, the resist layer 157 is patterned to form the resist layer 157 with openings (second intermediate openings) 85*a* and 86*a* for exposing the electrode film 74 on the conductive layers 83 and 84 formed in the openings 83*a* and 84*a* and openings 65*a* and 66*a* for exposing the electrode film 74 on the conductive layers 83 and 84 formed in the openings 63*a* and 64*a*.

Next, as shown in FIGS. 149A and 149B, Cu conductive layers (first intermediate conductive layers) 85 having a thickness of about 17 μm are formed on the electrode film 74 in the openings 65*a* and 85*a*, and conductive layers (first intermediate conductive layers) 86 are formed from the same material with the same thickness on the electrode film 74 in the openings 66*a* and 86*a*. The conductive layers 85 and 86 are formed using a pattern plating process and are each electrically connected to the electrode film 74 located under the same. Next, as shown in FIGS. 150A and 150B, the resist layer 157 is etched away. As shown in FIGS. 151A and 151B, dry etching is then performed to remove the electrode film 74 exposed as a result of the removal of the resist layer 157 and to remove the electrode film 73 under the electrode film 74. Through the above-described steps, coil side parts 33*a* and 33*b* having a multi-layer structure are provided by forming the conductive layers 83, the electrode films 73 and 74 one over another, and the conductive layers 85, and coil side parts 34*a* and 34*b* having a multi-layer structure are provided by forming the conductive layers 84, the electrode films 73 and 74, and the conductive layers 86 one over another. Referring to FIG. 151B, the coil side parts 33*a* and 34*a* are alternately disposed on the left side to align on a straight line at equal intervals, and the coil side parts 33*b* and 34*b* are alternately disposed on the right side to align on a straight line at equal intervals.

Next, a resist is applied throughout the surface to form a resist layer (organic insulating material) 773 having a thickness of about 15 μm. The process is performed so as to expose surfaces of the coil side parts 33*a*, 33*b*, 34*a*, and 34*b*. Next, as shown in FIGS. 152A and 152B, the insulating resist layer 773 is patterned to expose the insulation layer 54 near the outer circumference of the element forming region. Thus, an insulating resist layer 773 is provided in the form of an island on each of the element forming regions of the wafer.

Next, as shown in FIGS. 153A and 153B, the insulating resist layer 773 is heated and cured to improve the insulation properties. Adjoining coil side parts 33*a* and 34*a* are insulated from each other by the insulating resist layer 773 formed in the gap between those parts. Similarly, adjoining coil side parts 33*b* and 34*b* are insulated from each other by the insulating resist layer 773 formed in the gap between those parts.

Next, as shown in FIGS. 154A and 154B, a film of alumina is formed throughout the surface using a sputtering process to provide an insulation layer (second insulation layer) 56 having a thickness of about 17 μm. As shown in FIGS. 155A and 155B, a CMP process is then performed to polish the surface of the insulation layer 56 until the conductive layers 85 and 86 are exposed, whereby a planar surface 56*a* is formed. The process is performed so as not to polish the insulation layer 56 until the core 41 and the magnetic member part 42 are exposed.

Next, as shown in FIGS. 156A and 156B, a Ti electrode film 75 having a thickness of about 5 nm is formed on the planar surface 56*a* of the insulation layer 56 using a sputtering process, and a Cu electrode film (second electrode film) 76 having a thickness of about 100 nm is formed on the electrode film 75 using a sputtering process. The electrode films 75 and 76 are electrically connected to the conductive layers 83 through the electrode films 73 and 74 and the conductive layers 85 and are electrically connected to the conductive layers 84 through the electrode films 73 and 74 and the conductive layers 86.

A resist is then applied to the electrode film 76 to form a resist layer (third resist layer) 159 having a thickness of about 15 μm. Next, as shown in FIGS. 157A and 157B, the resist layer 159 is patterned to form a plurality of openings (third openings) 87*a* and 88*a* for exposing the electrode film 76 in the form of elongate strips and to form openings 67*a* and 68*a* for exposing the electrode film 76 on the conductive layers 85 and 86 formed in the openings 65*a* and 66*a*. As a result, when the element forming region is viewed in the normal direction thereof, the openings 87*a* and the openings 88*a* are alternately formed in parallel at substantially equal intervals, each opening 87*a* exposing the electrode film 76 on a coil side part 33*a* at one end thereof and exposing, at another end thereof, the electrode film 76 on the coil side part 33*b* on a coil bottom part 31 extending adjacent to the coil bottom part 31 directly under the above-mentioned coil side 33*a* so as to sandwich a coil bottom part 32 between them, each opening 88*a* exposing the electrode film 76 on a coil side part 34*a* at one end thereof and exposing, at another end thereof, the electrode film 76 on the coil side part 34*b* on a coil bottom part 32 extending adjacent to the coil bottom part 32 directly under the above-mentioned coil side part 34*a* so as to sandwich a coil bottom part 31 between them. The openings 87*a* are formed to extend across the coil bottom parts 32 and to face the bottom parts with the core 41 sandwiched between them when the element forming region is viewed in the normal direction thereof. The openings 88*a* are formed to extend across the coil bottom parts 31 and to face the bottom parts 31 with the core 41 sandwiched between them, when viewed in the same direction. The openings 87*a* disposed near the shorter sides of the element forming region are formed in connection with the respective openings 67*a* at one end thereof.

Next, as shown in FIGS. 158A and 158B, Cu conductive layers (third conductive layers) 87 having a thickness of about 10 μm are formed on the electrode film 76 in the openings 67*a* and 87*a*, and conductive layers (third conductive layers) 88 are formed from the same material to the same thickness on the electrode film 76 in the openings 68*a* and 88*a*. The conductive layers 87 and 88 are simultaneously formed using a pattern plating process and are each electrically connected to the electrode film 76 under the same. Next, as shown in FIGS. 159A and 159B, the resist layer 159 is removed. Next, as shown in FIGS. 160A and 160B, the electrode film 76 which has been exposed as a result of the removal of the resist layer 159 and the electrode film 75 under the electrode film 76 are removed. Thus, coil top parts 35 having a multi-layer structure are provided by forming the electrode films 75 and 76 and the conductive layers 87 one over another, and coil top parts 36 having a multi-layer structure are provided by forming the electrode films 75 and 76 and the conductive layers 88 one over another.

Through the above-described steps, first and helical coil units 11 and 12 are formed, which are similar in structure to those of the common mode choke coil 1 of the first embodiment and which include the insulating resist layers 771 and 773 provided in gaps between the coil parts. Thus, improved insulation is provided between the first and second helical coil units 11 and 12.

Next, as shown in FIGS. 161A and 161B, a film of alumina is formed throughout the surface using a sputtering process to provide an insulation layer 58 having a thickness of about 15 μm which is to serve as a protective film for the coil top parts 35 and 36. Referring to the material to form the insulation layer 58, an insulating material other than alumina may be used. Through the above-described steps, an insulation layer 60 having a multi-layer structure is provided by forming the insulation layers 52, 54, 56, and 58 one over another. The first and second helical coil units 11 and 12, the insulating resist layers 771 and 773, and the closed magnetic path 141 are enclosed in the insulation layer 60.

Next, the silicon path 51 is ground from the bottom thereof to achieve a desired thickness or to remove the substrate completely. The wafer is then cut along predetermined cutting lines to divide a plurality of the common mode choke coils coil 801 formed on the wafer into each element forming region in the form of a chip. The external electrode connecting parts 61 and 62 are partially exposed on an outer surface of the insulation layer 60. Although not shown, external electrodes are then formed in electrical connection with the external electrode connecting parts 61 and 62. Next, chamfering is performed on corners of the chip as occasion demands to complete a common mode choke coil 801.

As described above, in the common mode choke coil 801 and the method of manufacturing the same according to the present embodiment, the insulating resist layers 771 and 773 which are heated and cured to improve insulating properties are provided in gaps between the helical coil units 11 and 12. Since insulation between the first and second helical coil units 11 and 12 can therefore be sufficiently maintained even if the coil pitches of the coil units 11 and 12 are small, the common mode choke coil 801 can be provided with a small size.

The invention is not limited to the above-described embodiments and may be modified in various ways.

Although the first to fifth embodiments have been described by referring to a common mode choke coil having a closed magnetic path constituted by a core and a magnetic member part, the invention is not limited to such a configuration. For example, a common mode choke coil may only include a core. It is not essential that a common mode choke coil includes a closed magnetic path constituted by a core and a magnetic member part.

The insulation layer enclosing the first and second helical coil units is formed from alumina that is a non-magnetic material. Therefore, it is desirable to form the insulation layer from an insulating material having permeability of 1 or more in order to provide a common mode choke coil having high performance. In the case of a common mode choke coil having a core, a closed magnetic path is formed by the core and an insulation layer. In the case of a common mode choke coil having no core, a closed magnetic path is formed by an insulation layer provided on the side of the inner circumferences of first and second helical coil units and an insulation layer provided on the side of the outer circumferences. A common mode choke coil having such a closed magnetic path can be manufactured at a low cost because there is no need for steps for forming a core and a magnetic member part and the number of manufacturing steps is therefore reduced, although the choke coil is somewhat lower in electrical characteristics than the common mode choke coils of the first to fifth embodiments.

Referring to the method of manufacturing a common mode choke coil of the first embodiment, it is possible to omit the step for forming a closed magnetic path after forming the planar surface 54*a* of the insulation layer 54 on which the conductive layers (second conductive layers) 83 and 84 are exposed along with steps associated therewith (see FIGS. 15A to 26B), and the step of forming the electrode film 75 and the electrode film (second electrode film) 76 and steps subsequent thereto (FIGS. 27A to 32B) may be performed on the planar surface 54*a* instead of the planar surface 56*a* formed on the insulation layer 56. Thus, a common mode choke coil having no closed magnetic path can be manufactured. In the first embodiment, the magnetic member layer 101 may alternatively be provided by forming only the opening 41*a* without forming the opening 42*a* (see FIGS. 16A to 17B) to manufacture a common mode choke coil having only a core.

Referring to the method of manufacturing a common mode choke coil of the second embodiment, it is possible to omit the step for forming a closed magnetic path after forming the planar surface 254*a* of the insulation layer 254 on which the conductive layers (second conductive layers) 283 and 284 are exposed along with steps associated therewith (see FIGS. 42A to 51B), and the step of forming the electrode film 275 and the electrode film (second electrode film) 276 and steps subsequent thereto may be performed on the planar surface 254*a*. Thus, a common mode choke coil having no closed magnetic path can be manufactured. In the second embodiment, the magnetic member layer 301 may alternatively be provided by forming only the opening 361*a* and the groove portion 361 without forming the opening 362*a* and the groove portion 362 (see FIGS. 42A to 47B) to manufacture a common mode choke coil having only a core.

Although the silicon path 51 is used in the first to fifth embodiments, the invention is not limited to such a substrate. For example, the same advantages as those of the above-described embodiments can be provided by using an insulating substrate made of a material other than silicon or a magnetic substrate.

Although the electrode films of the first to fifth embodiments are formed using a sputtering process, the invention is not limited to the process. For example, the same advantages as those of the above-described embodiments can be provided by forming the electrode films using a thin film forming technique such as vacuum deposition.

Modifications 1 to 8 of the common mode choke coil in the first embodiment associated with the number of turns of the first and second helical coils, the coil winding positions on the core, and the shapes and positions of the external electrode connecting parts 63 and 64 may be made also on the common mode choke coils according to the second to fifth embodiments.

The second embodiment was described with reference to the exemplary common mode choke coil 201 in which the resist layer 354 is formed on the electrode film 292; the resist layer 354 is patterned to form the resist layer 354 with the opening 301*a* for exposing the electrode film 292 in the groove 382; and the magnetic member layer 301 is formed on the electrode film 292 in the groove 382 using a pattern plating process. However, the invention is not limited to such an embodiment. In the second embodiment, for example, the magnetic member layer 301 may alternatively be formed on the entire surface of the electrode film 292 using a pattern plating process, and the magnetic member layer 301 may be removed except the part of the layer in the groove 382 using a CMP process. A common mode choke coil formed in such a manner can provide the same advantage as that of the second embodiment.

The fourth embodiment was described with reference to the common mode choke coil 601 in which the magnetic member layer 701 is formed on the entire surface of the electrode film 692 using a pattern plating process, by way of example. However, the invention is not limited to such an embodiment. In the fourth embodiment, for example, a resist layer may be formed on the electrode film 692; the resist layer may be patterned to form the resist layer with an opening for exposing the groove 761; and the magnetic member layer 701 may be formed only on the electrode film 692 in the groove 761. A common mode choke coil formed in such a manner can provide the same advantage as that of the fourth embodiment.

Although the fifth embodiment was described with reference to the common mode choke coil 801 having the same structure as that of the common mode choke coil 1 of the first embodiment by way of example, the invention is not limited to such a structure. For example, the same advantage as that of the fifth embodiment can be achieved by forming insulating resist layers in gaps between first and second helical coil units of a common mode choke coil similar in structure to the common mode choke coils 201, 401, and 601 of the second to fourth embodiments.

What is claimed is:

1. A common mode choke coil, comprising:

a first helical coil unit having a plurality of elongate first conductive layers arranged in parallel on a bottom insulation layer, second conductive layers formed on both ends of the first conductive layers; and a third conductive layer formed on the second conductive layers, which is electrically connected to the second conductive layer at one end thereof and which is electrically connected, at another end thereof, to the second conductive layer formed on the first conductive layer adjacent to the first conductive layer directly under the second conductive layer, one turn of the coil being formed by the first conductive layer, the second conductive layer, the third conductive layer and the another second conductive layer; and a second helical coil unit having a configuration similar to that of the first helical coil unit, wherein a first imaginary plane including three conductive layers among the first, second, third, and the another second conductive layers forming one turn of the coil of the first helical coil unit and a second imaginary plane including three conductive layers among the first, second, third, and the another second conductive layers forming one turn of the coil of the second helical coil unit are substantially orthogonal to axes of spiral of the first and second helical coil units.

2. A common mode choke coil according to claim 1, further comprising:

a core extending through the first and second helical coil units on the side of the inner circumferences thereof; and a magnetic member part connected to the core and cooperating with the core to form a closed magnetic path.

3. A common mode choke coil according to claim 2, wherein the closed magnetic path is formed substantially parallel to the surface on which the first conductive layers are formed.

4. A common mode choke coil according to claim 2, wherein the closed magnetic path is formed substantially orthogonal to the surface on which the first conductive layers are formed.

5. A common mode choke coil according to claim 2, wherein the core is formed from a material having a high permeability.

6. A common mode choke coil according to claim 1, wherein, when an element forming surface is viewed in the normal direction thereof, the first and second helical coils are formed like comb teeth and are interdigitated with each other.

7. A common mode choke coil according to claim 1, wherein the first and second imaginary planes are substantially orthogonal to the extending direction of the core.

8. A common mode choke coil according to claim 1, wherein the conductive layer which is not included in the first imaginary plane among the first, second, third and the another second conductive layers forming one turn of the coil of the first helical coil unit is formed so as not to extend across the second imaginary plane and wherein the conductive layer which is not included in the second imaginary plane among the first, second, third and the another second conductive layers forming one turn of the coil of the second helical coil unit is formed so as not to extend across the first imaginary plane.

9. A method of manufacturing a common mode choke coil, comprising:

forming a first electrode film on a substrate;

forming a first resist layer on the first electrode film;

forming a plurality of elongated first openings in parallel in the first resist layer to expose the first electrode film;

forming each of first conductive layers electrically connected to the first electrode film through the first openings using a plating process;

forming a second resist layer on the entire surface after removing the first resist layer;

forming a plurality of second openings for exposing both ends of the first conductive layers in the second resist layer;

forming each of second conductive layers electrically connected to the first conductive layers through the second openings using a plating process;

removing the second resist layer and the first electrode film under the second resist layer;

forming a first insulation layer on which the tops of the second conductive layers are exposed;

forming a second electrode film electrically connected to the second conductive layers on the first insulation layer;

forming a third resist layer on the second electrode film;

forming the third resist layer with a plurality of elongated third openings arranged in parallel to expose the second electrode film in positions where the openings overlap the second conductive layers at one end thereof and overlap, at another end thereof, the second conductive layers formed on the first conductive layer adjacent to the first conductive layer directly under the second conductive layer when the substrate surface is viewed in the normal direction thereof;

forming each of third conductive layers electrically connected to the second electrode film through the third openings using a plating process;

removing the third resist layer and the second electrode film under the third resist layer;

forming a first helical coil unit one turn of which is formed by the first, second, third, and the another second conductive layers;

similarly forming a second helical coil unit simultaneously with the first helical coil unit;

forming a first intermediate electrode film between the second conductive layers and the second electrode film;

forming a first intermediate resist layer on the first intermediate electrode film;

forming the first intermediate resist layer with a first intermediate opening exposing the first intermediate electrode film and extending across the first conductive layers when the substrate surface is viewed in the normal direction thereof;

forming a first magnetic member layer on the first intermediate electrode film in the first intermediate opening using a plating process;

removing the first intermediate resist layer and the first intermediate electrode film under the first intermediate resist layer;

forming a core constituted by the first magnetic member layer and extending through the first and second helical coil units on a side of an inner circumference thereof;

forming a second intermediate electrode film electrically connected to the second conductive layers on the entire surface;

forming a second intermediate resist layer on the second intermediate electrode film;

forming a second intermediate opening in the second intermediate resist layer to expose the second intermediate electrode film on the second conductive layer;

forming a first intermediate conductive layer electrically connected to the second intermediate electrode film through the second intermediate opening using a plating process;

removing the second intermediate resist layer and the second intermediate electrode film under the second intermediate resist layer;

forming a second insulation layer on the first insulation layer with the first intermediate conductive layer exposed; and forming the first and second helical coil units with the second electrode film electrically connected to the second conductive layers through the second intermediate electrode film and the first intermediate conductive layer.

10. A method of manufacturing a common mode choke coil according to claim 9, further comprising:

forming an organic insulating material in a gap between the first and second helical coil units; and heating and curing the organic insulating material to insulate the first and second helical coil units from each other.

11. A method of manufacturing a common mode choke coil according to claim 9, further comprising:

forming the first intermediate opening in an annular shape; and forming a magnetic member part forming a closed magnetic path in cooperation with the core in the first intermediate opening at the same time when the core is formed.

12. A method of manufacturing a common mode choke coil according to claim 9, further comprising:

removing the first intermediate resist layer instead of the step of removing the first intermediate resist layer and the first intermediate electrode film under the first intermediate resist layer;

forming a third intermediate resist layer on the first intermediate electrode film and the first magnetic member layer;

forming the third intermediate resist layer with a third intermediate opening for exposing both ends of the first magnetic member layer;

forming a second magnetic member layer on the first magnetic member layer in the third intermediate opening using a plating process;

forming the core by removing the third intermediate resist layer and the first intermediate electrode film under the same;

forming a third electrode film on the second insulation layer and the second magnetic member layer after forming the first and second helical coil units;

forming a fourth resist layer on the third electrode film;

forming the fourth resist layer with a fourth opening for exposing the third electrode film on the second magnetic member layer;

forming a third magnetic member layer on the third electrode film in the fourth opening using a plating process;

removing the fourth resist layer and the third electrode film under the same;

forming a third insulation layer on which the third magnetic member layer is exposed;

forming a fourth electrode film on the third insulation layer;

forming a fifth resist layer on the fourth electrode film;

forming the fifth resist layer with a fifth opening for exposing the fourth electrode film on the third magnetic member layer on both ends thereof;

forming a fourth magnetic member layer on the fourth electrode film in the fifth opening using a plating process; and forming a closed magnetic path constituted by the core and the second, third, and fourth magnetic member layers by removing the fifth resist layer and the fourth conductive film under the fifth resist layer.

13. A method of manufacturing a common mode choke coil, comprising:

forming a first electrode film on a substrate;

forming a first resist layer on the first electrode film;

forming a plurality of elongated first openings in parallel in the first resist layer to expose the first electrode film;

forming each of first conductive layers electrically connected to the first electrode film through the first openings using a plating process;

forming a second resist layer on the entire surface after removing the first resist layer;

forming a plurality of second openings for exposing both ends of the first conductive layers in the second resist layer;

forming each of second conductive layers electrically connected to the first conductive layers through the second openings using a plating process;

removing the second resist layer and the first electrode film under the second resist layer;

forming a first insulation layer on which the tops of the second conductive layers are exposed;

forming a second electrode film electrically connected to the second conductive layers on the first insulation layer;

forming a third resist layer on the second electrode film;

forming the third resist layer with a plurality of elongated third openings arranged in parallel to expose the second electrode film in positions where the openings overlap the second conductive layers at one end thereof and overlap, at another end thereof, the second conductive layers formed on the first conductive layer adjacent to the first conductive layer directly under the second conductive layer when the substrate surface is viewed in the normal direction thereof;

forming each of third conductive layers electrically connected to the second electrode film through the third openings using a plating process;

removing the third resist layer and the second electrode film under the third resist layer;

forming a first helical coil unit one turn of which is formed by the first, second, third, and the another second conductive layers; and similarly forming a second helical coil unit simultaneously with the first helical coil unit;

forming a first intervening resist layer between the second conductive layer and the second electrode film after forming the first insulation layer;

forming the first intervening resist layer with a first intervening opening exposing the first insulation layer and extending across the first conductive layer when the substrate surface is viewed in the normal direction thereof;

forming a groove on the first insulation layer under the first intervening opening;

removing the first intervening resist layer;

forming a first intervening electrode film in the groove and on the first insulation layer;

forming a first magnetic member layer on the first intervening electrode film in the groove using a plating process;

forming a core constituted by the first magnetic member layer and extending through the first and second helical coil units on the side of the inner circumferences thereof; and forming the second electrode film on the first insulation layer.

14. A method of manufacturing a common mode choke coil according to claim 13, further comprising:

forming the first intervening opening in an annular shape; and forming a magnetic member part forming a closed magnetic path in cooperation with the core in the first intervening opening at the same time when the core is formed.

15. A method of manufacturing a common mode choke coil according to claim 13, further comprising:

forming a second intervening resist electrode film on the first insulation layer after forming the first insulation layer;

forming a second intervening resist layer on the second intervening electrode film;

forming the second intervening resist layer with a second intervening opening for exposing the second intervening electrode film on both ends of the core;

forming a second magnetic member layer on the second intervening electrode film in the second intervening opening using a plating process;

removing the second intervening resist layer and the second intervening electrode film under the second intervening resist layer;

forming the second electrode film on the first insulation layer;

forming a second insulation layer for exposing the second magnetic member layer after forming the first and second helical coil units;

forming a third electrode film on the second insulation layer;

forming a fourth resist layer on the third electrode film;

forming the fourth resist layer with a fourth opening exposing the third electrode film on the second magnetic member layer at both ends thereof;

forming a third magnetic member layer on the third electrode film in the fourth opening using a plating process; and forming a closed magnetic path constituted by the core and the second and third magnetic member layers by removing the fourth resist layer and the third electrode film under the fourth resist layer.

16. A method of manufacturing a common mode choke coil according to claim 13, comprising:

forming an organic insulating material in a gap between the first and second helical coil units; and heating and curing the organic insulating material to insulate the first and second helical coil units from each other.

* * * * *